US007186500B2

(12) United States Patent
Hosoya et al.

(10) Patent No.: US 7,186,500 B2
(45) Date of Patent: Mar. 6, 2007

(54) SILVER HALIDE PHOTOGRAPHIC LIGHTSENSITIVE MATERIAL

(75) Inventors: Yoichi Hosoya, Minami-Ashigara (JP); Kiyoshi Morimoto, Minami-Ashigara (JP); Tadashi Inaba, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 362 days.

(21) Appl. No.: 10/681,170

(22) Filed: Oct. 9, 2003

(65) Prior Publication Data

US 2004/0175662 A1 Sep. 9, 2004

Related U.S. Application Data

(62) Division of application No. 10/034,607, filed on Jan. 3, 2002.

(30) Foreign Application Priority Data

Jan. 5, 2001 (JP) ..... 2001-000800
Dec. 7, 2001 (JP) ..... 2001-374801

(51) Int. Cl.
*G03C 1/46* (2006.01)
*G03C 1/005* (2006.01)
*G03C 1/494* (2006.01)

(52) U.S. Cl. ..... 430/505; 430/546; 430/567; 430/631; 430/599; 430/600; 430/603

(58) Field of Classification Search ..... 430/505, 430/546, 567, 631, 599, 600, 603
See application file for complete search history.

(56) References Cited

U.S. PATENT DOCUMENTS

| | | | |
|---|---|---|---|
| 5,151,343 | A | 9/1992 | Begley et al. |
| 5,234,800 | A | 8/1993 | Begley et al. |
| 5,747,235 | A | 5/1998 | Farid et al. |
| 5,994,051 | A | 11/1999 | Gould et al. |
| 6,054,260 | A | 4/2000 | Adin et al. |
| 6,107,016 | A | 8/2000 | Ito et al. |
| 6,261,750 | B1 | 7/2001 | Ishii et al. |
| 6,306,570 | B1 | 10/2001 | Adin et al. |
| 6,428,947 | B1 | 8/2002 | Johnston et al. |
| 6,498,004 | B1 | 12/2002 | Lenhard et al. |
| 6,544,725 | B2 | 4/2003 | Morimoto |
| 6,610,466 | B2 | 8/2003 | Sakurada et al. |

FOREIGN PATENT DOCUMENTS

| | | |
|---|---|---|
| JP | 58-162949 | 9/1983 |
| JP | 59-142541 | 8/1984 |
| JP | 5-232610 | 9/1993 |
| JP | 6-19028 | 1/1994 |
| JP | 11-72862 | 3/1999 |
| JP | 11-119364 | 4/1999 |
| JP | 2000-119364 A | 4/2000 |
| JP | 2000-250157 A | 9/2000 |
| JP | 2000-314945 | 11/2000 |

OTHER PUBLICATIONS

Japanese Office Action dated Apr. 20, 2004.

*Primary Examiner*—Geraldine Letscher
(74) *Attorney, Agent, or Firm*—Sughrue Mion, PLLC

(57) ABSTRACT

A silver halide photographic lightsensitive material comprising a support having thereon at least one lightsensitive silver halide emulsion layer, wherein the lightsensitive material contains at least one compound represented by general formula (I) and at least one photographically useful group-releasing compound represented by general formula (II) or (III) that is capable of forming a compound having substantially no contribution to a dye after its coupling with an oxidized form of a developing agent:

(X)k-(L)m-(A-B)n (I)

COUP1-D1 (II)

COUP2-C-E-D2 (III)

The definitions of the substituents are set forth in the specification.

11 Claims, No Drawings

SILVER HALIDE PHOTOGRAPHIC LIGHTSENSITIVE MATERIAL

CROSS-REFERENCE TO RELATED APPLICATIONS

This is a divisional of application Ser. No. 10/034,607 filed Jan. 3, 2002; the disclosure of which is incorporated herein by reference.

This application is based upon and claims the benefit of priority from the prior Japanese Patent Applications No. 2001-000800, filed Jan. 5, 2001; and No. 2001-374801, filed Dec. 7, 2001, the entire contents of both of which are incorporated herein by reference.

BACKGROUND OF THE INVENTION

1. Field of the Invention

The present invention relates to a silver halide photographic lightsensitive material. More specifically, the present invention relates to a highly sensitive, low-fogging silver halide photographic lightsensitive material.

2. Description of the Related Art

A silver halide photographic lightsensitive material mainly comprises a dispersion medium containing lightsensitive silver halide grains applied on a support. To increase the sensitivity of silver halide lightsensitive materials, an enormous amount of study has been made. In order to enhance the sensitivity of a silver halide lightsensitive material, it is very important to increase the sensitivity inherent to the silver halide grains. For increasing the sensitivity of silver halide grains, various methods are employed. Enhancement of sensitivity are accomplished, such as enhancement of sensitivity using chemical sensitizers such as sulfur, gold and compounds of the VIII Group; enhancement of sensitivity using a combination of chemical sensitizers such as sulfur, gold and compounds of the VIII Group, and additives that facilitate the sensitizing effect of the chemical sensitizers; and enhancement of sensitivity by the addition of an additive having an sensitizing effect depending on a kind of silver halide emulsion. Descriptions on these methods can be found in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018 and 3,904,415, and British Patent No. 1,315,755. Further, a method comprising reduction-sensitizing silver halide grains is also employed as a method for enhancing sensitivity. Reduction-sensitization of silver halide grains is disclosed in, for example, U.S. Pat. Nos. 2,518,698, 3,201,254, 3,411,917, 3,779,777 and 3,930,867, and a method of using a reducing agent is disclosed in, for example, Jpn. Pat. Appln. KOKOKU Publication No. (hereinafter referred to as JP-B-) 57-33572, JP-B-58-1410, and Jpn. Pat. Appln. KOKAI Publication No. (hereinafter referred to as JP-A-) 57-179835. Furthermore, a sensitizing technique using an organic electron-donating compound comprising an electron-donating group and a leaving group has been reported as described recently in U.S. Pat. Nos. 5,747,235 and 5,747,236, EP Nos. 786692A1, 893731A1 and 893732A1, and WO99/05570. This is a novel sensitizing technique and is effective in enhancement of sensitivity. However, although the use of this compound results in an enhanced sensitivity, it has also the defect that the fogging or Dmin becomes high, and therefore improvement has been desired.

BRIEF SUMMARY OF THE INVENTION

The present invention was accomplished in order to solve the problems with the above-mentioned conventional techniques, and it is an object of the invention to provide a highly sensitive, low-fogging silver halide photographic lightsensitive material.

The object of the present invention has successfully been attained by the following approaches:

(1) A silver halide photographic lightsensitive material comprising a support having thereon at least one lightsensitive silver halide emulsion layer, wherein the lightsensitive material contains at least one compound represented by general formula (I) and at least one photographically useful group-releasing compound represented by general formula (II) or (III) that is capable of forming a compound having substantially no contribution to a dye after its coupling with an oxidized form of a developing agent:

$$(X)k\text{-}(L)m\text{-}(A\text{-}B)n \qquad (I)$$

wherein X represents an adsorbing group to silver halide or a light-absorbing group having at least one atom selected from the group consisting of N, S, P, Se and Te; L represents a bivalent linking group having at least one atom selected from the group consisting of C, N, S and O; A represents an electron-donating group; B represents a leaving group or a hydrogen atom, wherein after $\text{-}(A\text{-}B)_n$ portion is oxidized, B is eliminated or deprotonated thereby to form a radical A.; k and m independently represent an integer of 0 to 3; and n represents 1 or 2;

$$COUP1\text{-}D1 \qquad (II)$$

wherein COUP1 represents a coupler residue capable of releasing D1 by a coupling reaction with an oxidized form of a developing agent, along with forming a water-soluble or alkali-soluble compound; and D1 represents a photographically useful group or its precursor which is bonded to the coupling position of COUP1;

$$COUP2\text{-}C\text{-}E\text{-}D2 \qquad (III)$$

wherein COUP2 represents a coupler residue capable of coupling with an oxidized form of a developing agent; E represents an electrophilic portion; C represents a single bond or a bivalent linking group capable of releasing D2, along with a 4- to 8-membered ring formation, through an intramolecular nucleophilic substitution reaction between the electrophilic portion E and a nitrogen atom, wherein the nitrogen atom originates from the developing agent and is boned to the coupling position in a coupling product between COUP2 and the oxidized form of the developing agent, and wherein C may be bonded to COUP2 at the coupling position of COUP2 or may be bonded to COUP2 at a position other than the coupling position of COUP2; and D2 represents a photographically useful group or its precursor.

(2) A silver halide photographic lightsensitive material comprising a support having thereon at least one lightsensitive silver halide emulsion layer containing an emulsified dispersion, wherein the lightsensitive material contains at least one compound represented by general formula (I), and the emulsified dispersion contains at least one surfactant having a critical micelle concentration of $4.0\times10^{-3}$ mol/L or less in an amount of 0.01% by weight or more based on all the ingredients in the lightsensitive layer where the surfactant is contained:

$$(X)k\text{-}(L)m\text{-}(A\text{-}B)n \qquad (I)$$

wherein X represents an adsorbing group to silver halide or a light-absorbing group having at least one atom selected from the group consisting of N, S, P, Se and Te; L represents a bivalent linking group having at least one atom selected from the group consisting of C, N, S and O; A represents an electron-donating group; B represents a leaving group or a hydrogen atom, wherein after $-(A-B)_n$ portion is oxidized, B is eliminated or deprotonated thereby to form a radical A.; k and m independently represent an integer of 0 to 3; and n represents 1 or 2.

(3) The silver halide lightsensitive material according to item (1) above, wherein the emulsified dispersion further contains a high-boiling organic solvent having a dielectric constant of 7.0 or less.

(4) A silver halide photographic lightsensitive material comprising a support having thereon at least one lightsensitive silver halide emulsion layer, wherein the lightsensitive material contains at least one compound represented by general formula (I), and the silver halide emulsion layer contains a sensitizing dye and at least one compound represented by general formula (IV) in an amount of 1 to 50 mol % or less of the sensitizing dye:

$$(X)k-(L)m-(A-B)n \qquad (I)$$

wherein X represents an adsorbing group to silver halide or a light-absorbing group having at least one atom selected from the group consisting of N, S, P, Se and Te; L represents a bivalent linking group having at least one atom selected from the group consisting of C, N, S and O; A represents an electron-donating group; B represents a leaving group or a hydrogen atom, wherein after $-(A-B)_n$ portion is oxidized, B is eliminated or deprotonated thereby to form a radical A.; k and m independently represent an integer of 0 to 3; and n represents 1 or 2;

(IV)

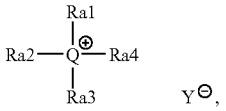

wherein Q represents an N or P atom; each of Ra1, Ra2, Ra3 and Ra4 represents an alkyl group, an aryl group or a heterocyclic group, wherein two of Ra1, Ra2, Ra3 and Ra4 may be bonded with each other to thereby form a saturated ring or three of Ra1, Ra2, Ra3 and Ra4 may cooperate with each other to thereby form an unsaturated ring; and Y represents an anionic group, provided that Y does not exist in the event of an intramolecular salt.

(5) The silver halide lightsensitive material according to item (4) above, wherein the compound represented by the general formula (IV) is represented by general formula (V):

(V)

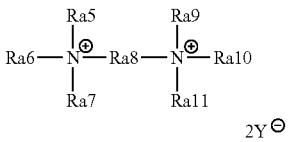

wherein each of Ra5, Ra6 and Ra7 represents an alkyl group, an aryl group or a heterocyclic group, wherein two of Ra5, Ra6 and Ra7 may cooperate with each other to thereby form a saturated ring, or three of Ra5, Ra6 and Ra7 may cooperate with each other to thereby form an unsaturated ring; Ra8 represents a divalent group constituted by each or any combination of an alkylene group, an arylene group, —O—, —S— and $—CO_2—$, provided that each of —O—, —S— and $—CO_2—$ is bonded so as to be adjacent to the alkylene group or the arylene group; Ra9, Ra10 and Ra11 each have the same meanings as Ra5, Ra6 and Ra7; and Y has the same meaning as Y of the general formula (IV).

(6) The silver halide photographic lightsensitive material according to any of items (1) to (5) above, wherein 50% or more of the total projected area of all the silver halide grains contained in the lightsensitive layer is occupied by silver halide grains satisfying the following requirements (a) to (d):

(a) parallel main planes thereof are (111) faces, (b) an aspect ratio thereof is 2 or more, (c) ten or more dislocation lines per grain are present, and (d) tabular silver halide grains each formed of silver iodobromide or silver chloroiodobromide whose silver chloride content is less than 10 mol %

(7) The silver halide photographic lightsensitive material according to any one of items (1) to (5) above, wherein 50% or more of the total projected area of all the silver halide grains contained in the lightsensitive layer is occupied by silver halide grains satisfying the following requirements (a), (d) and (e):

(a) parallel main planes thereof are (111) faces, (d) tabular silver halide grains each formed of silver iodobromide or silver chloroiodobromide whose silver chloride content is less than 10 mol %, and (e) hexagonal tabular grains each having at least one epitaxial junction per grain at an apex portion and/or a side face portion and/or a main plane portion thereof (8) The silver halide photographic lightsensitive material according to any one of items (1) to (5) above, wherein 50% or more of the total projected area of all the silver halide grains contained in the lightsensitive layer is occupied by silver halide grains satisfying the following requirements (d), (f) and (g):

(d) tabular silver halide grains each formed of silver iodobromide or silver chloroiodobromide whose silver chloride content is less than 10 mol %, (f) parallel main planes thereof are (100) faces, and (g) an aspect ratio thereof is 2 or more (9) The silver halide photographic lightsensitive material according to any of items (1) to (5) above, wherein 50% or more of the total projected area of all the silver halide grains contained in the lightsensitive layer is occupied by silver halide grains satisfying the following requirements (g), (h) and (i)

(g) an aspect ratio thereof is 2 or more, (h) parallel main planes thereof are (111) faces or (100) faces, and (i) tabular grains each having a silver chloride content of at least 80 mol %

(10) The silver halide photographic lightsensitive material according to any one of items (6) to (9) above, wherein the silver halide grains accounting for 50% or more of the total projected area of all the silver halide grains contained in the lightsensitive layer further satisfying the following requirements (j), (k) and (m):

(j) a projected area diameter thereof is 2 μm or more, (k) an aspect ratio thereof is 10 or more, and (m) an average AgI content of the individual grains is 5 mol % or more

(11) The silver halide photographic lightsensitive material according to item (6) or (7) above, wherein the silver halide grains accounting for the 50% or more of the total projected area of all the silver halide grains contained in the lightsensitive layer further satisfying the following requirement (j); and 80% or more of the total projected area of all the silver halide grains contained in the lightsensitive layer is occupied by silver halide grains each having no dislocation line in the region within 50% from the center of the grain projected area thereof:

(j) a projected area diameter thereof is 2 μm or more

(12) The silver halide photographic lightsensitive material according to item (6) above, wherein the silver halide grains accounting for 50% or more of the total projected area of all the silver halide grains contained in the lightsensitive layer, are those prepared by a production method comprising, during formation of grains, a step of forming grains while rapidly generating an iodide ion using an iodide ion-releasing agent.

(13) The silver halide photographic lightsensitive material according to item (6) above, wherein the silver halide grains accounting for 50% or more of the total projected area of all the silver halide grains contained in the lightsensitive layer, are those prepared by a production method comprising, during formation of grains, a step of adding silver iodide fine grains to a vessel in which the formation of grains is being performed.

(14) The silver halide photographic lightsensitive material according to item (13) above, wherein the silver iodide fine grains are those formed outside the vessel in which the formation of grains is being performed.

(15) The silver halide photographic lightsensitive material according to any one of items (6) to (9) above, wherein at least 30% of the total silver amount of the silver halide grains that are accounting for 50% or more of the total projected area of the silver halide grains contained in the lightsensitive layer, are prepared by a method comprising, during formation of grains, a step of adding, to a vessel in which the formation of grains is performed, silver halide fine grains formed in another vessel.

(16) The silver halide photographic lightsensitive material according to any one of items (6) to (15) above, wherein the silver halide grains accounting for the 50% or more of the total projected area of all the silver halide grains contained in the lightsensitive layer, are those subjected to a reduction-sensitization.

(17) The silver halide photographic lightsensitive material according to any one of items (6) to (16) above, wherein the silver halide emulsion contained in the lightsensitive layer, contains gelatin comprising components, in an amount of 20% or more, each having a molecular weight of 280,000 or more.

(18) The silver halide photographic lightsensitive material according to any one of items (1) to (17), wherein the lightsensitive layer contains at least one of compounds represented by general formulas (VI), (VII), (VIII-1), (VIII-2), (IX-1), (IX-2), (X) and (XI):

(VI)

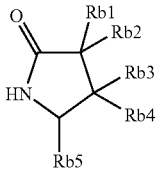

wherein Rb1, Rb2, Rb3 and Rb4 each independently represent a hydrogen atom, an aryl group, a chain-like or cyclic alkyl group, a chain-like or cyclic alkenyl group or an alkynyl group; and Rb5 represents a chain-like or cyclic alkyl group, a chain-like or cyclic alkenyl group, an alkynyl group, an aryl group or a heterocyclic group;

(VII)

$$(\mathrm{Het})_{K1}[(\mathrm{M})_{K2}\mathrm{Hy})]_{K3}$$

wherein Het is an adsorbing group to silver halide; M represents a bivalent linking group comprising an atom or atomic group containing at least one of a carbon atom, a nitrogen atom, a sulfur atom and an oxygen atom; Hy represents a group having a hydrazine structure represented by Rb6Rb7N—NRb8Rb9, wherein Rb6, Rb7, Rb8 and Rb9 each independently represent an alkyl group, an alkenyl group, an alkynyl group, an aryl group or a heterocyclic group, and Rb6 and Rb7, Rb8 and Rb9, Rb6 and Rb8, or Rb7 and Rb9 may be bonded together to form a ring, provided that at least one of Rb6, Rb7, Rb8 and Rb9 is an alkylene group, an alkenylene group, an alkynylene group, an arylene group or a bivalent heterocyclic residue for being substituted with —(M)k2(Het)k1 in the general formula (VII); k1 and k3 each independently represent 1, 2, 3 or 4; and k2 represents 0 or 1;

(VIII-1)

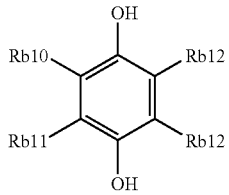

(VIII-2)

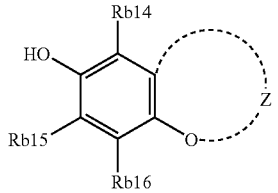

in formula (VIII-1), Rb10, Rb11, Rb12 and Rb13 each independently represent a hydrogen atom or a substituent, provided that when Rb10 and Rb13 each are an alkyl group, or Rb11 and Rb12 each are an alkyl group, these are not substituents having the same number of carbon atoms; and in formula (VIII-2), Rb14, Rb15 and Rb16 each independently represent a hydrogen atom or a substituent, and Z represents a non-metallic atomic group forming a 4- to 6-membered ring;

(IX-1)

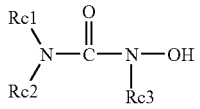

wherein Rc1 represents a substituted or unsubstituted alkyl, a substituted or unsubstituted alkenyl or a substituted or unsubstituted aryl group; Rc2 represents a hydrogen atom or the same groups as those represented by Rc1; and Rc3 represented by a hydrogen atom or a substituted or unsubstituted alkyl or a substituted or unsubstituted alkenyl group having 1 to 10 carbon atoms, wherein Rc1 and Rc2, Rc1 and Rc3, or Rc2 and Rc3 may be bonded together to form a 5- to 7-membered ring;

(IX-2)

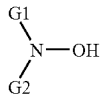

wherein each of G1 and G2 represents a hydrogen atom or a monovalent substituent, provided that these may be bonded together to form a ring;

(X)

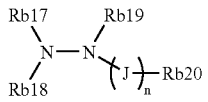

wherein Rb17, Rb18 and Rb19 each independently represent a hydrogen atom, an alkyl group, an alkenyl group, an aryl group or a heterocyclic group; Rb20 represents a hydrogen atom, an alkyl group, an alkenyl group, an alkynyl group, an aryl group, a heterocyclic group or —NRb21Rb22, wherein Rb21 represents a hydrogen atom, a hydroxyl group, an amino group, an alkyl group, an alkenyl group, an alkynyl group, an aryl group or a heterocyclic group, and Rb22 represents a hydrogen atom, an alkyl group, an alkenyl group an alkynyl group, an aryl group or a heterocyclic group; J represents —CO— or —$SO_2$—; and n represents 0 or 1; wherein Rb17 and Rb18, Rb17 and Rb19, Rb19 and Rb20, or Rb20 and Rb18 may be bonded together to form a ring;

(XI)

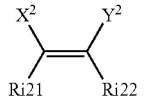

wherein $X^2$ and $Y^2$ each independently represent a hydroxyl group, —NRi23Ri24 or —$NHSO_2$Ri25; and Ri21 and Ri22 each independently represent a hydrogen atom or an optional substituent, wherein Ri21 and Ri22 may be bonded together to form a carbon ring or a heterocycle; Ri23 and Ri24 each independently represent a hydrogen atom, an alkyl group, an aryl group or a heterocyclic group, wherein Ri23 and Ri24 may be bonded together to form a heterocycle; and Ri25 represents an alkyl group, an aryl group, an amino group or a heterocyclic group.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

A silver halide emulsion in the present invention preferably is silver bromide, silver chloride, silver iodobromide, silver iodochlorobromide, silver chlorobromide, silver chloroiodobromide, and the like. The form of the silver halide grain may be a normal crystal such as octahedron, cube and tetradecahedron, but a tabular grain is preferable.

First, a description will be made to a first emulsion relative to the present invention, that is, tabular silver halide grains each comprising silver iodobromide or silver chloroiodobromide whose silver chloride content is less than 10 mol %, and each having (111) faces as its parallel main planes.

This emulsion comprises opposing (111) main planes and side faces connecting the main planes. A tabular grain emulsion is formed of silver iodobromide or silver chloroiodobromide. The emulsion may contain silver chloride, but the silver chloride content is preferably 8 mol % or less, more preferably 3 mol % or less or 0 mol %. The silver iodide content is 0.5 mol % or more and 40 mol % or less, and preferably 1.0 mol % or more and 20 mol % or less.

Regardless of the silver iodide content, the variation coefficient of intergrain distribution of silver iodide content is preferably 20% or less, and particularly preferably 10% or less.

With respect to the silver iodide distribution, it is preferable that the grains have a structure within the grains. In such as case, it is possible for the structure of silver iodide distribution to be a double, triple, quadruple, quintuple, or more multiple structures. The silver iodide content may be changed continuously within a grain.

Grains having an aspect ration of 2 or more occupy 50% or more of the total projected area. The projected area and aspect ratio of the tabular grains can be measured from an electron micrograph according to the technique of carbon replica shadowed together with spherical latex particles for reference. The tabular grains, when viewed from above its main planes, generally have a hexagonal, triangular or circular shape, and the aspect ratio is a quotient obtained by dividing the diameter of a circle having an area equal to the projected area of a grain by the thickness thereof. The higher the ratio of hexagons is, the more preferable the shape of the tabular grains. Further, the ratio of lengths of mutually neighboring sides of the hexagon is preferably 1:2 or less.

The tabular grains preferably have a size of 0.1 μm or more and 20.0 μm or less, and more preferably 0.2 μm or more and 10.0 μm or less, in terms of the projected area diameter. The "projected area diameter" of a silver halide grain refers to a diameter of a circle having an area equal to the projected area of the silver halide grain. The thickness of the tabular grains preferably is 0.01 μm or more and 0.5 μm or less, and more preferably 0.02 μm or more and 0.4 μm or less. The thickness of a tabular grain refers to the distance between two main planes. The tabular grains preferably have a size of 0.1 μm or more and 5.0 μm or less, and more preferably from 0.2 μm or more and 3 μm or less, in terms of the equivalent-sphere diameter. The "equivalent-sphere diameter" of a grain refers to a diameter of a sphere having a volume equal to the volume of individual grains. Further, the aspect ratio is preferably 1 or more and 100 or less, and more preferably 2 or more and 50 or less. The aspect ratio of a grain refers to a quotient obtained by dividing the diameter of a circle having an area equal to the projected area of the grain by the thickness thereof.

The silver halide grains contained in the first emulsion and the second emulsion used in the present invention are preferably monodisperse. The variation coefficient of sphere equivalent diameter of all the silver halide grains contained in the first and second emulsions related to the present invention is 30% or less, and preferably 25% or less. Further, in the case of tabular grains, the variation coefficient of projected area diameter is also important. The variation coefficient of projected area diameter of all the silver halide grains contained in the first and second emulsions related to the present invention is preferably 30% or less, more preferably 25% or less, and still more preferably 20% or less. Furthermore, the variation coefficient of thickness of the tabular grains is preferably 30% or less, more preferably 25% or less, and still more preferably 20% or less. The variation coefficient of projected area diameter of silver halide grains refers to a quotient obtained by dividing the standard deviation of the projected area diameter distribution of the individual silver halide grains by the average equivalent-circle diameter thereof. The variation coefficient of thickness of tabular silver halide grains refers to a quotient obtained by dividing the standard deviation of the thickness distribution of the individual tabular silver halide grains by the average thickness thereof.

The distance between twin planes of the tabular grains contained in the first and second emulsions related to the present invention may be set to 0.012 μm or less as disclosed in U.S. Pat. No. 5,219,720. Alternatively, the ratio of the distance between (111) main planes to the distance between twin planes may be set to 15 or more as disclosed in JP-A-5-249585. A selection suitable to application may be made.

The greater the aspect ratio is, the more conspicuous the effect attained. Thus, it is preferable that grains having an aspect ratio of 5 or more, more preferably 8 or more, occupy 50% or more of the total projected area of the tabular grain emulsion. Too great aspect ratios tend to increase the above-mentioned variation coefficient of grain size distribution. Thus, it is generally preferred that the aspect ratio is 100 or less.

The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 μm in thickness) is preferred for ensuring clearer observation. The thus obtained photograph of grains enables determining the position and number of dislocation lines in each grain viewed in the direction perpendicular to the principal planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the side faces of tabular grains. In this instance, the dislocation is nearly perpendicular to the side faces, and each dislocation line extends from a position corresponding to x % of the distance between the center of tabular grains and the side (periphery), to the side faces. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one that is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

The silver iodide content on the grain surface of a tabular grain emulsion of the present invention is preferably 10 mol % or less, and particularly preferably, 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg—Kα as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

The structure of a tabular grain emulsion of the present invention is preferably a triple structure of silver bromide/silver iodobromide/silver bromide or a higher-order structure. The boundary of silver iodide content between structures can be either a clear boundary or a continuously gradually changing boundary. Commonly, when measured by using a powder X-ray diffraction method, the silver iodide content does not show any two distinct peaks; it shows an X-ray diffraction profile whose tail extends in the direction of high silver iodide content.

The interior silver iodide content is preferably higher than the surface silver iodide content. The interior silver iodide content is higher than the surface silver iodide content by 3 mol % or more, preferably by 5 mol % or more.

Next, a description will be made to the second emulsion related to the present invention, that is, grains having (111) faces as their parallel main planes wherein there is at least one epitaxial junction per grain at an apex portion and/or a side face portion and/or a main plane portion of a hexagonal silver halide grain, and wherein a ratio of the length of an edge having the maximum length to the length of an edge having the minimum length, is 2 or less. The grain with an epitaxial junction refers to a grain having main body of the silver halide grain to which a crystal portion (that is, an epitaxial portion) is joined, wherein the joined crystal portion usually projects from the main body of the silver halide grain. It is preferable that the ratio of the joined crystal portion (epitaxial portion) to the amount of the total silver contained in the grain is 1% or more and 30% or less, and more preferably or more 2% and 15% or less. The epitaxial portion may be located anywhere in the main body of the grain, but it is preferably located at a grain main plane portion and/or a grain side face portion and/or a grain apex portion. The number of the epitaxial portion is preferably at least one. The composition of the epitaxial portion is preferably AgBr, AgCl, AgBrCl, AgBrClI, AgBrI, AgI, AgSCN and the like. When there is an epitaxial portion, a dislocation line may be present inside the grain, but it does not have to be present. Further, a dislocation line does not have to be present in an epitaxial portion, a junction portion between a main portion of a silver halide grain and a junction portion, or an epitaxial portion, but it is preferable that a dislocation line is present.

Next, a description will be made to methods for preparing the first emulsion and the second emulsion silver halide grains.

The preparation process of the present invention comprises (a) a base grain forming process and a grain forming process (process (b)) following step (a). Basically, it is preferable that process (a) is followed by process (b), but only process (a) may be carried out. Process (b) may be any of (b1) a step of introducing dislocation, (b2) a step of introducing dislocation at a corner portion restrictedly, and (b3) an epitaxial junction step. Process (b) may contain either one step or a combination of two or more steps.

First, (a) base grain forming process will be described. A base portion is preferably at least 50%, more preferably 60% or more of the amount of the total silver used for the grain formation. The average content of iodine relative to the amount of silver in the base portion is preferably 0 mol % or more and 30 mol % or less, and more preferably 0 mol % or more and 15 mol % or less. The base portion may have a core-shell structure, as needed. In this case, the core portion of the base portion is preferably 50% or more and 70% or less of the amount of the total silver contained in the base portion. The average iodine composition of the core portion is preferably 0 mol % or more and 30 mol % or less, and more preferably 0 mol % or more and 15 mol % or less. The iodine composition of the shell portion is preferably 0 mol % or more and 3 mol % or less.

A method comprising forming silver halide nuclei and then allowing the silver halide grains to grow, thereby obtaining grains with a desired size is general as a method for preparing a silver halide emulsion. The present invention is certainly similar to that. Further, with respect to the formation of tabular grains, steps of, at least, nucleation, ripening and growing are contained. These steps will be described in U.S. Pat. No. 4,945,037 in detail. Hereafter, the steps, nucleation, ripening and growing, will be described.

1. Nucleation Step

The nucleation of tabular grains is in general carried out by a double jet method comprising adding a silver salt aqueous solution and an alkali halide aqueous solution to a reaction vessel containing a protective colloid aqueous solution, or a single jet method comprising adding a silver salt aqueous solution to a protective colloid solution containing alkali halide. If necessary, a method comprising adding an alkali halide aqueous solution to a protective colloid solution containing silver salt may be used. Further, if necessary, a method comprising adding a protective colloid solution, a silver salt solution and an alkali halide aqueous solution to the mixer disclosed in JP-A2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding a silver salt aqueous solution thereto.

Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 μmol/g or less), amino group-modified gelatin of the present invention (e.g., phthalated gelatin, trimellitated gelatin, succinated gelatin, maleated gelatin, and esterified gelatin), and low molecular weight gelatin (molecular weight of from 3,000 to 40,000) are used. JP-B-5-12696 can be referred to about oxidized gelatin. Descriptions of JP-A's-8-82883 and 11-143002 can be referred to about amino group-modified gelatin. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. Further, natural high polymers will be described in JP-B-7-111550 and Research Disclosure, Vol. 176, No. 17643, item IX (December, 1978).

Excessive halides in the nucleation are preferably $Cl^-$, $Br^-$ and $I^-$, and they can be present individually or in combination. The concentration of the total halides is $3\times10^{-5}$ mol/L or more and 0.1 mol/L or less, and preferably $3\times10^{-4}$ mol/L or more and 0.01 mol/L or less.

The halogen composition in a halide solution added during nucleation is preferably $Br^-$, $Cl^-$, and $I^-$, and they can be present individually or in combination. Nucleation such that the chlorine content is 10 mol % or more of the amount of the silver used for the nucleation as disclosed in JP-A-10-293372 may be employed. At this time, the concentration of $Cl^-$ is preferably 10 mol % or more and 100 mol % or less, and more preferably 20 mol % or more and 80 mol % or less, based on the concentration of the total halides.

The protective colloid may be dissolved in a halide solution added during nucleation. Alternatively, the gelatin solution may also be added separately but simultaneously with a halide solution during nucleation.

The temperature in the nucleation is preferably from 5 to 60° C., but when fine tabular grains having an average grain diameter of 0.5 μm or less are produced, the temperature is more preferably from 5 to 48° C.

The pH of the dispersion medium when amino group-modified gelatin is used is preferably 4 or more and 8 or less but when other gelatins are used it is preferably 2 or more and 8 or less.

2. Ripening Step

In the nucleation described in 1 above, fine grains other than tabular grains are formed (in particular, octahedral and single twin grains). Accordingly, the grains other than tabular grains are necessary to be vanished before entering a growing step described infra to obtain nuclei having the forms of becoming tabular grains and good monodispersibility. For this purpose, it is well known that Ostwald ripening is conducted subsequent to the nucleation.

The pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10% by weight or less. The above-described alkali-processed gelatin, amino group-modified gelatin of the present invention, oxidized gelatin, low molecular weight gelatin, natural high polymers and synthetic high polymers can be used as additional protective colloids. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used.

The temperature during ripening is from 40 to 80° C., preferably from 50 to 80° C., and the pBr is from 1.2 to 3.0. The pH is preferably 4 or more and 8 or less when amino group-modified gelatin is present, and preferably 2 or more and 8 or less when other gelatins are used.

A silver halide solvent may be used for rapidly vanishing grains other than tabular grains. The concentration of the silver halide solvent at this time is preferably from 0.3 mol/L or less, more preferably 0.2 mol/L or less.

Thus, almost pure tabular grains are obtained by the ripening.

After the ripening is completed, if the silver halide solvent is unnecessary in the next growing stage, the silver halide solvent is removed as follows.

(i) In the case of alkaline silver halide solvents such as $NH_3$, an acid having great solubility product with Ag+ such as $HNO_3$ is added to be nullified.

(ii) In the case of thioether based silver halide solvent, an oxidizing agent such as $H_2O_2$ is added to be nullified as disclosed in JP-A-60-136736.

In the production method of an emulsion of the present invention, the completion of the ripening step is defined as a time of disappearance of tabular grains (regular or single twin grains) having hexagonal or triangular main planes but not having two or more twin planes. The disappearance of tabular grains having hexagonal or triangular main planes but not having two or more twin planes can be confirmed through the observation of the TEM image of a replica of grains.

In the ripening step, an over-ripening step disclosed in JP-A-11-174606 may be provided, if necessary. The over-ripening step refers to a step where ripening (ripening step) is performed until the proportion of hexagonal tabular grains becomes maximum, and then the tabular grains subjected to Ostwald ripening, thereby eliminating tabular grains with a slow anisotropic growing rate. When letting the number of grains obtained in the ripening step be 100, it is preferable to reduce the number of tabular grains to 90 or less, and more preferable to reduce it to 60 or more and 80 or less.

In the production method of the emulsion of the present invention, conditions of pBr, temperature and the like during the over-ripening step may be set as in the ripening step. Further, in the over-ripening step, a silver halide solvent may be added as in the ripening step, and the kind, concentration and the like thereof may be set to those the same as in the ripening step.

3. Growing Step

The pBr during the crystal growing stage subsequent to the ripening step is preferably maintained at 1.4 to 3.5. When the concentration of protective colloid in a dispersion medium solution before entering the growing step is low (1% by weight or less), protective colloid is additionally added in some cases. Further, protective colloid may be additionally added during the growing step. The timing of the addition may be any time during the growing step. The concentration of protective colloid in a dispersion medium solution at that time is preferably from 1 to 10% by weight. The above-described alkali-processed gelatin, amino group-modified gelatin of the present invention, oxidized gelatin, natural high polymers and synthetic high polymers can be used as additional protective colloids. Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. The pH during growing is preferably from 4 to 8 when amino group-modified gelatin is present, and preferably from 2 to 8 when other gelatins are used. The feeding rate of $Ag^+$ and a halogen ion in the crystal growing stage is preferably adjusted to such a degree that the crystal growing speed becomes from 20 to 100%, more preferably from 30 to 100%, of the critical growing speed of the crystal. In this case, the feeding rates of a silver ion and a halogen ion are increased with the crystal growth of the grains and, as disclosed in JP-B's-48-36890 and 52-16364, the feeding rates of an aqueous solution of silver salt and an aqueous solution of halide may be increased, alternatively, the concentrations of an aqueous solution of silver salt and an aqueous solution of halide may be increased.

When performing by the double-jet method in which an aqueous silver salt solution and an aqueous halide salt solution are added simultaneously, it is preferable to stir in the reaction vessel well or to dilute the concentration of the solution to be added for preventing the introduction of growth dislocation due to ununiformity of iodine.

A method is more preferable in which an AgI fine grain emulsion prepared outside the reaction vessel is added to the same timing when an aqueous silver salt solution and an aqueous halide salt solution are added. In this case, the temperature of growth is preferably 50° C. or more and 90° C. or less, and more preferably 60° C. or more and 85° C. or less. The AgI fine grain emulsion may be that prepared in advance. Alternatively, an AgI fine grain emulsion may be added while being prepared continuously. In this case, with respect to the preparation method, JP-A-10-43570 is available as a reference. The average grain size of the AgI emulsion to be added is 0.01 μm or more and 0.1 μm or less, and preferably 0.02 μm or more and 0.08 μm or less. The iodine composition of the base grains can be varied by adjusting the amount of the AgI emulsion to be added.

It is also possible to add silver iodobromide fine grains instead of adding an aqueous silver salt solution and an aqueous halide salt solution. In this case, base grains having a desired iodine composition are obtained by rendering the iodine amount of the fine grains equal to the iodine amount of the desired base grains. Although the silver iodobromide fine grains may be those prepared in advance, it is more preferable that the fine grains may be added while being prepared continuously. The size of the silver iodobromide fine grains to be added is 0.005 μm or more and 0.05 μm or less, and preferably 0.01 μm or more and 0.03 μm or less. The temperature during the growth is 60° C. or more and 90° C. or less, and preferably from 70° C. to 85° C.

It is also possible to combine the aforementioned ion adding method, the AgI fine grain adding method, and the AgBrI fine grain adding method.

In the present invention, tabular grains preferably have dislocation lines. However, for the purpose of reducing pressure desensitization, it is preferable that there are no dislocation lines in a base portion. Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, the greater the thickness of a grain, the more difficult it becomes to transmit electron rays through it. Therefore, grains can be observed more clearly by using an electron microscope of high voltage type (200 kV or more for a grain having a thickness of 0.25 μm). From photographs of grains obtained by the above method, it is possible to obtain the positions and the number of dislocation lines in each grain viewed in a direction perpendicular to the main planes of the grain.

Next, step (b) will be described.

First, step (b1) will be described. Step (b1) comprises a first shell step and a second shell step. A first shell is formed on the base described above. The ratio of the first shell is 1% or more and 30% or less of the total silver amount, and the average silver iodide content of the first shell is 20 mol % or more and 100 mol % or less. More preferably, the ratio of the first shell is 1% or more and 20% or less of the total silver amount, and the average silver iodide content of the first shell is preferably 25 mol % or more and 100 mol % or less. The growth of the first shell on a base is basically performed by the addition of an aqueous silver nitrate solution and an aqueous halogen solution containing both iodide and bromide by the double-jet method, or by the addition of an aqueous silver nitrate solution and an aqueous halogen solution containing iodide by the double-jet method. Alternatively, an aqueous halogen solution containing iodide is added by the single-jet method.

Any of these methods may be applied, and any combination thereof may also be applied. As is clear from the average silver iodide content of the first shell, silver iodide can also precipitate in addition to a silver iodobromide mixed crystal during the formation of the first shell. In either case, the silver iodide vanishes and entirely changes into a silver iodobromide mixed crystal during the formation of the second shell.

A preferable method for the formation of the first shell is a method comprising adding a silver iodobromide or silver iodide fine grain emulsion, ripening and dissolving. Another preferable method is a method comprising adding a silver iodide fine grain emulsion, followed by the addition of an aqueous silver nitrate solution or addition of aqueous silver nitrate solution and an aqueous halogen solution. In this case, the dissolution of the silver iodide fine grain emulsion is accelerated by the addition of the aqueous silver nitrate solution. The silver amount of the added silver iodide fine grain emulsion is used to obtain the first shell, and the silver iodide content thereof is assumed to be 100 mol %. The amount of silver of the added aqueous silver nitrate solution is used to calculate the second shell. It is preferable that the silver iodide fine grain emulsion is added abruptly.

"To add a silver iodide fine grain emulsion abruptly adding" is to add the silver iodide fine grain emulsion preferably within 10 minutes, and more preferably, within 7 minutes. This condition may vary in accordance with, e.g., the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate is not substantially added. The temperature of the system during the addition is preferably 40° C. or more and 90° C. or less, and most preferably, 50° C. or more and 80° C. or less.

A silver iodide fine grain emulsion essentially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, the disclosure of which is herein incorporated by reference, an α body or an α body similar structure. In the present invention, the crystal structure is not particularly restricted but is preferably a mixture of β and γ bodies, and more preferably, a β body. The silver iodide fine grain emulsion can be either an emulsion formed immediately before addition described in U.S. Pat. No. 5,004,679 the disclosure of which is herein incorporated by reference, or an emulsion subjected to a regular washing step. In the present invention, an emulsion subjected to a regular washing step is used. The silver iodide fine grain emulsion can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention.

Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by laying silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.06 to 0.02 μm and a grain size distribution variation coefficient of 18% or less.

After the grain formation described above, a silver iodide fine grain emulsion is preferably subjected to regular washing described in, e.g., U.S. Pat. No. 2,614,929, the disclosure of which is herein incorporated by reference, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount is preferably 10 to 100 g, and more preferably, 20 to 80 g per kg of an emulsion. The silver amount is preferably 10 to 100 g, and more preferably, 20 to 80 g, in terms of silver atoms, per kg of an emulsion. As the gelatin amount and/or the silver amount, it is preferable to choose values suited to abrupt addition of the silver iodide fine grain emulsion.

The silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

As a more preferable method for forming the first shell, it is possible to form a silver halide phase containing silver iodide while causing iodide ions to generate abruptly by using an iodide ion releasing agent described in U.S. Pat. No. 5,496,694, instead of the conventional iodide ion supply method (the method of adding free iodide ions).

The iodide ion-releasing agent releases iodide ions through its reaction with an iodide ion release control agent (a base and/or a nucleophilic reagent). Preferable examples of this nucleophilic reagent used include the following chemical species, e.g., hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines and sulfides.

The release rate and timing of iodide ions can be controlled through the control of the concentration and addition method of a base or a nucleophilic reagent or the control of the temperature of the reaction solution. A preferable base is alkali hydroxide.

To generate iodide ions abruptly, the concentrations of the iodide ion-releasing agent and iodide ion release control agent are preferably $1\times10^{-7}$ to 20 M, more preferably, $1\times10^{-5}$ to 10 M, further preferably, $1\times10^{-4}$ to 5 M, and particularly preferably, $1\times10^{-3}$ to 2 M.

If the concentration exceeds 20 M, the addition amounts of the iodide ion-releasing agent and iodide ion release control agent having large molecular weights adversely become too great compared to the capacity of the grain formation vessel.

If the concentration is less than $1\times10^{-7}$ M, the iodide ion-releasing reaction rate adversely becomes too low, and this makes it difficult to abruptly generate the iodide ion-releasing agent.

The temperature is preferably 30 to 80, more preferably, 35 to 75° C., and particularly preferably, 35 to 60° C.

At high temperatures exceeding 80° C., the iodide ion-releasing reaction rate generally becomes extremely high. At low temperatures below 30° C., the iodide ion-releasing reaction temperature generally becomes extremely low. Both cases are undesirable because the use conditions are restricted.

When a base is used to release iodide ions, a change in the solution pH can also be used. If this is the case, the pH range for controlling the rate and timing of releasing iodide ions is preferably 2 to 12, more preferably 3 to 11, and particularly preferably 5 to 10. Most preferably, the pH after adjustment is 7.5 to 10.0. Under a neutral condition of pH 7, hydroxide ions having a concentration determined by the ion product of water function as control agents.

A nucleophilic reagent and a base can be used jointly. When this is the case, the pH can be controlled within the above range to thereby control the rate and timing of releasing iodide ions.

When iodine atoms are to be released in the form of iodide ions from the iodide ion-releasing agent, these iodine atoms may be entirely released or may partially remain without decomposition.

The second shell is formed on the above-described base and a tabular grain having the first shell. The ratio of the second shell is 10 mol % or more and 40 mol % or less of the total silver amount, and the average silver iodide content of the second shell is 0 mol % or more and 5 mol % or less. More preferably, the ratio of the second shell is 15 mol % or more and 30 mol % or less of the total silver amount, and the average silver iodide content of the fourth shell is 0 mol % or more and 3 mol % or less. The growth of the second shell on a base and a tabular grain having the first shell can be performed either in a direction to increase the aspect ratio of the tabular grain or in a direction to decrease it. The growth of the second shell is basically performed by addition of an aqueous silver nitrate solution and an aqueous halogen solution containing bromide using the double-jet method. Alternatively, it is also possible to add an aqueous silver halogen solution containing bromide and then add an aqueous silver nitrate solution by the single-jet method. The temperature and pH of the system, the type and concentration of a protective colloid agent such as gelatin, and the presence/absence, type, and concentration of a silver halide solvent may vary over a broad range. With respect to pBr, the pBr at the end of the formation of the second shell layer is preferably higher than that in the initial stages of the formation of that layer. Preferably, the pBr in the initial stages of the formation of the layer is 2.9 or less, and the pBr at the end of the formation of the layer is 1.7 or more. More preferably, the pBr in the initial stages of the formation of the layer is 2.5 or less, and the pBr at the end of the formation of the layer is 1.9 or more. Most preferably, the pBr in the initial stages of the formation of the layer is 1 or more and 2.3 or less and the pBr at the end of the formation of the layer is 2.1 or more and 4.5 or less.

It is preferable that there are dislocation lines in the portion of step (b1). The dislocation lines are preferably present in the vicinities of the side faces of tabular grains. The vicinities of the side faces refer to the six side faces of a tabular grain and the area inside the faces, that is, the portion grown in step (b1). The average number of the dislocation lines present in the side faces is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50%, more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, step (b2) will be described.

Step (b2) includes the following embodiments: as a first embodiment, a method comprising dissolving only the vicinities of apexes with iodide ions; as a second embodiment, a method comprising adding a silver salt solution and an iodide salt solution simultaneously; as a third embodiment, a method comprising substantially dissolving only the vicinities of apexes with a silver halide solvent; and as a forth embodiment, a method via halogen conversion.

The first embodiment, the method of dissolving with iodide ions will be described below.

When iodide ions are added to base grains, the vicinity of each apex portion of the base grains is dissolved and the grains are somewhat rounded. When, successively, a silver nitrate solution and a bromide solution, or a silver nitrate solution and a mixed solution comprising a bromide solution and an iodide solution are added simultaneously, the grains further grow and dislocation is introduced in the vicinities of the apexes. With respect to this method, JP-A's-4-149541 and 9-189974 are available as references.

For attaining an effective dissolution according to the present embodiment, it is preferable that when the value obtained by multiplying, by 100, the quotient resulting from dividing the number of the whole iodide ions by the mol number of the total silver in the base grains is let be $I_2$ (mol %), the total amount of the iodide ions to be added in this embodiment satisfies the condition in which $(I_2-I_1)$ is 0 or more and 8 or less, and more preferably 0 or more and 4 or less, with respect to the silver iodide content of the base grains $I_1$ (mol %)

The lower the concentration of the iodide ions to be added in this embodiment, the more preferable.

Specifically, the concentration is preferably 0.2 mol/L or less, and more preferably 0.1 mol/L or less.

pAg during the addition of iodide ions is preferably 8.0 or more, and more preferably 8.5 or more.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The second embodiment, the method comprising adding a silver salt solution and an iodide salt solution simultaneously will be described below. By rapidly adding a silver salt solution and an iodide salt solution to base grains, it is possible to epitaxially generate silver iodide or a silver halide having a high silver iodide content at apex portions of the grains. At this time, the addition rates of the silver salt solution and the iodide salt solution are preferably 0.2 min. or more and 0.5 min. or less, more preferably 0.5 min. or more and 2 min. or less. This method is disclosed in JP-A's-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

The third embodiment, the method using a silver halide solvent will be described below.

When a silver halide solvent is added to a dispersion medium containing base grains and then a silver salt solution and an iodide salt solution are added simultaneously, silver iodide or a silver halide having a high silver iodide content preferentially grows at apex portions of the base grains dissolved with the silver halide solvent. In this operation, it is not necessary to add the silver salt solution or the iodide salt solution rapidly. This method is disclosed in JP-A's-4-149541 and therefore the publication is available as a reference.

Following the dissolution of the apex portions of the base grains by the addition of iodide ion to the base grains, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

Next, the forth embodiment, the method via halogen conversion will be described.

This is a method in which an epitaxially growing site director (hereinafter, referred to as a site director), such as a sensitizing dye disclosed in JP-A-58-108526 and a water-soluble iodide, is added to base grains so that epitaxial of silver chloride is formed at the apex portions of the base grains and then iodide ions are added so that the silver chloride is halogen converted into silver iodide or silver halide having a high silver iodide content. As the site director, sensitizing dyes, a water-soluble thiocyanate ion and water-soluble iodide ion can be used, and the iodide ion is preferable. The iodide ion is used in an amount of 0.0005 to 1 mol %, and preferably 0.001 to 0.5 mol % of the base grains. When the optimum amount of iodide ion is added and then a silver salt solution and a chloride salt solution are added simultaneously, epitaxial of silver chloride can be formed at apex portions of the base grains.

The following is a description on halogen conversion of silver chloride caused by iodide ions. A silver halide having a great solubility is converted into a silver halide having a less solubility by addition of halide ions capable of forming the silver halide having a less solubility. This process is called halogen conversion and is disclosed in U.S. Pat. No. 4,142,900. By selectively subjecting the silver chloride epitaxially grown at apex portions of the base to halogen conversion with iodide ions, a silver iodide phase is formed at apex portions of the base grains. The detail will be disclosed in JP-A-4-149541.

Following the halogen conversion of the silver chloride epitaxially grown at apex portions of the base grains into a silver iodide phase caused by the addition of iodide ions, the grains are further grown so that dislocation is introduced in the vicinities of the apexes by the addition of a silver nitrate solution or the simultaneous addition of a silver nitrate solution and a bromide solution or a silver nitrate solution and a mixed solution comprising a bromide solution and an iodide solution.

It is preferable that there are dislocation lines in the portion of step (b2). The dislocation lines are preferably present in the vicinities of the apex portions of tabular grains. The vicinity of an apex portion of a grain refers to the three-dimensional portion defined in the following manner. Perpendiculars are dropped each from a point located on a straight line connecting the center of the grain and x % away from the center of the straight line to each of the sides of the grain defining the apex. The above perpendiculars and the above sides surround a three-dimensional portion. The value of x is preferably 50 or more and less than 100, and more preferably 75 or more and less than 100. The average number of the dislocation lines present in the edge portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50%, more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, step (b3) will be described.

About the epitaxial formation of silver halide to base grains, U.S. Pat. No. 4,435,501 discloses that silver salt epitaxial can be formed at selected sites, e.g., apex portions or side face portions of base grains, by a site director such as iodide ions, aminoazaindene or spectral sensitizing dyes adsorbed to the surface of the base grains. In JP-A-8-69069, the enhancement of sensitivity is attained by forming silver salt epitaxial at selected sites in extremely thin tabular grains and subjecting the epitaxial phase to optimum chemical sensitization.

Also in the present invention, it is very preferable to enhance the sensitivity of the base grains of the present invention using these methods. As the site director, aminoazaindene or spectral sensitizing dyes may be used and iodide ions or thiocyanate ions may also be used. These may be properly used depending on the purposes, or may be used in combination.

By varying the addition amounts of the sensitizing dyes, sensitizing ions and thiocyanate ions, the site for forming silver salt epitaxial can be limited to the main plane portions, the side face portions or the apex portions of base grains. Combinations of them are also possible. It is preferable that the amounts of aminoazaindene, iodide ions, thiocyanate ions and spectral sensitizing dyes are suitably selected depending on the silver amount and the surface area of the silver halide base grains to be used, and the limited sites of epitaxial. The temperature at which silver salt epitaxial is formed is preferably 40 to 70° C., and more preferably 45 to 60° C. At this time, pAg is preferably 9.0 or less, and more preferably 8.0 or less. By suitably selecting the kind and addition amount of site directors and epitaxial deposition conditions (e.g., temperature and pAg) in such a manner, epitaxial of silver salt can be formed selectively on the main plane portions, side face portions or apex portions. The thus obtained emulsion may be enhanced its sensitivity by being subjected to chemical sensitization selectively in its epitaxial phase as in JP-A-8-69069, and also may be further grown by means of simultaneous addition of a silver salt solution and a halide salt solution following the silver salt epitaxial formation. As the aqueous halide salt solution to be added in this treatment, a bromide salt solution, or a mixed solution comprising a bromide salt solution and an iodide salt solution is preferable. In the treatment, the temperature is preferably 40 to 80° C., and more preferably 45 to 70° C. At this time, pAg is preferably 5.5 or more and 9.5 or less, and more preferably 6.0 or more and 9.0 or less. Furthermore, it is also possible to perform halogen conversion of the epitaxial by adding a halogen solution different from the epitaxial composition. The epitaxial formation and the subsequent growth, or the halogen conversion may be performed successively after the silver halide base grain formation, and also may be performed after washing with water/re-dispersion following the base grain formation. They also may be performed before chemical sensitization. The epitaxial formation and the subsequent growth, or the halogen conversion may be carried out separately before and after the washing with water/re-dispersion.

The epitaxial formed in step (b3) is characterized by projecting outside the base grains formed in step (a). The composition of epitaxial is preferably AgBr, AgCl, AgBrCl, AgBrClI, AgBrI, AgI, AgSCN, or the like. It is more preferable to introduce a "dopant (metal complex)" such as those disclosed in JP-A-8-69069, to an epitaxial layer. The position of epitaxial growth may be at least a part of the apex portions, the side face portions and the main plane portions of the base grains and also may be spread over two or more portions. The apex portion refers to each apex of a triangular or hexagonal, tabular grain (six apexes for a hexagon and three apexes for a triangle). It is preferable that at least one of the apexes has the epitaxial. The side face portion refers to, in the case of a hexagonal tabular grain, the six sides and the planes connecting the two main plane portions, namely side face portions. The epitaxial may be present in any portion of six sides and side face portions. It is only required that at least one epitaxial is present. The same are true for the case of triangle tabular grains. The main plane portion refers to two main planes in a tabular grain. The epitaxial may be present at any position in the main planes. It is only required that at least one epitaxial is present. With respect to the shape of the epitaxial, a {100} face, a {111} face, or a {110} face may appear alone. Alternatively, two or more of the faces may appear. Further, the epitaxial may have an amorphous structure where faces of a higher order appear.

No dislocation lines are required to be present in the portion of step (b3), but it is more preferable that there is a dislocation line. It is preferable for dislocation lines to be present in the connecting portion between a base grain and an epitaxial growth portion or in an epitaxial portion. The average number of the dislocation lines present in the connecting portions or epitaxial portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

It is preferable that the system is doped with a hexacyanometal complex during the formation of an epitaxial portion. Of hexacyanometal complexes, those containing iron, ruthenium, osmium, cobalt, rhodium, iridium or chromium are preferable. The addition amount of such a metal complex is preferably with in the range of from $10^{-9}$ to $10^{-2}$ mol per mol of silver halide, and more preferably within the range of from $10^{-8}$ to $10^{-4}$ mol per mol of silver halide. The metal complex may be added after being dissolved in water or an organic solvent. The organic solvent preferably has a miscibility with water. Examples of the organic solvent includes alcohol, ether, glycol, ketone, ester and amide.

The dislocation line amount distribution is preferably uniform between tabular grains of the present invention. In an emulsion of the present invention, silver halide grains containing 5 or more dislocation lines per grain account for preferably 100 to 50%, more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

As a protective colloid and as a binder of other hydrophilic colloid layers that are used when the emulsion according to the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethylcellulose, carboxymethylcellulose, and cellulose sulfate ester; sodium alginate, a saccharide derivative, such as a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole and a polyvinylpyrazole.

Preferably, the silver halide emulsion according to the present invention is washed with water for desalting and is dispersed in a freshly prepared protective colloid. Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 μmol/g or less) and amino group-modified gelatin of the present invention (e.g., phthalated gelatin, trimellitated gelatin, succinated gelatin, maleated gelatin, and esterified gelatin). Further, if necessary, lime-processed ossein gelatin containing 20% or more, preferably 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. Further, natural high polymers will be described in JP-B-7-111550 and Research Disclosure, Vol. 176, No. 17643, item IX (December, 1978). The temperature at which the washing with water is carried out can be selected in accordance with the purpose, and preferably the temperature is selected in the range of 5° C. to 50° C. The pH at which the washing with water is carried out can be selected in accordance with the purpose, and preferably the pH is selected in the range of 2 to 10, and more preferably in the range of 3 to 8. The pAg at which the washing with water is carried out can be selected in accordance with the purpose, and preferably the pAg is selected in the range of 5 to 10. As a method of washing with water, it is possible to select from the noodle washing method, the dialysis method using a diaphragm, the centrifugation method, the coagulation settling method, the ion exchange method and the ultrafiltration. In the case of the coagulation settling method, selection can be made from, for example, the method wherein sulfuric acid salt is used, the method wherein an organic solvent is used, the method wherein a water-soluble polymer is used, and the method wherein a gelatin derivative is used.

During the grain formation of the present invention, it is possible to cause a polyalkyleneoxide block copolymer disclosed in, for example, JP-A's-5-173268, 5-173269, 5-173270, 5-173271, 6-202258 and 7-175147, or a polyalkyleneoxide copolymer disclosed in Japanese Patent No. 3089578 to exist. Such a compound exists may exist at any timing during the preparation of the grains. However, its use in early stages of grain formation exhibits a great effect.

A third emulsion relating to the present invention, comprising tabular silver halide grains of silver iodobromide or silver chloroiodobromide whose silver chloride content is less than 10 mol %, and having (100) faces as parallel main planes will be described below.

With respect to the (100) tabular grains of the present invention, 50 to 100%, preferably 70 to 100%, and more preferably 90 to 100%, of the total projected area is occupied by tabular grains having (100) faces as main planes and having an aspect ratio of 2 or more. The grain thickness is preferably in the range of 0.01 to 0.10 μm, more preferably 0.02 to 0.08 μm, and most preferably 0.03 to 0.07 μm. The aspect ratio is preferably in the range of 2 to 100, more preferably 3 to 50, and most preferably 5 to 30. The variation coefficient of grain thickness (percentage of "standard deviation of distribution/average grain thickness", hereinafter referred to as "COV") is preferably 30% or less, more preferably 25% or less, and most preferably 20% or less. The smaller this COV, the higher the monodispersity of grain thickness.

In the measuring the equivalent circle diameter and thickness of tabular grains, a transmission electron micrograph (TEM) thereof is taken according to the replica method, and the equivalent circle diameter and thickness of each individual grain are measured. In this method, the thickness of tabular grains is calculated from the length of shadow of the replica. In the present invention, the COV is determined as a result of measuring at least 600 grains.

The silver halide composition of the (100) tabular grains of the present invention is silver iodobromide or silver chloroiodobromide having a silver chloride content of less than 10 mol %. Furthermore, other silver, salts, such as silver rhodanate, silver sulfide, silver selenide, silver telluride, silver carbonate, silver phosphate and an organic acid salt of silver, may be contained in the form of other separate grains or as parts of silver halide grains.

The X-ray diffraction method is known as means for investigating the halogen composition of AgX crystals. The X-ray diffraction method is described in detail in, for example, Kiso Bunseki Kagaku Koza 24 (Fundamental Analytical Chemistry Course 24) "X-sen Kaisetu (X-ray Diffraction)". In the standard method, Kβ radiation of Cu is used as a radiation source, and the diffraction angle of AgX (420) face is determined by the powder method.

When the diffraction angle 2θ is determined, the lattice constant (a) can be determined by Bragg's equation as follows:

$$2d \sin \theta = \lambda$$

$$d = a/(h^2+k^2+l^2)^{1/2},$$

wherein 2θ represents the diffraction angle of (hkl) face; λ represents the wavelength of X rays; and d represents the spacing of (hkl) faces. Because, with respect to silver halide solid solutions, the relationship between the lattice constant (a) and the halogen composition is known (described in, for example, T. H. James "The Theory of the Photographic Process, 4th ed.", Macmillian, New York), determination of the lattice constant leads to determination of the halogen composition.

The halogen composition structure of (100) tabular grains according to the present invention is not limited. Examples thereof include grains having a core/shell double structure wherein the halogen compositions of the core and the shell are different from each other and grains having a multiple structure composed of a core and two or more shells. The core is preferably constituted of silver bromide, to which, however, the core of the present invention is not limited. With respect to the composition of the shell, it is preferred that the silver iodide content be higher therein than in the core.

It is preferred that the (100) tabular grains of the present invention have an average silver iodide content of 2.3 mol % or more and an average silver iodide content, at the surface of grains, of 8 mol % or more. With respect to the (100) tabular grains of the present invention, preferably, the upper limit of average silver iodide content is 20 mol % and the upper limit of average surface silver iodide content is also 20 mol %. The intergranular variation coefficient of silver iodide content is preferably less than 20%. The surface silver iodide content, can be measured by above-mentioned XPS.

The (100) tabular grains of the present invention can be classified by shape into the following six types of grains. (1) Grains whose main plane shape is a right-angled parallelogram. (2) Grains whose main plane shape is a right-angled parallelogram having one or more, preferably 1 to 4 corners selected from four corners of which are non-equivalently deleted, namely, grains whose K1=(area of maximum deletion)/(area of minimum deletion) is 2 to ∞. (3) Grains whose main plane shape is a right-angled parallelogram having four corners of which are equivalently deleted (grains whose K1 is smaller than 2). (4) Grains whose 5 to 100%, preferably 20 to 100% of the side of faces in the deletions one (111) faces. (5) Grains having main planes each with four sides, of which at least two sides opposite to each other are outward protruding curves. (6) Grains whose main plane shape is a right-angled parallelogram having one or more, preferably 1 to 4 corners selected from four corners of which are deleted in the shape of a right-angled parallelogram. These features of the grains can be identified by observation through an electron microscope.

With respect to the (100) tabular grains of the present invention, the ratio of (100) faces to surface crystal habits is 80% or more, preferably 90% or more. A statistical estimation of the ratio can be performed by the use of an electron micrograph of grains. When the (100) tabular face ratio of AgX grains of an emulsion is nearly 100%, the above estimate can be ascertained by the following method. The method is described in Journal of the Chemical Society of Japan, 1984 No.6, page 942, which comprises causing a given amount of (100) tabular grains to adsorb varied amounts of benzothiacyanine dye at 40° C. for 17 hr, determining the sum total (S) of surface areas of all grains and the sum total (S1) of areas of (100) faces per unit emulsion from light absorption at 625 nm, and calculating the (100) face ratio by applying these sum total values to the formula: (S1/S)×100 (%).

The average equivalent sphere diameter of the (100) tabular grains of the invention is preferably 0.35 μm or less. The estimation of the grain size can be conducted by measuring projected areas and thickness by the replica method.

A fourth emulsion relating to the invention, silver halide grains having (111) faces or (100) faces as parallel main planes, having an aspect ratio of 2 or more and containing silver chloride in an amount of at least 80 mol %, will be explained below.

Special measures must be implemented for producing (111) grains of high silver chloride content. Use may be made of the method of producing tabular grains of high silver chloride content with the use of ammonia as described in U.S. Pat. No. 4,399,215 to Wey. Also, use may be made of the method of producing tabular grains of high silver chloride content with the use of a thiocyanate as described in U.S. Pat. No. 5,061,617 to Maskasky. Further, use may be made of the following methods of incorporating additives (crystal habit-controlling agents) at the time of grain formation in order to form grains of high silver chloride content having (111) faces as external surfaces:

| Patent No. | crystal habit-controlling agent | Inventor |
|---|---|---|
| U.S. Pat. No. 4,400,463 | azaindene + thioether peptizer | Maskasky |
| U.S. Pat. No. 4,783,398 | 2,4-dithiazolidinone | Mifune et al. |

-continued

| Patent No. | crystal habit-controlling agent | Inventor |
|---|---|---|
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyrimidine | Maskasky |
| U.S. Pat. No. 5,178,997 | 7-azaindole compound | Maskasky |
| U.S. Pat. No. 5,178,998 | xanthine | Maskasky |
| JP-A-64-70741 | dye | Nishikawa et al. |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al. |
| JP-A-8-227117 | monopyridinium salt | Ozeki et al. |

With respect to the formation of (111) tabular grains, although various methods of using crystal habit-controlling agents are known as listed in the above table, the compounds (compound examples 1 to 42) described in JP-A-2-32 are preferred, and the crystal habit-controlling agents 1 to 29 described in JP-A-8-227117 are especially preferred. However, the present invention is in no way limited to these.

The (111) tabular grains are obtained by forming two parallel twinned crystal faces. The formation of such twin faces is influenced by the temperature, dispersion medium (gelatin), halide concentration, etc., so that appropriate conditions must be set on these. In the presence of a crystal habit-controlling agent at the time of nucleation, the gelatin concentration is preferably in the range of 0.1 to 10%. The chloride concentration is 0.01 mol/liter or more, preferably 0.03 mol/liter (liter hereinafter referred to as "L") or more.

JP-A-8-184931 discloses that, for monodispersing grains, it is preferred not to use any crystal habit-controlling agent at the time of nucleation. When no crystal habit-controlling agent is used at the time of nucleation, the gelatin concentration is in the range of 0.03 to 10%, preferably 0.05 to 1.0%. The chloride concentration is in the range of 0.001 to 1 mol/L, preferably 0.003 to 0.1 mol/L. The nucleation temperature, although can arbitrarily be selected as long as it is in the range of 2 to 90° C., is preferably in the range of 5 to 80° C., more preferably 5 to 40° C.

Nuclei of tabular grains are formed at the initial stage of nucleation. However, a multiplicity of non-tabular grain nuclei are contained in the reaction vessel immediately after the nucleation. Therefore, such a technology that, after the nucleation, ripening is carried out to thereby cause only tabular grains to remain while other grains are eliminated is required. When the customary Ostwald ripening is performed, nuclei of tabular grains are also dissolved and eliminated, so that the number of nuclei of tabular grains is reduced with the result that the size of obtained tabular grains is increased. In order to prevent this, a crystal habit-controlling agent is added. In particular, the simultaneous use of gelatin phthalate enables increasing the effect of the crystal habit-controlling agent and thus enables preventing the dissolution of tabular grains. The pAg during the ripening is especially important, and is preferably in the range of 60 to 130 mV with silver/silver chloride electrodes.

The thus formed nuclei are subjected to physical ripening and are grown in the presence of a crystal habit-controlling agent by adding a silver salt and a halide thereto. In the system, the chloride concentration is 5 mol/L or less, preferably in the range of 0.05 to 1 mol/L. The temperature for grain growth, although can be selected from among 10 to 90° C., is preferably in the range of 30 to 80° C.

The total addition amount of crystal habit-controlling agent is preferably $6\times10^{-5}$ mol or more, more preferably in the range of $3\times10^{-4}$ to $6\times10^{-2}$ mol, per mol of silver halides of completed emulsion. The timing of addition of the crystal habit-controlling agent can be at any stage from the silver halide grain nucleation to physical ripening and during the grain growth. After the addition, the formation of (111) faces is started. Although the crystal habit-controlling agent may be placed in the reaction vessel in advance, in the formation of tabular grains of small size, it is preferred that the crystal habit-controlling agent be placed in the reaction vessel simultaneously with the grain growth so that the concentration thereof is increased.

When the amount of dispersion medium used at nucleation is short in growth, it is needed to compensate for the same by an addition. It is preferred that 10 to 100 g/L of gelatin be present for growth. The compensatory gelatin is preferably gelatin phthalate or gelatin trimellitate.

The pH at grain formation, although arbitrary, is preferably in the neutral to acid region.

Now, the (100) tabular grains will be described. The (100) tabular grains are tabular grains having (100) faces as main planes. The shape of these main planes is, for example, a right-angled parallelogram, or a tri- to pentagon corresponding to a right-angled parallelogram having one corner selected from the four corners of which has been deleted (deletion having the shape of a right-angled triangle composed of the corner apex and sides making the corner), or a tetra- to octagon corresponding to a right-angled parallelogram having two to four corners selected from the four corners of which have been deleted.

When a right-angled parallelogram having been compensated for the deletions is referred to as a compensated tetragon, the neighboring side ratio (length of long side/length of short side) of the right-angled parallelogram or compensated tetragon is in the range of 1 to 6, preferably 1 to 4, and more preferably 1 to 2.

The formation of tabular silver halide emulsion grains having (100) main planes is performed by adding an aqueous solution of silver salt and an aqueous solution of halide to a dispersion medium such as an aqueous solution of gelatin under agitation and mixing them together. For example, JP-A's-6-301129, 6-347929, 9-34045 and 9-96881 disclose such a method that, at the formation, making silver iodide or iodide ions, or silver bromide or bromide ions, exist to thereby produce strain in nuclei due to a difference in size of crystal lattice from silver chloride so that a crystal defect imparting anisotropic growability, such as spiral dislocation, is introduced. When the spiral dislocation is introduced, the formation of two-dimensional nuclei at the surface is not rate-determining under low supersaturation conditions with the result that the crystallization at the surface is advanced. Thus, the introduction of spiral dislocation leads to the formation of tabular grains. Herein, the low supersaturation conditions preferably refer to 35% or less, more preferably 2 to 20%, of the critical addition. Although the crystal defect has not been ascertained as being a spiral dislocation, it is contemplated that the possibility of spiral dislocation is high from the viewpoint of the direction of dislocation introduction and the impartation of anisotropic growability to grains. It is disclosed in JP-A's-8-122954 and 9-189977 that, for reducing the thickness of tabular grains, retention of the introduced dislocation is preferred.

Moreover, the method of forming the (100) tabular grains by adding a (100) face formation accelerator is disclosed in JP-A-6-347928, in which use is made of imidazoles and 3,5-diaminotriazoles, and JP-A-8-339044, in which use is made of polyvinyl alcohols. However, the present invention is in no way limited thereto.

Although the grains of high silver chloride content refer to those having a silver chloride content of 80 mol % or more, it is preferred that 95 mol % or more thereof consist of silver chloride. The grains of the present invention preferably have a so-termed core/shell structure consisting of a core portion and a shell portion surrounding the core portion. Preferably, 90 mol % or more of the core portion consists of silver chloride. The core portion may further consist of two or more portions whose halogen compositions are different from each other. The volume of the shell portion is preferably 50% or less, more preferably 20% or less, of the total grain volume. The silver halide composition of the shell portion is preferably silver iodochloride or silver iodobromochloride. The shell portion preferably contains 0.5 to 13 mol %, more preferably 1 to 13 mol %, of iodide. The silver iodide content of a whole grain is preferably 5 mol % or less, more preferably 1 mol % or less.

Also, it is preferred that the silver bromide content be higher in the shell portion than in the core portion. The silver bromide content of a whole grain is preferably 20 mol % or less, more preferably 5 mol % or less.

The average grain size (equivalent sphere diameter in terms of volume) of silver halide grains, although not particularly limited, is preferably in the range of 0.1 to 0.8 μm, more preferably 0.1 to 0.6 μm.

The tabular grains of silver halides preferably have an projected area diameter of 0.2 to 1.0 μm. Herein, the projected area diameter of silver halide grains refers to the diameter of a circle having the same area as the projected area diameter of each individual grain in an electron micrograph. The thickness of silver halide grains is preferably 0.2 μm or less, more preferably 0.1 μm or less, and most preferably 0.06 μm or less. In the present invention, 50% or more, in terms of a ratio to total projected area of all the grains, are occupied by silver halide grains having an aspect ratio (ratio of grain diameter/thickness) of 2 or more, preferably ranging from 5 to 20.

Generally, the tabular grains are of a tabular shape having two parallel surfaces. Therefore, the "thickness" of the present invention is expressed by the spacing of two parallel surfaces constituting the tabular grains.

The grain size distribution of silver halide grains of the present invention, although may be polydisperse or monodisperse, is preferably monodisperse. In particular, the variation coefficient of equivalent circle diameter of tabular grains occupying 50% or more of the total projected area is preferably 20% or less, ideally 0%.

When the crystal habit-controlling agent is present on the grain surface after the grain formation, it exerts influence on the adsorption of sensitizing dye and the development. Therefore, it is preferred to remove the crystal habit-controlling agent after the grain formation. However, when the crystal habit-controlling agent is removed, it is difficult for the (111) tabular grains of high silver chloride content to maintain the (111) faces under ordinary conditions. Therefore, it is preferable to retain the grain configuration by substitution with a photographically useful compound such as a sensitizing dye. This method is described in, for example, JP-A's-9-80656 and 9-106026, and U.S. Pat. Nos. 5,221,602, 5,286,452, 5,298,387, 5,298,388 and 5,176,992.

The crystal habit-controlling agent is desorbed from grains by the above method. The desorbed crystal habit-controlling agent is preferably removed out of the emulsion by washing. The washing can be performed at such temperatures that the gelatin generally used as a protective colloid is not solidified. For the washing, use can be made of various known techniques such as the flocculation method and the ultrafiltration method. The washing temperature is preferably 40° C. or higher.

The desorption of the crystal habit-controlling agent from grains is accelerated at low pH values. Therefore, the pH of the washing step is preferably lowered as far as excess aggregation of grains does not occur.

The silver halide emulsion may be provided with additional characteristics depending on the layer in which the emulsion is to be used. Especially when the emulsion is used in a blue sensitive layer, silver halide grains contained in the silver halide emulsion preferably has a silver iodide content of 3 mol % or more, more preferably 5 mol % or more. Further, when the emulsion is used in a high-speed layer, the projected area diameter is preferably 1 μm or more, and more preferably 2 μm or more.

Further, in order to provide the sensitive material of the invention with pressure resistance, the silver halide emulsion may have the following characteristics. The silver halide emulsion comprising silver halide grains having no dislocation lines in a area within 50%, preferably 80%, from the center of the main plane, when observed with a transmission electron microscope, in an amount of preferably 80% or more, more preferably 90% or more of all the grains. The center of the main plane means the center of gravity in the area of the main plane.

The emulsion used in the invention in general will be explained below.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). In performing reduction sensitization, a compound represented by general formula (3) or general formula (4) is preferably used:

(3)

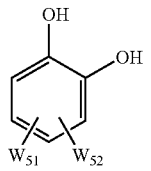

(4)

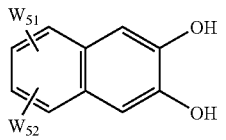

In formulas (3) and (4), each of $W_{51}$ and $W_{52}$ represents a sulfo group or a hydrogen atom. Provided that at least one of $W_{51}$ and $W_{52}$ represents a sulfo group. A sulfo group is generally an alkali metal salt such as sodium or potassium, or a water-soluble salt such as ammonium salt. Practical examples of preferable compounds are 3,5-disulfocatecholdisodium salt, 4-sulfocatecholammonium salt, 2,3-dihydroxy-7-sulfonaphthalenesodium salt, and 2,3-dihydroxy-6,7-disulfonaphthalenepotassium salt.

Although the addition amount of reduction sensitizers must be so selected as to meet the emulsion manufacturing conditions, a proper amount is $10^{-7}$ to $10^{-1}$ mol per mol of a silver halide. The reduction sensitizer is added during grain formation by dissolving thereof to water, or organic solvents such as alcohols, glycols, ketones, esters, and amides.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

It is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

In the formation of silver halide grains of the present invention, at least one of chalcogen sensitization including sulfur sensitization, selenium sensitization, and tellurium sensitization, noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, gold salts described, for example, in Chimie et Physique Photographique (P. Grafkides, Paul Momtel, 1987, 5th ed.), and Research Disclosure, vol. 307, Item 307105, can be used.

Specifically, in addition to chloroauric acid, potassium chloroaurate, and potassium auriothiocyanate, gold compounds can also be used, e.g., those disclosed in U.S. Pat. No. 2,642,361 (e.g., gold sulfide and gold selenide), U.S. Pat. No. 3,503,749 [e.g., gold thiolate having a water-soluble group], U.S. Pat. No. 5,049,484 (bis(methylhydantoinato) gold complex), U.S. Pat. No. 5,049,485 (mesoionic thiolate gold complexes, e.g., 1,4,5-trimethyl-1,2,4-triazolium-3-thiolate gold complex), U.S. Pat. Nos. 5,252,455 and 5,391,727 (macroheterocyclic gold complexes), U.S. Pat. Nos. 5,620,841, 5,700,631, 5,759,760, 5,759,761, 5,912,111, 5,912,112 and 5,939,245, JP-A's-1-147537, 8-69074, 8-69075 and 9-269554, JP-B-45-29274, German Patent DD-264524A, 264525A, 265474A and 298321A, JP-A's-2001-75214, 2001-75215, 2001-75216, 2001-75217 and 2001-75218.

A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

For the sulfur sensitization, unstable sulfur compounds are used as described in, for example, P. Grafkides, Chimie et Physique Photographique, 5th Ed., Paul Montel, 1987, and Research Disclosure, Vol. 307, No. 307105.

Specifically, thiosulfates (e.g., hypo), thioureas (e.g., diphenylthiourea, triethylthiourea, N-ethyl-N'-(4-methyl-2-thiazolyl) thiourea, dicarboxymethyl-dimethylthiourea and carboxymethyl-trimethylthiourea), thioamides (e.g., thioacetamide), rhodanines (e.g., diethylrhodanine and 5-benzylidene-N-ethylrhodanine), phosphine sulfides (e.g., trimethylphosphine sulfide), thiohydantoins, 4-oxo-oxazolidine-2-thiones, di- or poly-sulfides (e.g., dimorpholine disulfide, cystine, and hexathionic acid), mercapto compounds (e.g., cysteine), polythionates, and elemental sulfur as well as active gelatin. Particularly, thiosulfates, thioureas, phosphine sulfides and rhodanines are preferred.

For the selenium sensitization, unstable selenium compounds are used as described in, for example, JP-B's-43-13489 and 44-15748, JP-A's-4-25832, 4-109340, 4-271341, 5-40324, 5-11385, 6-51415, 6-180478, 6-180478, 6-208186, 6-208184, 6-317867, 7-92599, 7-98483 and 7-140539.

Specific example thereof include colloidal metallic selenium, selenoureas (e.g., N,N-dimethylselenourea, trifluoromethylcarbonyl-trimethylselenourea, and acetyl-trimethylselenourea), selenoamides (e.g., selenoamide and N,N-diethylphenylselenoamide), phosphine selenides (e.g., triphenylphosphine selenide and pentafluorophenyl-triphenylphosphine selenide), selenophosphates (e.g., tri-p-tolylselenophosphate and tri-n-butylselenophosphate), selenoketones (e.g., selenobenzophenone), isoselenocyanates, selenocarboxylic acids, selenoesters (e.g., methoxyphenylselenocarboxy-2,2-dimethoxycyclohexane ester) and diacylselenides. Also useful are non-unstable selenium compounds as described in JP-B's-46-4553 and 52-34492, for example, selenites, selenocyanic acids (e.g., potassium selenocyanide), selenazoles, and selenides. Particularly, phosphine selenides, selenoureas, selenoesters and selenocyanic acids are preferred.

For the tellurium sensitization, a unstable tellurium compound is used and the unstable tellurium compounds described in JP-A's-4-224595, 4-271341, 4-333043, 5-303157, 6-27573, 6-180478, 6-208186, 6-208184, 6-317867 and 7-140539 may be used.

Specific examples thereof include phosphine tellurides (e.g., butyl-diisopropylphosphine telluride, tributylphosphine telluride, tributoxyphosphine telluride, ethoxy-diphenylphosphine telluride), diacyl (di)tellurides (e.g., bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride, bis-(ethoxycarbonyl)telluride), telluroureas (e.g., N,N'-dimethylethylenetellurourea and N,N'-dephenylethylenetellurourea), telluroamides and telluroesters.

As a useful chemical sensitization auxiliary, a compound is used that is known to suppress fogging and to increase the sensitivity in the process of chemical sensitization, such as azaindenes, azapyridazines and azapyrimidines. Examples of the chemical sensitization auxiliary modifier will be described in U.S. Pat. Nos. 2,131,038, 3,411,914 and 3,554,757, JP-A-58-126526, and by G. F. Duffin in "Photographic Emulsion Chemistry" mentioned above, pages 138 to 143.

The amount used of the gold sensitizer or the chalcogen sensitizer use in the present invention varies depending on the silver halide grain or chemical sensitization conditions used, however, it may be from $10^{-8}$ to $10^{-2}$ mol, preferably approximately from $10^{-7}$ to $10^{-3}$ mol, per mol of silver halide.

There is no particular limitation on the conditions of chemical sensitization in the present invention, but pAg is from 6 to 11, preferably from 7 to 10, pH is from 4 to 10, preferably from 5 to 8, and temperature is from 40 to 95° C., preferably from 45 to 85° C.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3\ 3H_2O_2$, $Na_4P_2O_7.2H_2O_2$ and $2Na_2SO_4H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion for use in the present invention is preferably subjected to a spectral sensitization with a methine dye or the like to thereby exert the effects of the present invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. No. 2,688,545, U.S. Pat. No. 2,977,229, U.S. Pat. No. 3,397,060, U.S. Pat. No. 3,522,052, U.S. Pat. No. 3,527,641, U.S. Pat. No. 3,617,293, U.S. Pat. No. 3,628,964, U.S. Pat. No. 3,666,480, U.S. Pat. No. 3,672,898, U.S. Pat. No. 3,679,428, U.S. Pat. No. 3,703,377, U.S. Pat. No. 3,769,301, U.S. Pat. No. 3,814,609, U.S. Pat. No. 3,837,862, U.S. Pat. No. 4,026,707, GB No. 1,344,281, GB No. 1,507,803, JP-B-43-4936, JP-B-53-12375, JP-A-52-110618 and JP-A-52-109925.

The emulsion of the present invention may be doped with a dye which itself exerts no spectral sensitizing effect or a substance which absorbs substantially none of visible radiation and exhibits supersensitization, together with the above spectral sensitizing dye.

The doping of the emulsion with the spectral sensitizing dye may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. No. 3,628,969 and U.S. Pat. No. 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition amount of the sensitizing dye is $4\times10^{-6}$ to $8\times10^{-3}$ mol per mol of silver halide.

Next, compounds used for the lightsensitive materials of the present invention will be described.

First, a compound represented by general formula (I) of the present invention is explained.

The compound of the present invention represented by general formula (I) may be used in any situation in the preparation of an emulsion and in a process of producing a lightsensitive material, for example, during the grain formation, during a desalting step, during chemical sensitization and before coating. The compound can also be added separately a plurality of times during these steps. It is preferable that the compound of the present invention is used after being dissolved in any of water, a water-soluble solvent such as methanol and ethanol, and a mixed solvent of these. In the case of dissolving a compound in water, as for a compound whose solubility increases when the pH is raised or lowered, it can be added after being dissolved by raising or lowering the pH.

The compound of the present invention represented by general formula (I) is preferably used in an emulsion layer, but it is also possible to add the compound, in advance, to a protective layer or an intermediate layer as well as an emulsion layer, thereby diffusing it. The compound of the present invention may be added either before or after addition of a sensitizing dye. It is contained in a silver halide emulsion layer in a proportion of preferably from $1\times10^{-9}$ to $5\times10^{-2}$ mol, more preferably from $1\times10^{-8}$ to $2\times10^{-3}$ mol, per mol of silver halide.

In general formula (I), an adsorbing group to silver halide represented by X includes groups containing at least one selected from the group consisting of N, S, P, Se and Te, and preferably having a silver ion ligand structure. When k is 2 or more, plural Xs may be the same or different. Examples of the silver ion ligand structure are as follows:

$$—G_1—Z_1—R_1 \quad (X\text{-}1)$$

wherein $G_1$ is a bivalent linking group and represents a bivalent heterocyclic group or a combined bivalent group constituted from a bivalent heterocyclic group and any of a substituted or unsubstituted alkylene, alkenylene, alkynylene, arylene and $SO_2$ groups combined with the bivalent heterocyclic group; $Z_1$ represents a S, Se or Te atom, $R_1$ represents a hydrogen atom or a counter ion selected from sodium ion, potassium ion, lithium ion and ammonium ion which is necessary when the ligand structure becomes a dissociated form at $Z_1$;

(X-2a)

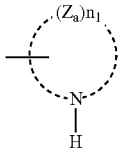

(X-2b)

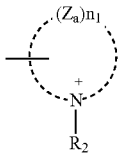

wherein general formulas (X-2a) and (X-2b) each contain a ring whose embodiment includes a 5- to 7-membered, saturated, heterocyclic ring, an unsaturated heterocyclic ring and an unsaturated carbon ring; $Z_a$ represents an O, N, S, Se or Te atom; n1 represents an integer of 0 to 3; $R_2$ represents a hydrogen atom, an alkyl group, an alkenyl group, an alkynyl group or an aryl group; when n1 is 2 or more, plural $Z_a$s may be the same or different;

$$—R_3—(Z_2)_{n2}—R_4 \quad (X\text{-}3)$$

wherein $Z_2$ represents an S, Se or Te atom, n2 represents an integer of 1 to 3; $R_3$ is a bivalent linking group and represents an alkylene group, an alkenylene group, an alkynylene group, an arylene group, a bivalent heterocyclic group, or a combined bivalent group constituted from a bivalent heterocyclic group and any of a substituted or unsubstituted alkylene, alkenylene, alkynylene, arylene and $SO_2$ groups combined with the bivalent heterocyclic group; $R_4$ represents an alkyl group, an aryl group or a heterocyclic group; when n2 is 2 or more, plural $Z_2$ may be the same or different;

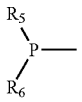

wherein $R_5$ and $R_6$ each independently represent an alkyl group, an alkenyl group, an aryl group or a heterocyclic group;

(X-5a)

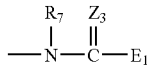

(X-5b)

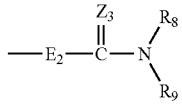

wherein $Z_3$ represents a S, Se or Te atom; $E_1$ represents a hydrogen atom, $NH_2$, $NHR_{10}$, $N(R_{10})_2$, $NHN(R_{10})_2$, $OR_{10}$ or $SR_{10}$; $E_2$ is a bivalent linking group and represents NH, $NR_{10}$, $NHNR_{10}$, O or S; $R_7$, $R_8$ and $R_9$ each independently represent a hydrogen atom, an alkyl group, an alkenyl group, an aryl group or a heterocyclic group, wherein $R_8$ and $R_9$ may be bonded together to form a ring; $R_{10}$ represents a hydrogen atom, an alkyl group, an alkenyl group, an aryl group or a heterocyclic group;

(X-6a)

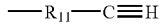

(X-6b)

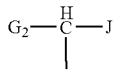

wherein $R_{11}$ is a bivalent linking group and represents an alkylene group, an alkenylene group, an alkynylene group, an arylene group or a bivalent heterocyclic group; $G_2$ and J each independently represent $COOR_{12}$, $SO_2R_{12}$, $COR_{12}$, $SOR_{12}$, CN, CHO or $NO_2$; $R_{12}$ represents an alkyl group, an alkenyl group or an aryl group.

A detailed description will be made to general formula (X-1). In the formula, examples of the linking group represented by $G_1$ include a substituted or unsubstituted, straight chain or branched alkylene group having 1-20 carbon atoms (e.g., methylene, ethylene, trimethylene, propylene, tetramethylene, hexamethylene, 3-oxapentylene and 2-hydroxytrimethylene), a substituted or unsubstituted cyclic alkylene group having 3-18 carbon atoms (e.g., cyclopropylene, cyclopentylene and cyclohexylene), a substituted or unsubstituted alkenylene group having 2-20 carbon atoms (e.g., ethene and 2-butenylene), a substituted or unsubstituted alkynylene group having 2-10 carbon atoms (e.g., ethyne), and a substituted or unsubstituted arylene group having 6-20 carbon atoms (e.g., unsubstituted p-phenylene and unsubstituted 2,5-naphthylene).

In that formula, examples of the $SO_2$ group represented by $G_1$ include $—SO_2—$ groups combined with a substituted or unsubstituted, straight chain or branched alkylene group having 1–10 carbon atoms, a substituted or unsubstituted cyclic alkylene group having 3–6 carbon atoms or an alkenylene group having 2–10 carbon atoms, besides a $—SO_2—$ group.

Further, examples of the bivalent linking group represented by $G_1$ include a bivalent heterocyclic group, or a combined bivalent group constituted from a bivalent heterocyclic group and any of an alkylene, alkenylene, alkynylene, arylene and $SO_2$ groups combined with the bivalent heterocyclic group, or bivalent groups resulting from benzo-condensation or naphtho-condensation of the heterocyclic moieties of the foregoing groups (e.g., 2,3-tetrazolediyl, 1,3-triazolediyl, 1,2-imidazolediyl, 3,5-oxadiazolediyl, 2,4-thiazolediyl, 1,5-benzimidazolediyl, 2,5-benzothiazolediyl, 2,5-benzooxazolediyl, 2,5-pyrimidinediyl, 3-phenyl-2,5-tetrazolediyl, 2,5-pyridinediyl, 2,4-furandiyl, 1,3-piperidinediyl and 2,4-morpholinediyl).

In the above formula, $G_1$ may have a substituent if possible. Examples of such a substituent are presented below. These substituents are herein called "substituent Y".

Examples of the substituent Y include halogen atom (e.g., a fluorine atom, chlorine atom, and bromine atom), an alkyl group (e.g., methyl, ethyl, isopropyl, n-propyl, and t-butyl), an alkenyl group (e.g., allyl, and 2-butenyl), an alkinyl group (e.g., propargyl), an aralkyl group (e.g., benzyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, butoxy, 2-ethylhexyloxy, ethoxyethoxy, and methoxyethoxy), an aryloxy group (e.g., phenoxy and 2-naphthyloxy), an amino group (e.g., unsubstituted amino, dimethylamino, diethyl amino, dipropylamino, ethylamino, and anilino), an acylamino group (e.g., acetylamino and benzoylamino), an ureido group (e.g., unsubstituted ureido, and N-methylureido), an urethane group (e.g., methoxycarbonylamino and phenoxycarbonylamino), a sulfonylamino group (e.g., methylsulfonylamino and phenylsulfonylamino), a sulfamoyl group (e.g., unsubstituted sulfamoyl, N,N-dimethylsulfamoyl and N-phenylsulfamoyl), a carbamoyl group (e.g., unsubstituted carbamoyl, N,N-diethylcarbamoyl, and N-phenylcarbamoyl), a sulfonyl group (e.g., mesyl and tosyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, formyl, and pivaloyl), an acyloxy group (e.g., acetoxy and benzoyloxy), an amide phosphate group (e.g., N,N-diethyl amide phosphate), a cyano group, a sulfo group, a thiosulfonic acid group, sulfinic acid group, a carboxy group, a hydroxy group, a phosphono group, a nitro group, an ammonio group, a phosphonio group, a hydrazino group, and a thiazolino group. If two or more substituents exist, these substituents can be the same or different. These groups can be further substituted.

Preferable examples of general formula (X-1) will be mentioned below.

In preferable examples of general formula (X-1), $G_1$ may be a substituted or unsubstituted arylene group having 6–10 carbon atoms, or a heterocyclic group that forms a 5- to 7-membered ring combined with a substituted or unsubstituted alkylene or arylene-group, a benzo-condensed 5- to 7-membered ring, or a naphtho-condensed 5- to 7-membered ring. S and Se are mentioned as $Z_1$, and a hydrogen atom, a sodium ion and a potassium ion are mentioned as $R_1$.

More preferably, $G_1$ is a heterocyclic group which forms a 5- or 6-membered ring combined with a substituted or unsubstituted arylene group having 6-8 carbon atoms or a benzo-condensed 5- or 6-membered ring, and most preferably is a heterocyclic group which forms a 5- or 6-membered ring combined with an arylene group or a benzo-condensed 5- or 6-membered ring. A further preferable example of $Z_1$ is S, and those of $R_1$ are a hydrogen atom and a sodium ion.

General formulas (X-2a) and (X-2b) will be described in detail.

Examples of the alkyl group, the alkenyl group, and the alkynyl group represented by $R_2$ include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, n-butoxypropyl and methoxymethyl), a substituted or unsubsituted, cycloalkyl group having 3-6 carbon atoms (e.g., cyclopropyl, cyclopentyl and cyclohexyl), an alkenyl group having 2-10 carbon atoms (e.g., allyl, 2-butenyl and 3-pentenyl), an alkynyl group having 2–10 carbon atoms (e.g., propargyl and 3-pentynyl), an aralkyl group having 6–12 carbon atoms (e.g., benzyl), and the like. Examples of the aryl group include a substituted or unsubstituted aryl group having 6–12 carbon atoms (e.g., unsubstituted phenyl and 4-methylphenyl), and the like.

The aforementioned $R_2$ may further have substituent Y, and the like.

Preferable examples of general formulas (X-2a) and (Z-2b) are mentioned below.

In the formula, preferably, $R_2$ is a hydrogen atom, a substituted or unsubstituted alkyl group having 1–6 carbon atoms, or a substituted or unsubstituted aryl group having 6–10 carbon atoms, $Z_a$ is O, N or S, and n1 is an integer of 1 to 3.

More preferably, $R_2$ is a hydrogen atom or an alkyl group having 1–4 carbon atoms, $Z_a$ is N or S, and n1 is 2 or 3.

Next, general formula (X-3) will be described in detail.

In the formula, examples of the linking group represented by $R_3$ include a substituted or unsubstituted, straight chain or branched alkylene group having 1–20 carbon atoms (e.g., methylene, ethylene, trimethylene, isopropylene, tetramethylene, hexamethylene, 3-oxapentylene and 2-hydroxytrimethylene), a substituted or unsubstituted cycloalkylene group having 3–18 carbon atoms (e.g., cyclopropylene, cyclopentynylene and cyclohexylene), a substituted or unsubstituted alkenylene group having 2-20 carbon atoms (e.g., ethene and 2-butenylene), an alkynylene group having 2–10 carbon atoms (e.g., ethyne), and a substituted or unsubstituted arylene group having 6–20 carbon atoms (e.g., unsubstituted p-phenylene and unsubstituted 2,5-naphtylene), an unsubstituted heterocyclic group and heterocyclic groups substituted with an alkylene group, an alkenylen group or an arylen group, and those further substituted with a heterocyclic group (e.g., 2,5-pyridinediyl, 3-phenyl-2,5-pyridinediyl, 1,3-piperidinediyl and 2,4-morpholinediyl).

In that formula, examples of the alkyl group represented by $R_4$ include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutylaminoethyl, n-butoxymethyl and methoxymethyl), a substituted or unsubstituted cycloalkyl group having 3–6 carbon atoms (e.g., cyclopropyl, cyclopentyl and cyclohexyl). Examples of the aryl group include a substituted or unsubstituted aryl group having 6–12 carbon atoms (e.g., unsubstituted phenyl and 2-methylphenyl).

Examples of the heterocyclic group include an unsubstituted heterocyclic group and heterocyclic groups substituted with an alkyl group, an alkenyl group or an aryl group, and those further substituted with a heterocyclic group (e.g., pyridyl, 3-phenylpyridyl, piperidyl and morpholyl).

The aforementioned $R_4$ may further have substituent Y, and the like.

Preferable examples of general formula (X-3) are mentioned below.

In the formula, preferably, $R_3$ is a substituted or unsubstituted alkylene group having 1–6 carbon atoms or a substituted or unsubstituted arylene group having 610 carbon atoms, $R_4$ is a substituted or unsubstituted alkyl group having 1–6 carbon atoms or a substituted or unsubstituted aryl group having 6–10 carbon atoms, $Z_2$ is S or Se, and n2 is 1 or 2.

More preferably, $R_3$ is an alkylene group having 14 carbon atoms, $R_4$ is an alkyl group having 1–4 carbon atoms, $Z_2$ is S, and n2 is 1.

Next, general formula (X-4) will be described in detail.

In the formula, examples of the alkyl group and the alkenyl group represented by R5 and R6 include a substituted or unsubstituted, straight chain or branched alkyl group having 1–10 carbon atoms (e.g., methyl, ethyl, isopropyl, n-propyl, n-butyl, t-but-yl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxymethyl, n-butoxypropyl and methoxymethyl), a substituted or unsubstituted cycloalkyl group having 3–6 carbon atoms (e.g., cyclopropyl, cyclopentyl and cyclohexyl), and an alkenyl group having 2–10 carbon atoms (e.g., allyl, 2-butenyl and 3-pentenyl). Examples of the aryl group include a substituted or unsubstituted aryl group having 6–12 carbon atoms (e.g., unsubstituted phenyl and 4-methylphenyl). Examples of the heterocyclic group include an unsubstituted heterocyclic group and heterocyclic groups substituted with an alkylene group, an alkenylene group or an arylene group, and those further substituted with a heterocyclic group (e.g., pyridyl, 3-phenylpyridyl, furyl, piperidyl and morpholyl).

The aforementioned $R_5$ and $R_6$ may further have substituent Y, and the like.

Preferable examples of general formula (X-4) are mentioned below.

In the formula, preferably, $R_5$ and $R_6$ are a substituted or unsubstituted alkyl group having 1–6 carbon atoms or a substituted or unsubstituted aryl group having 6–10 carbon atoms.

More preferably, RS and $R_6$ are an aryl group having 6–8 carbon atoms.

Next, general formulas (X-5a) and (X-5b) will be described in detail.

In the formulas, examples of the group represented by $E_1$ include $NH_2$, $NHCH_3$, $NHC_2H_5$, NHPh, $N(CH_3)_2$, $N(Ph)_2$, $NHNHC_3H_7$, NHNHPh, $OC_4H_9$, OPh and $SCH_3$. Examples of the group represented by $E_2$ include NH, $NCH_3$, $NC_2H_5$, NPh, $NHNC_3H_7$ and NHNPh (here, Ph=a phenyl group (the same below)).

In general formulas (X-5a) and (X-5b), examples of the alkyl group and the alkenyl group represented by $R_7$, $R_8$ and $R_9$ include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxymethyl, n-butoxypropyl and methoxymethyl), a substituted or unsubstituted cycloalkyl group having 3-6 carbon atoms (e.g., cyclopropyl, cyclopentyl and cyclohexyl), and an alkenyl group having 2–10 carbon atoms (e.g., allyl, 2-butenyl and 3-pentenyl). Examples of the aryl group include a substituted or unsubstituted aryl group having 6–12 carbon atoms (e.g., unsubstituted phenyl and 4-methylphenyl). Examples of the heterocyclic group include an unsubstituted heterocyclic group and heterocyclic groups substituted with an alkylene group, an alkenylene group or an arylene group, and those further substituted with a heterocyclic group (e.g., pyridyl, 3-phenylpyridyl, furyl, piperidyl and morpholyl).

$R_7$, $R_8$ and $R_9$ may further have substituent Y, and the like.

Preferable examples of general formulas (X-5a) and (X-5b) will be mentioned below.

In the formula, preferably, $E_1$ is an alkyl-substituted or unsubstituted amino group or an alkoxy group. $E_2$ is an alkyl-substituted or unsubstituted amino-linking group. $R_7$, $R_8$ and $R_9$ each are a substituted or unsubstituted alkyl group having 1–6 carbon atoms or a substituted or unsubstituted aryl group having 6–10 carbon atoms. $Z_3$ is S or Se.

More preferably, $E_1$ is an alkyl-substituted or unsubstituted amino group, $E_2$ is an alkyl-substituted or unsubstituted amino-linking group, $R_7$, $R_8$ and $R_9$ each are a substituted or unsubstituted alkyl group having 1–4 carbon atoms, and $Z_3$ is S.

Next, general formulas (X-6a) and (X-6b) will be described in detail.

In the formulas, examples of the groups represented by $G_2$ and J include $COOCH_3$, $COOC_3H_7$, $COOC_6H_{13}$, COOPh, $SO_2CH_3$, $SO_2C_4H_9$, $COC_2H_5$, COPh, $SOCH_3$, SOPh, CN, CHO and $NO_2$.

In the formulas, examples of the linking group represented by $R_{11}$ include a substituted or unsubstituted, straight chain or branched alkylene group having 1–20 carbon atoms (e.g., methylene, ethylene, trimethylene, propylene, tetramethylene, hexamethylene, 3-oxapentylene and 2-hydroxytrimethylene), a substituted or unsubstituted cycloalkylene group having 3–18 carbon atoms (e.g., cyclopropylene, cyclopentylene and cyclohexylene), a substituted or unsubstituted alkenylene group having 2-20 carbon atoms (e.g., ethene and 2-butenylene), an alkynylene group having 2–10 carbon atoms (e.g., ethyne), and a substituted or unsubstituted arylene group having 6–20 carbon atoms (e.g., unsubstituted p-phenylene and unsubstituted 2,5-naphtylene).

Further, examples of the bivalent linking group represented by $R_{11}$ include a bivalent heterocyclic group, or a bivalent group constituted from a bivalent group and any of an alkylene, alkenylene, alkynylene, arylene and $SO_2$ groups combined with the bivalent heterocyclic group (e.g., 2,5-pyridinediyl, 3-phenyl-2,5-pyridinediyl, 2,4-furandiyl, 1,3-piperidinediyl and 2,4-morpholinediyl).

In the formulas, $R_{11}$ may further have substituent Y, and the like.

Preferable examples of general formulas (X-6a) and (X-6b) are mentioned below.

In the formula, preferably, $G_2$ and J are a carboxylic acid ester or carbonyl having 2–6 carbon atoms, and $R_{11}$ is a substituted or unsubstituted alkylene group having 1–6 carbon atoms or a substituted or unsubstituted arylene group having 6–10 carbon atoms.

More preferably, $G_2$ and J are a carboxylic acid ester having 2–4 carbon atoms, and $R_{11}$ is a substituted or unsubstituted alkylene group having 1–4 carbon atoms or a substituted or unsubstituted arylene group having 6–8 carbon atoms.

A rank of the preferable general formulas of the silver halide-adsorbing group represented by X is: (X-1)>(X-2a)>(X-2b)>(X-3)>(X-5a)>(X-5b)>(X-4)>(X-6a)>(X-6b)

Next, the light-absorbing group represented by X in general formula (I) will be described in detail.

Examples of the light-adsorbing group represented by X in general formula (I) are as follows:

(X-7)

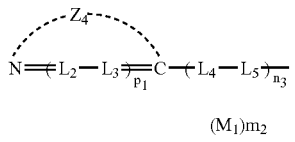

In the formula, $Z_4$ represents an atomic group necessary for forming a 5- or 6-membered nitrogen-containing heterocycle, and $L_2$, $L_3$, $L_4$ and $L_5$ each represent a methine group. p1 represents 0 or 1, and n3 represents an integer of 0 to 3. M1 represents a counter ion to balance a charge, and m2 represents an integer of 0 to 10 necessary to neutralize the charge in the molecule. The nitrogen-containing heterocycle that $Z_4$ forms may have an unsaturated carbon ring, such as a benzene ring, condensed therewith.

In the formula, examples of the 5- or 6-membered nitrogen-containing heterocycle represented by $Z_4$ include a thiazolidine nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

The 5- or 6-membered nitrogen-containing heterocycle represented by $Z_4$ may have the aforementioned substituent Y.

In the formula, $L_2$, $L_3$, $L_4$ and $L_5$ each represent an independent methine group. The methine group represented by $L_2$, $L_3$, $L_4$ and $L_5$ may have a substituent, examples of which include a substituted or unsubstituted alkyl group having 1–15 carbon atoms (e.g., methyl, ethyl and 2-carboxyethyl), a substituted or unsubstituted aryl group having 6–20 carbon atoms (e.g., phenyl and o-carboxyphenyl), a substituted or unsubstituted heterocyclic group having 3–20 carbon atoms (e.g., a monovalent group obtained by removing one hydrogen atom from N,N-diethylbarbituric acid), a halogen atom (e.g., chlorine, bromine, fluorine and iodine), an alkoxy group having 1–15 carbon atoms (e.g., methoxy and ethoxy), an alkylthio group having 1–15 carbon atoms (e.g., methylthio and ethylthio), an arylthio group having 6–20 carbon atoms (e.g., phenylthio), and an amino group having 0–15 carbon atoms (e.g., N,N-diphenylamino, N-methyl-N-phenylamino and N-methylpiperazino).

Further, the substituent may combine any two of $L_2$ to $L_5$ to form a ring. In addition, the methine group represented by any of $L_2$ to $L_5$ can combine with another site via a substituent to form a ring.

In the formula, $M_1$ is included in the formula to show the presence or absence of a cation or an anion when a counter ion is necessary for neutralizing an ionic charge in the light-absorbing group. Typical examples of such a cation include an inorganic cation such as a hydrogen ion ($H^+$) and an alkali metal ion (e.g., a sodium ion, a potassium ion, and a lithium ion), and an organic cation such as an ammonium ion (e.g., an ammonium ion, a tetraalkylammonium ion, a pyridinium ion, and an ethylpyridinium ion). While an anion may be an inorganic or organic one, with examples including a halogen anion (e.g., a fluoride ion, a chloride ion, a bromide ion and an iodide ion), a substituted arylsulfonate ion (e.g., a p-toluenesulfonate ion and a p-chlorobenzenesulfonate ion), an aryldisulfonate ion (e.g., a 1,3-benzenedisulfonate ion, a 1,5-naphthalenedisulfonate ion and a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion and a trifluoromethanesulfonate ion. Further, a light-absorbing group having an ionic polymer or reversed charge may be used as the light-absorbing group.

In the formula, a sulfo and carboxy groups will be described as $SO_3^-$ and $CO_2^-$, respectively, but they can be described as $SO_3H$ and $CO_2H$ when a counter ion is a hydrogen ion.

In the formula, m2 represents a number necessary for balancing the charge and when a salt is formed in a molecule, m2 is 0.

Preferable examples of general formula (X-7) are mentioned below.

In a preferable general formula (X-7), $Z_4$ is a benzoxazole nucleus, a benzothiazole nucleus, a benzoimidazole nucleus or a quinoline nucleus. $L_2$, $L_3$, $L_4$ and $L_5$ each are an unsubstituted methine group. p1 is 0 and n3 is 1 or 2.

More preferably, $Z_4$ is a benzoxazole nucleus or a benzothiazole nucleus, and n3 is 1. The especially preferable $Z_4$ is a benzothiazole nucleus.

In general formula (I), k is preferably 0 or 1, and more preferably 1.

The following are specific examples of X group used in the present invention, but the compounds to be used for the present invention are not restricted to them.

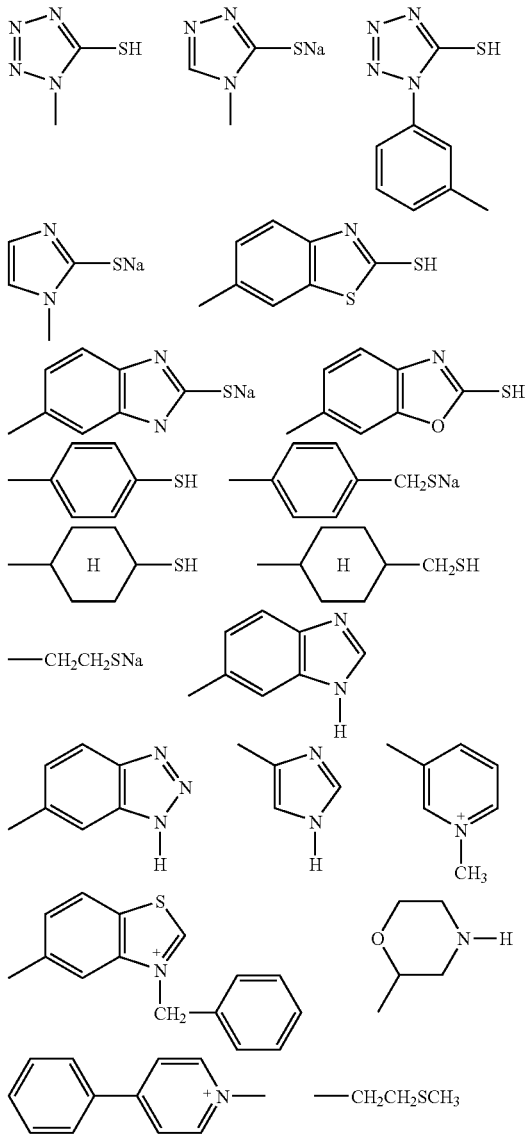

-continued

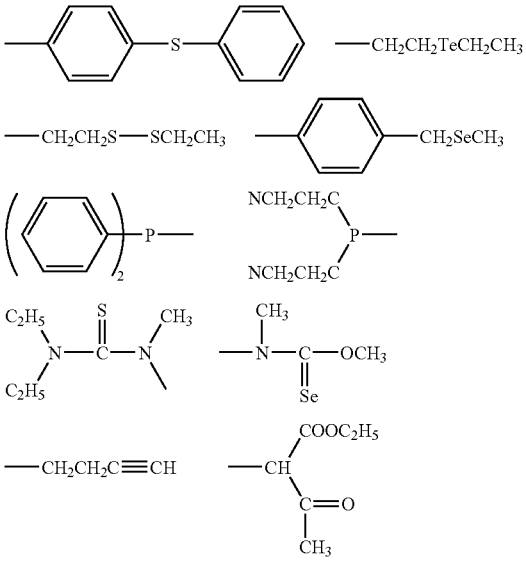

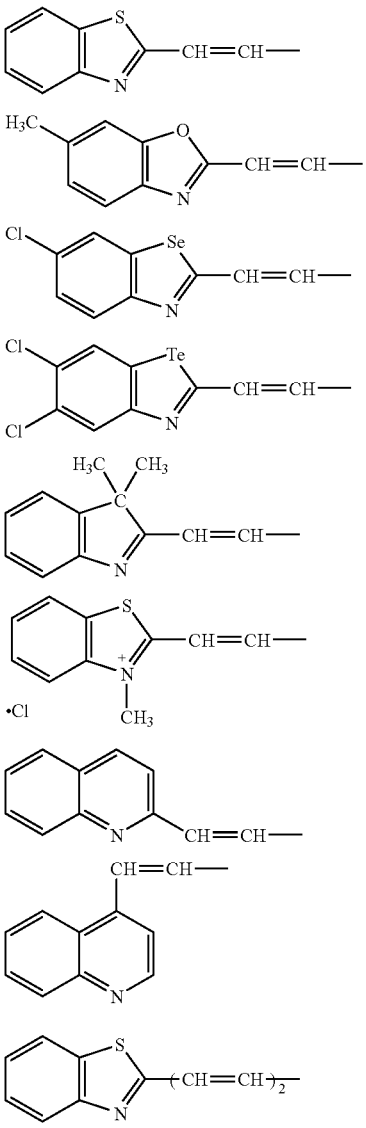

-continued

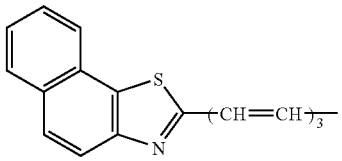

Next, a linking group represented by L in general formula (I) will be described in detail.

In general formula (I), examples of the linking group represented by L include a substituted or unsubstituted, straight chain or branched alkylene group having 1–20 carbon atoms (e.g., methylene, ethylene, trimethylene, propylene, tetramethylene, hexamethylene, 3-oxapentylene and 2-hydroxytrimethylene), a substituted or unsubstituted cycloalkylene group having 3–18 carbon atoms (e.g., cyclopropylene, cyclopentylene and cyclohexylene), a substituted or unsubstituted alkenylene group having 2–20 carbon atoms (e.g., ethene and 2-butenylene), an alkynylene group having 2–10 carbon atoms (e.g., ethyne), and a substituted or unsubstituted arylene group having 6–20 carbon atoms (e.g., unsubstituted p-phenylene and unsubstituted 2,5-naphtylene), a heterocyclic linking group (e.g., 2,6-pyridinediyl), a carbonyl group, a thiocarbonyl group, an imide group, a sulfonyl group, a bivalent sulfonic acid group, an ester group, a thioester group, a bivalent amide group, an ether group, a thioether group, a bivalent amino group, a bivalent ureido group, a bivalent thioureido group and a thiosulfonyl group. These linking groups may be combined to form a new linking group. When m is 2 or more, plural Ls may be the same or different.

L may further have the aforementioned substituent Y, and the like.

Preferable examples of the linking group L include an alkylene group having 1–10 carbon atoms resulting from combination of an unsubstituted alkylene group having 1–10 carbon atoms and an amino, amide, thioether, ureido, or sulfonyl group, and more preferably, a an alkylene group having 1–6 carbon atoms resulting from combination of an unsubstituted alkylene group having 1–6 carbon atoms and an amino, amide or thioether group.

In general formula (I), m is preferably 0 or 1, and more preferably 1.

Next, electron-donating group A will be described in detail.

There will be described below a reaction process in which an A-B portion is oxidized or fragmentized to generate an electron, resulting in formation of radical A. and the radical A. is further oxidized to generate an electron and increase sensitivity.

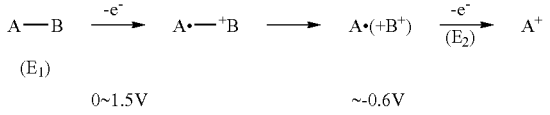

Since A is an electron-donating group, it is preferable that a substituent, even it has any structure, on the aromatic ring is selected so as to cause A to have excessive electron. For example, it is preferable to adjust the oxidation potential by introducing an electron-donating group when the aromatic ring does not have excessive electron or, conversely, by introducing an electron-withdrawing group when, like anthracene, the aromatic ring has extremely excessive electron.

Preferable A group is that having the following general formulas:

(A-1)

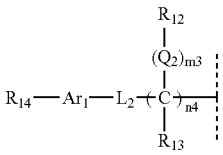

(A-2)

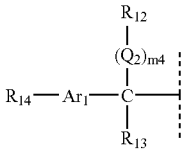

(A-3)

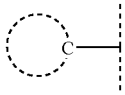

In general formulas (A-1) and (A-2), $R_{12}$ and $R_{13}$ each independently represent a hydrogen atom, a substituent or unsubstituted alkyl, aryl, alkylene or arylene group. $R_{14}$ represents an alkyl group, COOH, halogen, $N(R_{15})_2$, $OR_{15}$, $SR_{15}$, CHO, $COR_{15}$, $COOR_{15}$, $CONHR_{15}$, $CON(R_{15})_2$, $SO_3R_{15}$, $SO_2NHR_{15}$, $SO_2NR_{15}$, $SO_2R_{15}$, $SOR_{15}$ or $CSR_{15}$. $Ar_1$ represents an arylene group or a heterocyclic linking group. $R_{12}$ and $R_{13}$, and $R_{12}$ and $Ar_1$ each may be combined to form a ring. $Q_2$ represents O, S, Se or Te. m3 and m4 each represent 0 or 1. n4 represents an integer of 1 to 3. L2 represents N—R (here, R represents a substituted or unsubstituted alkyl group), N—Ar, O, S or Se. The form of the ring that $R_{12}$ and $R_{13}$, and $R_{12}$ and $Ar_1$ form represents a 5 to 7-membered heterocyclic or unsaturated ring. $R_{15}$ represents a hydrogen atom, an alkyl group or an aryl group. The form of ring of general formula (A-3) represents a substituted or unsubstituted, 5- to 7-membered, unsaturated or heterocyclic group.

General formulas (A-1), (A-2) and (A-3) will be described in detail.

In the formulas, examples of the alkyl group represented by $R_{12}$ and $R_{13}$ include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutylaminoethyl, n-butoxymethyl and methoxymethyl), a substituted or unsubstituted cycloalkyl group having 3–6 carbon atoms (e.g., cyclopropyl, cyclopentyl and cyclohexyl). Examples of the aryl group include a substituted or unsubstituted aryl group having 6–12 carbon atoms (e.g., unsubstituted phenyl and 2-methylphenyl).

Examples of the alkylene group include a substituted or unsubstituted, straight chain or branched alkylene group having 1–10 carbon atoms (e.g., methylene, ethylene, trimethylene, tetramethylene and methoxyethylene), and examples of the arylene group include a substituted or unsubstituted arylene group having 6–12 carbon atoms (e.g., unsubstituted phenylene, 2-methylphenylene and naphthylene).

In general formulas (A-1) and (A-2), examples of the group represented by $R_{14}$ include an alkyl group (e.g., methyl, ethyl, isopropyl, n-propyl, n-butyl, 2-pentyl, n-hexyl, n-octyl, 2-ethylhexyl, 2-hydroxyethyl and n-butoxymethyl), a COOH group, a halogen atom (e.g., a fluorine atom, a chlorine atom and a bromine atom), OH, $N(CH_3)_2$, $NPh_2$, $OCH_3$, OPh, $SCH_3$, SPh, CHO, $COCH_3$, COPh, $COOC_4H_9$, $COOCH_3$, $CONHC_2Hs$, $CON(CH_3)_2$, $SO_3CH_3$, $SO_3C_3H_7$, $SO_2NHCH_3$, $SO_2N(CH_3)_2$, $SO_2C_2Hs$, $SOCH_3$, CSPh and $CSCH_3$.

Examples of $Ar_1$ represented by general formulas (A-1) and (A-2) include a substituted or unsubstituted arylene having 6–12 carbon atoms (e.g., phenylene, 2-methylphenylene and naphthylene), and a bivalent or trivalent group obtained by removing one or two hydrogen atoms from a substituted or unsubstituted heterocyclic group (e.g., pyridyl, 3-phenylpyridyl, piperidyl and morpholyl).

Examples of $L_2$ represented by general formula (A-1) include NH, $NCH_3$, $NC_4H_9$, $NC_3H_7$(i), NPh, NPh—$CH_3$, O, S, Se and Te.

Examples of the ring form of (A-3) include an unsaturated 5- to 7-membered carbon ring, a saturated or unsaturated 5- to 7-membered heterocycle (e.g., furyl, piperidyl and morpholyl).

On $R_{12}$, $R_{13}$, $R_{14}$, $Ar_1$ and $L_2$ in general formulas (A-1) and (A-2), and a ring in general formula (A-3) may further have substituent Y, and the like.

Preferable examples of general formulas (A-1), (A-2) and (A-3) are mentioned below.

In general formulas (A-1) and (A-2), preferably, $R_{12}$ and $R_{13}$ are each a substituted or unsubstituted alkyl group having 1–6 carbon atoms, an alkylene group, or a substituted or unsubstituted aryl group having 6–10 carbon atoms; $R_{14}$ is a substituted or unsubstituted alkyl group having 1–6 carbon atoms, an amino group monosubstituted or disubstituted with an alkyl group having 1–4 carbon atoms, a carboxylic acid, halogen or a carboxylic ester having 1–4 carbon atoms; $Ar_1$ is a substituted or unsubstituted arylene group having 6–10 carbon atoms; Q2 is O, S or Se; m3 and m4 are each 0 or 1; n4 is 1 to 3; and $L_2$ is an amino group having 0–3 carbon atoms substituted with an alkyl group.

In general formula (A-3), a preferable ring form is a saturated or unsaturated 5- to 7-membered heterocycle.

In general formulas (A-1) and (A-2), $R_{12}$ and $R_{13}$ are more preferably a substituted or unsubstituted alkyl group or alkylene group having 1–4 carbon atoms, $R_{14}$ is an unsubstituted alkyl group having 1–4 carbon atoms or an alkyl group having 1–4 carbon atoms substituted with monoamino or diamino, $Ar_1$ is a substituted or unsubstituted arylene group having 6–10 carbon atoms, $Q_2$ is O or S, m3 and m4 are 0, n4 is 1, and $L_2$ is an amino group having 0–3 carbon atoms substituted with an alkyl group.

In general formula (A-3), a more preferable ring form is a 5- or 6-membered heterocycle.

The location where group A is combined with group L (group X when m=0) is $Ar_1$ and $R_{12}$ or $R_{13}$.

The following are specific examples of group A used in the present invention, but the compounds to be used for the present invention are not restricted to them.

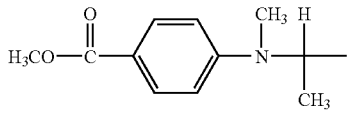

-continued
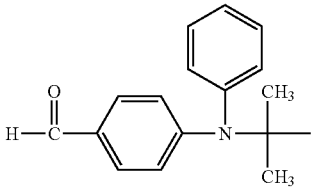
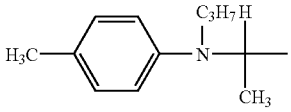
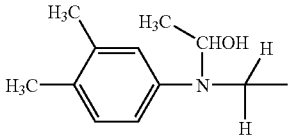
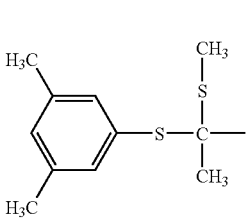
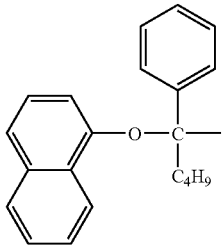
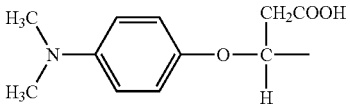
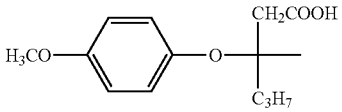
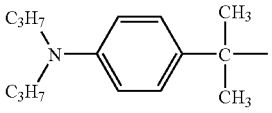
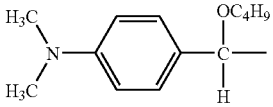
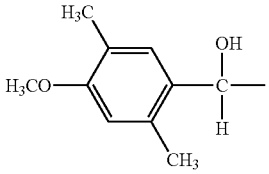
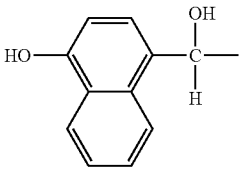
-continued
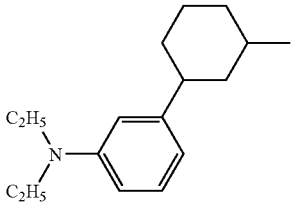
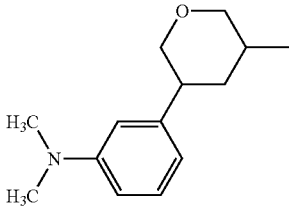
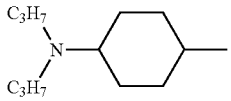
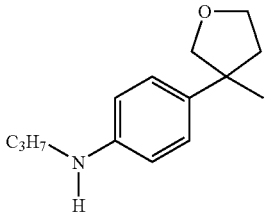
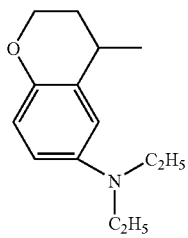
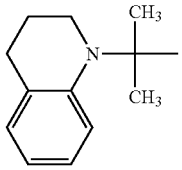
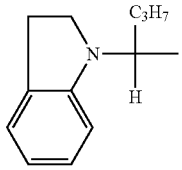
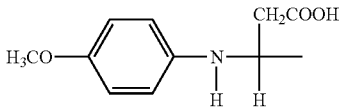
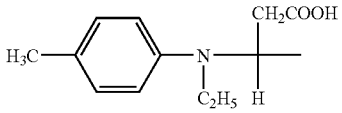
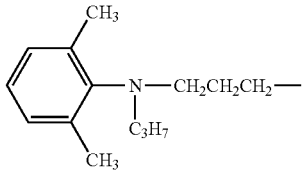
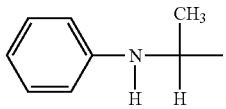
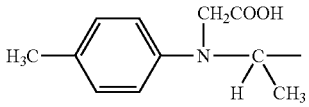
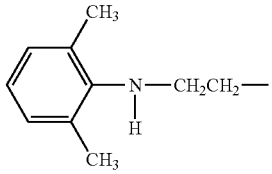

-continued

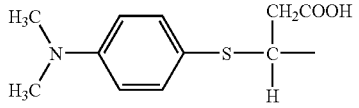

Next, group B will be described in detail.

When B is a hydrogen atom, it is oxidized and then deprotonated to generate a radical A..

A preferable group B is one having a hydrogen atom and the following formula.

(B-1)

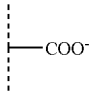

(B-2)

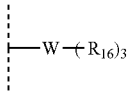

(B-3)

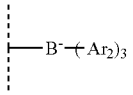

In general formulas (B-1), (B-2) and (B-3), W represents Si, Sn or Ge. $R_{16}$ each independently represent an alkyl group, and $Ar_2$ each independently represent an aryl group.

It is possible to cause general formulas (B-2) and (B-3) to combine with a adsorbing group X.

General formulas (B-1), (B-2) and (B-3) will be described in detail. In the formulas, examples of the alkyl group represented by $R_{16}$ include a substituted or unsubstituted, straight chain or branched alkyl group having 1–6 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, n-butoxyethyl and methoxymethyl), and a substituted or unsubstituted aryl group having 6–12 carbon atoms (e.g., phenyl and 2-methylphenyl).

$R_{16}$ and $Ar_2$ in general formulas (B-2) and (B-3) may further have the aforementioned substituent Y, and the like.

The following are preferable examples of general formulas (B-1), (B-2) and (B-3).

In general formulas (B-2) and (B-3), preferably, $R_{16}$ is a substituted or unsubstituted alkyl group having 1–4 carbon atoms, $Ar_2$ is a substituted or unsubstituted aryl group having 6–10 carbon atoms, and W is Si or Sn.

In general formulas (B-2) and (B-3), more preferably, $R_{16}$ is a substituted or unsubstituted alkyl group having 1–3 carbon atoms, $Ar_2$ is a substituted or unsubstituted aryl group having 6–8 carbon atoms, and W is Si.

In general formulas (B-1), (B-2) and (B-3), the most preferred are $COO^-$ of general formula (B-1) and $Si\text{-}(R_{16})_3$.

In general formula (I), a preferable n is 1.

Further, in general formula (I), when n is 2, two (A-B)s may be the same or different.

The following are examples of group (A-B) used in the present invention, but the present invention is not restricted to them.

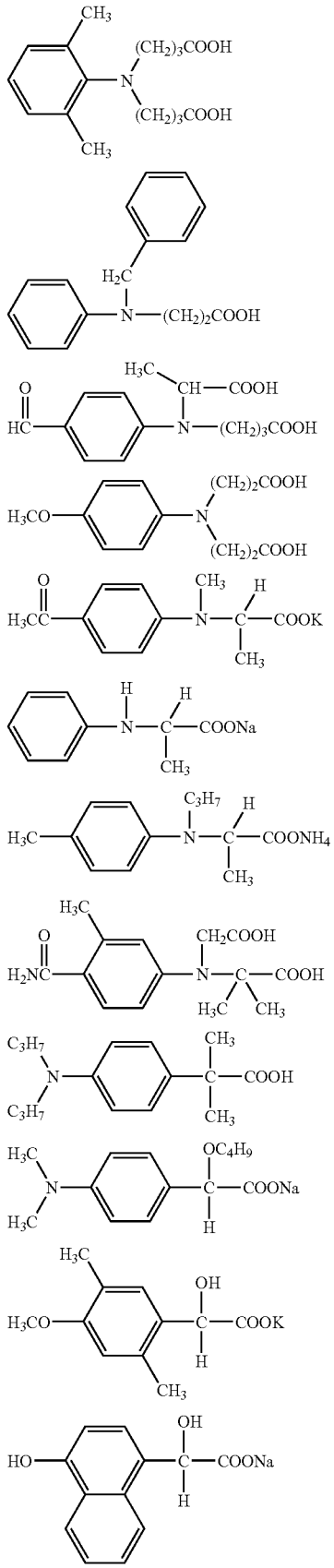

-continued

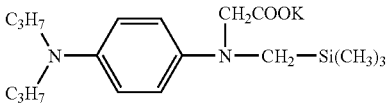

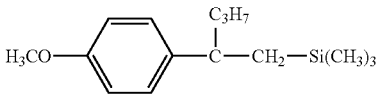

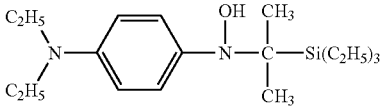

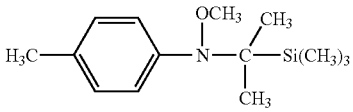

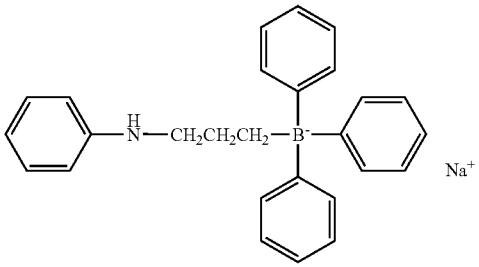

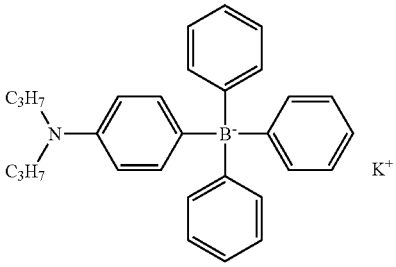

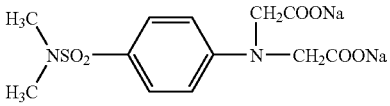

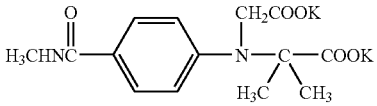

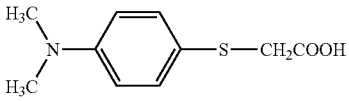

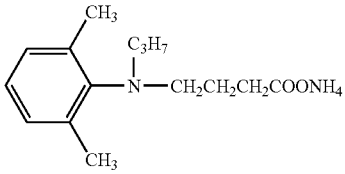

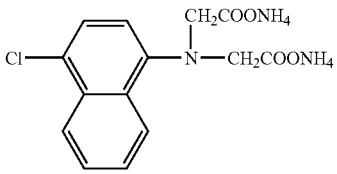

-continued

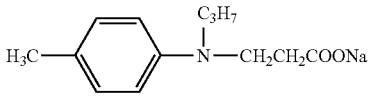

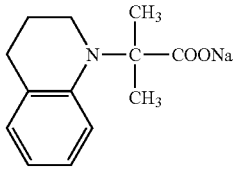

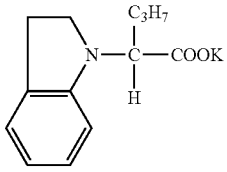

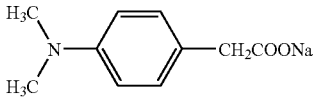

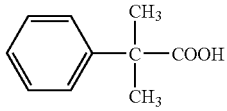

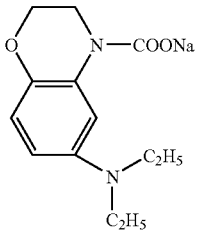

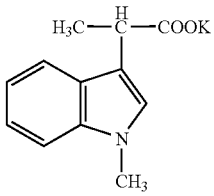

Examples of the counter ion necessary for balancing the charge of the compound A-B shown above include a sodium ion, a potassium ion, a triethylammonium ion, a diisopropylammonium ion, a tetrabutylammonium ion and a tetramethylguanidinium ion.

A preferable oxidation potential of A-B ranges from 0 to 1.5 V, more preferably from 0 to 1.0 V, and still more preferably from 0.3 to 1.0 V.

A preferable oxidation potential of the radical A.($E_2$) resulting from a bond cleavage reaction ranges from −0.6 to −2.5 V, more preferably from −0.9 to −2V, and still more preferably from −0.9 to −1.6 V.

A method for measuring the oxidation potential is as follows.

E1 can be performed by the cyclic voltammetry method. An electron donor A is dissolved in acetonitrile/0.1 M or a water 80%/20% (volume %) solution containing lithium chlorate. A glassy carbon disc, a platinum wire and a saturated calomel electrode (SCE) are used as a working electrode, a counter electrode and a reference electrode, respectively. Measurement is performed a 25° C., at a potential scanning speed of 0.1 V/sec. At a time of a peak potential of a cyclic voltammetry wave, a ratio of an oxidation potential versus SCE is detected. E1 values of these compounds A-B are disclosed in EP No. 93,731A1.

Measurement of oxidation potential of radicals is performed by excessive electrochemistry and pulse radiolysis. These are reported in J. Am. Chem. Soc., 1988, 110, 132; 1974, 96, 1287; and 1974, 96, 1295.

The following are specific examples of the compound represented by general formula (I), but the compounds to be used for the present invention are not restricted to them.

(I-1)
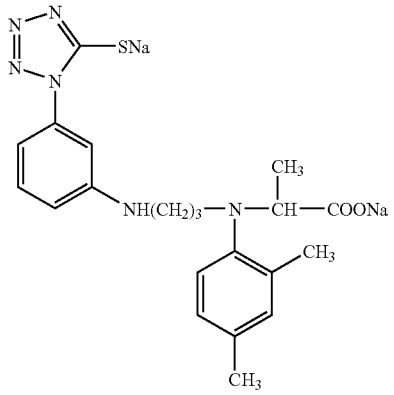
(I-2)
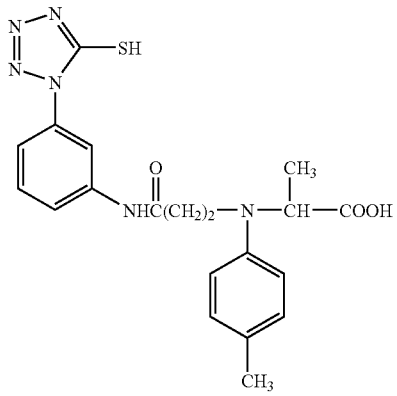
(I-3)
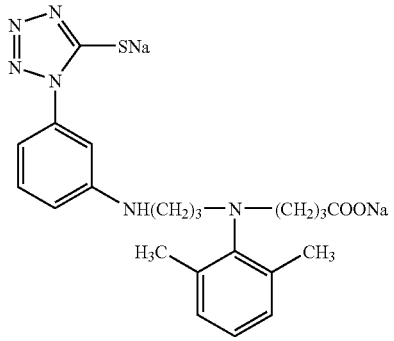
(I-4)
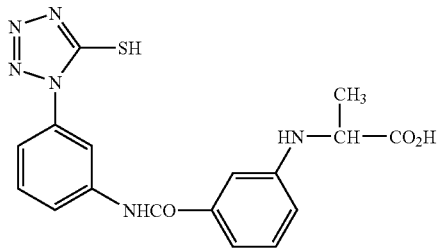
-continued
(I-5)
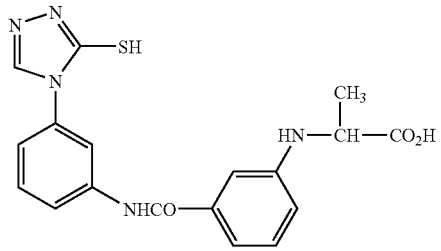
(I-6)
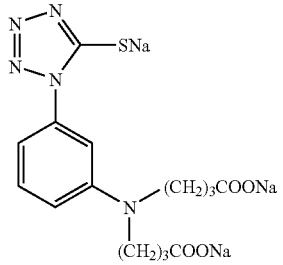
(I-7)
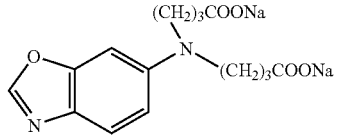
(I-8)
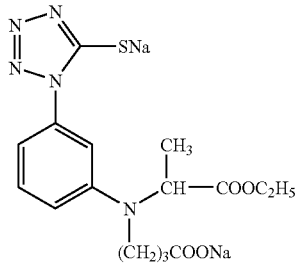
(I-9)
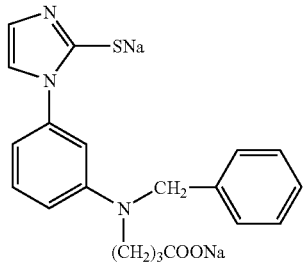
(I-10)
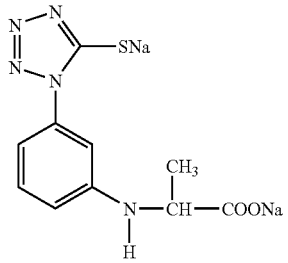

-continued
(I-11)
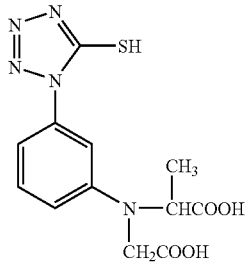
(I-12)
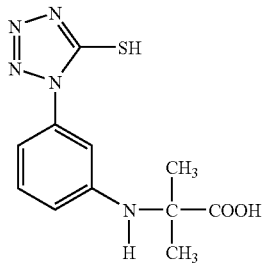
(I-13)
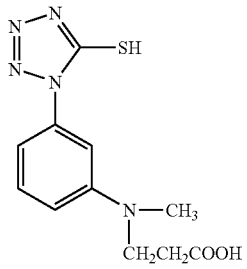
(I-14)
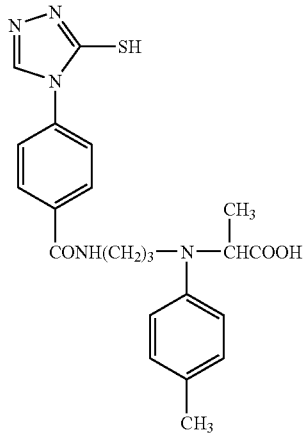
(I-15)
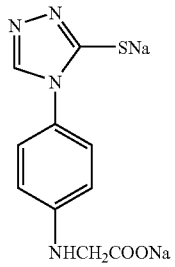
-continued
(I-16)
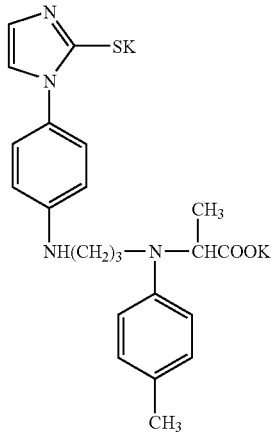
(I-17)
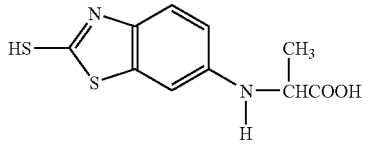
(I-18)
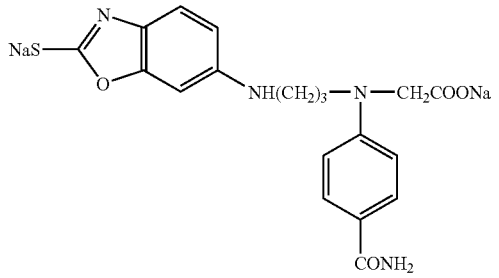
(I-19)
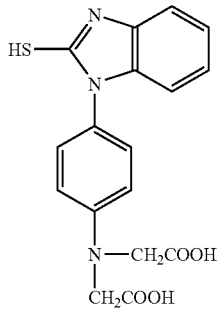
(I-20)
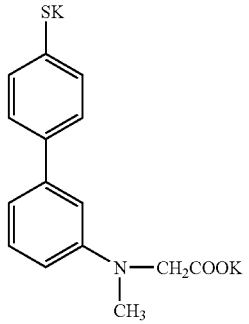

-continued
(I-21)
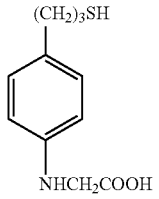
(I-22)
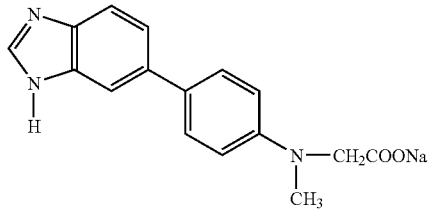
(I-23)
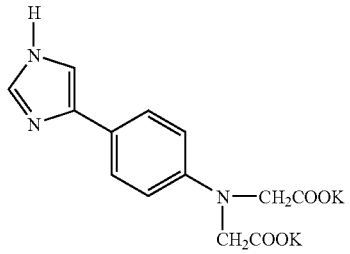
(I-24)
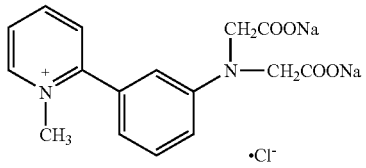
(I-25)
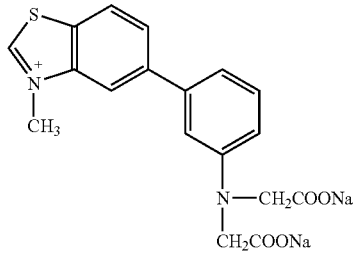
(I-26)
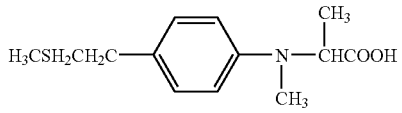
(I-27)
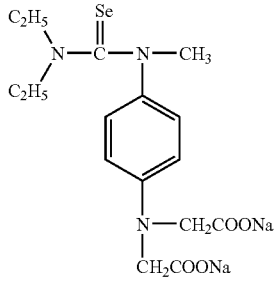
-continued
(I-28)
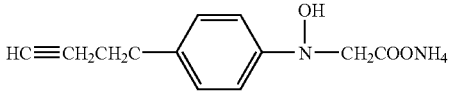
(I-29)
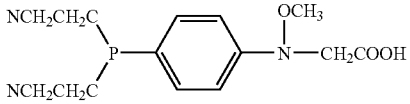
(I-30)
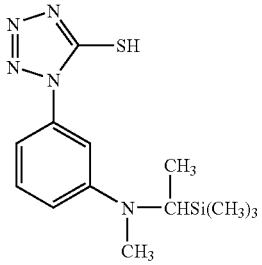
(I-31)
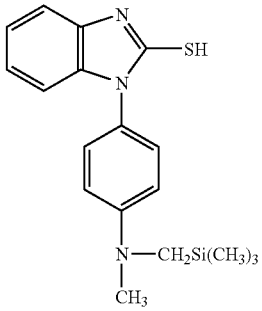
(I-32)
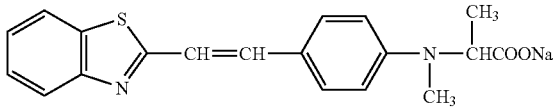
(I-33)
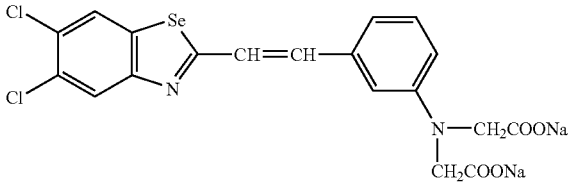
(I-34)
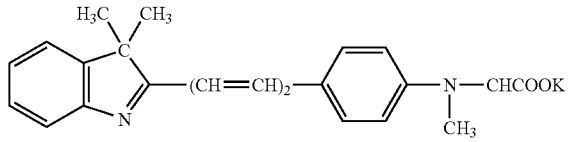
(I-35)
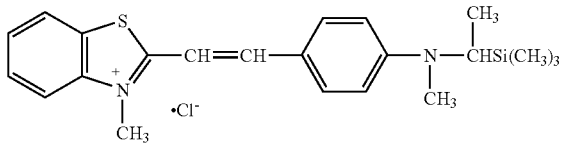

-continued
(I-36)
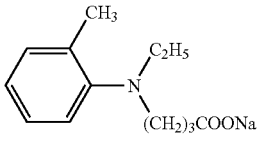
(I-37)
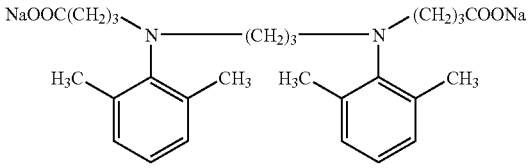
(I-38)
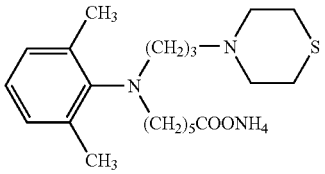
(I-39)
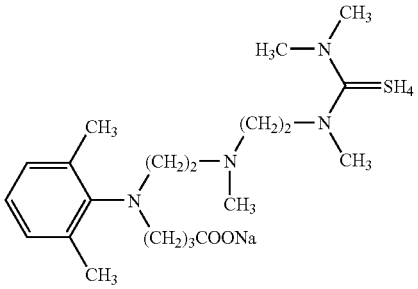
(I-40)
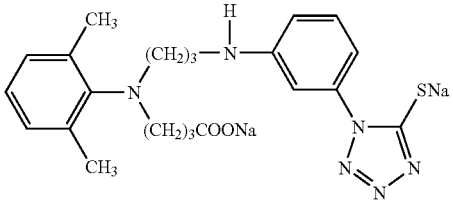
(I-41)
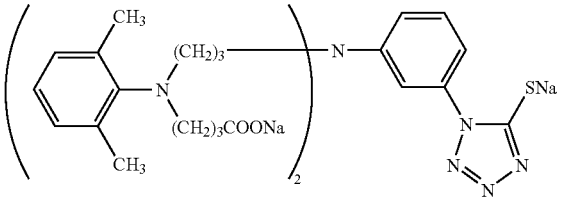
(I-42)
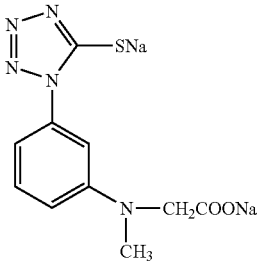
-continued
(I-43)
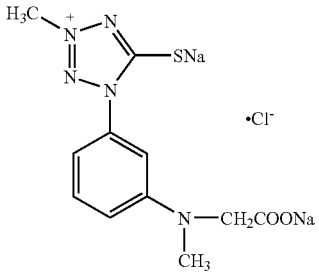
(I-44)
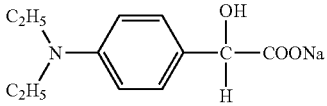
(I-45)
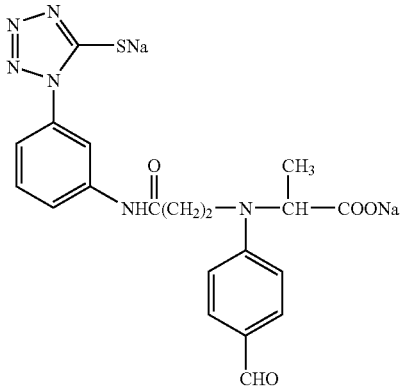
(I-46)
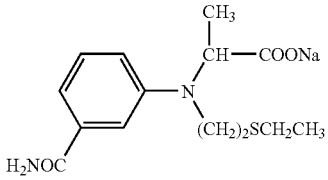
(I-47)
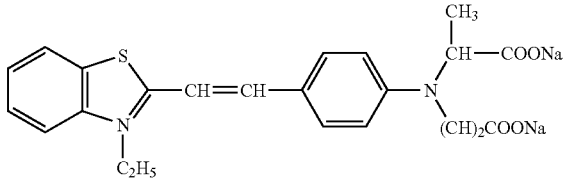
(I-48)
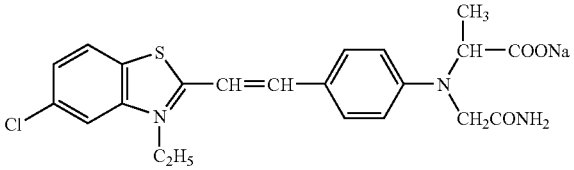
(I-49)
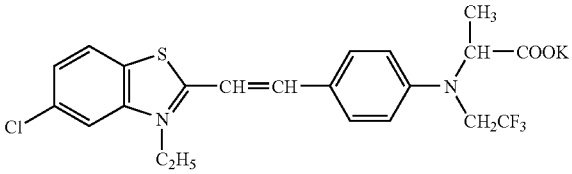

-continued (I-50)

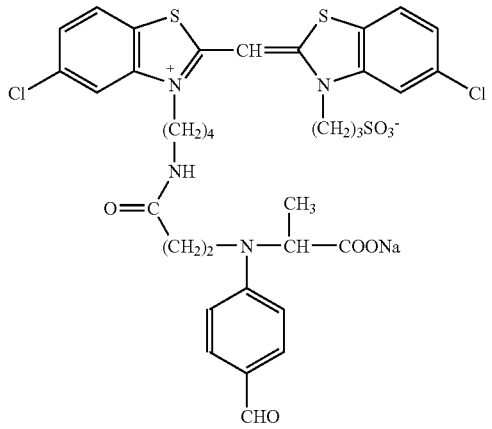

(I-51)

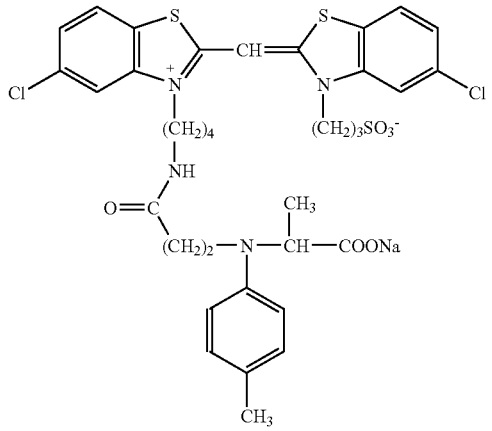

(I-52)

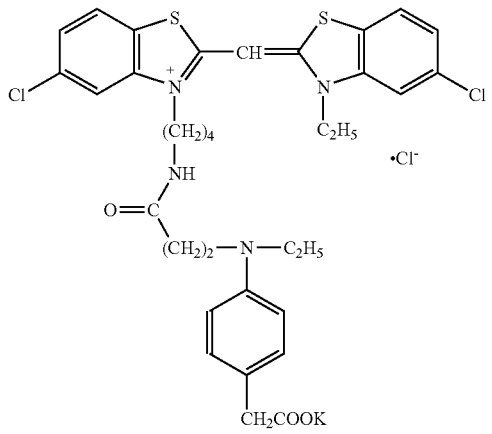

Next, a photographically useful group-releasing compound represented by general formula (II) will be described in detail:

COUP1-D1 (II)

wherein COUP1 represents a coupler residue that releases D1 by a coupling reaction with the oxidized form of a developing agent and also forms a water-soluble or alkali-soluble compound; and D1 represents a photographically useful group or its precursor that connects at the coupling position of COUP1.

The photographically useful group-releasing compound represented by general formula (II) will be described.

In detail, the photographically useful group-releasing compound represented by general formula (II) is represented by the following general formula (IIa) or (IIb).

$$\text{COUP1-(TIME)}_m\text{-PUG} \quad \text{(IIa)}$$

$$\text{COUP1-(TIME)}_i\text{-RED-PUG} \quad \text{(IIb)}$$

In the formulas, COUP1 represents a coupler residue that releases $(\text{TIME})_m$-PUG or $(\text{TIME})_i$-RED-PUG by a coupling reaction with the oxidized form of a developing agent and also forms a water-soluble or alkali-soluble compound; TIME represents a timing group that cleave PUG or RED-PUG after its release from COUP1 by the coupling reaction; RED represents a group that reacts with the oxidized form of the developing agent after its release, thereby cleaving PUG; PUG represents a photographically useful group; m represents an integer of 0 to 2; and i represents 0 or 1. When m is 2, the two TIMEs are the same or different.

If COUP1 represents a yellow coupler residue, examples of this coupler residue are a pivaloylacetanilide type coupler residue, benzoylacetanilide type coupler residue, malondiester type coupler residue, malondiamide type coupler residue, dibenzoylmethane type coupler residue, benzothiazolylacetamide type coupler residue, malonestermonoamide type coupler residue, benzoxazolylacetamide type coupler residue, benzoimidazolylacetamide type coupler residue, quinazoline-4-one-2-ylacetanilide type coupler residue, and cycloalkanoylacetamide type coupler residue.

If COUP1 represents a magenta coupler residue, examples of this coupler residue are a 5-pyrazolone type coupler residue, pyrazolo[1,5-a]benzimidazole type coupler residue, pyrazolo[1,5-b][1,2,4]triazole type coupler residue, pyrazolo[5,1-c][1,2,4]triazole type coupler residue, imidazo[1,2-b]pyrazole type coupler residue, pyrrolo[1,2-b][1,2,4]triazole type coupler residue, pyrazolo[1,5-b]pyrazole type coupler residue, and cyanoacetophenone type coupler residue.

If COUP1 represents a cyan coupler residue, examples of this coupler residue are a phenol type coupler residue, naphthol type coupler residue, pyrrolo[1,2-b][1,2,4]triazole type coupler residue, pyrrolo[2,1-c][1,2,4]triazole type coupler residue, and 2,4-diphenylimidazole type coupler residue.

COUP1 can also be a coupler residue that does not substantially leave any color image. Examples of a coupler residue of this type are indanone type and acetophenone type coupler residues.

Preferable examples of COUP1 are coupler residues represented by formulas (Cp-1), (Cp-2), (Cp-3), (Cp-4), (Cp-5), (Cp-6), (Cp-7), (Cp-8), (Cp-9), (Cp-10), (Cp-11) and (Cp-12) below. These couplers are preferable because of their high coupling rates.

(Cp-1)

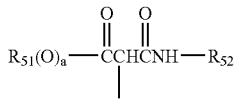

(Cp-2)

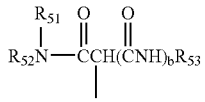

-continued (Cp-3)

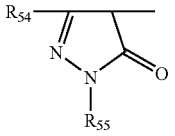

(Cp-4)

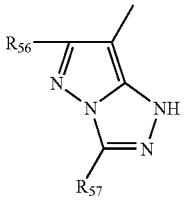

(Cp-5)

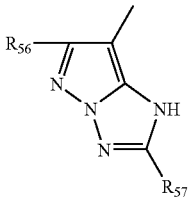

(Cp-6)

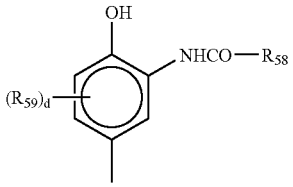

(Cp-7)

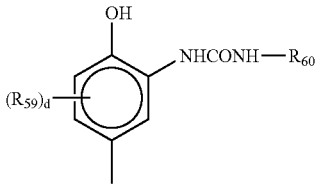

(Cp-8)

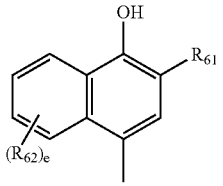

(Cp-9)

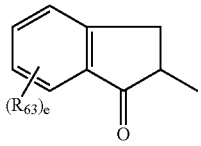

(Cp-10)

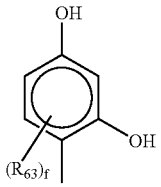

-continued (Cp-11)

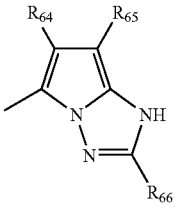

(Cp-12)

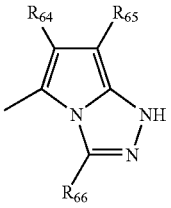

In the above formulas, a free bond hand stemming from the coupling position represents the bonding position of a coupling split-off group.

In the above formulas, the number of carbon atoms of each of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, $R_{65}$ and $R_{66}$ is preferably 10 or less.

A coupler residue represented by COUP1 preferably has at least one substituent selected from an $R_{71}OCO$— group, $HOSO_2$— group, HO— group, $R_{72}NHCO$— group and $R_{72}NHSO_2$— group. That is, at least one of $R_{51}$ and $R_{52}$ in formula (Cp-1), at least one of $R_{51}$, $R_{52}$ and $R_{53}$ in formula (Cp-2), at least one of $R_{54}$ and $R_{55}$ in formula (Cp-3), at least one of $R_{56}$ and $R_{57}$ in formulas (Cp-4) and (Cp-5), at least one of $R_{58}$ and $R_{59}$ in formula (Cp-6), at least one of $R_{59}$ and $R_{60}$ in formula (Cp-7), at least one of $R_{61}$ and $R_{62}$ in formula (Cp-8), at least one $R_{63}$ in formulas (Cp-9) and (Cp-10), and at least one of $R_{64}$, $R_{65}$, and $R_{66}$ in formulas (Cp-11) and (Cp-12) preferably have at least one substituent selected from an $R_{71}OCO$— group, $HOSO_2$— group, HO— group, $R_{72}NHCO$— group, and $R_{72}NHSO_2$— group. $R_{71}$ represents a hydrogen atom, an alkyl group (e.g., methyl, ethyl, propyl, isopropyl, butyl and t-butyl) having 6 or less carbon atoms, or a phenyl group. $R_{72}$ represents a group represented by $R_{71}$, $R_{74}CO$— group, $R_{74}N(R_{75})CO$— group, $R_{73}SO_2$— group or $R_{74}N(R_{75})SO_2$— group. $R_{73}$ represents an alkyl group (e.g., methyl, ethyl, propyl, isopropyl, butyl or t-butyl) having 6 or less carbon atoms, or a phenyl group. Each of $R_{74}$ and $R_{75}$ represents a group represented by $R_{71}$. These groups can further have a substituent.

$R_{51}$ to $R_{66}$, a, b, d, e, and f will be described in detail below. In the following description, $R_{41}$ represents an aliphatic hydrocarbon group, an aryl group or a heterocyclic group. $R_{42}$ represents an aryl group or a heterocyclic group. Each of $R_{43}$, $R_{44}$ and $R_{45}$ represents a hydrogen atom, an aliphatic hydrocarbon group, an aryl group or a heterocyclic group.

$R_{51}$ represents the same meaning as $R_{41}$. a represents 0 or 1. Each of $R_{52}$ and $R_{53}$ represents the same meaning as $R_{43}$. If $R_{52}$ is not a hydrogen atom in formula (Cp-2), $R_{52}$ and $R_{51}$ can combine with each other to form a 5- to 7-membered ring. b represents 0 or 1.

$R_{54}$ represents a group having the same meaning as $R_{41}$, $R_{41}CON(R_{43})$— group, $R_{41}SO_2N(R_{43})$— group, $R_{41}N(R_{43})$— group, $R_{41}S$— group, $R_{43}O$— group or $R_{45}N(R_{43})CON(R_{44})$— group. $R_{55}$ represents a group having the same meaning as $R_{41}$.

Each of $R_{56}$ and $R_{57}$ independently represents a group having the same meaning as $R_{43}$, $R_{41}S$— group, $R_{43}O$— group, $R_{41}CON(R_{43})$— group, $R_{41}OCON(R_{43})$— group or $R_{41}SO_2N(R_{43})$— group.

$R_{58}$ represents a group having the same meaning as $R_{43}$. $R_{59}$ represents a group having the same meaning as $R_{41}$, $R_{41}CON(R_{43})$— group, $R_{41}OCON(R_{43})$— group, $R_{41}SO_2N(R_{43})$— group, $R_{43}N(R_{44})CON(R_{45})$— group, $R_{41}O$— group, $R_{41}S$— group, a halogen atom or $R_{41}N(R_{43})$— group. d represents 0 to 3. If d is the plural number, a plurality of $R_{59}$'s represent the same substituent or different substituents.

$R_{60}$ represents a group having the same meaning as $R_{43}$.

$R_{61}$ represents a group having the same meaning as $R_{43}$, $R_{43}OSO_2$— group, $R_{43}N(R_{44})SO_2$— group, $R_{43}OCO$— group, $R_{43}N(R_{44})CO$— group, a cyano group, $R_{41}SO_2N(R_{43})CO$— group, $R_{43}CON(R_{44})CO$— group, $R_{43}N(R_{44})SO_2N(R_{45})CO$— group, $R_{43}N(R_{44})CON(R_{45})CO$— group, $R_{43}N(R_{44})SO_2N(R_{45})SO_2$— group or $R_{43}N(R_{44})CON(R_{45})SO_2$— group.

$R_{62}$ represents a group having the same meaning as $R_{41}$, $R_{41}CONH$— group, $R_{41}OCONH$— group, $R_{41}SO_2NH$— group, $R_{43}N(R_{44})CONH$— group, $R_{43}N(R_{44})SO_2NH$— group, $R_{43}O$— group, $R_{41}S$— group, a halogen atom or $R_{41}N(R_{43})$— group. In formula (Cp-8), e represents an integer from 0 to 4. If e is 2 or more, a plurality of $R_{62}$'s represent the same substituent or different substituents.

$R_{63}$ represents a group having the same meaning as $R_{41}$, $R_{43}CON(R_{44})$— group, $R_{43}N(R_{44})CO$— group, $R_{41}SO_2N(R_{43})$— group, $R_{41}N(R_{43})SO_2$— group, $R_{41}SO_2$— group, $R_{43}OCO$— group, $R_{43}OSO_2$— group, a halogen atom, a nitro group, a cyano group or $R_{43}CO$— group. In formula (Cp-9), e represents an integer from 0 to 4. If e is 2 or more, a plurality of $R_{63}$'s represent the same substituent or different substituents. In formula (Cp-10), f represents an integer from 0 to 3. If f is 2 or more, a plurality of $R_{63}$'s represent the same substituent or different substituents. Each of $R_{64}$, $R_{65}$ and $R_{66}$ independently represents a group having the same meaning as $R_{43}$, $R_{41}S$— group, $R_{43}O$— group, $R_{41}CON(R_{43})$— group, $R_{41}SO_2.N(R_{43})$— group, $R_{41}OCO$— group, $R_{41}OSO_2$— group, $R_{41}SO_2$— group, $R_{41}N(R_{43})CO$— group, $R_{41}N(R_{43})SO_2$— group, a nitro group or a cyano group.

In the above description, an aliphatic hydrocarbon group represented by $R_{41}$, $R_{43}$, $R_{44}$ or $R_{45}$ is a saturated or unsaturated, chainlike or cyclic, straight chain or branched, substituted or unsubstituted aliphatic hydrocarbon group having 1–10 carbon atoms, preferably 1–6 carbon atoms. Representative examples of this aliphatic hydrocarbon group are methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl and allyl.

An aryl group represented by $R_{41}$, $R_{42}$, $R_{43}$, $R_{44}$ or $R_{45}$ is an aryl group having 6–10 carbon atoms, preferably substituted or unsubstituted phenyl or substituted or unsubstituted naphthyl.

A heterocyclic group represented by $R_{41}$, $R_{42}$, $R_{43}$, $R_{44}$ or $R_{45}$ is a preferably 3- to 8-membered, substituted or unsubstituted heterocyclic group having 1–10 carbon atoms, preferably 1–6 carbon atoms which contains a hetero atom selected from a nitrogen atom, oxygen atom and sulfur atom. Representative examples of this heterocyclic group are 2-pyridyl, 2benzoxazolyl, 2-imidazolyl, 2-benzimidazolyl, 1-indolyl, 1,3,4-thiadiazol-2-yl, 1,2,4-triazol-2-yl and 1-indolynyl.

If the aliphatic hydrocarbon group, aryl group and heterocyclic group described above have substituents, representative examples of the substituents are a halogen atom, $R_{43}O$— group, $R_{41}S$— group, $R_{43}CON(R_{44})$— group, $R_{43}N(R_{44})CO$— group, $R_{41}OCON(R_{43})$— group, $R_{41}SO_2N(R_{43})$— group, $R_{43}N(R_{44})SO_2$— group, $R_{41}SO_2$— group, $R_{43}OCO$— group, $R_{41}SO_2O$— group, a group having the same meaning as $R_{41}$, $R_{43}N(R_{44})$— group, $R_{41}CO_2$— group, $R_{41}OSO_2$— group, a cyano group, and a nitro group.

Preferable ranges of $R_{51}$ to $R_{66}$, a, b, d, e, and f will be described below.

$R_{51}$ is preferably an aliphatic hydrocarbon group or an aryl group. a is most preferably 1. Each of $R_{52}$ and $R_{55}$ is preferably an aryl group. If b is 1, $R_{53}$ is preferably an aryl group; if b is 0, $R_{53}$ is preferably a heterocyclic group. $R_{54}$ is preferably an $R_{41}CON(R_{43})$— group or $R_{41}$ $N(R_{43})$— group. Each of $R_{56}$ and $R_{57}$ is preferably an aliphatic hydrocarbon group, an aryl group, $R_{41}O$— group, or $R_{41}S$— group. $R_{58}$ is preferably an aliphatic hydrocarbon group or an aryl group.

In formula (Cp-6), $R_{59}$ is preferably a chlorine atom, aliphatic hydrocarbon group or $R_{41}CON(R_{43})$— group, and d is preferably 1 or 2. $R_{60}$ is preferably an aryl group. In formula (Cp-7), $R_{59}$ is preferably an $R_{41}CON(R_{43})$— group, and d is preferably 1.

$R_{61}$ is preferably an $R_{43}OSO_2$— group, $R_{43}N(R_{44})SO_2$ group, $R_{43}OCO$— group, $R_{43}N(R_{44})CO$—, a cyano group, $R_{41}SO_2N(R_{43})CO$— group, $R_{43}CON(R_{44})CO$— group, $R_{43}N(R_{44})SO_2N(R_{45})CO$— group or $R_{43}N(R_{44})CON(R_{45})CO$— group. In formula (Cp-8), e is preferably 0 or 1. $R_{62}$ is preferably an $R_{41}OCON(R_{43})$— group, $R_{41}CON(R_{43})$— group or $R_{41}SO_2N(R_{43})$— group, and the substitution position of any of these substituents is preferably the 5-position of a naphthol ring.

In formula (Cp-9), $R_{63}$ is preferably an $R_{41}CON(R_{43})$— group, $R_{41}SO_2N(R_{43})$— group, $R_{41}N(R_{43})SO_2$— group, $R_{41}SO_2$— group, $R_{41}N(R_{43})CO$— group, a nitro group or a cyano group. e is preferably 1 or 2.

In formula (Cp-10), $R_{63}$ is preferably an $R_{43}N(R_{44})CO$— group, $R_{43}OCO$— group or $R_{43}CO$— group. f is preferably 1 or 2.

In formulas (Cp-11) and (Cp-12), each of $R_{64}$ and $R_{65}$ is preferably an $R_{41}OCO$— group, $R_{41}OSO_2$— group, $R_{41}SO_2$— group, $R_{44}N(R_{43})CO$— group, $R_{44}N(R_{43})SO_2$— group or a cyano group, and most preferably an $R_{41}OCO$— group, $R_{44}N(R_{43})CO$— group or a cyano group. $R_{66}$ is preferably a group having the same meaning as $R_{41}$. The total number of carbon atoms, including those of the substituent(s) that attaches thereto, of each of $R_{51}$ to $R_{66}$ is preferably 18 or less, and more preferably, 10 or less.

A photographically useful group represented by PUG will be described below.

A photographically useful group represented by PUG can be any photographically useful group known to those skilled in the art.

Examples include development inhibitors, bleaching accelerators, development accelerators, dyes, bleaching inhibitors, couplers, developing agents, development auxiliaries, reducing agent, silver halide solvents, silver complex forming agents, fixers, image toner, stabilizers, film hardeners, tanning agents, fogging agents, ultraviolet absorbents, antifoggants, nucleating agents, chemical or spectral sensitizers, desensitizers, and brightening agents. However, PUG is not limited to these examples.

Preferable examples of PUG are development inhibitors (e.g., development inhibitors described in U.S. Pat. Nos. 3,227,554, 3,384,657, 3,615,506, 3,617,291, 3,733,201, and 5,200,306, and British Patent No. 1450479), bleaching accelerators (e.g., bleaching accelerators described in Research Disclosure 1973, Item No. 11449 and EP No. 193389, and those described in JP-A's-61-201247, 4-350848, 4-350849, and 4-350853), development auxiliaries (e.g., development auxiliaries described in U.S. Pat. No. 4,859,578 and JP-A-10-48787), development accelerators (e.g., development accelerators described in U.S. Pat. No. 4,390,618 and JP-A-2-56543), reducing agents (e.g., reducing agents described in JP-A's-63-109439 and 63-128342), and brightening agents (e.g., brightening agents described in U.S. Pat. Nos. 4,774,181 and 5,236,804). The pKa of conjugate acid of PUG is preferably 13 or less, and more preferably, 11 or less.

PUG is more preferably a development inhibitor or a bleaching accelerator.

Preferable development inhibitors are a mercaptotetrazole derivative, a mercaptotriazole derivative, a mercaptothiadiazole derivative, a mercaptoxadiazole derivative, a mercaptoimidazole derivative, a mercaptobenzimidazole derivative, a mercaptobenzthiazole derivative, a mercaptobenzoxazole derivative, a tetrazole derivative, a 1,2,3-triazole derivative, a 1,2,4-triazole derivative and a benzotriazole derivative.

More preferable development inhibitors are represented by formulas DI-1 to DI-6 below.

DI-1

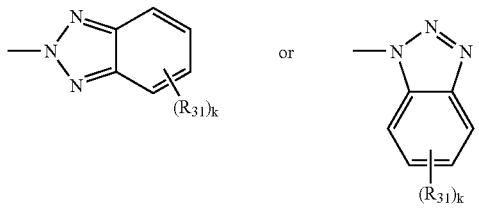

DI-2

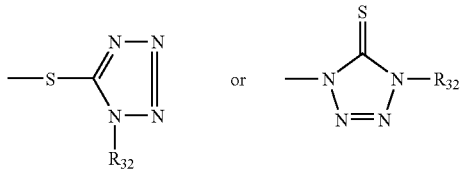

DI-3

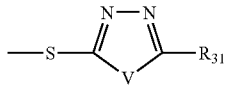

DI-4

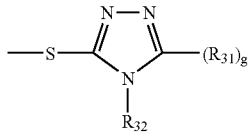

DI-5

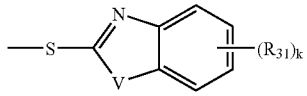

DI-6

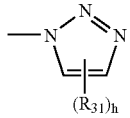

In the formula, $R_{31}$ represents a halogen atom, $R_{46}O$— group, $R_{46}S$— group, $R_{47}CON(R_{48})$— group, $R_{47}N(R_{48})CO$— group, $R_{46}OCON(R_{47})$— group, $R_{46}O_2(R_{47})$— group, $R_{47}N(R_{48})SO_2$ group, $R_{46}SO_2$— group, $R_{47}OCO$— group, $R_{47}N(R_{48})CON(R_{49})$— group, $R_{47}CON(R_{48})SO_2$— group, $R_{47}N(R_{48})CON(R_{49})SO_2$— group, group having the same meaning as $R_{46}$, $R_{47}N(R_{48})$— group, $R_{46}CO_2$— group, $R_{47}OSO_2$— group, a cyano group or a nitro group.

$R_{46}$ represents an aliphatic hydrocarbon group, an aryl group or a heterocyclic group. Each of $R_{47}$, $R_{48}$ and $R_{49}$ represents an aliphatic hydrocarbon group, an aryl group, a heterocyclic group or a hydrogen atom. An aliphatic hydrocarbon group represented by $R_{46}$, $R_{47}$, $R_{48}$ or $R_{49}$ is a saturated or unsaturated, chainlike or cyclic, straight chain or branched, substituted or unsubstituted aliphatic hydrocarbon group having 1–32 carbon atoms, preferably 1–20 carbon atoms. Representative examples are methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, allyl and ethynyl.

An aryl group represented by $R_{46}$, $R_{47}$, $R_{48}$ or $R_{49}$ is an aryl group having 6–32 carbon atoms, preferably a substituted or unsubstituted phenyl or a substituted or unsubstituted naphthyl.

A heterocyclic group represented by $R_{46}$, $R_{47}$, $R_{48}$ or $R_{49}$ is a preferably 3- to 8-membered, substituted or unsubstituted heterocyclic group having 1–32 carbon atoms, preferably 1–20 carbon atoms which contains a hetero atom selected from a nitrogen atom, an oxygen atom and a sulfur atom. Representative examples of this heterocyclic group are 2-pyridyl, 2-benzoxazolyl, 2-imidazolyl, 2-benzimidazolyl, 1-indolyl, 1,3,4-thiodiazol-2-yl, 1,2,4-triazol-2-yl or 1-indolinyl.

$R_{32}$ represents a group having the same meaning as $R_{46}$.

k represents an integer from 1 to 4, g represents 0 or 1, and h represents 1 or 2.

V represents an oxygen atom, a sulfur atom or —$N(R_{46})$—.

$R_{31}$ and $R_{32}$ may further have a substituent.

Preferable bleaching accelerators are as follows.

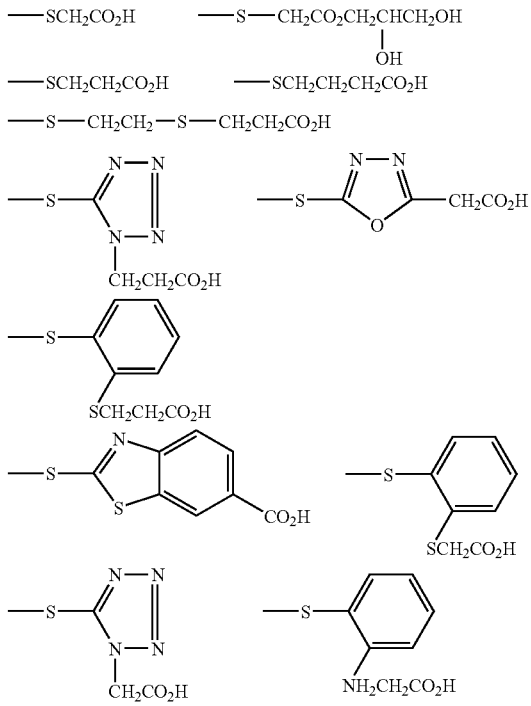

-continued

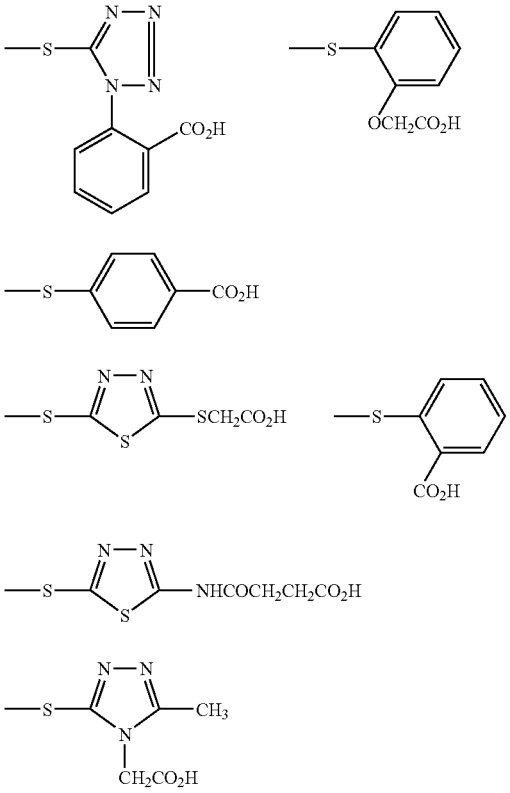

(Each free bonding hand bons to the side of COUP1)

A group represented by TIME will be described next.

A group represented by TIME can be any linking group which can cleave PUG or RED-PUG after being cleaved from COUP1 during development. Examples are a group described in U.S. Pat. Nos. 4,146,396, 4,652,516, or 4,698,297, which uses a cleavage reaction of hemiacetal; a timing group described in U.S. Pat. Nos. 4,248,962, 4,847,185 or 4,857,440, which causes a cleavage reaction by using an intramolecular nucleophilic substitution reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using a hydrolytic reaction of iminoketal; and a group described in West German Patent 2626317, which causes a cleavage reaction by using a hydrolytic reaction of ester. At a hetero atom, preferably an oxygen atom, a sulfur atom or a nitrogen atom contained in it, TIME bonds to COUP1 in general formula (IIa) or (IIb). Preferable examples of TIME are general formulas (T-1), (T-2) or (T-3) below.

| | |
|---|---|
| $*—W—(X{=}Y)_j—C(R_{21})R_{22}—**$ | General formula (T-1) |
| $*—W—CO—**$ | General formula (T-2) |
| $*—W\text{-}LINK\text{-}E1\text{-}**$ | General formula (T-3) |

In the formulas, * represents a position where TIME bonds to COUP1 in general formula (IIa) or (IIb), ** represents a position where TIME bonds to PUG, another TIME (if m is the plural number) or RED (in the case of general formula (IIa)), W represents an oxygen atom, a sulfur atom or $>N—R_{23}$, each of X and Y represents methine or a nitrogen atom, j represents 0, 1, or 2, and each of $R_{21}$, $R_{22}$ and $R_{23}$ represents a hydrogen atom or a substituent. If X and Y each represent substituted methine, this substituent and any two substituents of each of $R_{21}$, $R_{22}$ and $R_{23}$ may connect to form a cyclic structure (e.g., a benzene ring or a pyrazole ring) or not. In general formula (T-3), E1 represents an electrophilic group. LINK represents a linking group which three-dimensionally relates W to E1 so as to allow an intramolecular nucleophilic substitution reaction.

Specific examples of TIME represented by general formula (T-1) are as follows.

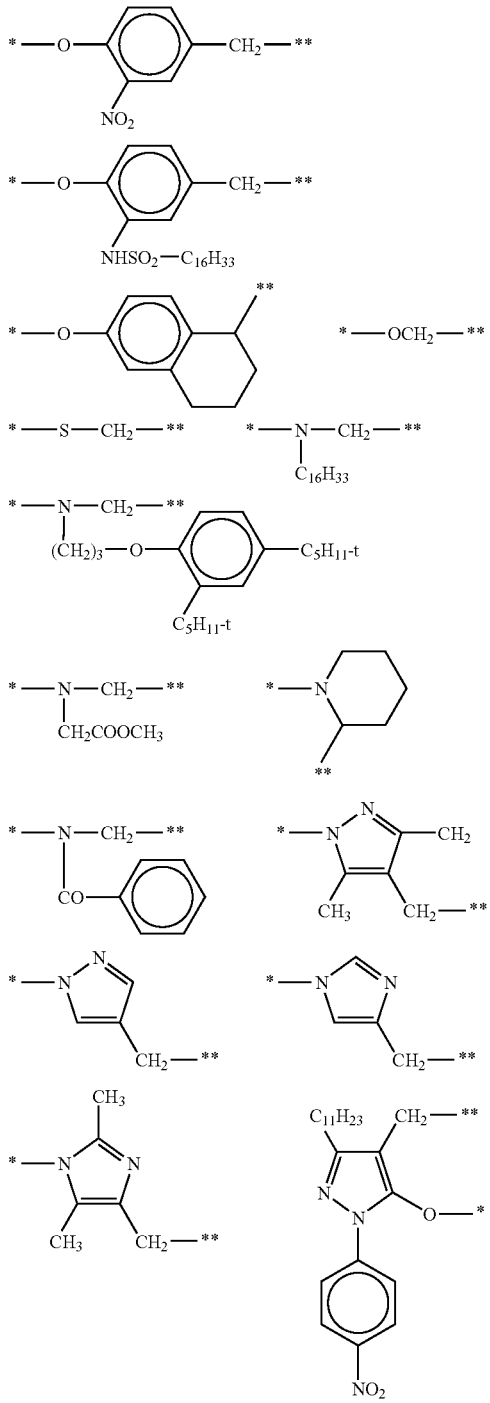

-continued
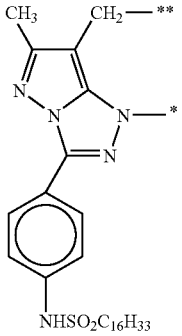
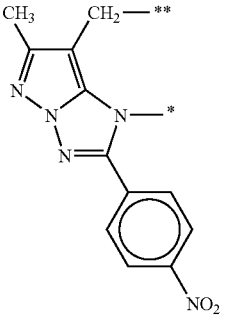
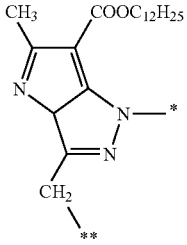
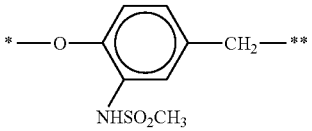
Specific examples of TIME represented by general formula (T-2) are as follows.
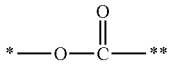
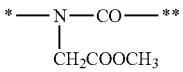
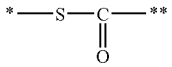
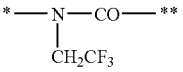
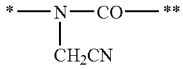
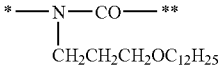
Specific examples of TIME represented by general formula (T-3) are as follows.
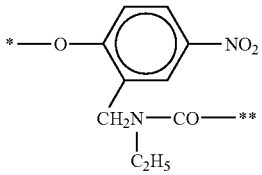
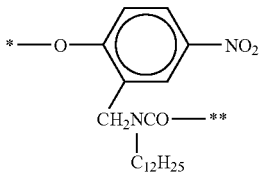
-continued
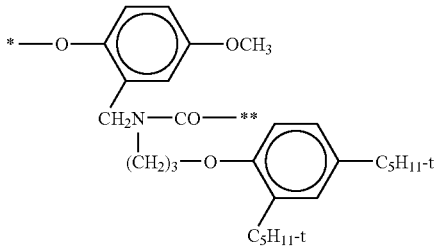
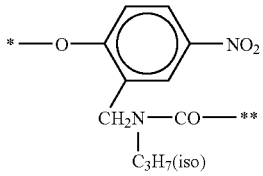
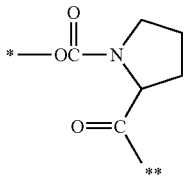
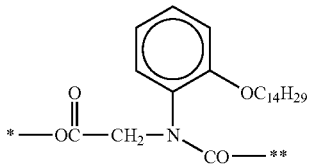
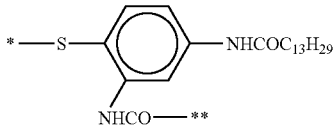
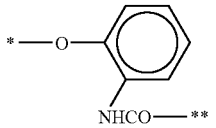
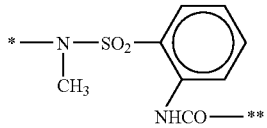
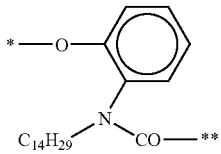
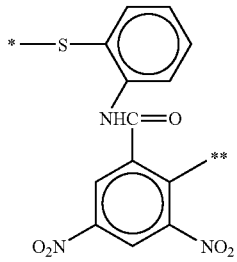
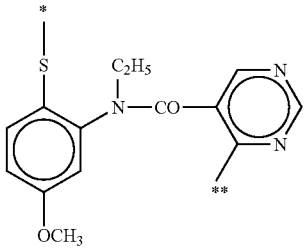
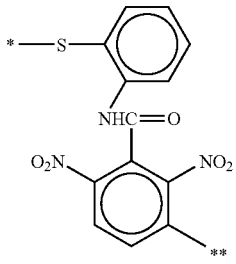
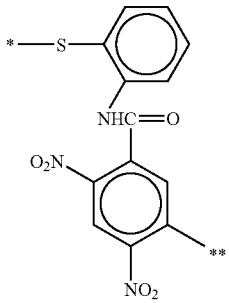

If m is 2 in general formula (IIa), specific examples of $(TIME)_m$ are as follows.

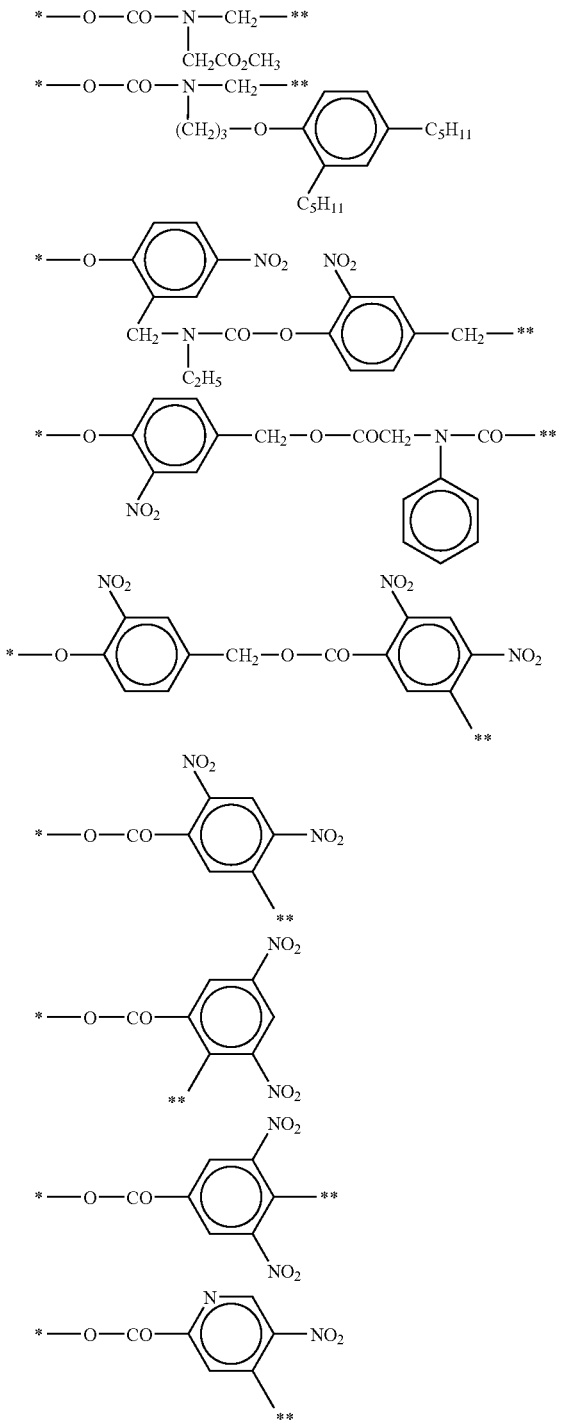

A group represented by RED in general formula (IIb) will be described below. RED is a group that cleaves from COUP1 or TIME to form RED-PUG and can be cross-oxidized by an acidic substance, such as the oxidized form of a developing agent, present during development. RED-PUG can be any compound as long as it cleaves PUG when oxidized. Examples of RED are hydroquinones, catechols, pyrogallols, 1,4-naphthohydroquinones, 1,2-naphthohydroquinones, sulfonamidophenols, hydrazides and sulfonamidonaphthols. Specific examples of these groups will be described in JP-A's-61-230135, 62-251746 and 61-278852, U.S. Pat. Nos. 3,364,022, 3,379,529, 4,618,571, 3,639,417 and 4,684,604, and J. Org. Chem., Vol. 29, page 588 (1964).

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group combines with COUP1 or TIME at an oxygen atom of the phenol group.

In order for a compound represented by general formula (IIa) or (IIb) to be fixed to a lightsensitive layer or a non-lightsensitive layer to which the compound is added before a silver halide lightsensitive material containing the compound represented by general formula (IIa) or (IIb) is developed, a compound represented by general formula (IIa) or (IIb) preferably has a non-diffusing group. Most preferably, this non-diffusing group is contained in TIME or RED. Preferable examples of the non-diffusing group are an alkyl group having 8–40 carbon atoms, preferably 12–32 carbon atoms or an aryl group having 8–40 carbon atoms, preferably 12–32 carbon atoms that has at least one alkyl group (having 3–20 carbon atoms), an alkoxy group (having 3–20 carbon atoms) or an aryl group (having 6 –20 carbon atoms).

Methods of synthesizing compounds represented by general formulas (IIa) and (IIb) will be described in, e.g., the known patents and references cited to explain TIME, RED and PUG, JP-A's-61-156127, 58-160954, 58162949, 61-249052 and 63-37350, U.S. Pat. No. 5,026,628, and EP Publication Nos. 443530A2 and 444501A2.

A photographically useful group-releasing compound represented by general formula (III) will be described below.

COUP2-C-E-D2 (III)

In the formula, COUP2 represents a coupler residue capable of coupling with the oxidized form of a developing agent, E represents an electrophilic portion, C represents a bivalent linking group or a single bond capable of releasing D2 with 4- to 8-membered ring formation by an intramolecular nucleophilic substitution reaction of a nitrogen atom, which arises from the developing agent in the product of coupling between COUP2 and the oxidized form of the developing agent and which directly bonds to the coupling position, with the nucleophilic portion E, which may bond to COUP2 either at a coupling position of COUP2 or at a position of COUP2 other than its coupling position. D2 represents a photographically useful group or its precursor.

As a coupler residue represented by COUP2, coupler residues generally known as photographic couplers can be used. Examples are yellow coupler residues (e.g., open-chain ketomethine type coupler residues such as acylacetanilide and malondianilide), magenta coupler residues (e.g., 5-pyrazolon type and pyrazolotriazole type coupler residues), and cyan coupler residues (e.g., phenol type, naphthol type, and pyrrolotriazole type coupler residues). It is also possible to use yellow, magenta, and cyan dye forming couplers having novel skeletons described in, e.g., U.S. Pat. No. 5,681,689, JP-A's-7-128824, 7-128823, 6-222526, 9-258400, 9-258401, 9-269573 and 6-27612. Other coupler residues can also be used (e.g., coupler residues described in U.S. Pat. Nos. 3,632,345 and 3,928,041, which form a colorless substance by reacting with the oxidized form of an aromatic amine-based developing agent and coupler residues described in U.S. Pat. Nos. 1,939,231 and 2,181,944, which form a black or intermediate-color substance by reacting with the oxidized form of an aromatic amine-based developing agent).

The coupler residue represented by COUP2 may be a monomer, and also may be dimer, oligomer or a part of a polymer coupler. In the latter case, the coupler may contain more than one PUG.

Preferable examples of COUP2 of the present invention will be presented below, but COUP2 is not limited to these examples.

(III-1A)

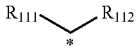

(III-2A)

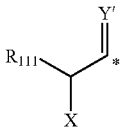

(III-1B)

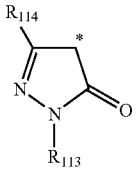

(III-2B)

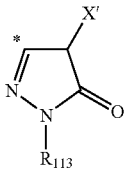

(III-1C)

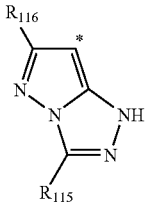

(III-2C)

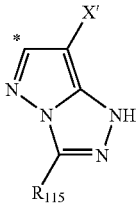

(III-1D)

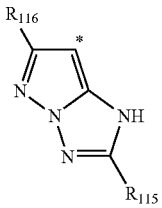

-continued (III-2D)

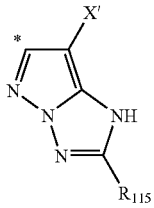

(III-1E)

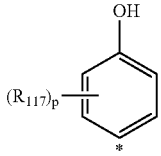

(III-2E)

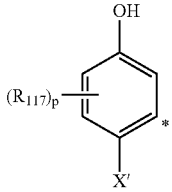

(III-1F)

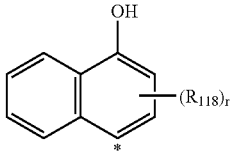

(III-2F)

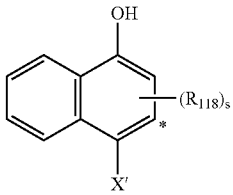

(III-3F)

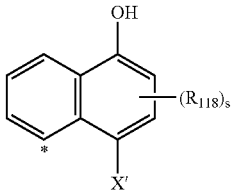

(III-1G)

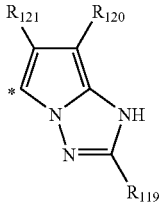

-continued (III-2G)

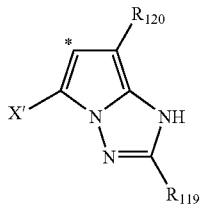

wherein * represents a position of bonding to C, X' represents a hydrogen atom, halogen atom (e.g., a fluorine atom, chlorine atom, bromine atom, or iodine atom), $R_{131}$—, $R_{131}O$—, $R_{131}S$—, $R_{131}OCOO$—, $R_{132}COO$—, $R_{132}(R_{133})NCOO$—, or $R_{132}CON(R_{133})$—, Y' represents an oxygen atom, sulfur atom, $R_{132}N$═, or $R_{132}ON$═.

$R_{131}$ represents an aliphatic group (an "aliphatic group" means a saturated or unsaturated, chain or cyclic, straight-chain or branched, and substituted or unsubstituted aliphatic hydrocarbon group, and an aliphatic group used in the following description has the same meaning), aryl group, or heterocyclic group.

The aliphatic group represented by $R_{131}$ is an aliphatic group having preferably 1 to 32 carbon atoms, and more preferably 1 to 22 carbon atoms. Examples are methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl, and octadecyl. If the aliphatic group is a substituted aliphatic group, the number of "carbon atoms" is the total number of carbon atoms including carbon atoms of the substituent. The number of carbon atoms of a group other than an aliphatic group also means the total number of carbon atoms including carbon atoms of a substituent.

The aryl group represented by $R_{131}$ is a substituted or unsubstituted aryl group having preferably 6 to 32 carbon atoms, and more preferably 6 to 22 carbon atoms. Examples are phenyl, tolyl, and naphthyl.

The heterocyclic group represented by $R_{131}$ is a substituted or unsubstituted heterocyclic group having preferably 1 to 32 carbon atoms, and more preferably 1 to 22 carbon atoms. Examples are 2-furyl, 2-pyrrolyl, 2-thienyl, 3-tetrahydrofuranyl 4-pyridyl, 2-pyrimidinyl, 2-(1,3,4-thiadiazolyl), 2-benzothiazolyl, 2-benzoxazolyl, 2-benzoimidazolyl, 2-benzoselenazolyl, 2-quinolyl, 2-oxazolyl, 2-thiazolyl, 2-selenazolyl, 5-tetrazolyl, 2-(1,3,4-oxadiazolyl), and 2-imidazolyl.

Each of $R_{132}$ and $R_{133}$ independently represents a hydrogen atom, aliphatic group, aryl group, or heterocyclic group. The aliphatic group, aryl group, and heterocyclic group represented by $R_{132}$ and $R_{133}$ have the same meanings as those represented by $R_{131}$, respectively.

Preferably, X' represents a hydrogen atom, aliphatic group, aliphatic oxy group, aliphatic thio group, or $R_{132}CON(R_{133})$—, and Y' represents an oxygen atom.

Examples of substituents suited to the groups described above and groups to be described below and examples of "substituents" to be described below are a halogen atom (e.g., a fluorine atom, chlorine atom, bromine atom, and iodine atom), hydroxyl group, carboxyl group, sulfo group, cyano group, nitro group, alkyl group (e.g., methyl, ethyl, and hexyl), fluoroalkyl group (e.g., trifluoromethyl), aryl group (e.g., phenyl, tolyl, and naphthyl), heterocyclic group (e.g., a heterocyclic group having the same meaning as $R_{131}$), alkoxy group (e.g., methoxy, ethoxy, and octyloxy), aryloxy group (e.g., phenoxy and naphthyloxy), alkylthio group (e.g., methylthio and butylthio), arylthio group (e.g., phenylthio), amino group (e.g., amino, N-methylamino, N,N-dimethylamino, and N-phenylamino), acyl group (e.g., acetyl, propionyl, and benzoyl), alkylsulfonyl and arylsulfonyl groups (e.g., methylsulfonyl and phenylsulfonyl), acylamino group (e.g., acetylamino and benzoylamino), alkylsulfonylamino and arylsulfonylamino groups (e.g., methanesulfonylamino and benzenesulfonylamino), carbamoyl group (e.g., carbamoyl, N-methylaminocarbonyl, N,N-dimethylaminocarbonyl, and N-phenylaminocarbonyl), sulfamoyl group (e.g., sulfamoyl, N-methylaminosulfonyl, N,N-dimethylaminosulfonyl, and N-phenylaminosulfonyl), alkoxycarbonyl group (e.g., methoxycarbonyl, ethoxycarbonyl, and octyloxycarbonyl), aryloxycarbonyl group (e.g., phenoxycarbonyl and naphthyloxycarbonyl), acyloxy group (e.g., acetyloxy and benzoyloxy), alkoxycarbonyloxy group (e.g., methoxycarbonyloxy and ethoxycarbonyloxy), aryloxycarbonyloxy group (e.g., phenoxycarbonyloxy), alkoxycarbonylamino group (e.g., methoxycarbonylamino and butoxycarbonylamino), aryloxycarbonylamino group (e.g., phenoxycarbonylamino), aminocarbonyloxy group (e.g., N-methylaminocarbonyloxy and N-phenylaminocarbonyloxy), aminocarbonylamino group (e.g., N-methylaminocarbonylamino and N-phenylaminocarbonylamino).

Each of $R_{111}$ and $R_{112}$ independently represents $R_{132}CO$—, $R_{131}OCO$—, $R_{132}(R_{133})NCO$—, $R131SO_n$—, $R_{132}(R_{133})NSO_2$—, or a cyano group. $R_{131}$, $R_{132}$, and $R_{133}$ have the same meanings as above. n represents 1 or 2.

$R_{113}$ represents a group having the same meaning as $R_{131}$.

$R_{114}$ represents $R_{132}$—, $R_{132}CON(R_{133})$—, $R_{132}(R_{133})N$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NCO$—, or a cyano group. $R_{131}$, $R_{132}$, and $R_{133}$ have the same meanings as above. $R_{134}$ represents a group having the same meaning as $R_{132}$.

Each of $R_{115}$ and $R_{116}$ independently represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NCO$—, a halogen atom, or cyano group, and more preferably a group represented by $R_{131}$. $R_{131}$, $R_{132}$, $R_{133}$, and $R_{134}$ have the same meanings as above.

$R_{117}$ represents a substituent, p represents an integer from 0 to 4, and q represents an integer from 0 to 3. Preferable examples of a substituent represented by $R_{117}$ are $R_{131}$-, $R_{132}CON(R_{133})$—, $R_{131}OCON(R_{132})$—, $R_{131}SO_2N(R_{132})$—, $R_{132}(R_{133})NCON(R_{134})$—, $R_{131}S$—, $R_{131}O$—, and a halogen atom. $R_{131}$, $R_{132}$, $R_{133}$, and $R_{134}$ have the same meanings as above. If p and q are 2 or more, a plurality of $R_{117}$'s can be the same or different, and adjacent $R_{117}$'s can combine with each other to form a ring. In preferable forms of formulas (III-1E) and (III-2E), at least one of the two ortho positions with respect to the hydroxyl group is substituted by $R_{132}CONH$—, $R_{131}OCONH$—, or $R_{132}(R_{133})NCONH$—.

$R_{118}$ represents a substituent, r presents an integer from 0 to 6, and s represents an integer from 0 to 5. Preferable examples of a substituent represented by $R_{118}$ are $R_{132}CON(R_{133})$—, $R_{131}OCON(R_{132})$—, $R_{131}SO_2N(R_{132})$—, $R_{132}(R_{133})NCON(R_{134})$—, $R_{131}S$—, $R_{131}O$—, $R_{132}(R_{133})NCO$—, $R_{132}(R_{133})NSO_2$—, $R_{131}OCO$—, a cyano group, and halogen atom. $R_{131}$, $R_{132}$, $R_{133}$, and $R_{134}$ have the same meanings as above. When r and s are 2 or more, a plurality of $R_{118}$'s can be the same or different, and adjacent $R_{18}$'s can combine with each other to form a ring. In preferable forms of formulas (III-1F), (III-2F), and (III-3F), an ortho position to a hydroxyl group is substituted by $R_{132}CONH$—, $R_{132}HNCONH$—, $R_{132}(R_{133})NSO_2$—, or $R_{132}NHCO$—.

$R_{119}$ represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{131}OCO$—, $R_{132}(R_{133})NSO_2$—, $R_{132}(R_{133})NCO$—, a halogen atom, or cyano group, and more preferably a group represented by $R_{131}$. $R_{131}$, $R_{132}$, $R_{133}$, and $R_{134}$ have the same meanings as above.

Each of $R_{120}$ and $R_{121}$ independently represents a substituent, preferably $R_{132}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{132}(R_{133})NCO$—, $R_{132}(R_{133})NSO_2$—, $R_{131}OCO$—, a halogen atom, or cyano group, and more preferably $R_{132}(R_{133})NCO$—, $R_{132}(R_{133})NSO_2$—, a trifluoromethyl group, $R_{131}OCO$—, or cyano group. $R_{131}$, $R_{132}$, $R_{133}$, and $R_{134}$ have the same meanings as above.

E represents an electrophilic group such as —CO—, —CS—, —COCO—, —SO—, —$SO_2$—, —P(=O)($R_{151}$)—, or —P(=S)($R_{151}$)—, wherein $R_{151}$ represents an aliphatic group, aryl group, aliphatic oxy group, aryloxy group, aliphatic thio group, or arylthio group, and preferably —CO—.

C represents a linking group or bivalent group capable of releasing D2, along with formation of a ring, that is preferably a 4- to 8-membered ring, more preferably a 5- to 7-membered ring, and much more preferably a 6-membered ring, by intramolecular nucleophilic substitution between the electrophilic portion E and the nitrogen atom, which arises from a developing agent and directly bonds to the coupling position in the coupling product obtained by the coupling of COUP2 with an oxidized from of an developing agent.

Examples of the connecting groups represented by C include:

x—$(CO)_{n1}$—$(Y')_{n2}$—$\{C(R_{141})(R_{142})\}_{n4}$—xx,
x—$(CO)_{n1}$—$\{N(R_{143})\}_{n3}$—$\{C(R_{141})(R_{142})\}_{n4}$—xx,
x—$(Y')_{n2}$—$(CO)_{n1}$—$\{C(R_{141})(R_{142})\}n_4$—xx,
x—$\{N(R_{143})\}_{n3}$—$(CO)_{n1}$—$\{C(R_{141})(R_{142})\}n_4$—xx,
x—$(CO)_{n1}$—$\{C(R_{141})(R_{142})\}_{n4}$—$(Y')_{n2}$—xx,
x—$(CO)_{n1}$—$\{C(R_{141})(R_{142})\}_{n4}$—$\{N(R_{143})\}n_3$—xx,
x—$(Y')_{n2}$—xx, and x—$\{N(R_{143})\}_{n3}$—xx.

In the above formulae, x represents a site at which the connecting group is bonded with COUP, and xx represents a site at which the connecting group is bonded with E. Y' represents an oxygen atom or a sulfur atom. Each of $R_{141}$, $R_{142}$ and $R_{143}$ represents a hydrogen atom, an aliphatic group, an aryl group or a heterocyclic group (the aliphatic group, aryl group and heterocyclic group have the same meaning as described with respect to $R_{131}$), provided that two of $R_{141}$, $R_{142}$ and $R_{143}$ may be bonded with each other or each of $R_{141}$, $R_{142}$ and $R_{143}$ may be bonded with COUP2, so as to form a ring.

$R_{141}$ and $R_{142}$ are preferably a hydrogen atom or an aliphatic hydrocarbon group, more preferably a hydrogen atom.

$R_{143}$ is preferably a hydrogen atom or an aliphatic hydrocarbon group.

Each of n1 and n3 is an integer of 0 to 2, n2 is 0 or 1, and n4 is an integer of 1 to 5 (when n3 and n4 are an integer of 2 or more, relevant $N(R_{143})$ moieties as well as $C(R_{141})(R_{142})$ moieties may be identical with or different from each other). Further, n1+n2+n4, n1+n3+n4, n2, and n3 are so selected that a 4 to 8-membered ring is formed through an intramolecular nucleophilic substitution reaction between the electrophilic moiety E and the nitrogen atom of a coupling product of COUP2 and a developing agent oxidation product, the nitrogen atom attributed to the developing agent and directly bonded to the coupling position. Provided, however, that when —$N(R_{143})$— is directly bonded with E, $R_{143}$ is not a hydrogen atom, and that when the connecting group C is connected to COUP2 at the coupling position thereof, the part directly connected to COUP2 is not —Y'—.

Although the position at which COUP2 is bonded with the connecting group C is not limited as long as D2 can be released while forming a (preferably 4 to 8-membered, more preferably 5 to 7-membered, and most preferably 6-membered) ring through an intramolecular nucleophilic substitution reaction between the electrophilic moiety E and the nitrogen atom of a coupling product of COUP2 and a developing agent oxidation product, the nitrogen atom attributed to the developing agent, it is preferred that the position be the coupling position of COUP2 or position vicinal thereto, i.e., the atom adjacent to the coupling position or the atom adjacent to that adjacent atom.

When the connecting group C is bonded to the coupling position (1), or the atom adjacent to the coupling position (2), or the atom adjacent to the atom adjacent to the coupling position (3), of the coupler residue represented by COUP, the coupler of the present invention and the reaction between the coupler of the present invention and an oxidation product, i.e., Ar'=NH, of an aromatic amine developing agent represented by the formula: $ArNH_2$ can be expressed by the following formulae.

1) A case where C bonds at the coupling position of COUP2

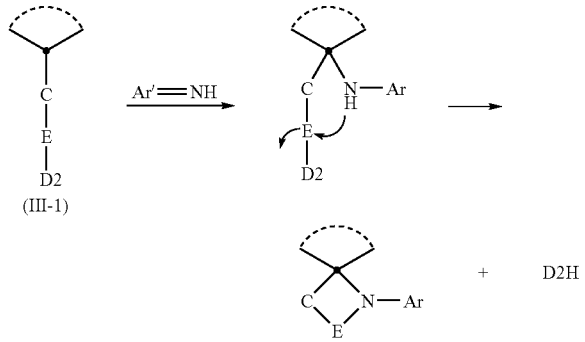

2) A case where C bonds to an atom nexst to the coupling position of COUP2

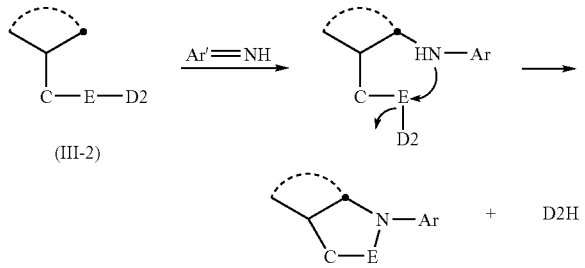

3) A case where C bons to an atom next to the next atom of the coupling position of COUP 2

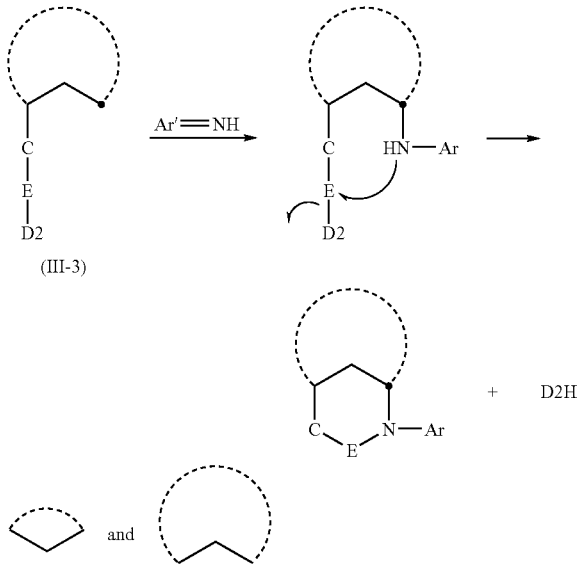

(III-3)

Examples of the connecting groups C preferably used in the general formula (III-1) {wherein COUP2 is preferably represented by the formula (III-1A), (III-1B), (III-1C), (III-1D), (III-1E), (III-1F) or (IIII-1G)} include:

x—CO—C($R_{141}$)($R_{142}$)—C($R_{141}$)($R_{142}$)—xx,
x—C($R_{141}$)($R_{142}$)—C($R_{141}$)($R_{142}$)—xx,
x—C($R_{141}$)($R_{142}$)—C($R_{141}$)($R_{142}$)—C($R_{141}$)($R_{142}$)—xx,
x—C($R_{141}$)($R_{142}$)—N($R_{143}$)—xx,
x—C($R_{141}$)($R_{142}$)—C($R_{141}$)($R_{142}$)—O—xx,
x—C($R_{141}$)($R_{142}$)—C($R_{141}$)($R_{142}$)—S—xx, and
x—C($R_{141}$)($R_{142}$)—C($R_{141}$)($R_{142}$)—N($R_{143}$)—xx.

More preferred examples thereof are:

x—C($R_{141}$)($R_{142}$)—N($R_{143}$)—xx,
x—C($R_{141}$)($R_{142}$)—C($R_{141}$)($R_{142}$)—O—xx, and
x—C($R_{141}$)($R_{142}$)—C($R_{141}$)($R_{142}$)—N($R_{143}$)—xx.

In the above formulae, x, xx, $R_{141}$, $R_{142}$ and $R_{143}$ are as defined above (when at least two —C($R_{141}$)($R_{142}$)— groups are present in one connecting group, relevant $R_{141}$ moieties as well as $R_{142}$ moieties may be identical with or different from each other).

Examples of the connecting groups C preferably used in the general formula (III-2) {wherein COUP2 is preferably represented by the formula (III-2A), (III-2B), (III-2C), (III-2D), (III-2E), (III-2F) or (III-2G)} include:

x—C($R_{141}$)($R_{142}$)-xx,
x—C($R_{141}$)($R_{142}$)—C($R_{141}$)($R_{142}$)—xx,
x—O—xx, x—S—xx, x—N($R_{143}$)—xx,
x—C($R_{141}$)($R_{142}$)—O—xx,
x—C($R_{141}$)($R_{142}$)—S—xx, and
x—C($R_{141}$)($R_{142}$)—N($R_{143}$)—xx.

More preferred examples thereof are:

x—O—xx, x—N($R_{143}$)—xx,
x—C($R_{141}$)($R_{142}$)—O—xx, and
x—C($R_{141}$)($R_{142}$)—N($R_{143}$)—xx.

In the above formula, x, xx, $R_{141}$, $R_{142}$ and $R_{143}$ are as defined above (when at least two —C($R_{141}$)($R_{142}$)— groups are present in one connecting group, relevant $R_{141}$ moieties as well as $R_{142}$ moieties may be identical with or different from each other).

Examples of the connecting groups C preferably used in the general formula (III-3) {wherein COUP2 is preferably represented by the formula (III-3F)} include x—C($R_{141}$)($R_{142}$)—xx, x—O—xx, x—S—xx, and x—N($R_{143}$)—xx. More preferred examples thereof are x—O—xx and x—N($R_{143}$)—xx. Most preferred examples thereof are x—N($R_{143}$)—xx. In the formulae, x, xx, $R_{141}$, $R_{142}$ and $R_{143}$ are as defined above.

D2 represents a photographically useful group or its precursor. A preferable form of D2 is represented by formula (III-B) below

#-$(T)_k$-PUG (III-B)

wherein # represents a portion coupling with E, T represents a timing group capable of releasing PUG after being released from E, k represents an integer from 0 to 2, preferably 0 or 1, and PUG represents a photographically useful group.

Examples of a timing group represented by T are a group described in U.S. Pat. Nos. 4,146,396, 4,652,516, or 4,698,297, which releases PUG by using a cleavage reaction of hemiacetal; a group described in JP-A-9-114058 or U.S. Pat. Nos. 4,248,962, 5,719,017, or 5,709,987, which releases PUG by using an intramolecular ring closure reaction; a group described in JP-B-54-39727, JP-A-57-136640, JP-A-57-154234, JP-A-4-261530, JP-A-4-211246, JP-A-6-324439, JP-A-9-114058, or U.S. Pat. Nos. 4,409,323 or 4,421,845, which releases PUG by using electron transfer via π electrons; a group described in JP-A-57-179842, JP-A-4-261530, or JP-A-5-313322, which releases PUG by generating carbon dioxide; a group described in U.S. Pat. No. 4,546,073, which releases PUG by using a hydrolytic reaction of iminoketal; a group described in laid-open West German Patent 2,626,317, which releases PUG by using a hydrolytic reaction of ester; and a group described in EP572084, which releases PUG by using a reaction with sulfurous acid ions, the disclosures of all the references are herein incorporated by reference.

Preferable examples of the timing group represented by T in formula (III) of the present invention are set forth below. However, the present invention is not limited to these examples.

(T1)

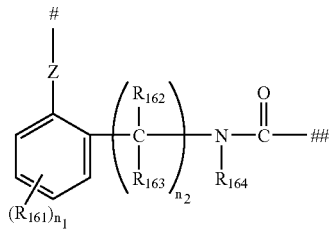

(T2)

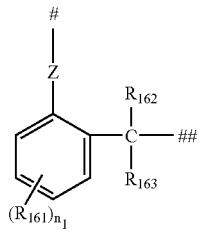

(T3)

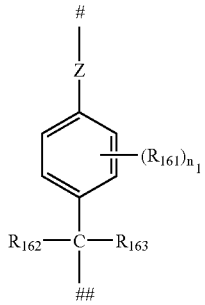

-continued (T4)

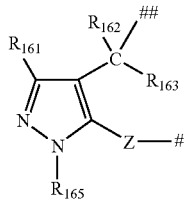

wherein # represents a portion coupling with the electrophilic portion E or ##, and ## represents a position coupling with PUG or #. Z represents an oxygen atom or sulfur atom, preferably an oxygen atom. $R_{161}$ represents a substituent, preferably $R_{131}$—, $R_{132}CON(R_{133})$—, $R_{131}SO_2N(R_{132})$—, $R_{131}S$—, $R_{131}O$—, $R_{131}OCON(R_{132})$—, $R_{132}(R_{133})NCON(R_{134})$—, $R_{132}(R_{133})NCO$—, $R_{132}(R_{133})NSO_2$—, $R_{131}OCO$—, a halogen atom, nitro group, or cyano group. $R_{131}$, $R_{132}$, $R_{133}$, and $R_{134}$ have the same meanings as above. $R_{161}$ can combine with any of $R_{162}$, $R_{163}$, and $R_{164}$ to form a ring. $n_1$ represents an integer from 0 to 4. When $n_1$ represents 2 or more, a plurality of $R_{161}$'s can be the same or different and can combine with each other to form a ring.

Each of $R_{162}$, $R_{163}$, and $R_{164}$ independently represents a group having the same meaning as $R_{132}$. $n_2$ represents 0 or 1. $R_{162}$ and $R_{163}$ can combine with each other to form a spiro ring. Each of $R_{162}$ and $R_{163}$ is preferably a hydrogen atom or an aliphatic group having 1 to 20, preferably 1 to 10 carbon atoms, and more preferably a hydrogen atom. $R_{164}$ is preferably an aliphatic group having 1 to 20, preferably 1 to 10 carbon atoms or an aryl group having 6 to 20, preferably 6 to 10 carbon atoms). $R_{165}$ represents $R_{132}$—, $R_{132}(R_{133})NCO$—, $R_{132}(R_{133})NSO_2$—, $R_{131}OCO$—, or $R_{132}CO$— $R_{131}$, $R_{132}$, and $R_{133}$ have the same meanings as above. $R_{165}$ represents preferably $R_{132}$, and more preferably an aryl group having 6 to 20 carbon atoms.

The photographically useful group represented by PUG has the same meaning as above.

In a preferred embodiment of the present invention, the coupler of the invention is represented by formula (III-2) or (III-3), and the coupler represented by formula (III-3) is more preferred, wherein C, E, and D2, and preferred A, E, and B are the same as those mentioned above.

In a more preferred embodiment, the coupler represented by formula (III-3) is represented by formula (III-3a), the coupler represented by formula (III-3b) is much more preferred, and the coupler represented by formula (III-3c) is still much more preferred. The structure of the cyclization product obtained by the reaction between the coupler represented by formula (III-3c) and the oxidized form, i.e., Ar'═NH, of the aromatic amine developing agent, i.e., $ArNH_2$, may be illustrate as follows:

(III-3a)

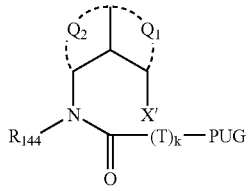

-continued (III-3b)

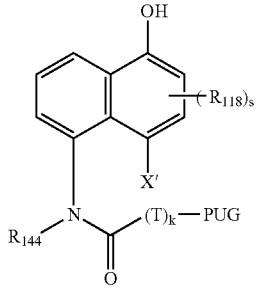

(III-3c)

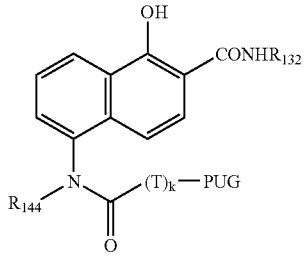

(III-C)

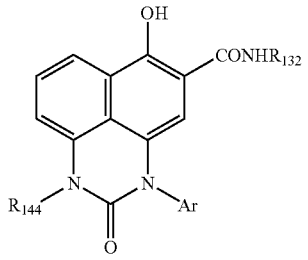

wherein $Q_1$ and $Q_2$ each represent a group of nonmetallic atoms required to form a 5-membered or 6-membered ring and induce the coupling reaction with a developing agent in a oxidized form at the atom of the joint part of X'; X', T, k, PUG, $R_{118}$, s, and $R_{132}$ are as defined above; and $R_{144}$ represents a hydrogen atom, an aliphatic group, an aryl group, or a heterocyclic group, preferably an aliphatic group, an aryl group or a heterocyclic group, more preferably an aliphatic group. The aliphatic group, aryl group and heterocyclic group are the same as defined above for $R_{131}$.

In the present invention, D1 and D2 are not at least the following groups:

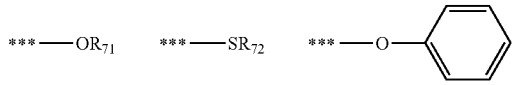

In the formulas, *** represents the potion at which it bonds to the electron attracting moiety represented by E or the timing group represented by T; $R_{71}$ represents a substituted or unsubstituted aliphatic hydrocarbon group; and $R_{72}$ represents an unsubstituted aliphatic hydrocarbon group.

Examples of the couplers that may be used in the present invention are set forth below, but the present invention is not limited to these.

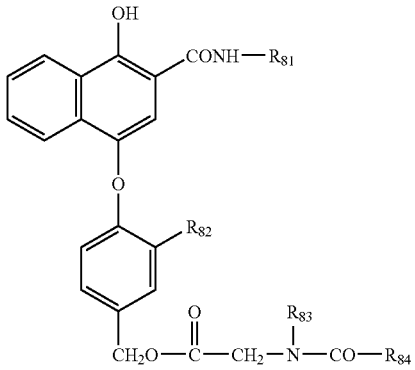
| No. | $R_{81}$ | $R_{82}$ | $R_{83}$ | $R_{84}$ |
|---|---|---|---|---|
| II-1 | —$CH_3$ | —$NHSO_2C_{16}H_{33}$(n) | —$C_6H_5$ | 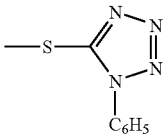 |
| II-2 | —$CH_3$ | —$NHSO_2C_{16}H_{33}$(n) | —$C_6H_5$ | 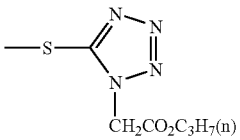 |
| II-3 | —$CH_3$ | —$NHSO_2C_{16}H_{33}$(n) | —$C_6H_5$ | 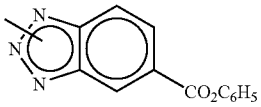 |
| II-4 | —$CH_2CH_2OCH_3$ | —$NHSO_2C_{16}H_{33}$(n) | —$C_6H_5$ | —$SCH_2CH_2CO_2H$ |
| II-5 | 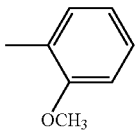 | —$NHSO_2C_{16}H_{33}$(n) | —$C_6H_5$ | 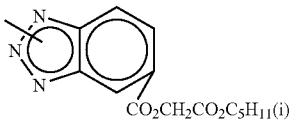 |
| II-6 | —$CH_3$ | —$NHSO_2C_{16}H_{33}$(n) | 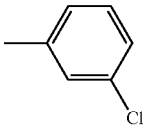 | 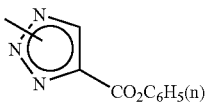 |

-continued
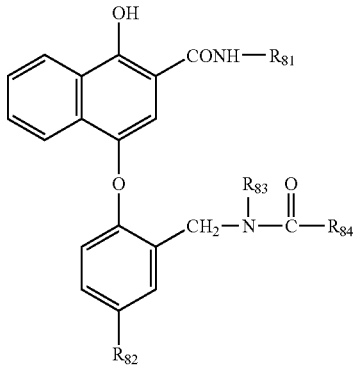
| No. | $R_{81}$ | $R_{82}$ | $R_{83}$ | $R_{84}$ |
|---|---|---|---|---|
| II-7 | $—(CH_2)_2CO_2C_2H_5$ | $—NO_2$ | $—C_{12}H_{25}(n)$ | 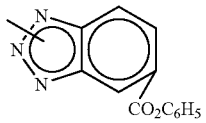 |
| II-8 | $—CH_3$ | $—NO_2$ | $—C_{12}H_{25}(n)$ | 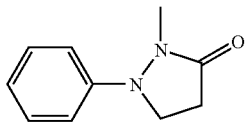 |
| II-9 | H | $—NHSO_2C_{16}H_{33}(n)$ | $—C_6H_5$ | 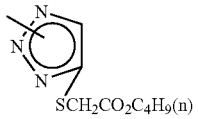 |
| II-10 | 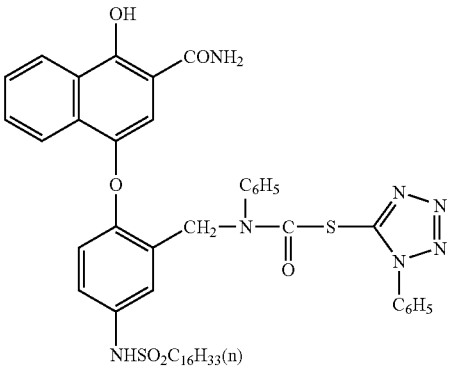 | | | |
| II-11 | 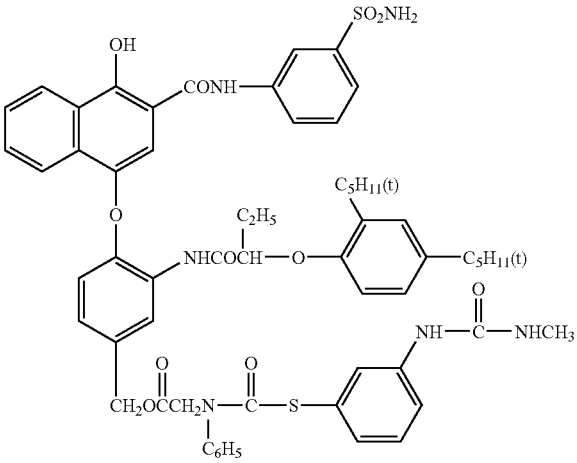 | | | |

-continued
II-12
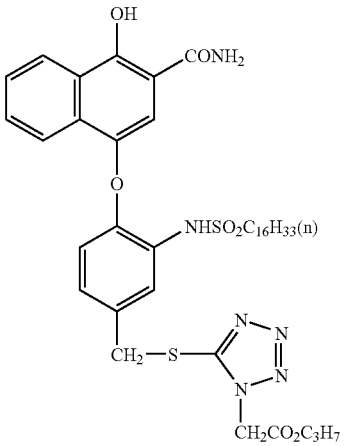
II-13
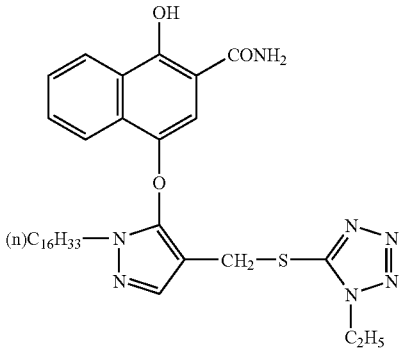
II-14
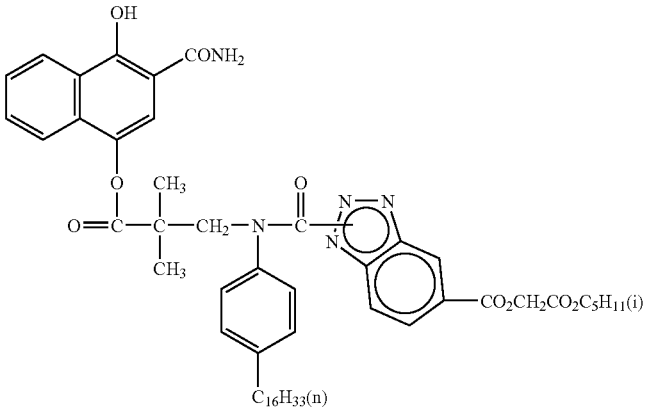
II-15
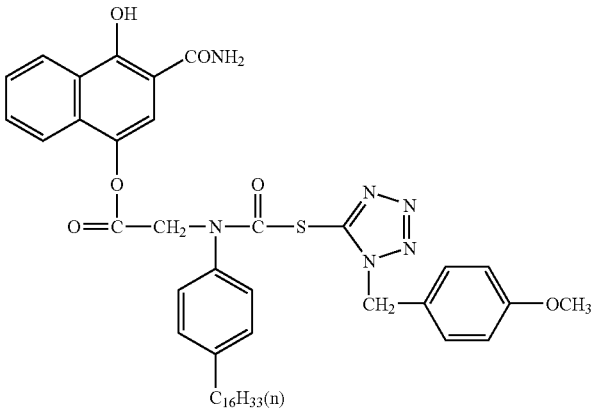

-continued
II-16
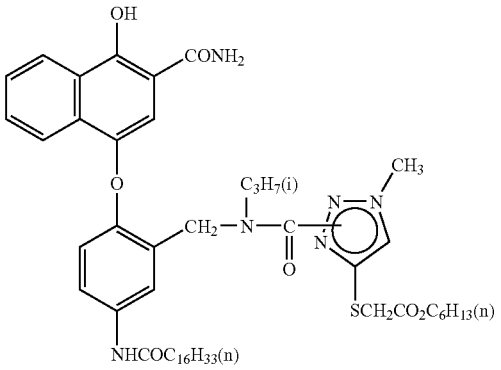
11-17
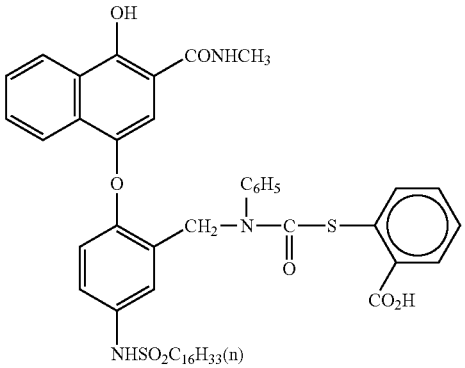
II-18
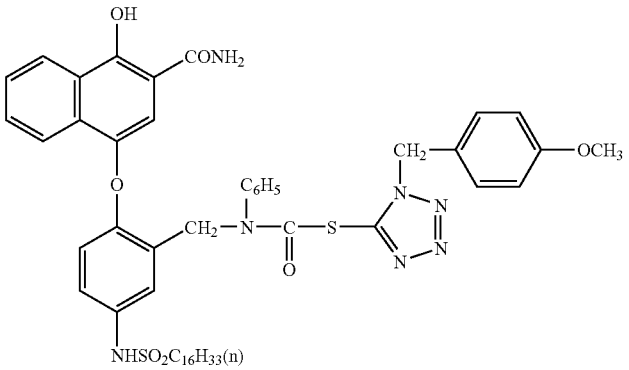
II-19
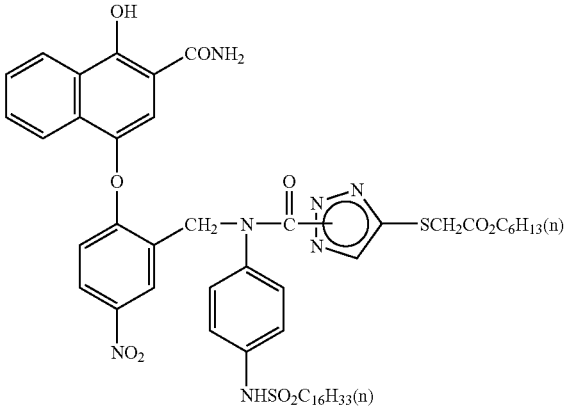

-continued
II-20
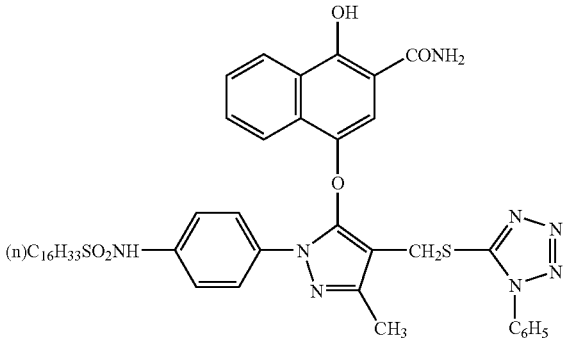
II-21
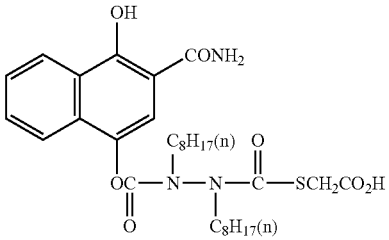
II-22
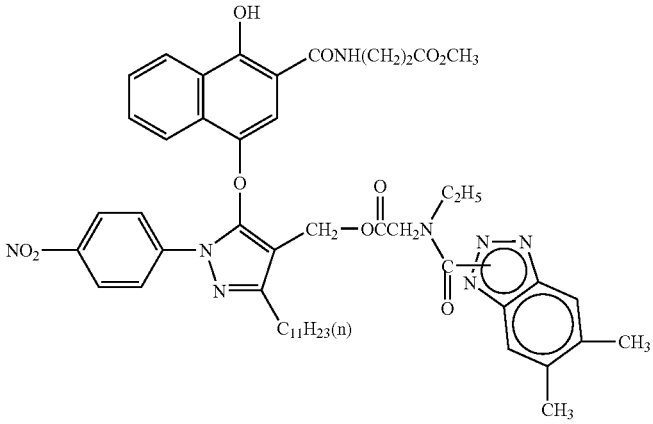
II-23
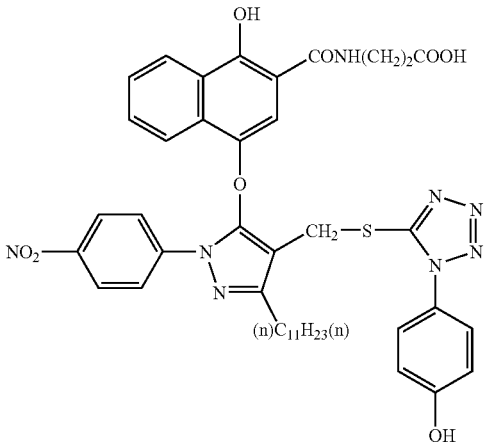

-continued
II-24
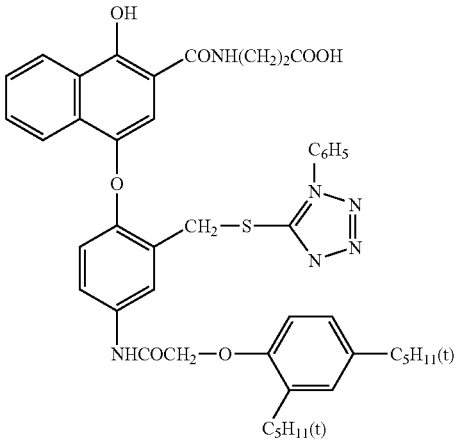
II-25
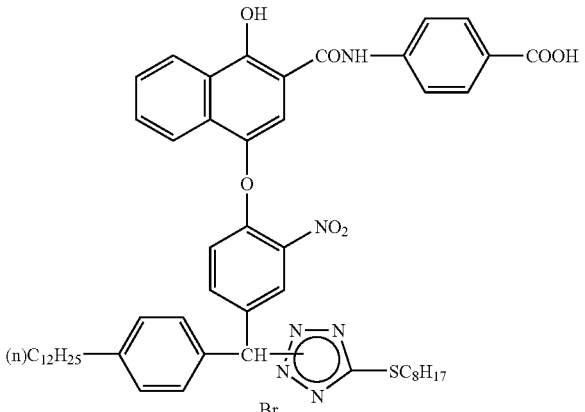
II-26
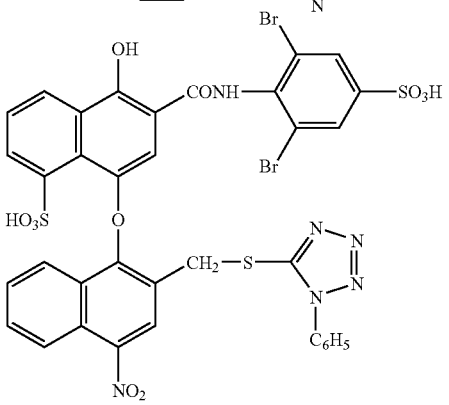
II-27
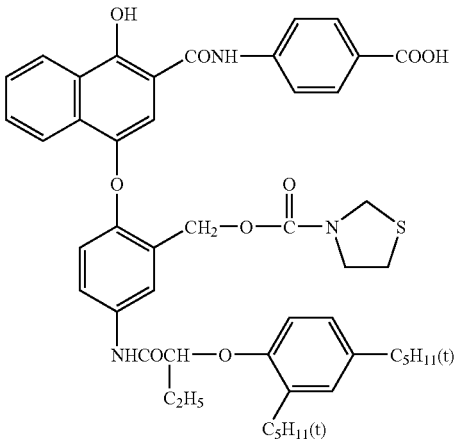

-continued
II-28
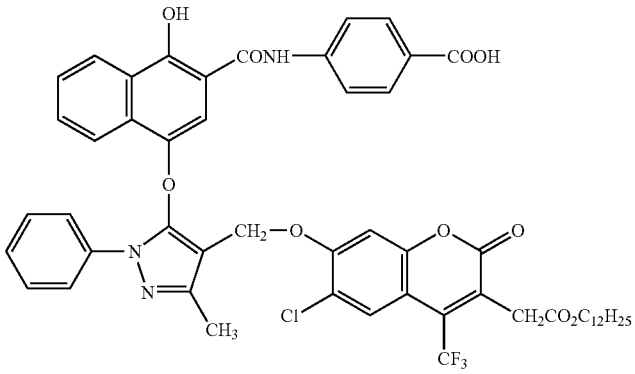
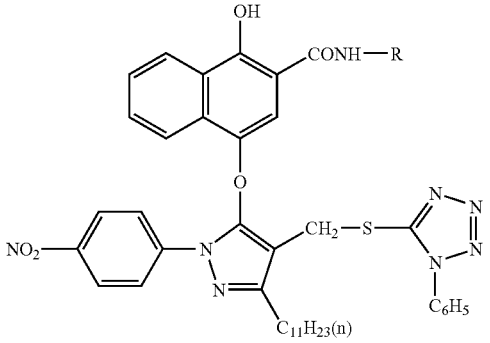
| No. | R |
|---|---|
| II-29 | $—(CH_2)_2CO_2CH_3$ |
| II-30 | $—(CH_2)_2CO_2C_4H_9(n)$ |
| II-31 | $—CH(CH_3)C_2H_5$ <br> \| <br> $CHCO_2CH_3$ |
| II-32 | $—(CH_2)_4CO_2CH_3$ |
| II-33 | 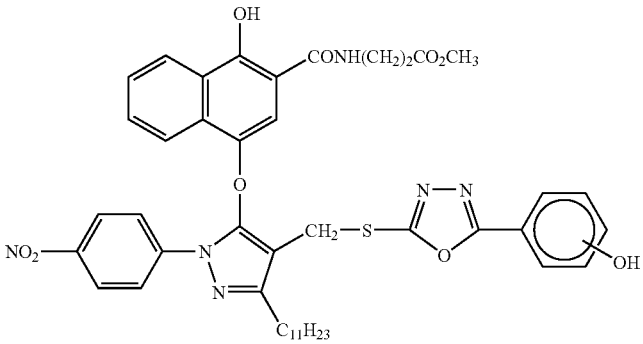 |

-continued
II-34
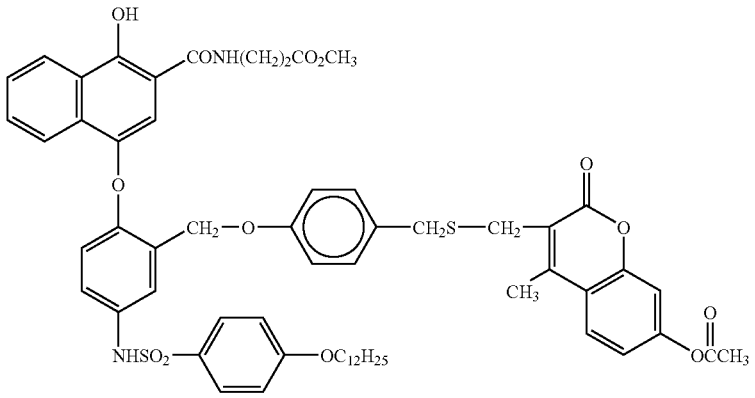
II-35
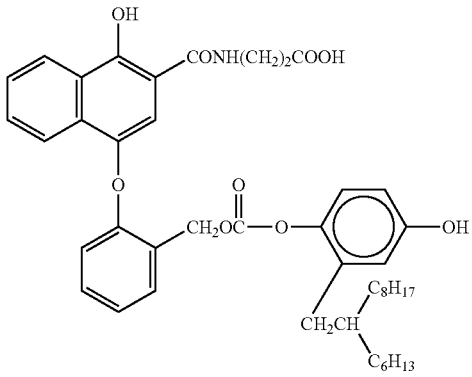
II-36
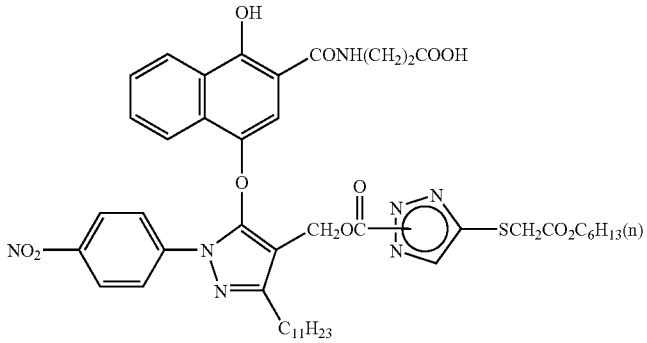
II-37
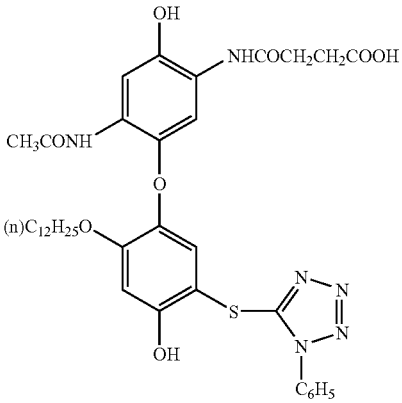

-continued
II-38
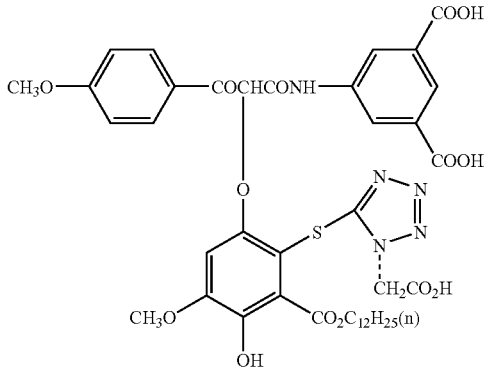
II-39
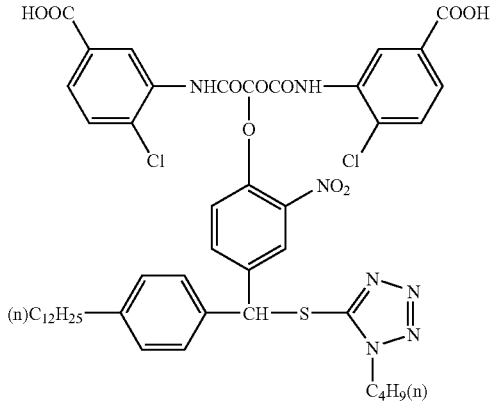
II-40
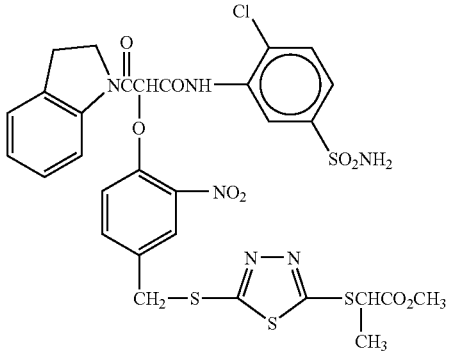
II-41
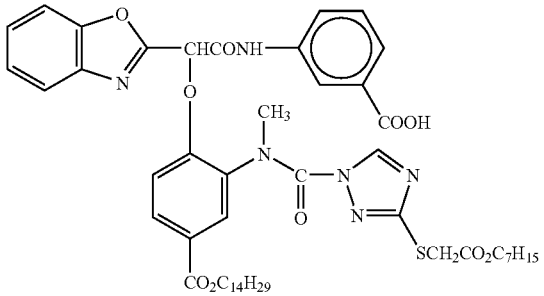

-continued
II-42
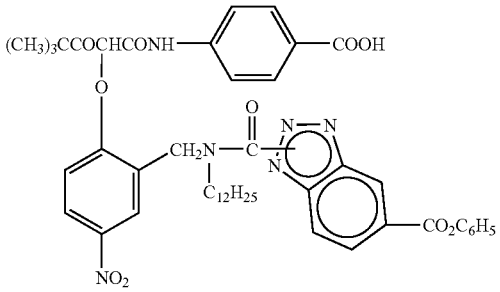
II-43
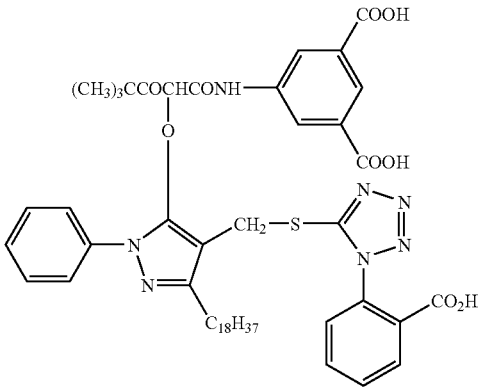
II-44
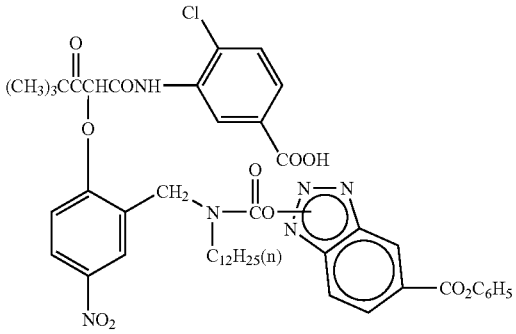
II-45
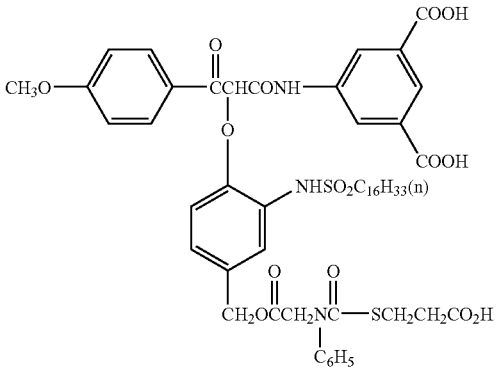

-continued
II-46
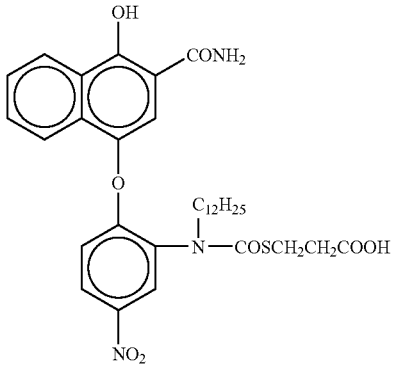
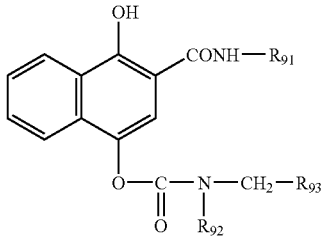
| No. | $R_{91}$ | $R_{92}$ | $R_{93}$ |
|---|---|---|---|
| II-47 | H | $—CH_2CO_2C_{10}H_{21}(n)$ | 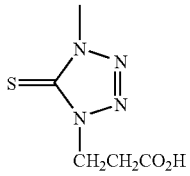 |
| II-48 | H | 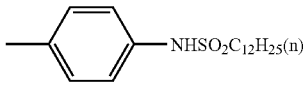 | 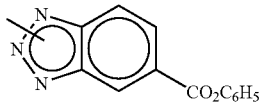 |
| II-49 | $—CH_3$ | $—CH_2CO_2C_{12}H_{25}(n)$ | 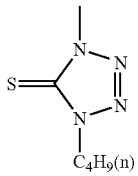 |
| II-50 | $—CH_3$ | $—C_8H_{17}(n)$ | 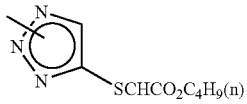 |
| II-51 | $—(CH_2)_2OCH_3$ | $—CH_2CO_2C_{10}H_{21}(n)$ | 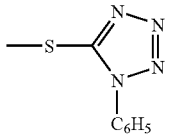 |
| II-52 | $—(CH_2)_2COOH$ | 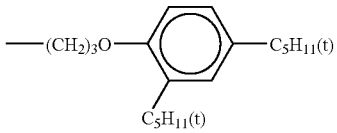 | 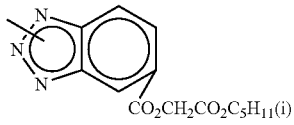 |

-continued
| | | | |
|---|---|---|---|
| II-53 | $—(CH_2)_2COOH$ | 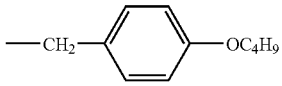 | 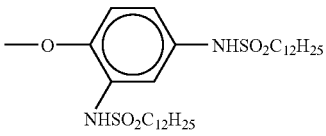 |
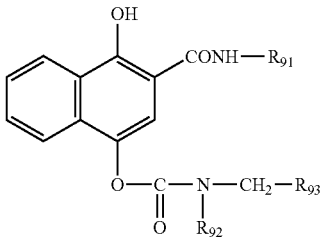
| No. | $R_{91}$ | $R_{92}$ | $R_{93}$ $R_{93}$ |
|---|---|---|---|
| II-54 | $—SO_2CH_3$ | $—CH_2CO_2C_{10}H_{21}(n)$ | 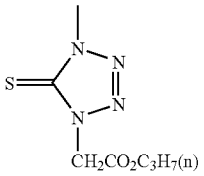 |
| II-55 | $—COCH_3$ | $—C_{12}H_{25}(n)$ | 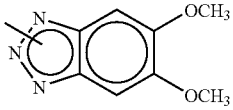 |
| II-56 | 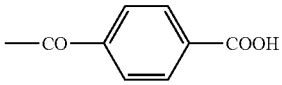 | $—C_{10}H_{21}(n)$ | 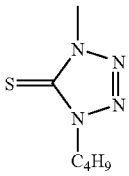 |
| II-57 | $—SO_2C_4H_9(n)$ | $—CO_2C_{12}H_{25}(n)$ | 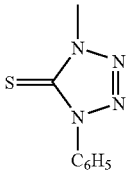 |
| II-58 | H | 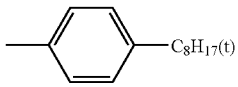 | 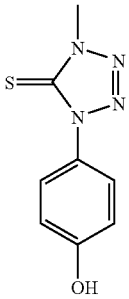 |
| II-59 | $—(CH_2)_2CO_2CH_3$ | $—CO_2C_{10}H_{21}(n)$ | 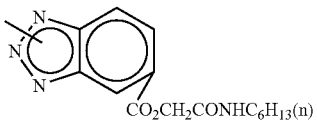 |

-continued
II-60
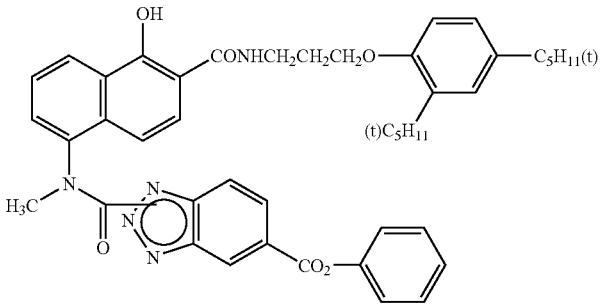
II-61
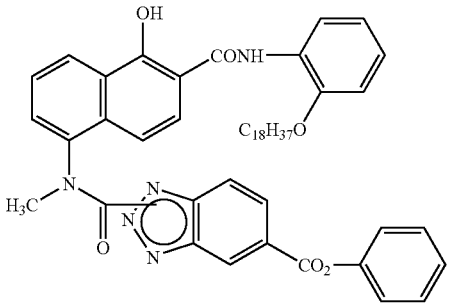
II-62
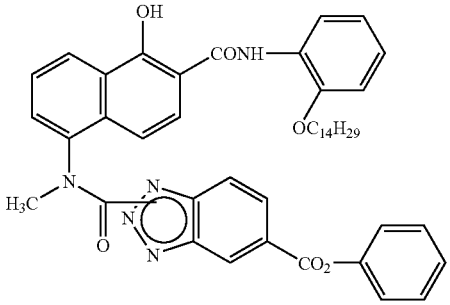
II-63
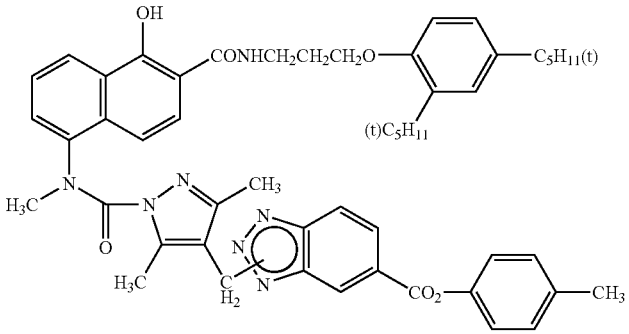
II-64
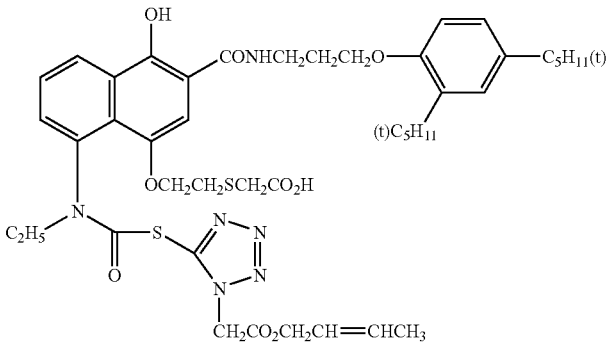

-continued
II-65
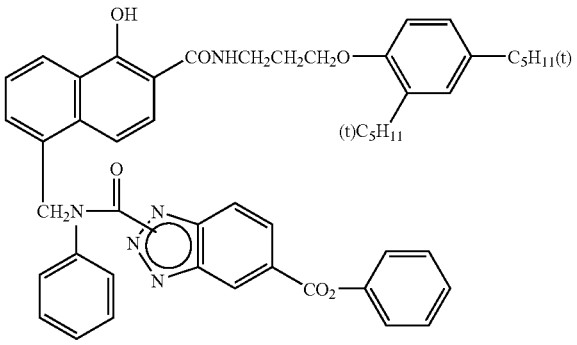
II-66
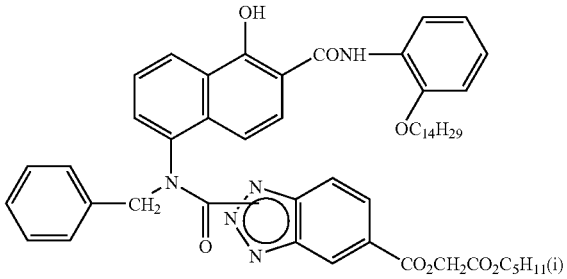
II-67
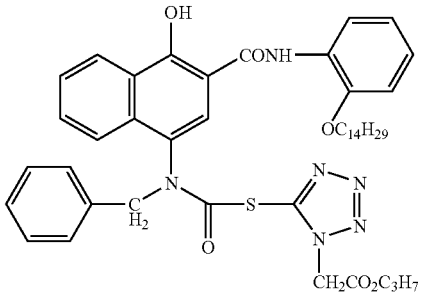
II-68
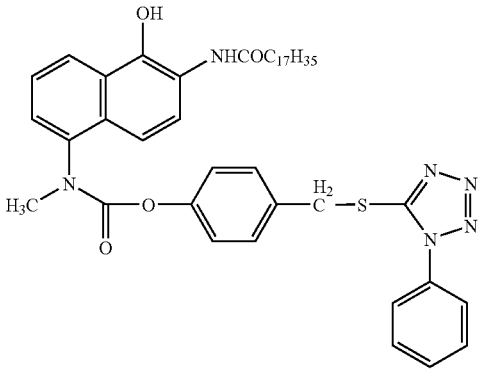
II-69
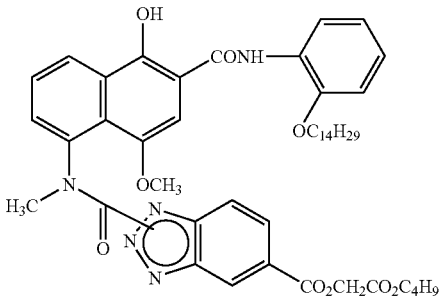

-continued
II-70
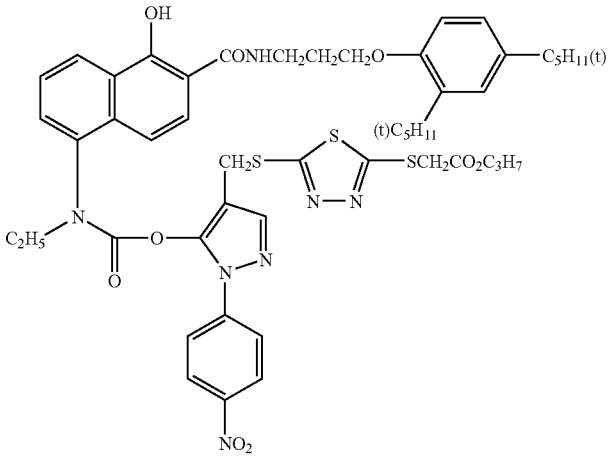
II-71
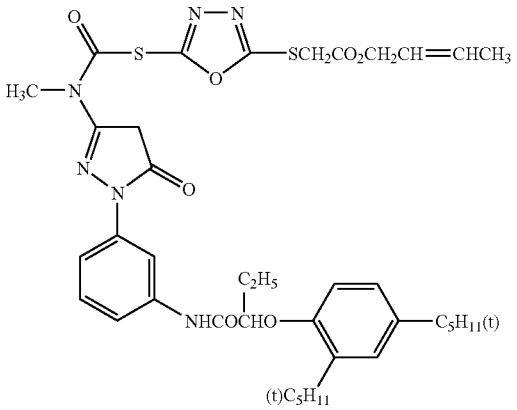
II-72
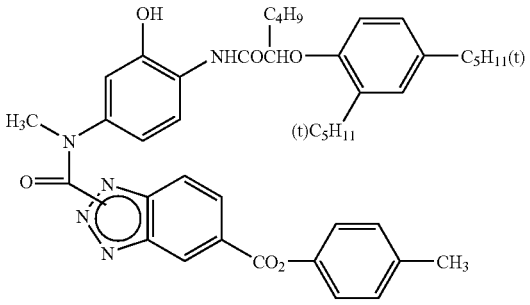
II-73
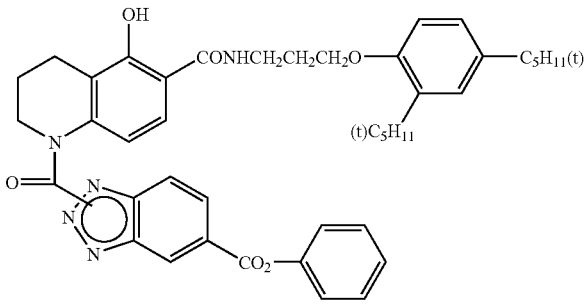

-continued
II-74
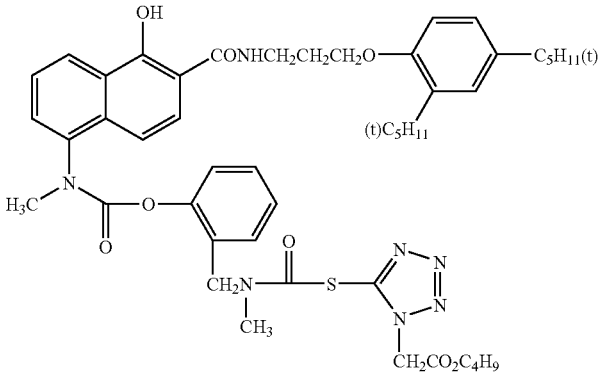
II-75
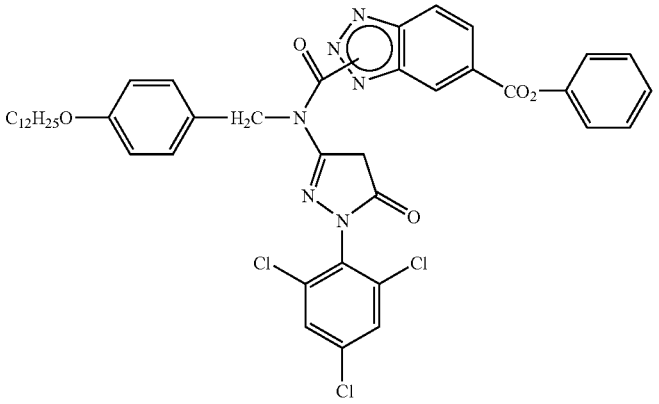
II-76
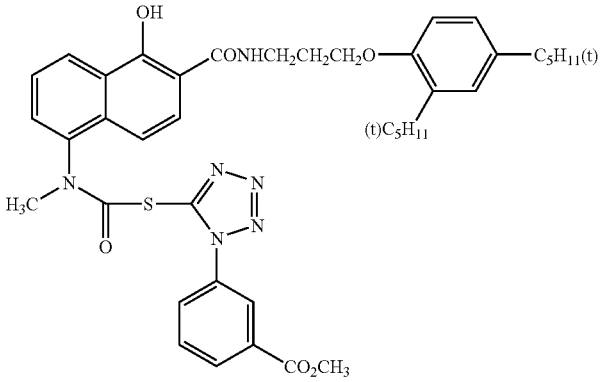
II-77
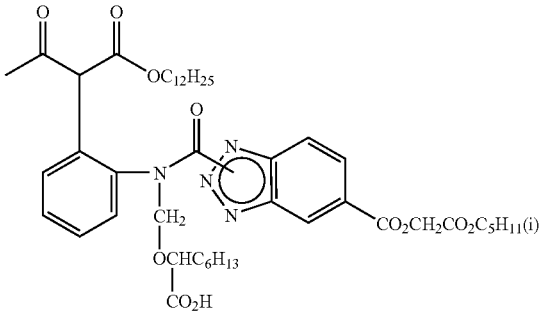

-continued
II-78
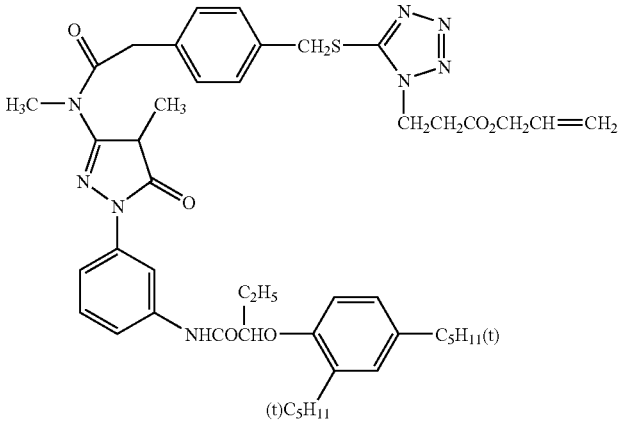
II-79
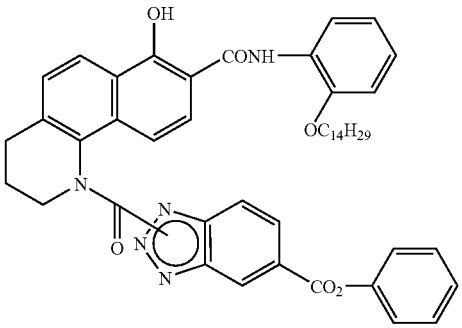
II-80
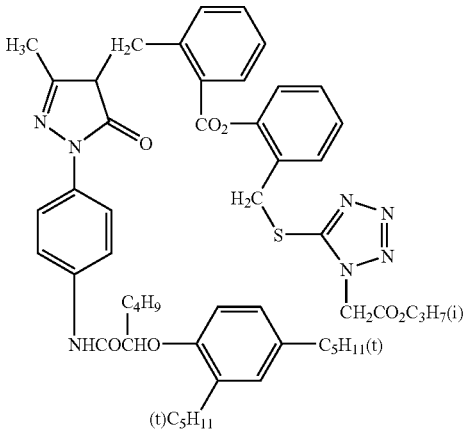
II-81
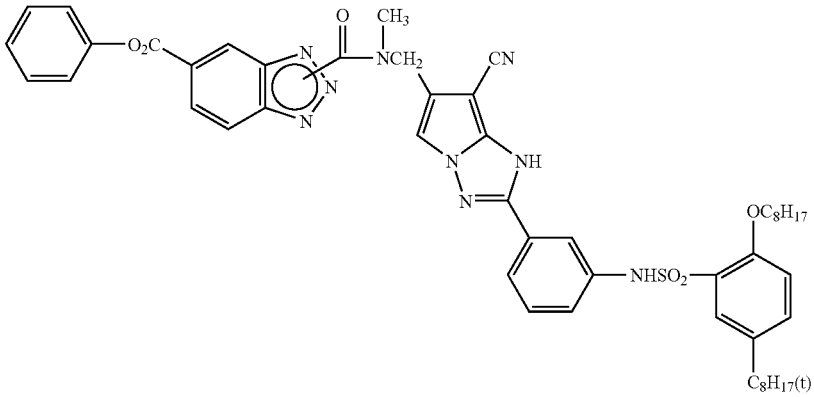

-continued
II-82
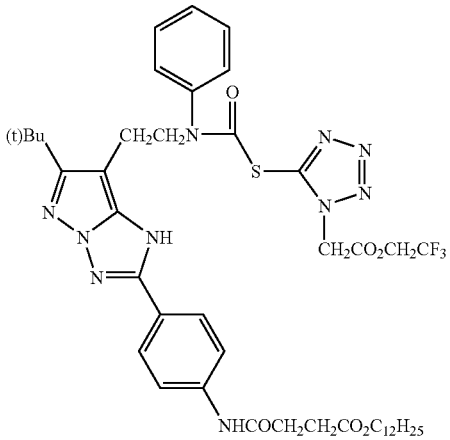
II-83
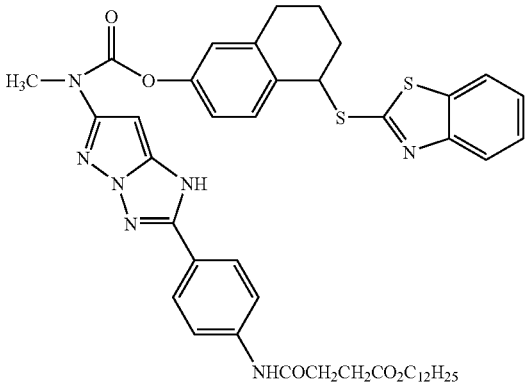
II-84
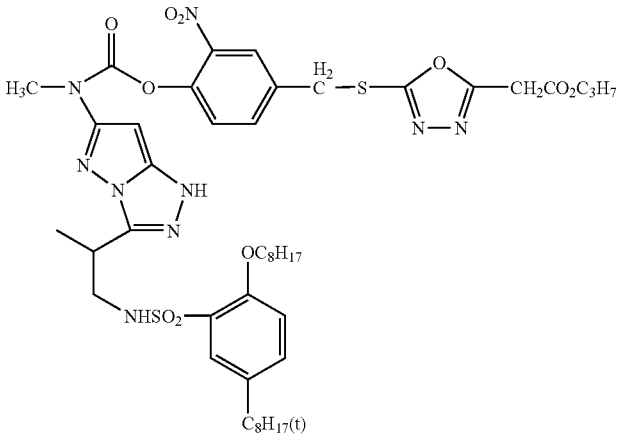
II-85
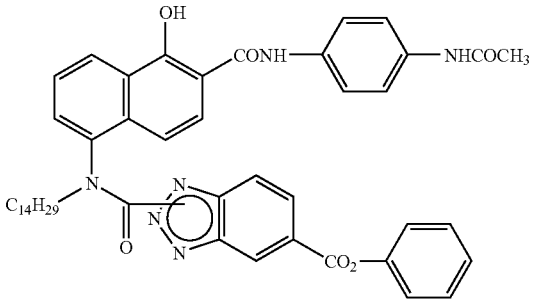

-continued
II-86
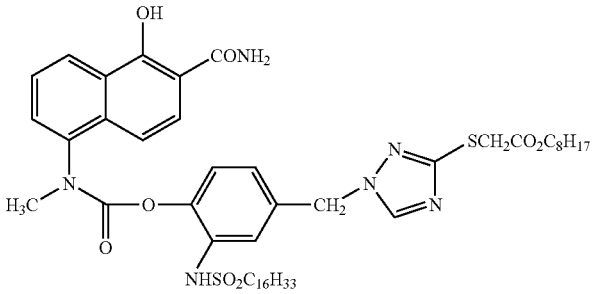
II-87
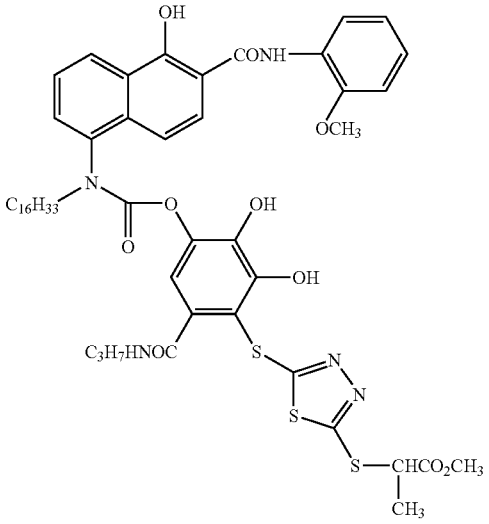
II-88
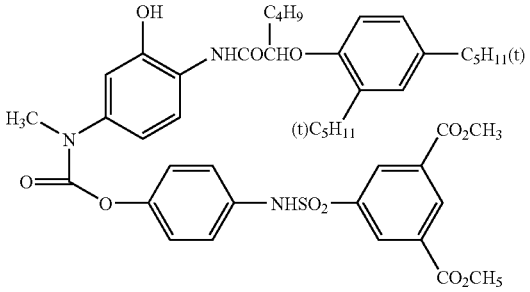
II-89
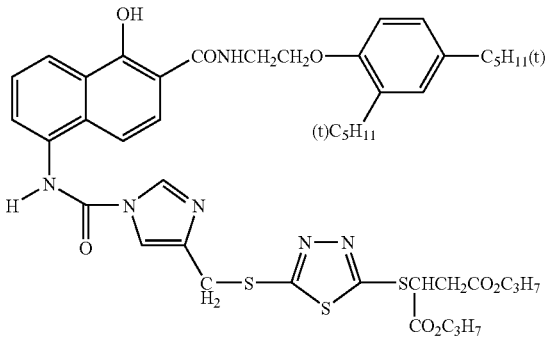

-continued
II-90
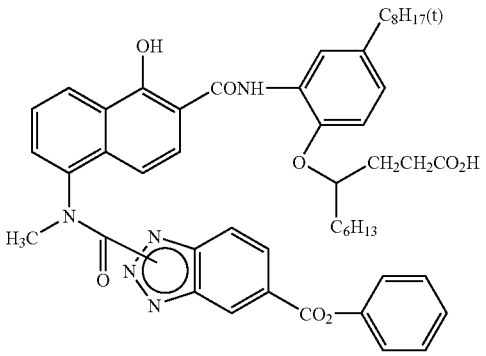
II-91
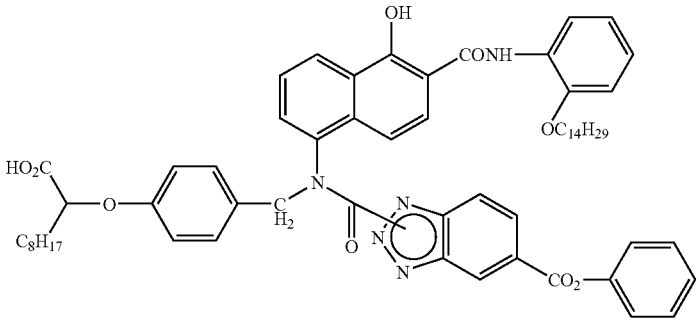
II-92
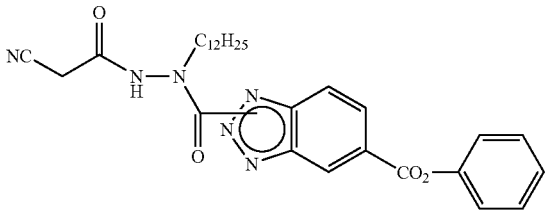
II-93
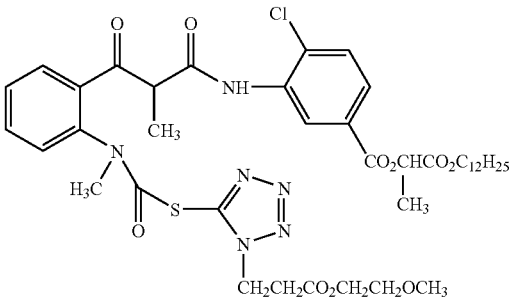
II-94
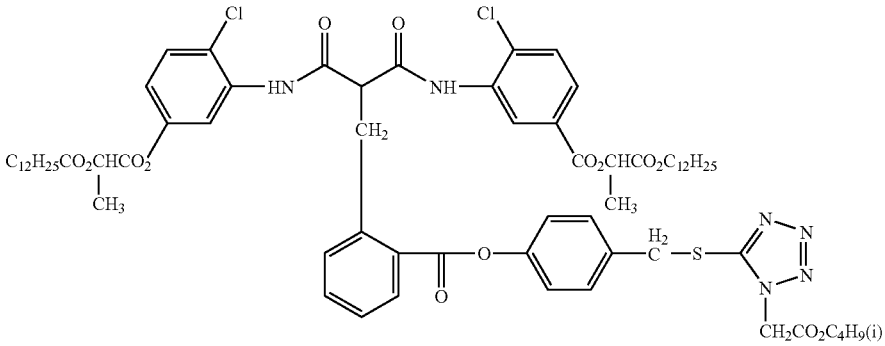

-continued
II-95
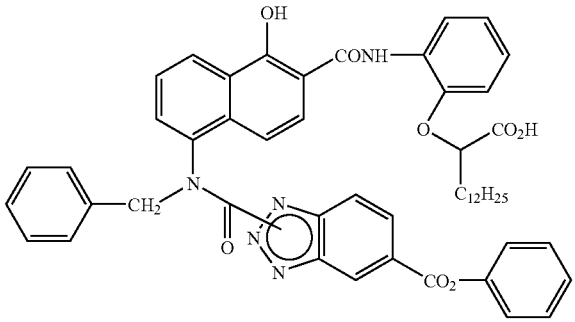
II-96
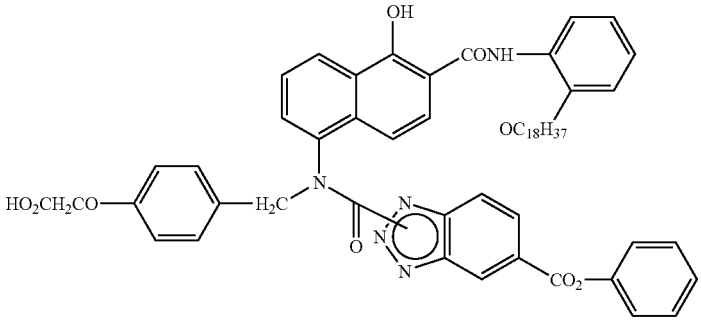
II-97
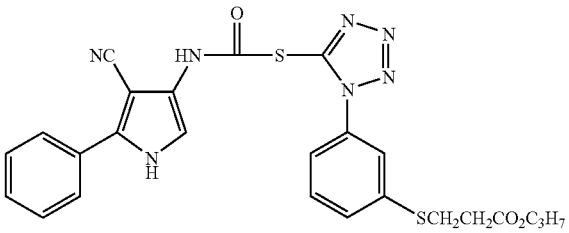
II-98
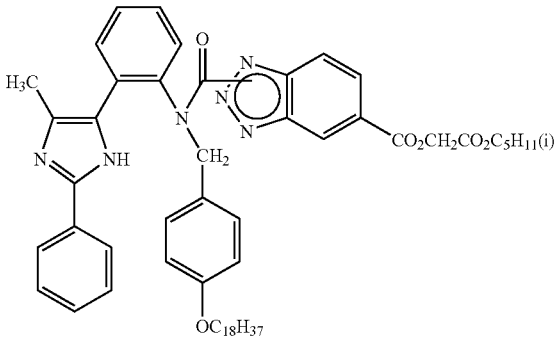

-continued
II-99
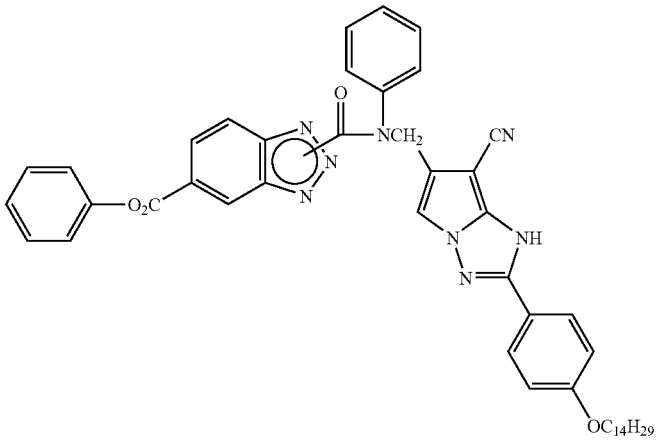
II-100
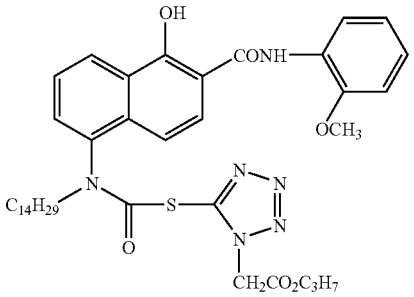
II-101
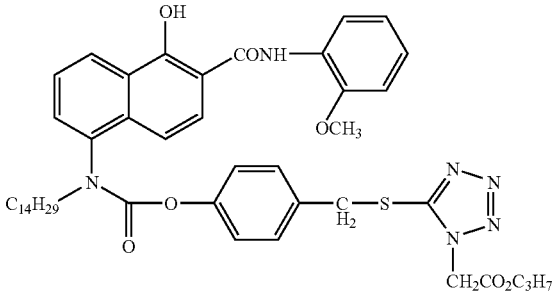
II-102
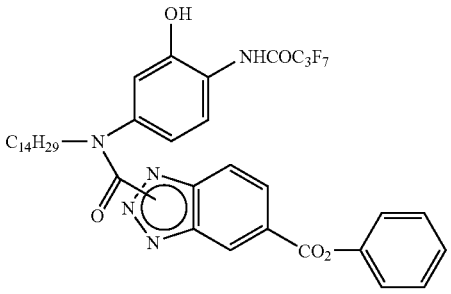

-continued
II-103
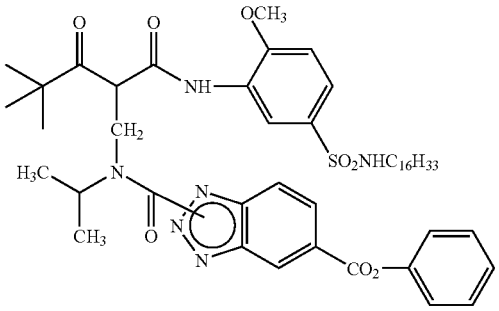
II-104
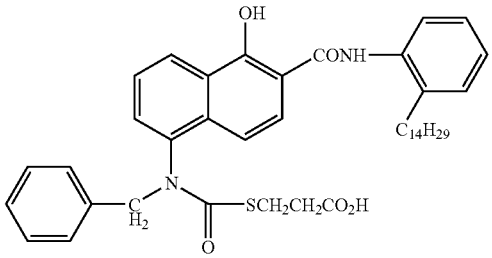
II-105
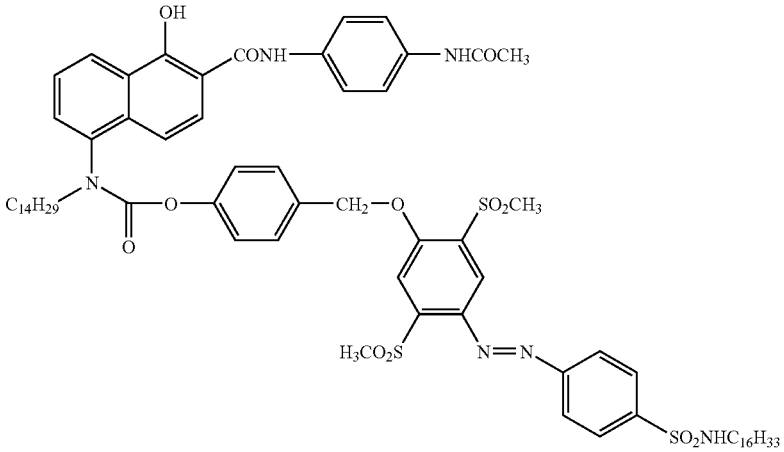
II-106
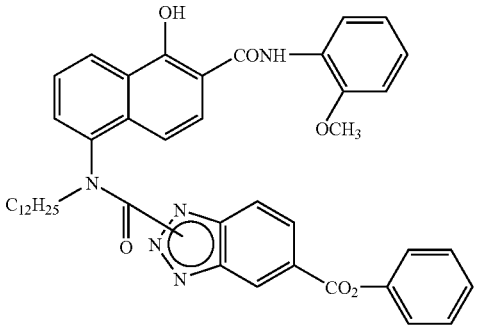

-continued
II-107
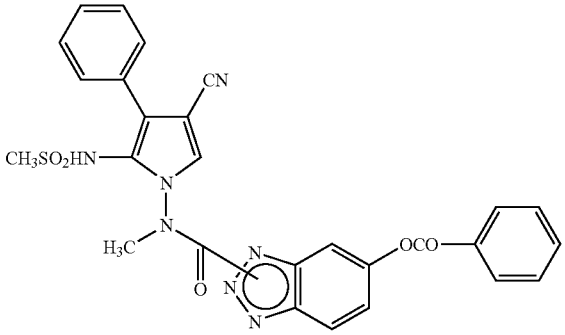
II-108
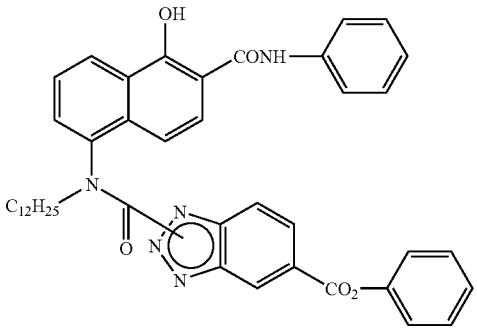
II-109
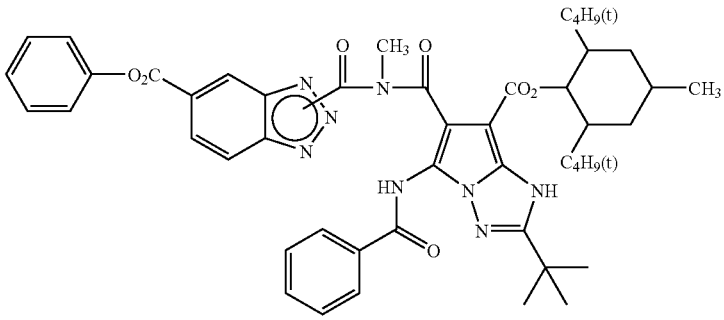
II-110
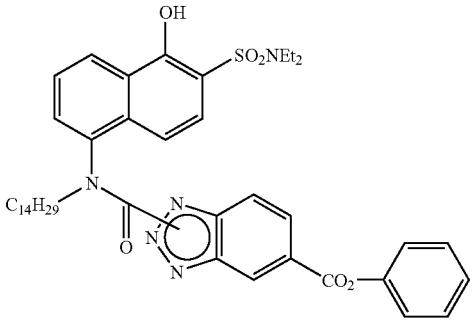

-continued
II-111
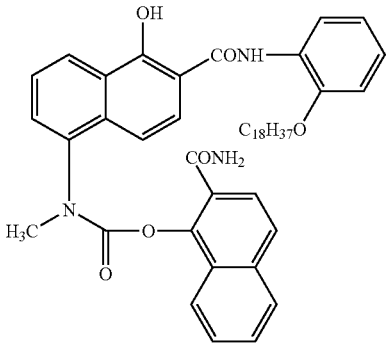
II-112
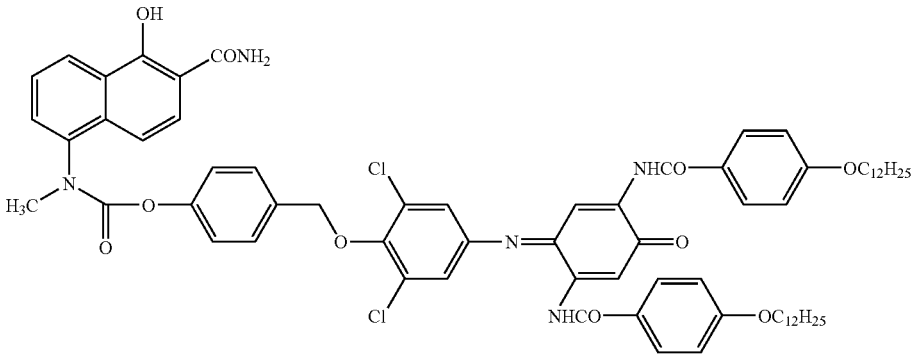
II-113
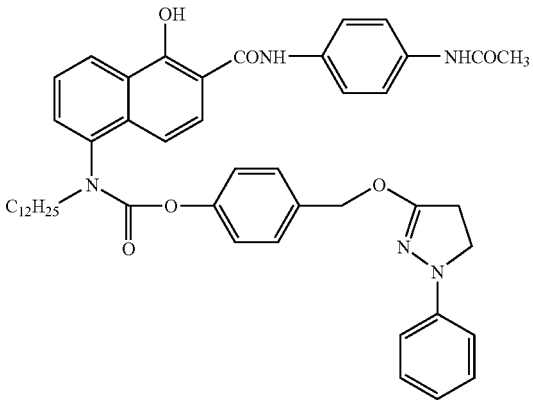
II-114
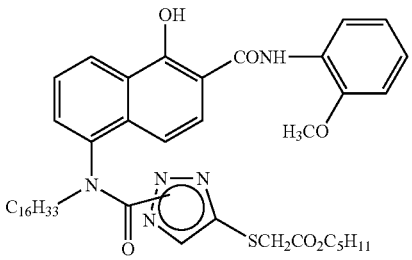

-continued
II-115
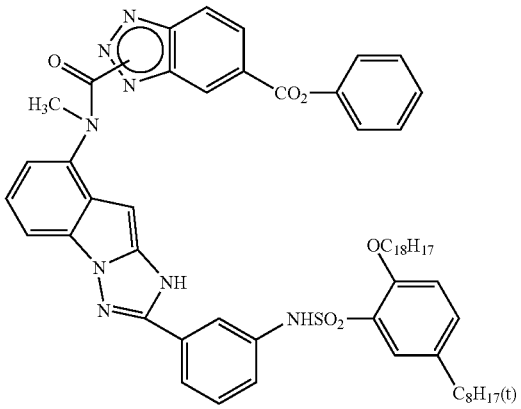
II-116
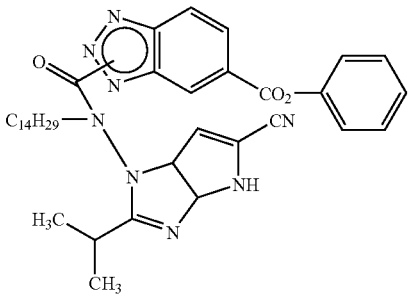
II-117
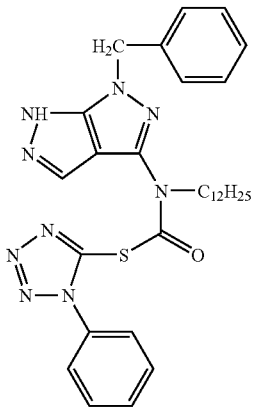
II-118
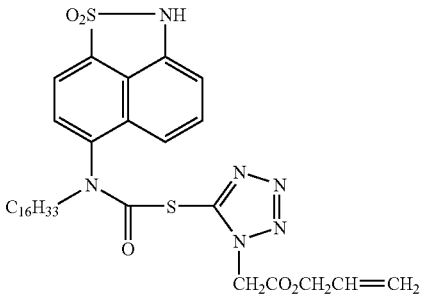

-continued
II-119
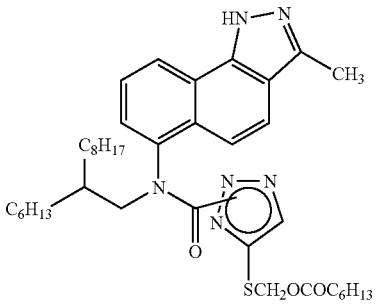
II-120
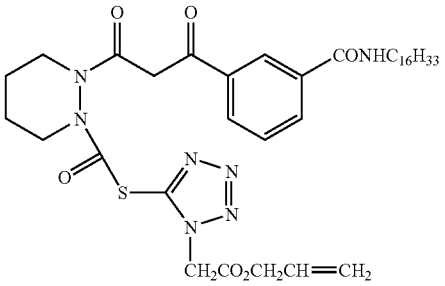
II-121
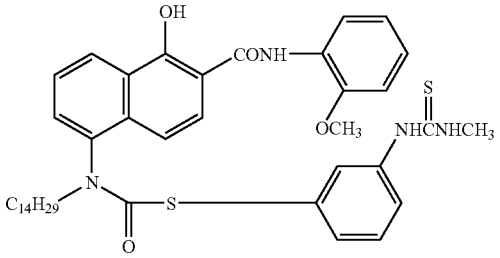
II-122
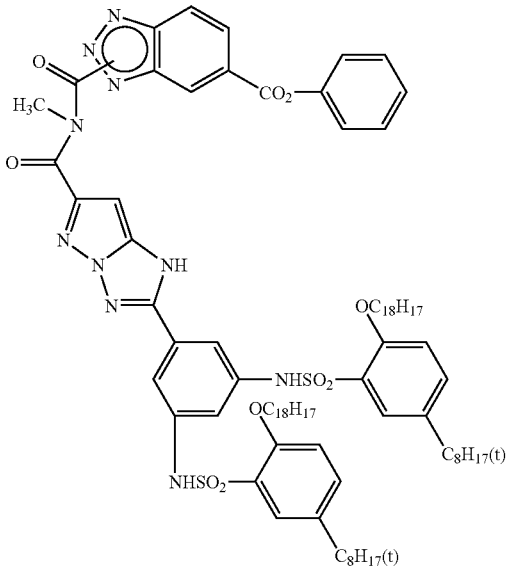

-continued
II-123
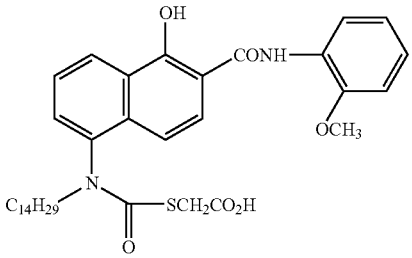
II-124
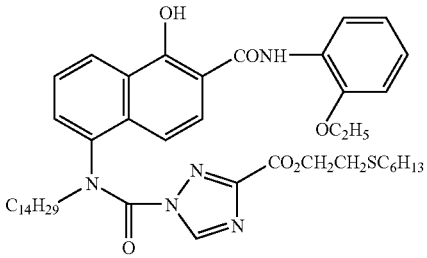
II-125
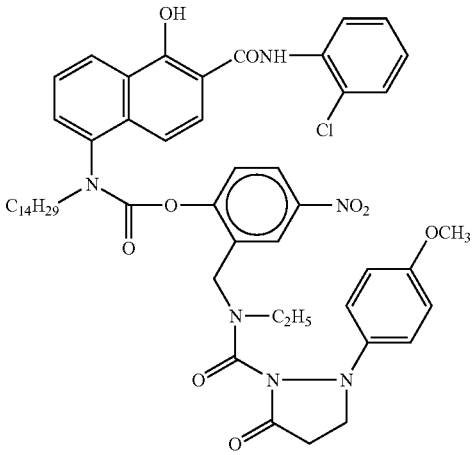
II-126
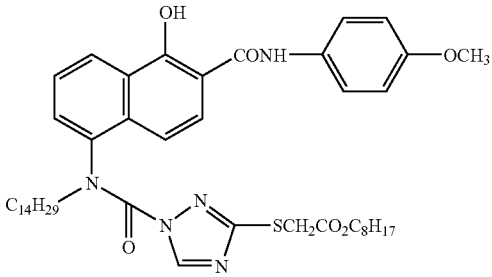
II-127
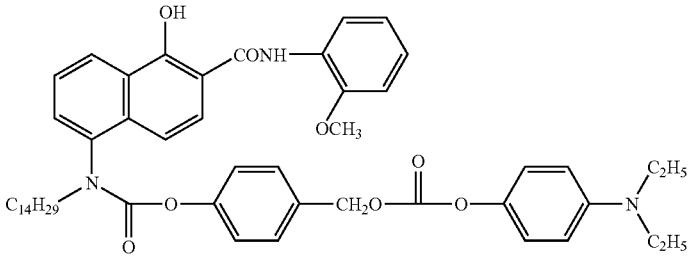

-continued
II-128
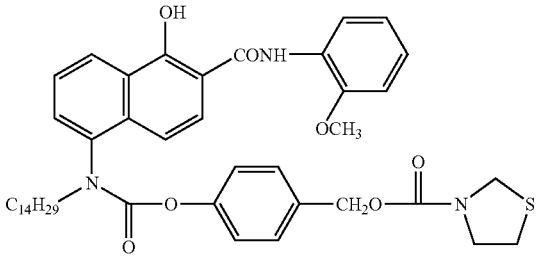
II-129
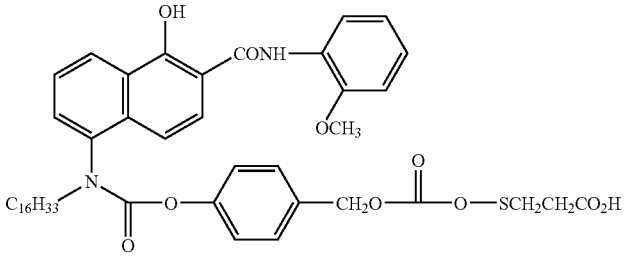
II-130
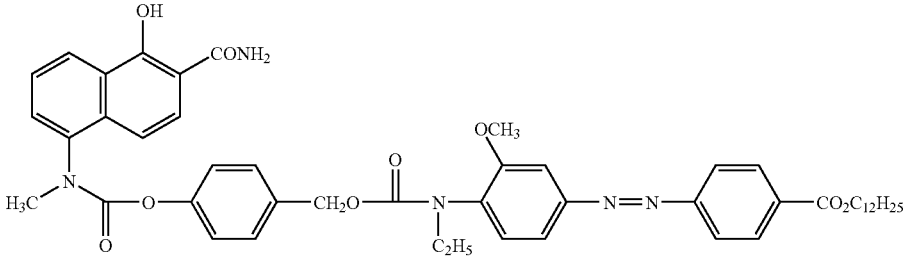
II-131
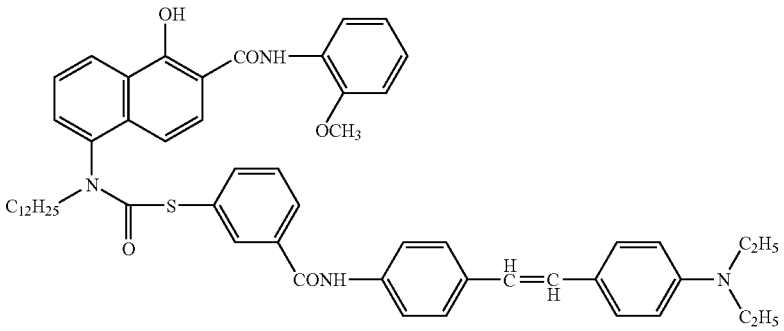
II-132
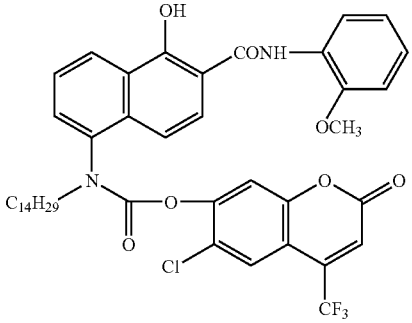

-continued
II-133
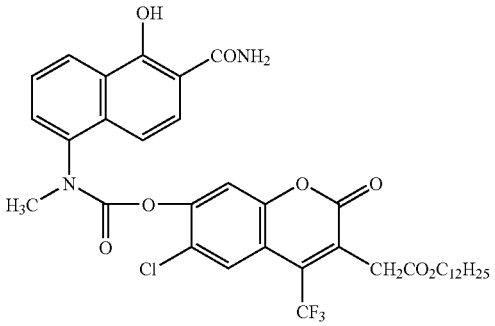
II-134
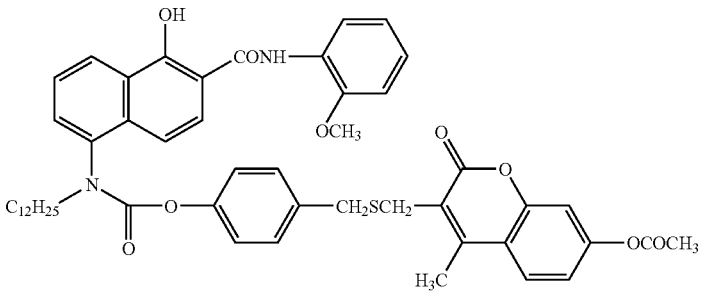
II-135
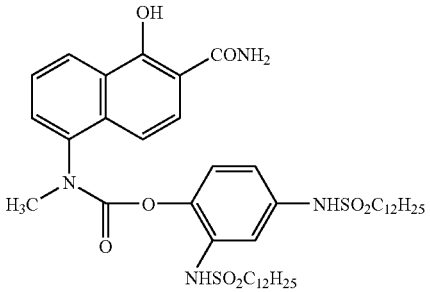
II-136
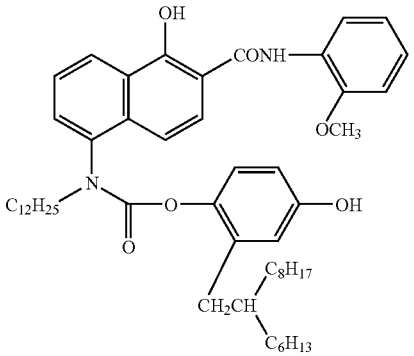
II-137
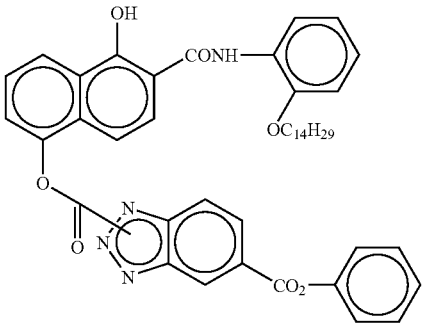

-continued
II-138
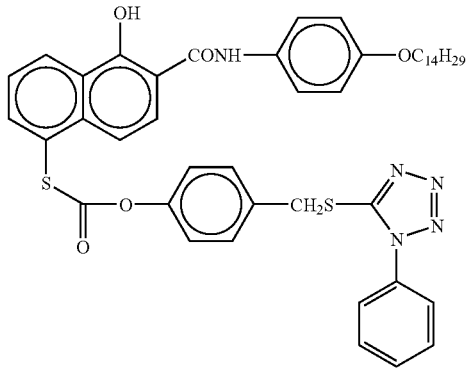
II-139
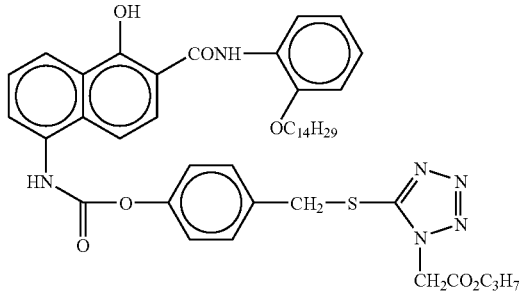
II-140
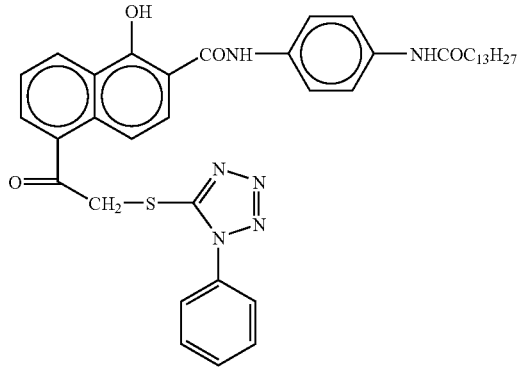
II-141
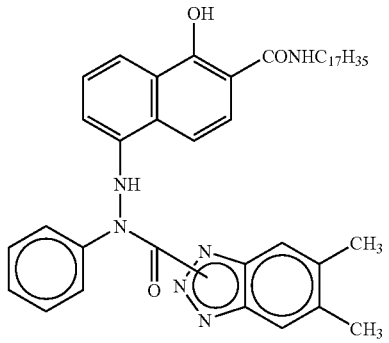

-continued
II-142
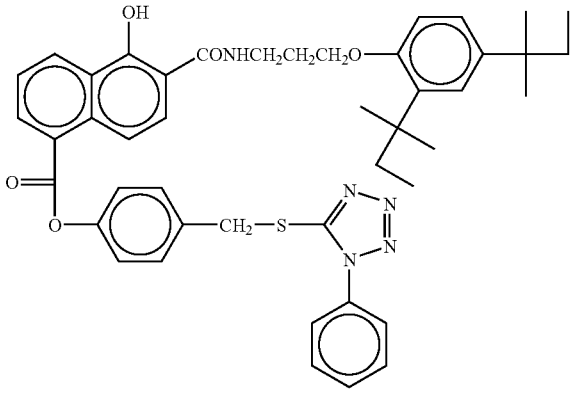
II-143
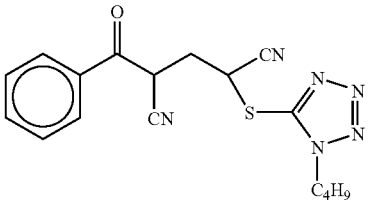
II-144
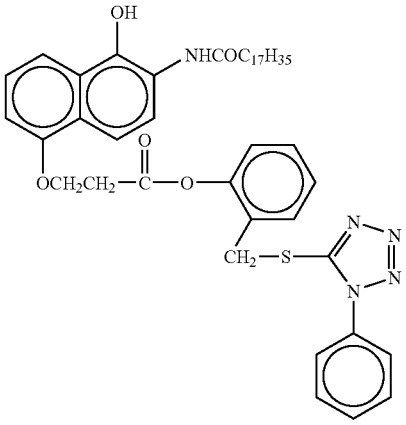
II-145
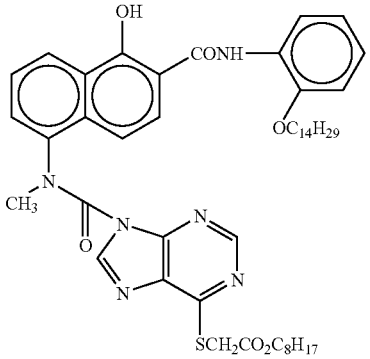

-continued
II-146
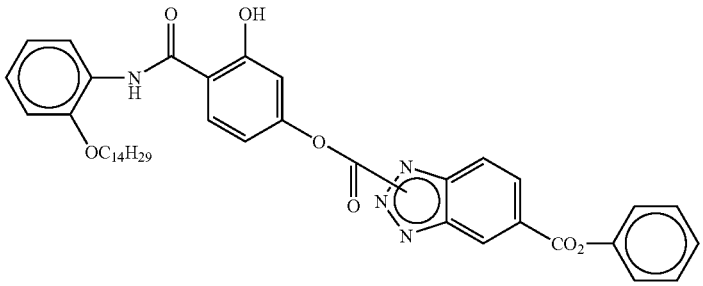
II-147
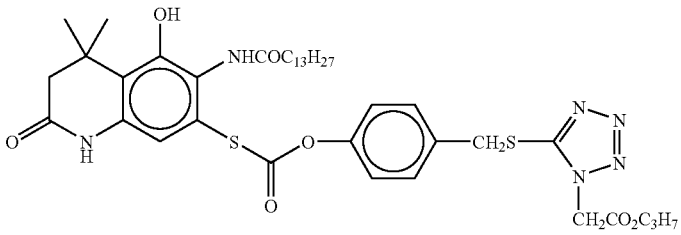
II-148
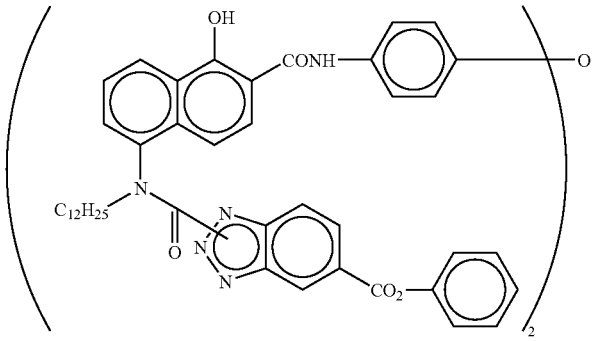
II-149
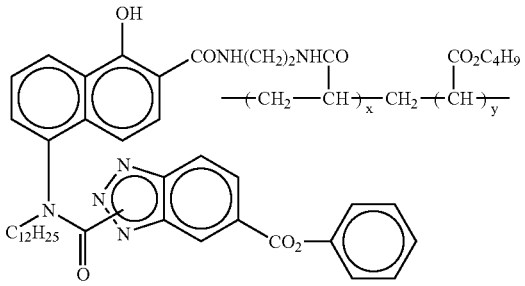
x:y = 70:30 (molar ratio)

Synthesis methods of the compounds represented by general formula (III) are described, for example, in JP-A's-58-162949, 63-37350, 4-356042, 5-61160, and 6-130594, and U.S. Pat. No. 5,234,800.

An example of a synthesis method of a compound represented by the general formula (III) is set forth below.

Synthesis of Coupler, Exemplified Compound (62)

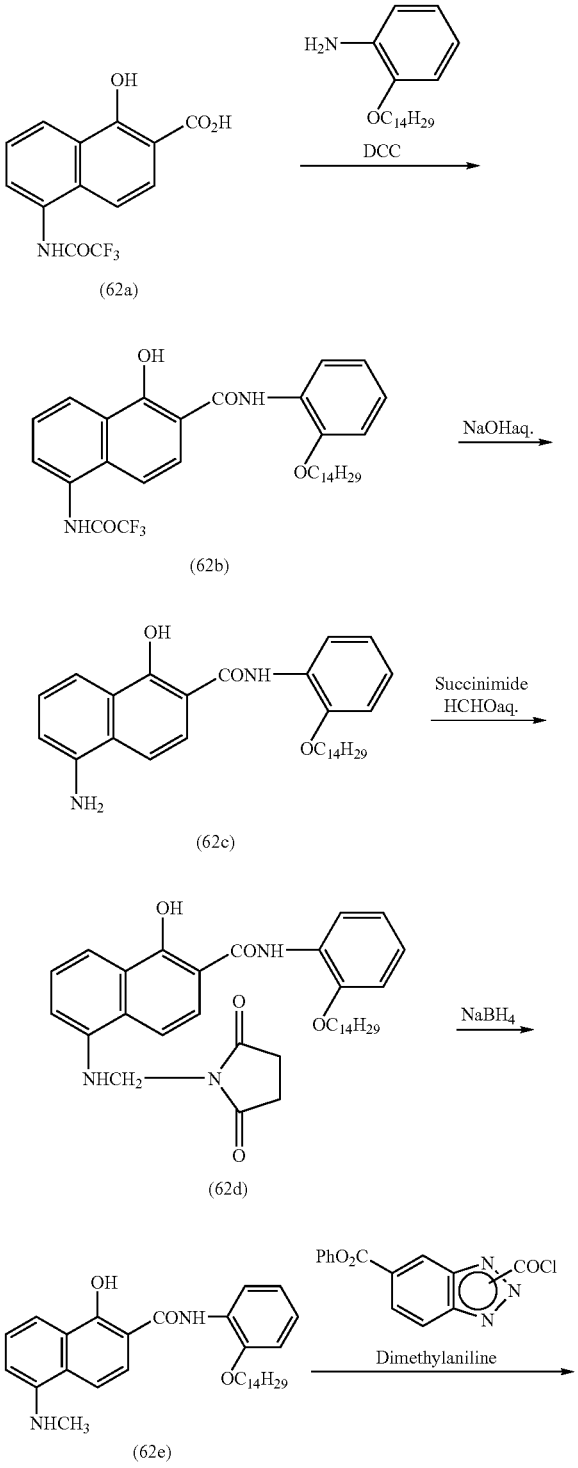

-continued

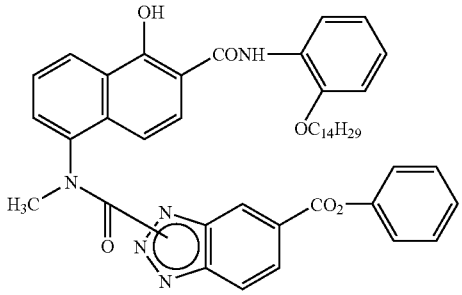

An N,N-dimethylacetamide (60 milliliters (to be referred to as "mL" hereinafter) solution of dicyclohexylcarbodiamide (41.3 g) was dropped into an N,N-dimethylacetamide (250 mL) solution of a compound 62a (50 g) and o-tetradecyloxyaniline (51.1 g) at 30° C. After the reaction solution was stirred at 50° C. for 1 hr, ethyl acetate (250 mL) was added, and the resultant solution was cooled to 20° C. The reaction solution was filtered by suction, and 1N hydrochloric acid aqueous solution (250 mL) was added to the filtrate to separate it. Hexane (100 mL) was added to the organic layer, and the separated crystals were filtered out, washed with acetonitrile, and dried to obtain a compound 62b (71 g).

Synthesis of Compound 62c

An aqueous solution (150 mL) of sodium hydroxide (30 g) was dropped into a methanol (350 mL)/tetrahydrofuran (70 mL) solution of the compound 62b (71 g). The resultant solution was stirred in a nitrogen atmosphere at 60° C. for 1 hr. After the reaction solution was cooled to 20° C., concentrated hydrochloric acid was dropped until the system became acidic. The separated crystals were filtered out, washed with water and followed by acetonitrile, and dried to obtain a compound 62c (63 g).

Synthesis of Compound 62d

An ethanol solution (150 mL) of the compound 62c (20 g), succinic acid imide (5.25 g), and an aqueous 37% formalin solution (4.3 mL) was stirred under reflux for 5 hrs. After the resultant solution was cooled to 20° C., the separated crystals were filtered out and dried to obtain a compound 62d (16 g).

Synthesis of Compound 62e

Sodium boron hydride (1.32 g) was slowly added to a dimethylsulfoxide (70 mL) solution of the compound 62d (7 g) at 60° C. such that the temperature did not exceed 70° C. The resultant solution was stirred at the same temperature for 15 min. After the reaction solution was slowly added to 1N hydrochloric acid aqueous solution (100 mL), ethyl acetate (100 mL) was added for extraction. The organic layer was washed with water, dried by magnesium sulfate, and condensed at reduced pressure. After a placing point component was removed by a short-passage column (developing solvent: ethyl acetate/hexane=2/1), the resultant material was recrystallized from the ethyl acetate/hexane system to obtain a compound 62e (3.3 g).

Synthesis of Compound (62)

A dichloromethane (100 mL)/ethyl acetate (200 mL) solution of phenoxycarbonylbenzotriazole (4.78 g) and N,N-dimethylaniline (2.42 g) was dropped into a dichloromethane (80 mL) solution of bis(trichloromethyl) carbonate (1.98 g). The resultant solution was stirred at 20° C. for 2 hrs (solution S).

120 mL of this solution S were dropped into a tetrahydrofuran (20 mL)/ethyl acetate (20 mL) solution of the compound 62e (2.0 g) and dimethylaniline (0.60 g). The resultant solution was stirred at 20° C. for 2 hrs. After the reaction solution was slowly added to 1N hydrochloric acid aqueous solution (200 mL), ethyl acetate (200 mL) was added for extraction. The organic layer was washed with water, dried by magnesium sulfate, and concentrated at reduced pressure. The resultant material was purified through a column (developing solvent: ethyl acetate/hexane=1/5) and recrystallized from the ethyl acetate/hexane system to obtain a compound example (62) weighing 1.3 g (m.p.=138 to 140° C.) (the compound was identified by elementary analysis, NMR, and mass spectrum).

Although any surfactant having a critical micelle concentration of $4.0\times10^{-3}$ mol/L or less can be used in the present invention, preferred are those which function as dispersing agents for high boiling organic solvents. More preferable surfactants for use in the present invention include anionic surfactants such as sulfoalkyl and sulfoaryl, nonionic surfactants such as alkyl polyethylene oxide, and betaine surfactants such as sulfoalkylammonium. Polymer surfactants comprising polymers with functional groups bonded can also be used. The critical micelle concentration used herein is defined as a concentration at which a concentration-surface tension curve reaches the minimum surface tension. The concentration-surface tension curve is obtained through a process comprising preparing solutions with varied concentrations of a surfactant and plotting values of surface tension measured at every concentrations with SURFACE TENSIOMETER A3 manufactured by Kyowa Kagaku Co., Ltd., versus logarithms of the concentrations. The critical micelle concentration is the minimum concentration at which the surfactant can form micelle; the less the value thereof, the better surface activating property.

In the present invention, the content of a surfactant used in a lightsensitive material is preferably 0.01% by weight or more, and more preferably 0.02% by weight or more of all the ingredients contained in a lightsensitive layer in which the surfactant is contained. The content of a surfactant in a lightsensitive material is preferably 5% by weight or less.

Only specific examples of surfactants that can be used in the present invention are presented below, but the invention, of course, is not limited to these them.

| | | Critical micelle concentration (mol/L) |
|---|---|---|
| A-1 | 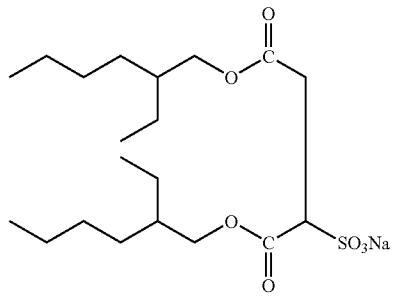 | $2.25\times10^{-3}$ |
| A-2 | 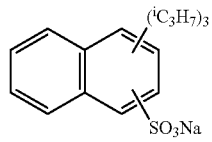 | $3.65\times10^{-3}$ |
| A-3 | 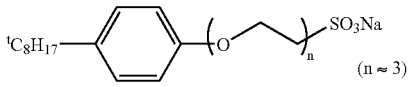 | $0.16\times10^{-3}$ |
| A-4 | $C_{12}H_{25}OSO_3Na$ | $1.73\times10^{-3}$ |
| A-5 | 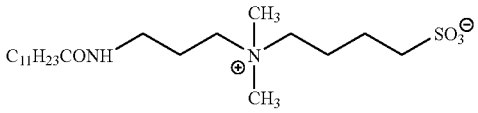 | $1.19\times10^{-3}$ |
| A-6 | 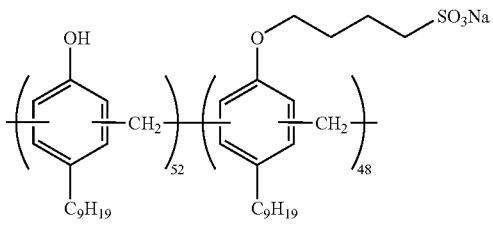 | $4.46\times10^{-3}$ |

-continued

| | | Critical micelle concentration (mol/L) |
|---|---|---|
| A-7 | 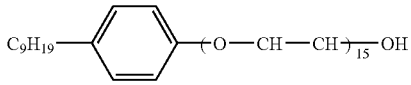 | $0.12 \times 10^{-3}$ |
| A-8 | 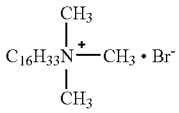 | $1.0 \times 10^{-3}$ |

As a high boiling organic solvent that can be used in the present invention, a high boiling organic solvent having a dielectric constant of 7.0 or less is preferable. It can be selected from high boiling organic solvents having a boiling point of about 175° C. or higher under atmospheric pressure such as phthalic esters, phosphoric esters, phosphonic esters, benzoic esters, esters of fatty acids, amides, phenols, alcohols, ethers, carboxylic acids, N,N-dialkylanilines, trialkylamines, hydrocarbons, oligomers and polymers. When two or more high boiling organic solvents are used after being mixed, if the mixture after mixing has a dielectric constant of 7.0 or less, it corresponds to the high boiling organic solvent.

Further, such a high boiling organic solvent having a dielectric constant of 7.0 or less can be used after being mixed with a high boiling organic solvent having a dielectric constant of more than 7.0. In such a case, if the dielectric constant after mixing is 7.0 or less, the mixture corresponds to a high boiling organic solvent having a dielectric constant of 7.0 or less. The dielectric constant used herein refers to a specific inductive capacity with respect to vacuum, measured by a transformer bridge at a measuring temperature of 25° C., a measuring frequency of 10 kHz using a TRS-10T dielectric constant measuring device manufactured by Ando Electric Co., Ltd. The dielectric constant of organic solvents correlate to the square of the dipolar moment molecules of organic solvents and therefore represents the degree of the polarity of molecules. In general, a molecule with a high dielectric constant has a high polarity.

High boiling organic solvents preferably used in the present invention are high boiling organic solvents having a dielectric constant of 7.0 or less and represented by the following general formulas [S-1] to [S-8].

[S-1]

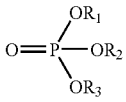

[S-2]

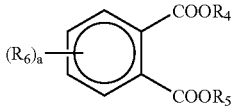

[S-3]

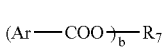

[S-4]

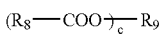

-continued

[S-5]

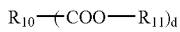

[S-6]

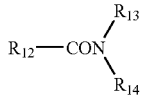

[S-7]

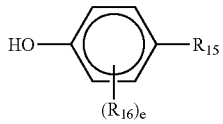

[S-8]

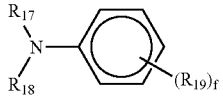

In formula [S-1], $R_1$, $R_2$ and $R_3$ each independently represent an aliphatic hydrocarbon group, an alicyclic hydrocarbon group or an aryl group. In formula [S-2], $R_4$ and $R_5$ each independently represent an aliphatic hydrocarbon group, an alicyclic hydrocarbon group or an aryl group, $R_6$ represents a halogen atom (F, Cl, Br, I; the same below), an aliphatic hydrocarbon group, an aliphatic hydrocarbon oxy group, an aryloxy group, or an aliphatic hydrocarbon oxycarbonyl group, and a represents an integer of 0 to 3. When a is 2 or more, plural $R_6$s may be the same or different.

In formula [S-3], Ar represents an aryl group, b represents an integer of 1 to 6, and $R_7$ represents a b-valent hydrocarbon group or a hydrocarbon groups bonded together through an ether bond. In formula [S-4], $R_8$ represents an aliphatic hydrocarbon group or an alicyclic hydrocarbon group, c represents an integer of 1 to 6, and $R_9$ represents a c-valent hydrocarbon group or hydrocarbon groups bonded together through an ether bond. In formula [S-5], d represents an integer of 2 to 6, $R_{10}$ represents a d-valent hydrocarbon group (except aromatic groups), and $R_{11}$ represents an aliphatic hydrocarbon group, an alicyclic hydrocarbon group or an aryl group. In formula [S-6], $R_{12}$, $R_{13}$ and $R_{14}$ each independently represent an aliphatic hydrocarbon group, an alicyclic hydrocarbon group or an aryl group. $R_{12}$ and $R_{13}$, or $R_{13}$ and $R_{14}$ may be bonded together to form a ring.

In formula [S-7], $R_{15}$ represents an aliphatic hydrocarbon group, an alicyclic hydrocarbon group, an aliphatic hydrocarbon oxycarbonyl group, an aliphatic hydrocarbon sulfonyl group, an arylsulfonyl group, an aryl group or a cyano group, $R_{16}$ represents a halogen atom, an aliphatic hydrocarbon group, an alicyclic hydrocarbon group, an aryl group, an alkoxy group or an aryloxy group, and e represents an integer of 0 to 3. When e is 2 or more, plural $R_{16}$s may be the same or different.

In formula [S-8], $R_{17}$ and $R_{18}$ each independently represent an aliphatic hydrocarbon group, an alicyclic hydrocarbon group or an aryl group, $R_{19}$ represents a halogen atom, an aliphatic hydrocarbon group, an alicyclic hydrocarbon group, an aryloxy group or an aliphatic hydrocarbon oxy group, and f represents an integer of 0 to 4. When f is 2 or more, plural $R_{19}$ may be the same or different. In formulas [S-1] to [S-8], when $R_1$ to $R_6$, $R_8$ and $R_{11}$ to $R_{19}$ are aliphatic hydrocarbon groups or groups containing an aliphatic hydrocarbon group, an alkyl group may be either straight chain or branched, and may have an unsaturated bond and also may have a substituent. Examples of the substituent include a halogen atom, an aryl group, an alkoxy group, an aryloxy group, an alkoxycarbonyl group, a hydroxyl group, an acyloxy group and an epoxy group.

In formulas [S-1] to [S-8], when $R_1$ to $R_6$, $R_8$ and $R_{11}$ to $R_{19}$ are alicyclic hydrocarbon groups or groups containing an alicyclic hydrocarbon group, each alicyclic hydrocarbon group may contain an unsaturated bond in its 3- to 8-membered ring, and may have a substituent or a cross-linking group. Examples of the substituent include a halogen atom, a hydroxyl group, an acyl group, an aryl group, an alkoxy group, an epoxy group and an alkyl group. Examples of the cross-linking group include methylene, ethylene and isopropylidene.

In formulas [S-1] to [S-8], when $R_1$ to $R_6$, $R_8$ and $R_{11}$ to $R_{19}$ are aryl groups or groups containing an aryl group, each aryl group may be substituted with a substituent such as a halogen atom, an alkyl group, an aryl group, an alkoxy group, an aryloxy group and an alkoxycarbonyl group.

In formulas [S-3], [S-4] and [S-5], when $R_7$, $R_9$ or $R_{10}$ is a hydrocarbon group, the hydrocarbon group may contain a cyclic structure (e.g., a benzene ring, a cyclopentane ring and a cyclohexane ring) or an unsaturated bond, and also may have a substituent. Examples of the substituent include a halogen atom, a hydroxyl group, an acyloxy group, an aryl group, an alkoxy group, an aryloxy group and an epoxy group.

In formula [S-1], examples of $R_1$, $R_2$ and $R_3$ include an aliphatic hydrocarbon group having a total number of carbon atoms of 1–24 (preferably 4–18), hereinafter, the total number of carbon atoms is referred to as C number, (e.g., n-butyl, 2-ethylhexyl, 3,3,5-trimethylhexyl, n-dodecyl, n-octadecyl, benzyl, 2-chloroethyl, 2,3-dichloropropyl, 2-butoxyethyl and 2-phenoxyethyl), an alicyclic hydrocarbon group of a C number of 5–24 (preferably, 6–18) (e.g., cyclopentyl, cyclohexyl, 4-t-butylcyclohexyl and 4-methylcyclohexyl), or an aryl group having a C number of 6–24 (preferably 6–18) (e.g., phenyl, cresyl, p-nonylphenyl, xylyl, cumenyl, p-methoxyphenyl and p-methoxycarbonylphenyl).

In formula [S-2], examples of $R_4$ and $R_5$ include an aliphatic hydrocarbon group having a C number of 1–24 (preferably, 4–18) (e.g., groups the same as the aliphatic hydrocarbon groups mentioned above for $R_1$, ethoxycarbonylmethyl, 1,1-diethylpropyl, 2-ethyl-1-methylhexyl, cyclohexylmethyl and 1-ethyl-1,5-dimethylhexyl), an alicyclic hydrocarbon group having a C number of 5–24 (preferably, 6–18) (e.g., groups the same as the alicyclic hydrocarbon groups mentioned above for $R_1$, 3,3,5-trimethylcyclohexyl, menthyl, bornyl and 1-methylcyclohexyl), or an aryl group having a C number of 6–24 (preferably, 6–18) (e.g., the aryl groups mentioned above for $R_1$, 4-t-butylphenyl, 4-t-octylphenyl, 1,3,5-trimethylphenyl, 2,4-di-t-butylphenyl and 2,4-di-t-pentylphenyl); examples of $R_6$ include a halogen atom (preferably, Cl), an aliphatic hydrocarbon group having a C number of 1–18 (e.g., methyl, isopropyl, t-butyl and n-dodecyl), an aliphatic hydrocarbon oxy group having a C number of 1–18 (e.g., methoxy, n-butoxy, n-octyloxy, methoxyethoxy and benzyloxy), an aryloxy group having a C number of 6–18 (e.g., phenoxy, p-tolyloxy, 4-methoxyphenoxy and 4-t-butylphenoxy), or an aliphatic hydrocarbon oxycarbonyl group having a C number of 2–19 (e.g., methoxycarbonyl, n-butoxycarbonyl and 2-ethylhexyloxycarbonyl); and a is 0 to 3 (preferably, 0 or 1).

In formula [S-3], examples of Ar include an aryl group having a C number of 6–24 (preferably, 6–18) (e.g., phenyl, 4-chlorophenyl, 4-methoxyphenyl, 1-naphthyl, 4-n-butoxyphenyl and 1,3,5-trimethylphenyl), b is an integer of 1 to 6 (preferably, 1 to 3), examples of $R_7$ include a b-valent hydrocarbon group having a C number of 2–24 (preferably, 2–18) [e.g., the aliphatic hydrocarbon groups, alicyclic hydrocarbon groups, aryl groups, mentioned above for $R_4$, $—(CH_2)_2—$,

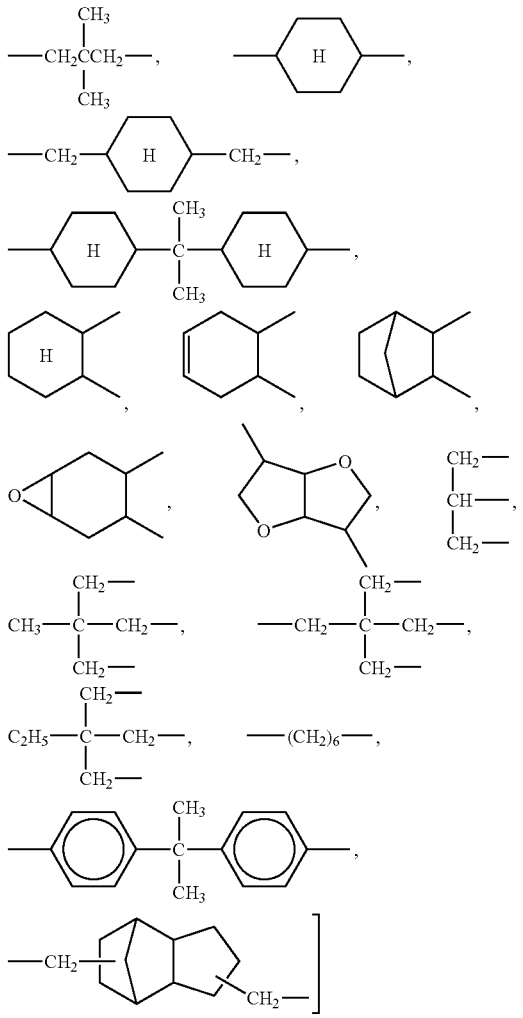

or c-valent hydrocarbon groups having a C number of 4–24 (preferably, 4–18) bonded together through an ether bond, [e.g., $—CH_2CH_2OCH_2CH_2—$, $—CH_2CH_2(OCH_2CH_2)_3—$, $—CH_2CH_2CH_2OCH_2CH_2CH_2—$,

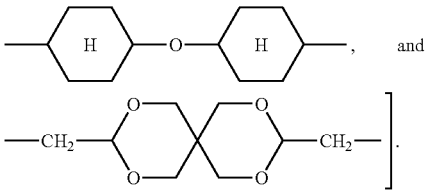

In formula [S-4], examples of $R_8$ include an aliphatic hydrocarbon group having a C number of 1–24 (preferably, 1–17) (e.g., methyl, n-propyl, 1-hydroxyethyl, 1-ethylpentyl, n-undecyl, pentadecyl and 8,9-epoxyheptadecyl), or an alicyclic hydrocarbon group having a C number of 3–24 (preferably, 6–18) (e.g., cyclopropyl, cyclohexyl and 4-methylcyclohexyl), c is an integer of 1 to 6 (preferably, 1 to 3), examples of $R_9$ include a c-valent hydrocarbon group having a C number of 2–24 (preferably, 2–18) or a c-valent hydrocarbon group having a C number of 4–24 (preferably, 4–18) bonded together through an ether bond, (e.g., the groups presented for the aforementioned $R_7$).

In formula [S-5], d is 2 to 6 (preferably, 2 or 3), examples of $R_{10}$ include a d-valent hydrocarbon group [e.g.,

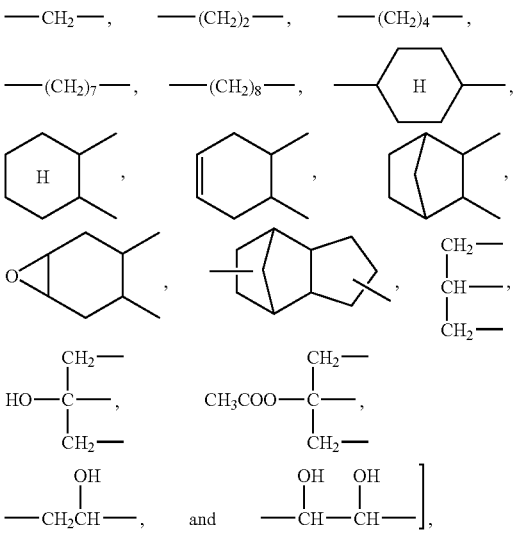

examples of $R_{11}$ include an aliphatic hydrocarbon group having a C number of 1–24 (preferably, 4–18), an alicyclic hydrocarbon group having a C number of 5–24 (preferably, 6–18) or an aryl group having a C number of 6–24 (preferably, 6–18) (e.g., the alkyl, cycloalkyl and aryl groups presented for the aforementioned $R_4$).

In formula [S-6], examples of $R_{12}$ include an aliphatic hydrocarbon group having a C number of 1–24 (preferably, 3–20) [e.g., n-propyl, 1-ethylpentyl, n-undecyl, n-pentadecyl, 2,4-di-t-pentylphenoxymethyl, 4-t-octylphenoxymethyl, 3-(2,4-di-t-butylphenoxy)propyl and 1-(2,4-di-t-butylphenoxy)propyl], an alicyclic hydrocarbon group having a C number of 5–24 (preferably, 6–18) (e.g., cyclohexyl and 4-methylcyclohexyl) or an aryl group having a C number of 6–24 (preferably, 6–18) (e.g., the aryl groups presented for the aforementioned Ar), examples of $R_{13}$ and $R_{14}$ include an aliphatic hydrocarbon group having a C number of 1–24 (preferably, 1–18) (e.g., methyl, ethyl, isopropyl, n-butyl, n-hexyl, 2-ethyl hexyl and n-dodecyl), an alicyclic hydrocarbon group having a C number of 5–18 (preferably, 6–15) (e.g., cyclopentyl and cyclopropyl) or an aryl group having a C number of 6–18 (preferably, 6–15) (e.g., phenyl, 1-naphthyl and p-tolyl). $R_{13}$ and $R_{14}$ may be bonded together to form together N a pyrrolidine ring, a piperidine ring or a morpholine ring. $R_{12}$ and $R_{13}$ may be bonded together to form a pyrrolidone ring.

In formula [S-7], examples of $R_{15}$ include an aliphatic hydrocarbon group having a C number of 1–24 (preferably, 1–18) (e.g., methyl, isopropyl, t-butyl, t-pentyl, t-hexyl, t-octyl, 2-butyl, 2-hexyl, 2-octyl, 2-dodecyl, 2-hexadecyl and t-pentadecyl), an alicyclic hydrocarbon group having a C number of 3–18 (preferably, 5–12) (e.g., cyclopentyl and cyclohexyl), an aliphatic hydrocarbon oxycarbonyl group having a C number of 2–24 (preferably, 5–17) (e.g., n-butoxycarbonyl, 2-ethylhexyloxycarbonyl and n-dodecyloxycarbonyl), an aliphatic hydrocarbon sulfonyl group having a C number of 1–24 (preferably, 1–18) (e.g., methylsulfonyl, n-butylsulfonyl and n-dodecylsulfonyl), an arylsulfonyl group having a C number of 6–30 (preferably, 6–24) (e.g., p-tolylsulfonyl, p-dodecylphenylsulfonyl, phexadecyloxyphenylsulfonyl), an aryl group having a C number of 6–32 (preferably, 6–24) (e.g., phenyl and p-tolyl) or a cyano group. Examples of $R_{16}$ include a halogen atom (preferably, Cl), an aliphatic hydrocarbon group having a C number of 1–24 (preferably, 1–18) (e.g., the aliphatic hydrocarbon groups presented for the aforementioned $R_{15}$), an alicyclic hydrocarbon group having a C number of 3–18 (preferably, 5–17) (e.g., cyclopentyl and cyclohexyl), an aryl group having a C number of 6–32 (preferably, 6–24) (e.g., phenyl and p-tolyl), an aliphatic hydrocarbon oxy group having a C number of 1–24 (preferably, 1–18) (e.g., methoxy, n-butoxy, 2-ethylhexyloxy, benzyloxy, n-dodecyloxy and n-hexadecyloxy), or an aryloxy group having a C number of 6–32 (preferably, 6–24) (e.g., phenoxy, p-t-butylphenoxy, p-t-octylphenoxy, m-pentadecylphenoxy and p-dodecyloxyphenoxy). e is an integer of 0 to 3 (preferably, 1 or 2).

In formula [S-8], $R_{17}$ and $R_{18}$ are the same as the aforementioned $R_{13}$ and $R_{14}$, $R_{19}$ is the same as the aforementioned $R_{16}$, and f is an integer of 0 to 4 (preferably, 0 to 2)

Of the high boiling organic solvents represented by general formulas [S-1] to [S-8], the high boiling organic solvents represented by general formulas [S-1] (preferably, $R_1$, $R_2$ and $R_3$ are each an alkyl group), [S-2], [S-3] (preferably, b is 1), [S-4], [S-5] and [S-7] are particularly preferable. The high boiling organic solvents represented by general formulas [S-1], [S-2], [S-4] and [S-5] are most preferable. Specific examples of the high boiling organic solvent to be used in the present invention will be presented below. The number indicated at the right side of each formula is dielectric constant thereof.

| | | dielectric constant |
|---|---|---|
| S-1 | $O{=}P(OC_6H_{13})_3$ | 5.86 |
| S-2 | $O{=}P(OCH_2CHC_4H_9)_3$ (with $C_2H_5$) | 4.80 |

-continued

| | | di-electric constant |
|---|---|---|
| S-3 | $O{=}P(OCH_2CH_2CH(CH_3)CH_2C(CH_3)CH_2)_3$ | 4.46 |
| S-4 | $O{=}P(OC_{12}H_{25})_3$ | 3.87 |
| S-5 | $O{=}P(OC_{16}H_{33})_3$ | 3.45 |
| S-6 | $O{=}P{-}(O(CH_2)_8CH{=}CHC_8H_{17})_3$ | 3.63 |
| S-7 | $O{=}P{-}(O{-}C_6H_{10}{-}C_4H_9\text{-}t)_3$ | 5.42 |
| S-8 | $C_6H_4(COOC_6H_{13})_2$ | 5.50 |
| S-9 | $C_6H_4(COOC_7H_{15}\text{(branched)})_2$ | 5.17 |
| S-10 | $C_6H_4(COOCH_2CH(C_2H_5)C_4H_9)(COOCH_2CH(C_2H_5)C_4H_9)$ | 5.18 |
| S-11 | $C_6H_4(COOC_{12}H_{25})_2$ | 4.17 |
| S-12 | $C_6H_4(COOC(C_2H_5)_3)_2$ | 5.64 |
| S-13 | $C_6H_5{-}COOCH_2CH(C_2H_5)C_4H_9$ | 4.49 |
| S-14 | $Cl{-}C_6H_3(COOC_8H_{17}){-}Cl$ | 5.18 |
| S-15 | $C_6H_4(COOC_4H_9)_2$ | 5.28 |
| S-16 | $C_{15}H_{31}COOC_{16}H_{33}$ | 3.06 |

-continued

| | | di-electric constant |
|---|---|---|
| S-17 | $C_8H_{17}CH(O)CH(CH_2)_7COOCH_2CH(C_2H_5)C_4H_9$ | 4.54 |
| S-18 | $CH_3CH(OH)COOCH_2CH(CH_3)CH_2CH_2CH_2CH(CH_2)CH_2C_4H_9\text{-t}$ | 4.48 |
| S-19 | $C_4H_9CH(C_2H_5)COOCH_2CH_2OCOCH(C_2H_5)C_4H_9$ | 4.26 |
| S-20 | $C_4H_9CH(C_2H_5)COOCH_2C(CH_3)(CH_3)CH_2OCOCH(C_2H_5)C_4H_9$ | 3.54 |
| S-21 | $C_4H_9CH(C_2H_5)COOCH_2{-}C_6H_{10}{-}CH_2OCOCH(C_2H_5)C_4H_9$ | 3.87 |
| S-22 | $C_4H_9CH(C_2H_5)CH_2OCO(CH_2)_4COOCH_2CH(C_2H_5)C_4H_9$ | 4.23 |
| S-23 | $C_4H_9CH(C_2H_5)CH_2OCO(CH_2)_8COOCH_2CH(C_2H_5)C_4H_9$ | 3.96 |
| S-24 | $C_4H_9OCO(CH_2)_8COOC_4H_9$ | 4.47 |
| S-25 | $C_4H_9OCOCH(C_2H_5)CH_2CH{=}CH_2CH_2COOCH(C_2H_5)C_4H_9$ | 4.59 |
| S-26 | $C_6H_8O(COOCH_2CH(C_2H_5)C_4H_9)(COOCH_2CH(C_2H_5)C_4H_9)$ | 5.37 |
| S-27 | $C_4H_9OCO{-}C_7H_8{-}COOC_4H_9$ | 4.51 |

-continued

| | | di-electric constant |
|---|---|---|
| S-28 | 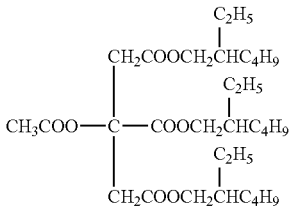 | 4.66 |
| S-29 | 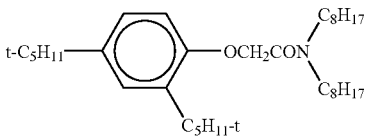 | 5.48 |
| S-30 | 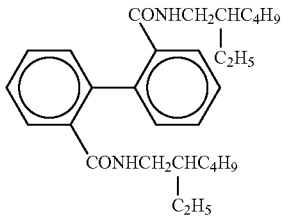 | 4.32 |
| S-31 | 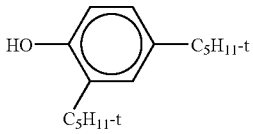 | 3.25 |
| S-32 | 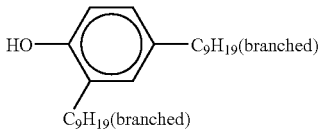 | 2.87 |
| S-33 | 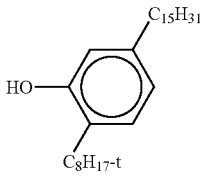 | 2.66 |
| S-34 | 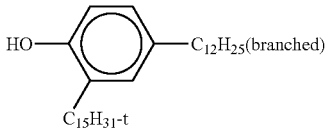 | 2.54 |

-continued

| | | di-electric constant |
|---|---|---|
| S-35 | 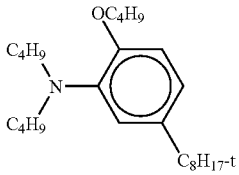 | 2.76 |
| S-36 | 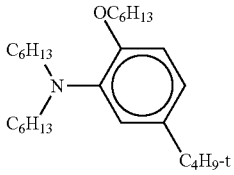 | 2.63 |
| S-37 | 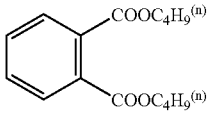 | 6.45 |

These high boiling organic solvents may be used individually or in combination of two or more of them [for example, a combination of di(2-ethylhexyl) phthalate and trioctyl phosphate, a combination of di(2-ethylhexyl) sebacate and triisononyl phosphate, and a combination of dibutyl phthalate and di(2-ethylhexyl) adipate]. When two or more high boiling organic solvents are used after being mixed, it is preferable that the dielectric constant after mixing is 7.0 or less.

Examples of compounds of high boiling organic solvents to be used in the present invention other than those mentioned above and/or methods for preparing these high boiling organic solvents will be described in U.S. Pat. Nos. 2,322,027, 2,533,514, 2,772,163, 2,835,579, 3,594,171, 3,676,137, 3,689,271, 3,700,454, 3,748,141, 3,764,336, 3,765,897, 3,912,515, 3,936,303, 4,004,929, 4,080,209, 4,127,413, 4,193,802, 4,207,393, 4,220,711, 4,239,851, 4,278,757, 4,353,979, 4,363,873, 4,430,421, 4,464,464, 4,483,918, 4,540,657, 4,684,606, 4,728,599 and 4,745,049, EP Nos. 276,319A, 286,253A, 289,820A, 309,158A, 309,159A and 309,160A, and JP-A's-48-47335, 50-26530, 51-25133, 51-26036, 51-277921, 51-27922, 51-149028, 52-46816, 53-1520, 53-1521, 53-15127, 53-146622, 54-106228, 56-64333, 56-81836, 59-204041, 61-84641, 62-118345, 62-247364, 63-167357, 63-214744, 63-301941, 64-68745, 1-101543 and 1-102454.

In the present invention, a high boiling organic solvent is preferably contained in the form of emulsion (fine dispersion). The average particle diameter of the emulsion is preferably 50 μm or less, more preferably 10 μm or less, particularly preferably 2 μm or less, and most preferably 0.5 μm or less. In preparation of the emulsion, it is possible to disperse by means only of mechanical stirring, but it is also preferable to use a surfactant. Further, it is also preferable to prepare the emulsion by adding a macromolecule such as gelatin thereto.

The content of a high boiling organic solvent in an emulsion, in % by weight (the weight of an organic solvent contained in 100 g of emulsion), is preferably 0.05% to 10%, more preferably 0.1% to 10%, and still more preferably 0.2% to 10%.

The general formula (IV) and general formula (V) will now be described in detail. In formula (IV), Q represents a N or P atom. Each of Ra1, Ra2, Ra3 and Ra4 preferably represents a substituted, or unsubstituted alkyl having 1 to 20 carbon atoms (for example, methyl, butyl, hexyl, dodecyl, hydroxyethyl or trimethylammonioethyl, or an aryl substituted alkyl having 7 to 20 carbon atoms, such as benzyl, phenethyl or p-chlorobenzyl); a substituted or unsubstituted aryl having 6 to 20 carbon atoms (for example, phenyl or p-chlorophenyl); or a substituted or unsubstituted heterocycle (for example, thienyl, furyl, pyrrolyl, imidazolyl or pyridyl). Provided, however, that two of Ra1, Ra2, Ra3 and Ra4 may be bonded with each other to thereby form a saturated ring (for example, pyrrolidine ring, piperidine ring, piperazine ring or morpholine ring); or three of Ra1, Ra2, Ra3 and Ra4 may cooperate with each other to thereby form an unsaturated ring (for example, pyridine ring, imidazole ring, quinoline ring or isoquinoline ring). Examples of substituted alkyls represented by Ra1, Ra2, Ra3 and Ra4 include those having a quaternary ammonium salt, a quaternary pyridinium salt or a quaternary phosphonium salt as a substituent.

Y represents an anion group, provided that Y does not exist in the event of an intramolecular salt. Y is, for example, a chloride ion, a bromide ion, an iodide ion, a nitrate ion, a sulfate ion, a p-toluenesulfonate ion or an oxalate ion.

Each of Ra5, Ra6 and Ra7 preferably represents a substituted or unsubstituted alkyl having 1 to 20 carbon atoms (for example, methyl, butyl, hexyl, dodecyl or hydroxyethyl, or an aryl substituted alkyl having 7 to 20 carbon atoms, such as benzyl, phenethyl or p-chlorobenzyl); a substituted or unsubstituted aryl having 6 to 20 carbon atoms (for example, phenyl or p-chlorophenyl); or a substituted or unsubstituted heterocycle (for example, thienyl, furyl, pyrrolyl, imidazolyl or pyridyl). Provided, however, that two of Ra5, Ra6 and Ra7 may be bonded with each other to thereby form a saturated ring (for example, pyrrolidine ring, piperidine ring, piperazine ring or morpholine ring); or Ra5, Ra6 and Ra7 may cooperate with each other to thereby form an unsaturated ring (for example, pyridine ring, imidazole ring, quinoline ring or isoquinoline ring).

Ra8 represents a group constituted by each or any combination of alkylene, arylene, —O—, —S— and —$CO_2$—, provided that each of —O—, —S— and —$CO_2$— is bonded so as to be adjacent to alkylene or arylene. The alkylene may be substituted with, for example, a hydroxyl group as a substituent. The alkylene preferably has 1 to 10 carbon atoms, and can be any of, for example, trimethylene, pentamethylene, heptamethylene, nonamethylene, —$CH_2CH_2OCH_2CH_2$—, —$(CH_2CH_2O)_2$—$CH_2CH_2$—, —$(CH_2CH_2O)_3$—$CH_2CH_2$—, —$(CH_2CH_2S)_3$—$CH_2CH_2$— and —$CH_2CH_2COOCH_2CH_2OCOCH_2CH_2$—.

Ra9, Ra10 and Ra11 have the same meaning as Ra5, Ra6 and Ra7.

The compound of general formula (IV) according to the present invention is preferably the compound of general formula (V).

The compound of general formula (IV) or general formula (V) according to the present invention is preferably dissolved in a water-soluble solvent such as any of water, methanol and ethanol or a mixed solvent thereof before the addition to the emulsion.

The timing of addition of the compound of general formula (IV) or general formula (V) according to the present invention may be before or after the addition of the sensitizing dye. Preferred addition amounts thereof are such that the compound is contained in the silver halide emulsion in an amount of 1 to 50 mol %, more preferably 2 to 25 mol %, based on the sensitizing dye. These addition amounts are preferred from the viewpoint that, when the addition amount of the compound of general formula (IV) or general formula (V) for use in the present invention is greater than the above, the amount of sensitizing dye which can be adsorbed on emulsion grains is occasionally unfavorably reduced.

The compound of general formula (IV) or general formula (V) according to the present invention can be easily synthesized by the same synthetic process as described in Quart. Rev., 16, 163 (1962).

Representative examples of the compounds of general formula (IV) and general formula (V) which can be used in the present invention will be set forth below, to which, however, the present invention is in no way limited.

IV-1

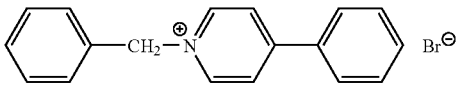

IV-2

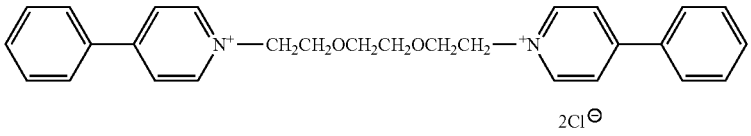

IV-3

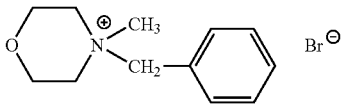

IV-4

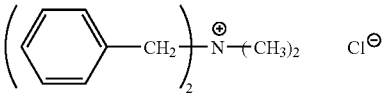

-continued

IV-5

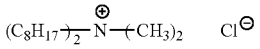

IV-6

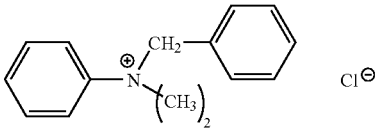

IV-7

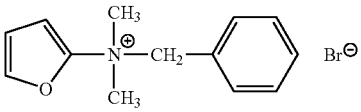

IV-8

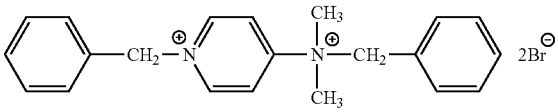

IV-9

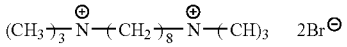

IV-10

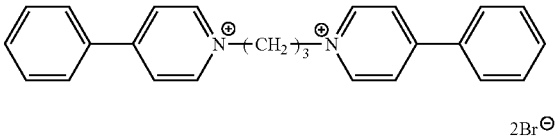

IV-11

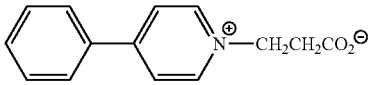

IV-12

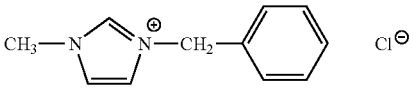

IV-13

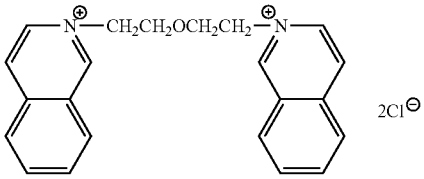

IV-14

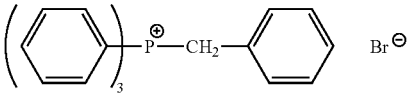

IV-15

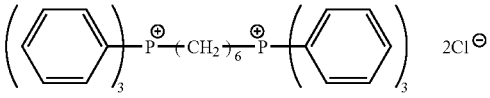

IV-16

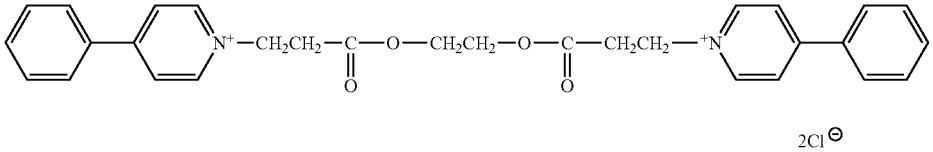

IV-17

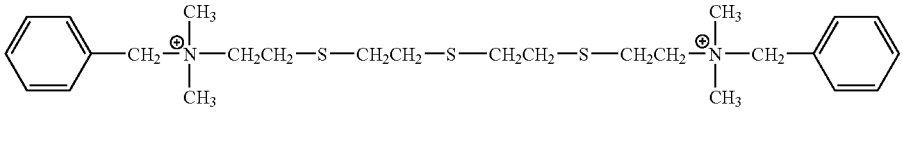

IV-18

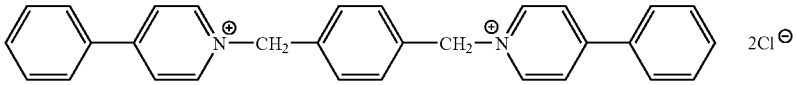

Next, general formulas (VI) to (XI) will be described in detail.

All of the compounds represented by formulas (VI) to (XI) are reducing compounds. The oxidation potential of the compounds may be measured by the methods described in "DENKIKAGAKUSOKUTEIHOU (Electrochemistry Measuring Method)" (Akira Shimazaki, pp. 150–208, Gihodo Publisher), and "JIKKENKAGAKUKOUZA (NIHONKAGAKUKAI ed., 4th edition, vol. 9, pp. 282–344, MARUZEN). For example, the measurement can be made by a rotary disk voltammetry technique. Specifically, a sample is dissolved in a solution of methanol:Briton-Robinson buffer (pH6.5)=10%:90% (volume ratio). After nitrogen gas is made to pass through the sample for 10 min, the measurement can be made using a rotary disk electrode made of glassy carbon (RDE), a platinum wire, and a saturated calomel electrode, as wording electrode, counter electrode and reference electrode, respectively, at 25° C., 1000 rpm, and 20 mV/sec sweep speed. From voltammogram obtained, half-wave potential ($E_{1/2}$) can be obtained.

The reducing compounds used in the invention has an oxidation potential preferably in a range of about −0.3V to about 1.0V, more preferably in a range of about −0.1V to about 0.8V, and especially preferably in a range of about 0 to about 0.6V.

In general formula (VI), examples of the alkyl, alkenyl group and the alkynyl group represented by Rb1 and Rb2 include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxypropyl and methoxymethyl), a substituted or unsubstituted cyclic alkyl group having 3–6 carbon atoms (e.g., cyclopropyl, cyclopentyl and cyclohexyl), an alkenyl group having 2–10 carbon atoms (e.g., allyl, 2-butenyl, 3-pentenyl and 2-cyclohexenyl), an alkynyl group having 2–10 carbon atoms (e.g., propargyl and 3-pentynyl), and an aralkyl group having 7–12 carbon atoms (e.g., benzyl). Examples of the aryl group include a substituted or unsubstituted phenyl group having 6–12 carbon atoms (e.g., unsubstituted phenyl and 4-methylphenyl).

In general formula (VI), examples of the alkyl group, the alkenyl group and the alkynyl group represented by Rb3 and Rb4 include a substituted or unsubstituted, straight chain or branched alkyl group having 1–10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, diethylaminoethyl, dibutylaminoethyl, methoxyethyl and ethoxyethoxyethyl), a substituted or unsubstituted cyclic alkyl group having 3–6 carbon atoms (e.g., cyclopropyl, cyclopentyl and cyclohexyl), an alkenyl group having 2–10 carbon atoms (e.g., allyl, 2-butenyl, 3-pentenyl and 2-cyclohexenyl), an alkynyl group having 2–10 carbon atoms (e.g., propargyl and 3-pentynyl), and an aralkyl group having 7–12 carbon atoms (e.g., benzyl). Examples of the aryl group include a substituted or unsubstituted phenyl group having 6–12 carbon atoms (e.g., unsubstituted phenyl and 4-methylphenyl) and a substituted or unsubstituted naphthyl group having 10–16 carbon atoms (e.g., unsubstituted naphthyl).

Rb1 or Rb2 and Rb3 or Rb4 may be bonded together to form a ring.

In general formula (VI), examples of the alkyl group, the alkenyl group and the alkynyl group represented by Rb5 include a substituted or unsubstituted, straight chain or branched alkyl group having 1–8 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl and diethylaminoethyl), a substituted or unsubstituted cyclic alkyl group having 3–6 carbon atoms (e.g., cyclopropyl, cyclopentyl and cyclohexyl), an alkenyl group having 2–10 carbon atoms (e.g., allyl, 2-butenyl and 3-pentenyl), an alkynyl group having 2–10 carbon atoms (e.g., propargyl and 3-pentynyl), and an aralkyl group having 7–12 carbon atoms (e.g., benzyl). Examples of the aryl group include a substituted or unsubstituted phenyl group having 6–16 carbon atoms (e.g., unsubstituted phenyl, 4-methylphenyl, 4-(2-hydroxyethyl)-phenyl, 4-sulfophenyl, 4-chlorophenyl, 4-trifluoromethylphenyl, 3-trifluoromethylphenyl, 4-carboxyphenyl, 2,5-dimethylphenyl, 4-dimethylaminophenyl, 4-(3-carboxypropionylamino)-phenyl, 4-methoxyphenyl, 2-methoxyphenyl, 2,5-dimethoxyphenyl and 2,4,6-trimethylphenyl) and a substituted or unsubstituted naphthyl group having 10–16 carbon atoms (e.g., unsubstituted naphthyl and 4-methylnaphthyl). Examples of the heterocyclic group include pyridyl, furyl, imidazolyl, piperidyl and morpholyl.

Further, Rb1, Rb2, Rb3, Rb4 and Rb5 may further be substituted with the substituents of Yy set forth below. Examples of the substituent Yy include a halogen atom (e.g., a fluorine atom, chlorine atom, and bromine atom), an alkyl group (e.g., methyl, ethyl, isopropyl, n-propyl, t-butyl), an alkenyl group (e.g., allyl, and 2-butenyl), an alkinyl group (e.g., propargyl), an aralkyl group (e.g., benzyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, butoxy, 2-ethylhexyloxy, ethoxyethoxy, and methoxyethoxy), an aryloxy group (e.g., phenoxy and 2-naphthyloxy), an amino group (e.g., unsubstituted amino, dimethylamino, diethylamino, dipropylamino, dibutylamino, ethylamino, and anilino), an acylamino group (e.g., acetylamino and benzoylamino), an ureido group (e.g., unsubstituted ureido, and N-methylureido), an urethane group (e.g., methoxycarbonylamino and phenoxycarbonylamino), a sulfonylamino group (e.g., methylsulfonylamino and phenylsulfonylamino), a sulfamoyl group (e.g., unsubstituted sulfamoyl, N,N-dimethylsulfamoly and N-phenylsulfamoyl), a carbamoyl group (e.g., unsubstituted carbamoyl, N,N-diethylcarbamoyl, and N-phenylcarbamoyl), a sulfonyl group (e.g., mesyl and tosyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaloyl), an acyloxy group (e.g., acetoxy and benzoyloxy), an amide phosphate group (e.g., N,N-diethyl amide phosphate), a cyano group, a sulfo group, thiosulfonic acid group, a sulfinic acid, a carboxy group, a hydroxy group, a phosphono group, a nitro group, an ammonio group, a phosphonio group, a hydrazino group and thiazolino group. These groups can be further substituted. If two or more substituents exist, these substituents can be the same or different.

It is preferable that in general formula (VI), Rb1 and Rb2 each independently are a substituted or unsubstituted, straight chain or branched alkyl group having 1–4 carbon atoms or a substituted or unsubstituted phenyl group having 6–10 carbon atoms, Rb3 and Rb4 each independently are a hydrogen atom, a substituted or unsubstituted, straight chain or branched alkyl group having 1–4 carbon atoms or a substituted or unsubstituted phenyl group having 6–10 carbon atoms, Rb5 is a substituted or unsubstituted phenyl group having 6–12 carbon atoms, and the compound represented by general formula (VI) has a molecular weight of 350 or less.

Further, it is preferable that in general formula (VI), Rb1 and Rb2 each are a substituted or unsubstituted straight chain alkyl group having 1–3 carbon atoms, Rb3 and Rb4 each are a hydrogen atom, Rb5 is a substituted or unsubstituted phenyl group having 6–10 carbon atoms, and the compound represented by general formula (VI) has a molecular weight of 300 or less. Furthermore, it is most preferable that in general formula (VI), the sum of the numbers of carbon atoms of Rb1 through Rb5 is 11 or less.

The following are specific examples of the compound represented by general formula (VI), but the present invention is not restricted to them.

(VI-1)
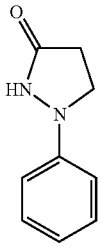
(VI-2)
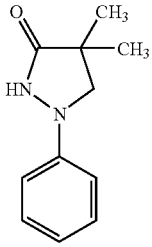
(VI-3)
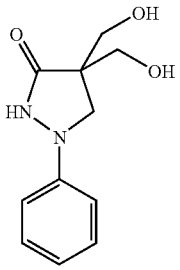
(VI-4)
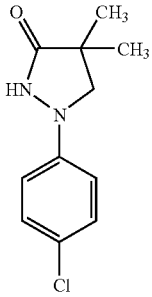
(VI-5)
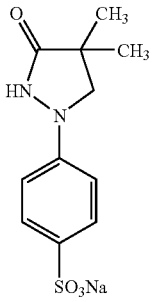
(VI-6)
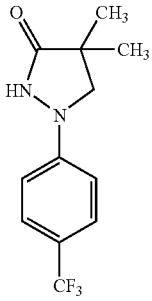
-continued
(VI-7)
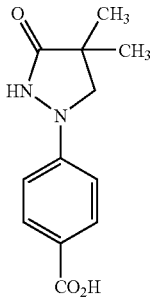
(VI-8)
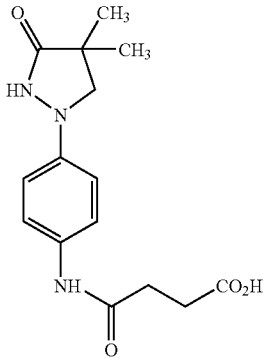
(VI-9)
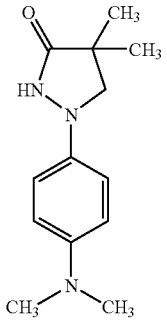
(VI-10)
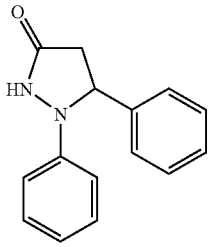
(VI-11)
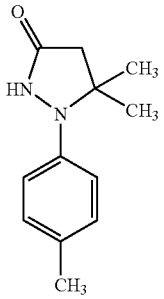

-continued (VI-12)

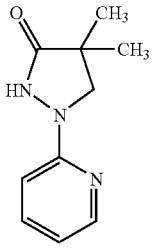

(VI-13)

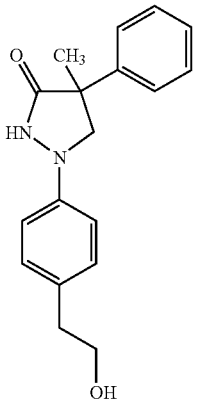

(VI-14)

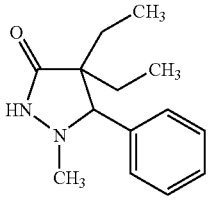

(VI-15)

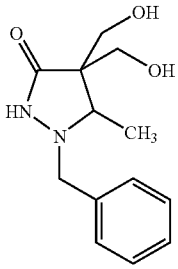

(VI-16)

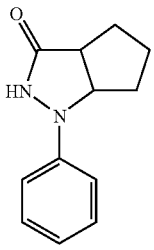

-continued (VI-17)

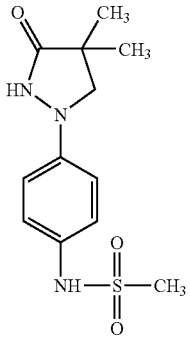

(VI-18)

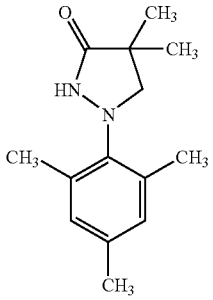

(VI-19)

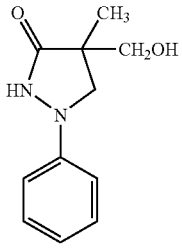

The compounds represented by general formula (VI) are readily available as chemicals on the market or as compounds synthesized from these chemicals on the market by known methods. The compounds of general formula (VI) can be easily prepared by the synthesis methods described, for example, in Journal of Chemical Society (J. Chem. Soc.,) 408 (1954), U.S. Pat. No. 2,743,279 (1953) and U.S. Pat. No. 2,772,282 (1953), and methods according to those methods.

The compound represented by general formula (VI) is preferably added to a layer adjacent to an emulsion layer or another layer before or during application of a coating solution, thereby being added to the emulsion layer through its dispersion therein. It is also possible to add that compound before, during or after completion of the chemical sensitization in preparation of an emulsion. The compound represented by general formula (VI) can be added to either a photosensitive layer or a non-photosensitive layer.

The preferable addition amount of that compound depends greatly on the manner of its addition as described above and the kind of the compound to be added, but in general, the compound is used in an amount of from $5\times10^{-6}$ mol to 0.05 mol, preferably from $1\times10^{-5}$ mol to 0.005 mol, per mol of an lightsensitive silver halide. The addition of the compound in an amount more than the amount mentioned above is not preferable because it will result in some adverse effect such as increase of fogging.

It is preferable that a compound represented by general formula (VI) is added after being dissolved in a water-soluble solvent. The pH of the solution may be decreased or increased with an acid or a base, and a surfactant may exist together with that compound. Further, that compound may be added after being formed into an emulsified dispersion and then being dissolved in a high boiling organic solvent. Alternatively, it may be added after being formed into a fine crystal dispersion by a known dispersing process.

The compound represented by general formula (VII) will be described in more detail. First, a hydrazine structure represented by Rb6Rb7N—NRb8Rb9, which is preferably used as Hy, will be described in detail.

Rb6, Rb7, Rb8 and Rb9 each represent an alkyl group, an alkenyl group, an alkynyl group, an aryl group or a heterocyclic group. Each of the combinations of Rb6 and Rb7, Rb8 and Rb9, Rb6 and Rb8, and Rb7 and Rb9 may be bonded together to form a ring, but no aromatic heterocycle (ex. pyridazine, and pyrazole) is formed, provided that at least one of Rb6, Rb7, Rb8 and Rb9 is an alkylene group, an alkenylene group, an alkynylene group, an arylene group or a bivalent heterocyclic moiety for being substituted with —(M)k2-(Het)k1 in the general formula (VII).

Examples of Rb6, Rb7, Rb8 and Rb9 include an unsubstituted alkyl, alkenyl and alkynyl groups having 1–18 carbon atoms (preferably, 1–8 carbon atoms) (e.g., a methyl group, an ethyl group, a propyl group, an isopropyl group, a butyl group, an isobutyl group, a hexyl group, an octyl group, a dodecyl group, an octadecyl group, a cyclopentyl group, a cyclopropyl group and a cyclohexyl group), a substituted alkyl, alkenyl and alkynyl groups having 1–18 carbon atoms (preferably, 1–8 carbon atoms).

Each of the combinations Rb6 and Rb7, Rb8 and Rb9, Rb6 and Rb8, and Rb7 and Rb9 may be bonded together to form a ring, but no aromatic heterocycle is formed. These rings may be substituted with the aforementioned substituent Yy.

More preferable examples of Rb6, Rb7, Rb8 and Rb9 include an unsubstituted alkyl, alkenyl and alkynyl groups and a substituted alkyl, alkenyl and alkynyl groups. It is also preferable for Rb6, Rb7, Rb8 and Rb9 that each of the combinations Rb6 and Rb7, Rb8 and Rb9, Rb6 and Rb8, and Rb7 and Rb9 is bonded together to form an alkylene group containing no atom other than carbon atoms (e.g., an oxygen atom, a sulfur atom and a nitrogen atom) as atoms constituting a ring, wherein the alkylene group may have a substituent (for example, the aforementioned substituent Yy).

More preferably, each of the carbon atom of Rb6, Rb7, Rb8 and Rb9 which directly attaches to a nitrogen atom of the hydrazine form an unsubstituted methylene group. Particularly preferable examples of Rb6, Rb7, Rb8 and Rb9 include an unsubstituted alkyl group having 1–6 carbon atoms (e.g., methyl, ethyl, propyl and butyl), a substituted alkyl group having 1–8 carbon atoms {for example, a sulfoalkyl group (e.g., 2-sulfoethyl, 3-sulfopropyl, 4-sulfobutyl and 3-sulfobutyl), a carboxyalkyl group (e.g., carboxymethyl and 2-carboxyethyl), and a hydroxyalkyl group (e.g., 2-hydroxyethyl)}. It is also preferable for Rb6, Rb7, Rb8 and Rb9 that each of the combinations Rb6 and Rb7, Rb8 and Rb9, Rb6 and Rb8, and Rb7 and Rb9 is combined through an alkylene chain to form a 5-, 6- or 7-membered ring.

The hydrazine group represented by Rb6Rb7N—NRb8Rb9 is substituted with at least one —(M)k2-(Het)k1 the substitution site of which may be any of Rb6, Rb7, Rb8 and Rb9.

Further, it is particularly preferable that the compound represented by Rb6Rb7N—NRb8Rb9, which is used in the present invention, is a compound selected from the following general formulas (Hy-1), (Hy-2) and (Hy-3).

(Hy-1)

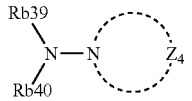

(Hy-2)

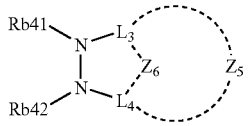

(Hy-3)

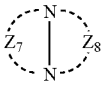

In the formulas, Rb39, Rb40, Rb41 and Rb42 each independently represent an alkyl group, an alkenyl group, an alkynyl group, an aryl group or a heterocyclic group. Each of the combinations Rb39 and Rb40, and Rb41 and Rb42 may be bonded together to form a ring.

$Z_4$ represents an alkylene group having 4, 5 or 6 carbon atoms. $Z_5$ represents an alkylene group having 2 carbon atoms. $Z_6$ represents an alkylene group having 1 or 2 carbon atoms. $Z_7$ and $Z_8$ each represent an alkylene group having 3 carbon atoms. $L_3$ and $L_4$ each represent a methine group.

Each of general formulas (Hy-1), (Hy-2) and (Hy-3) is substituted with at least one —(M)k2-(Het)k1. A compound selected from general formulas (Hy-1) and (Hy-2) is more preferable. A compound selected from general formula (Hy-1) is particularly preferable.

General formula (Hy-1) will be described in detail below. Rb39 and Rb40 have the same meaning as Rb6, Rb7, Rb8 and Rb9, and their preferable ranges are also the same as those of Rb6, Rb7, Rb8 and Rb9. Particularly preferable case is that an alkyl group, Rb39 and Rb40 are bonded together to form an unsubstituted tetramethylene group or a pentamethylene group.

$Z_4$ represents an alkylene group having 4, 5 or 6 carbon atoms, and a preferable case is that $Z_4$ is an alkylene group having 4 or 5 carbon atoms, provided that no oxo group is bonded to a carbon atom directly attached to a nitrogen atom of the hydrazine. The alkylene group may be either unsubstituted or substituted. Examples of the substituent include the aforementioned substituent Yy and it is preferable that a carbon atom directly bonded to a nitrogen atom of the hydrazine forms an unsubstituted methylene group. $Z_4$ is particularly preferably an unsubstituted tetramethylene group or an unsubstituted pentamethylene group. The hydrazine group represented by general formula (Hy-1) is substituted with at least one —(M)k2-(Het)k1 the substitution site of which may be any of Rb39, Rb40 and $Z_4$, and preferably is Rb39 and Rb40.

General formula (Hy-2) will be described in detail below. Rb41 and Rb42 have the same meaning as Rb6, Rb7, Rb8 and Rb9, and their preferable ranges are also the same as those of Rb6, Rb7, Rb8 and Rb9. Particularly preferable case is that an alkyl group, Rb41 and Rb42 are bonded together to form a trimethylene group. $Z_5$ represents an alkylene group having 2 carbon atoms. $Z_6$ represents an alkylene group having 1 or 2 carbon atoms. These alkylene groups may be either unsubstituted or substituted. Examples of the substituent include the aforementioned substituent Yy. More preferable as $Z_5$ is an unsubstituted ethylene group. More preferable as $Z_6$ is an unsubstituted methylene group and an ethylene group. $L_3$ and $L_4$ each represent substituted and unsubstituted methine groups. Examples of the substituent include the aforementioned substituent Yy. The substituent is preferably an unsubstituted alkyl group (e.g., a methyl group and a t-butyl group). More preferably $L_3$ and $L_4$ each represent an unsubstituted methine group. The hydrazine group represented by general formula (Hy-2) is substituted with at least one —(M)k2-(Het)k1 the substitution site of which may be any of Rb41, Rb42, $Z_5$, $Z_6$, $L_3$ and $L_4$, and preferably is Rb41 and Rb42.

General formula (Hy-3) will be described in detail below. $Z_7$ and $Z_8$ each independently represent an alkylene group having 3 carbon atoms, provided that no oxo group is substituted for a carbon atom directly bonded to a nitrogen atom of the hydrazine. The alkylene group may be either unsubstituted or substituted. Examples of the substituent include the aforementioned substituent Yy and it is preferable that a carbon atom directly bonded to a nitrogen atom of the hydrazine forms an unsubstituted methylene group. $Z_7$ and $Z_8$ are particularly preferably an unsubstituted trimethylene group, a trimethylene group substituted with unsubstituted alkyl group (e.g., 2,2-dimethyltrimethylene). The hydrazine group represented by general formula (Hy-3) is substituted with at least one —(M)k2-(Het)k1 the substitution site of which may be any of $Z_7$ and $Z_8$.

In general formula (NII), the group represented by Het preferably has any of the following structures (1)(5):

(1) A 5-, 6- or 7-membered heterocycle having two or more hetero atoms.

(2) A 5-, 6- or 7-membered, nitrogen-containing heterocycle having a quaternary nitrogen atom represented by the following A.

(3) A 5-, 6- or 7-membered, nitrogen-containing heterocycle having a thioxo group represented by the following B.

(4) A 5-, 6- or 7-membered, nitrogen-containing heterocycle represented by the following C.

(5) A 5-, 6- or 7-membered, nitrogen-containing heterocycle represented by the following D and E.

A

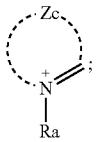

B

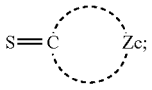

C

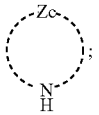

-continued

D

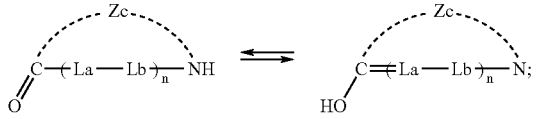

E

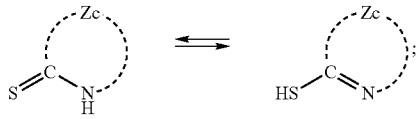

Examples of Ra include those presented as examples of the alkyl group, the alkenyl group, and the alkynyl group for Rb6, Rb7, Rb8 and Rb9.

A nitrogen-containing heterocycle containing Zc as a ring-constituting atom is a 5-, 6- or 7-membered heterocycle that contains at least one nitrogen atom and may also contain a hetero atom other than the nitrogen atom (e.g., an oxygen atom, a sulfur atom, a selenium atom and tellurium atom), and preferably is an azole ring (e.g., imidazole, triazole, tetrazole, oxazole, thiazole, selenazole, benzimidazole, benzotriazol, benzoxazole, benzothiazole, thiadiazole, oxadiazole, benzoselenazole, pyrazole, napthothiazole, naphthoimidazole, naphthoxazole, azabenzoimidazole and purine), a pyrimidine ring, a triazine ring and an azaindene ring (e.g., triazaindene, tetrazaindene and pentazaindene).

It is to be noted that a group represented by Het is substituted with at least one —(M)k2-(Hy).

More preferred as Het are the compounds represented by the following general formulas (Het-a), (Het-b), (Het-c), (Het-d) and (Het-e).

(Het-a)

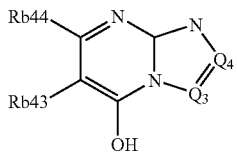

$Q_3$=N, $Q_4$=C—Rb45 or $Q_3$=C—Rb45, $Q_4$=N (Het-b)

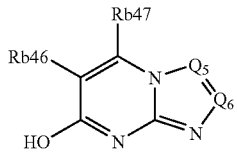

$Q_5$=N, $Q_6$=C—Rb48 or $Q_5$=C—Rb48, $Q_6$=N (Het-c)

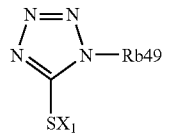

(Het-d)

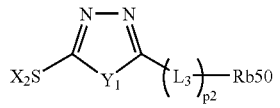

(Het-e)

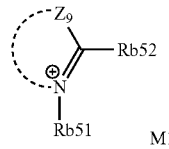

M1m1

In the formulas, Rb43, Rb44, Rb45, Rb46, Rb47 and Rb48 each independently are a hydrogen atom or a monovalent substituent. Rb49 represents an alkyl group, an alkenyl group, an alkynyl group, an aryl group or a heterocyclic group. $X_1$ represents a hydrogen atom, an alkali metal atom, an ammonium group or a blocking group. $Y_1$ represents an oxygen atom, a sulfur atom, >NH or >N—($L_4$)p3-Rb53. $L_3$ and $L_4$ each represent a bivalent linking group. Rb50 and Rb53 each represent a hydrogen atom, an alkyl group, an alkenyl group, an alkynyl group, an aryl group or a heterocyclic group. $X_2$ has the same meaning as $X_1$. p2 and p3 each independently are an integer of 0 to 3, preferably 1.

$Z_9$ represents an atomic group necessary for forming a 5- or 6-membered nitrogen-containing heterocycle. Rb51 represents an alkyl group, an alkenyl group or an alkynyl group. Rb52 represents a hydrogen atom, an alkyl group, an alkenyl group or an alkynyl group. It is to be noted that each of general formulas (Het-a) to (Het-e) is substituted with at least one —(M)k2-(Hy). Provided that —(M)k2-(Hy) does not substituted with $X_1$, and $X_2$ of general formulas (Het-c) and (Het-d). Of general formulas (Het-a) to (Het-e), general formulas (Het-a), (Het-c) and (Het-d) are preferable, and general formula (Het-c) is more preferable.

Next, general formulas (Het-a) to (Het-e) will be described in more detail. Rb43, Rb44, Rb45, Rb46, Rb47 and Rb48 each independently are a hydrogen atom or a monovalent substituent. Examples of the monovalent substituent include the aforementioned Rb6, Rb7, Rb8, Rb9 and substituent Yy, and more preferably a lower alkyl group (preferably, those being substituted or unsubstituted and having 1–4 carbon atoms, e.g., methyl, ethyl, n-propyl, isopropyl, n-butyl, t-butyl, methoxyethyl, hydroxyethyl, hydroxymethyl, vinyl and allyl), a carboxyl group, an alkoxy group (preferably, those being substituted or unsubstituted and having 1–5 carbon atoms, e.g., methoxy, ethoxy, methoxyethoxy and hydroxyethoxy), an aralkyl group (preferably, those being substituted or unsubstituted and having 7–12 carbon atoms, e.g., benzyl, phenethyl, and phenylpropyl), an aryl group (preferably, those being substituted or unsubstituted and having 6–12 carbon atoms, e.g., phenyl, 4-methylphenyl and 4-methoxyphenyl), a heterocyclic group (e.g., 2-pyridyl), an alkylthio group (preferably, those being substituted or unsubstituted and having 1–10 carbon atoms, e.g., methylthio and ethylthio), an arylthio group (preferably, those being substituted or unsubstituted and having 6–12 carbon atoms, e.g., phenylthio), an aryloxy group (preferably, those being substituted or unsubstituted and having 6–12 carbon atoms, e.g., phenoxy), an alkylamino group having three or more carbon atoms (e.g., propylamino and butylamino), an arylamino group (e.g., anilino), a halogen atom (e.g., a chlorine atom, a bromine atom and a fluorine atom), or the following substituent.

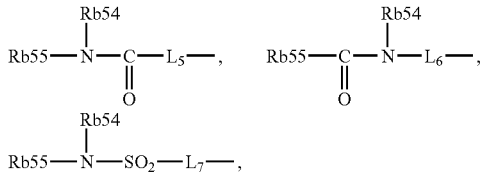

Here, L5, L6 and L7 each represent a linking group represented by an alkylene group (preferably, those having 1–5 carbon atoms, e.g., methylene, propylene and 2-hydroxypropylene). Rb54 and Rb55 may be the same or different, and each represent a hydrogen atom, an alkyl group, an alkenyl group, an alkynyl group (preferably, those being substituted or unsubstituted and having 110 carbon atoms, e.g., methyl, ethyl, n-propyl, isopropyl, n-butyl, t-butyl, n-octyl, methoxyethyl, hydroxyethyl, allyl and propargyl), an aralkyl group (preferably, those being substituted or unsubstituted and having 7–12 carbon atoms, e.g., benzyl, phenethyl and vinylbenzyl), an aryl group (preferably, those being substituted or unsubstituted and having 6–12 carbon atoms, e.g., phenyl and 4-methylphenyl), or a heterocyclic group (e.g., 2-pyridyl).

The alkyl group, the alkenyl group, the alkynyl group, the aryl group and the heterocyclic group represented by Rb49 may be unsubstituted or substituted, and may preferably be substituents presented as Rb6, Rb7, Rb8, Rb9 and Yy.

More preferable examples include a halogen atom (e.g., a chlorine atom, a bromine atom and a fluorine atom), a nitro group, a cyano group, a hydroxyl group, an alkoxy group (e.g., methoxy), an aryl group (e.g., phenyl), an acylamino group (e.g., propionylamino), an alkoxycarbonylamino group (e.g., methoxycarbonylamino), an ureido group, an amino group, a heterocyclic group (e.g., 2-pyridyl), an acyl group (e.g., acetyl), a sulfamoyl group, a sulfonamide group, a thioureido group, a carbamoyl group, an alkylthio group (e.g., methylthio), an arylthio group (e.g., phenylthio), a heterocyclic thio group (e.g., 2-benzothiazolylthio), a carboxylic acid group, a sulfo group and salts thereof. The aforementioned ureido group, thioureido group, sulfamoyl group, carbamoyl group and amino group include those being unsubstituted, those being N-alkyl substituted and those being N-aryl substituted. Examples of the aryl group include a phenyl group and a substituted phenyl group. Examples of the substituent include the aforementioned Rb6, Rb7, Rb8, Rb9 and substituent Yy.

The alkali metal atom represented by X1 and X2 include a sodium atom and a potassium atom. The ammonium group include, for example, tetramethylammonium and trimethylbenzylammonium. The blocking group is a group capable of cleaving under alkaline condition. Examples of the blocking group include acetyl, cyanoethyl and methanesulfonylethyl.

Specific examples of the bivalent linking groups represented by $L_3$ and $L_4$ include the linking group presented below or combinations of them.

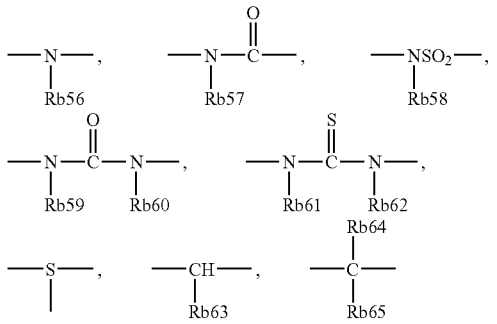

Rb56, Rb57, Rb58, Rb59, Rb60, Rb61, Rb62, Rb63, Rb64 and Rb65 each independently represent a hydrogen atom, an alkyl group, an alkenyl group, an alkynyl group (preferably, those being substituted or unsubstituted and having 1–4 carbon atoms, e.g., methyl, ethyl, n-butyl, methoxyethyl, hydroxyethyl and allyl) or an aralkyl group (preferably, those being substituted or unsubstituted and having 7–12 carbon atoms, e.g., benzyl, phenethyl and phenylpropyl). Rb50 and Rb53 preferably are the same as those presented for the aforementioned Rb49.

Examples of the heterocyclic group having Z9 as a ring-constituting atom include thiazoliums {e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium and naphtho[2,1-d]thiazolium}, oxazoliums (e.g., oxazolium, 4-methyloxazolium, benzoxazolium, 5-chlorobenzoxazolium, 5-phenylbenzoxazolium, 5-methylbenzoxazolium and naphtho[1,2-d]oxazolium), imidazoliums (e.g., 1-methylbenzoimidazolium, 1-propyl-5-chlorobenzoimidazolium, 1-ethyl-5,6-cyclobenzoimidazolium and 1-allyl-5-trifluoromethyl-6-chloro-benzoimidazolium), and selenazoliums (e.g., benzoselenazolium, 5-chlorobenzoselenazolium, 5-methylbenzoselenazolium, 5-methoxybenzoselenazolium and naphtho[1,2-d]selenazolium. Particularly preferred are thiazoliums (e.g., benzothiazolium, 5-chlorobenzothiazolium, 5-methoxybenzothiazolium and naphtho[1,2-d]thiazolium).

Preferable examples of Rb51 and Rb52 include a hydrogen atom, an unsubstituted alkyl group having 1–18 carbon atoms (e.g., methyl, ethyl, propyl, butyl, pentyl, octyl, decyl, dodecyl and octadecyl) and a substituted alkyl group {e.g., an alkyl group having 2–18 carbon atoms substituted with a substituent examples of which include a vinyl group, a carboxyl group, a sulfo group, a cyano group, a halogen atom (e.g., fluorine, chlorine and bromine), a hydroxyl group, an alkoxycarbonyl group having 1–8 carbon atoms (e.g., methoxycarbonyl, ethoxycarbonyl, phenoxycarbonyl and benzyloxycarbonyl), an alkoxy group having 1–8 carbon atoms (e.g., methoxy, ethoxy, benzyloxy and phenethyloxy), a monocyclic aryloxy group having 6–10 carbon atoms (e.g., phenoxy and p-tolyloxy), an acyloxy group having 1–3 carbon atoms (e.g., acetyloxy and propionyloxy), an acyl group having 1–8 carbon atoms (e.g., acetyl, propionyl, benzoyl and mesyl), a carbamoyl group (e.g., carbamoyl, N,N-dimethylcarbamoyl, morpholinocarbonyl and piperidinocarbonyl), a sulfamoyl group (e.g., sulfamoyl, N,N-dimethylsulfamoyl, morpholinosulfonyl and piperidinosulfonyl) and an aryl group having 6–10 (e.g., phenyl, 4-chlorophenyl, 4-methylphenyl and α-naphthyl)}. It is to be noted that Rb51 is not a hydrogen atom. More preferably, Rb51 is an unsubstituted alkyl group (e.g., methyl and ethyl) or an alkenyl group (e.g., an allyl group), and Rb52 is a hydrogen atom or an unsubstituted lower alkyl group (e.g., methyl and ethyl).

M1 and m1 are included in the formula to show the presence or absence of a cation or an anion when a counter ion is necessary for neutralizing an ionic charge in the compound represented by general formula (Het-e). Whether a dye is a cation or an anion, or whether or not it has a net ionic charge depends on its auxochrome and substituent. Typical examples of such a cation include an inorganic or organic ammonium ion an and alkali metal ion; while such an anion may be an inorganic or organic one, with examples including a halogen anion (e.g., a fluoride ion, a chloride ion, a bromide ion and an iodide ion), a substituted arylsulfonate ion (e.g., a p-toluenesulfonate ion and a p-chlorobenzenesulfonate ion), an aryldisulfonate ion (e.g., a 1,3-benzenedisulfonate ion, a 1,5-naphthalenedisulfonate ion and a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion and a trifluoromethanesulfonate ion. Preferable examples include an ammonium ion, an iodine ion, a bromine ion and a p-toluenesulfonate ion.

Each of the nitrogen-containing heterocycles represented by general formulas (Het-a) to (Het-e) is substituted with at least one —(M)k2-(Hy) the substitution site of which is, for example, Rb43, Rb44, Rb45, Rb46, Rb47, Rb48, Rb49, R50, Rb51, $Y_1$, $L_3$ and $Z_9$.

In general formula (VII), M represents a bivalent linking group comprising an atom or atomic group containing at least one of a carbon atom, a nitrogen atom, a sulfur atom and an oxygen atom, and preferably represents a bivalent linking group having 4–20 carbon atoms made up of an alkylene group having 1–8 carbon atoms (e.g., methylene, ethylene, propylene, butylene and pentylene), an arylene group having 6–12 carbon atoms (e.g., phenylene and naphthylene), an alkenylene group having 2–8 carbon atoms (e.g., ethynylene and propenylene), an amide group, an ester group, a sulfoamide group, a sulfonic acid ester group, an ureido group, a sulfonyl group, a sulfinyl group, a thioether group, an ether group, a carbonyl group, —N(RO)— (wherein RO represents a hydrogen atom, a substituted or unsubstituted alkyl group or a substituted or unsubstituted aryl group) or a heterocyclic divalent group (e.g., 6-chloro-1,3,5-trizin-2,4-diyl, pyrimidin-2,4-diyl, quinoxalin-2,3-diyl) individually or in combination of two or more thereof. More preferably, M is an ureido group, an ester group or an amide group.

In general formula (VII), k1 and k3 each preferably are 1 or 2. It is more preferable that all of k1, k2 and k3 are 1. When k1 or k3 is 2 or more, Hy and Het may be the same or different.

Of the compounds represented by general formula (VII) of the present invention, more preferable compounds are represented by the following general formulas (VII-A), (VII-B), (VII-C), (VII-D) and (VII-E):

(VII-A)

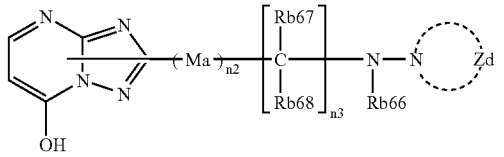

-continued (VII-B)

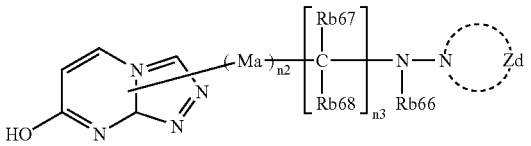

(VII-C)

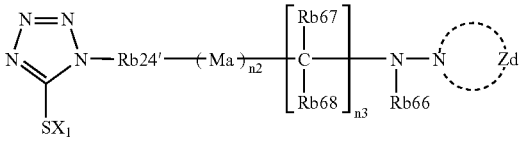

Rb24′ represents an alkylen group, arylene group or bivalent heterocyclic group (VII-D)

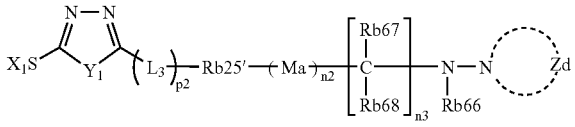

Rb25′ has the same meaning as Rb24′

(VII-E)

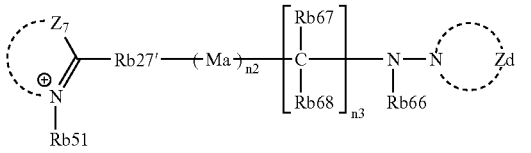

Rb27′ represents an alkylene group

Further, the compounds particularly preferable in the present invention are represented by the following general formula (VII-F):

(VII-F)

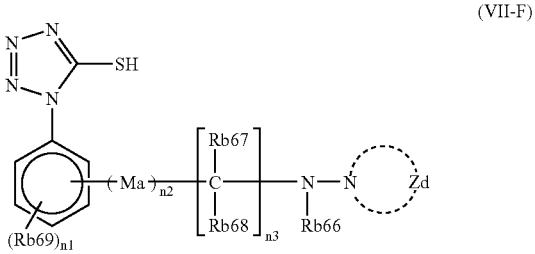

In the formulas, Ma has the same meaning as M in general formula (VII). Zd has the same meaning as Z4 in general formula (Hy-1). Rb59 represents a monovalent substituent. Rb66 represents an alkyl group, an alkenyl group, an alkynyl group, an aryl group or a heterocyclic group. Rb67 and Rb68 each independently represent a hydrogen atom or a monovalent substituent. n1 represents an integer of 0 to 4. n2 represents 0 or 1. n3 represents an integer of 1 to 6. $X_1$ has the same meaning as $X_1$ in general formula (Het-c). $Y_1$, $L_3$ and p2 have the same meanings as $Y_1$, $L_3$ and p2 in general formula (Het-d), respectively. Rb51 has the same meaning as Rb51 in general formula (Het-e). when n1 and n3 are 2 or more, Rb59 and C(Rb67)(Rb68) are repeated, but they are not required to be the same.

Describing in more detail, it is preferable that Ma is the same as M in general formula (VII), and more preferably an ureido group, an ester group or an amide group. Zd is preferably the same as $Z_4$ in general formula (Hy-1), and more preferably an unsubstituted tetramethylene or pentamethylene group. Rb69 is preferably the same as Rb43. Rb66 is preferably the same as Rb6, Rb7, Rb8 and Rb9, and particularly preferably an unsubstituted alkyl group having 1–4 carbon atoms (e.g., methyl and ethyl). Rb67 and Rb68 are preferably the same as Rb43, and particularly preferably a hydrogen atom. n1 is preferably 0 or 1. n2 is preferably 1. n3 is preferably 2 to 4.

Compounds to be used in the present invention are typically exemplified by, but are not limited to, the following:

VII-1

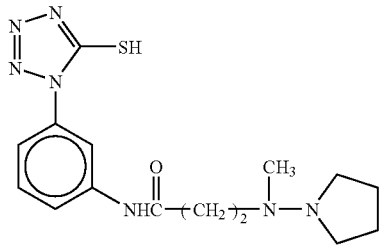

VII-2

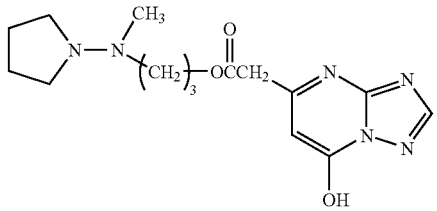

VII-3

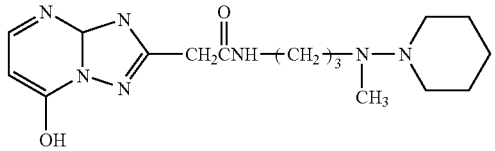

VII-4

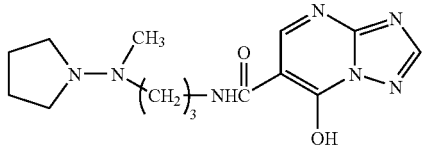

VII-5

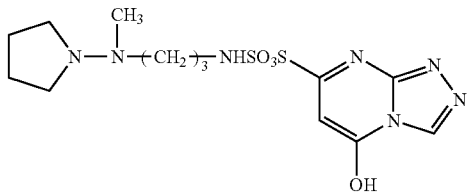

VII-6

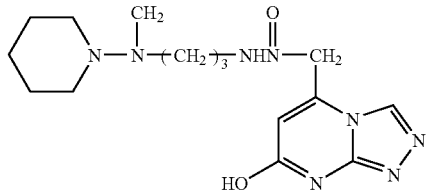

-continued

VII-7

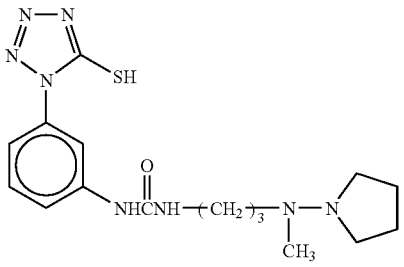

VII-8

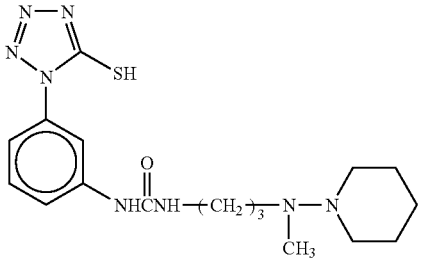

VII-9

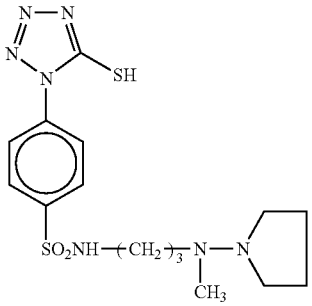

VII-10

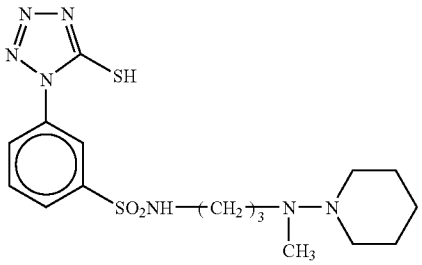

VII-11

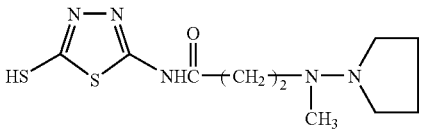

VII-12

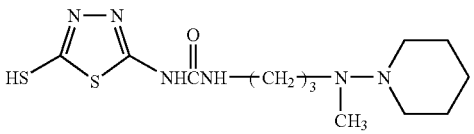

-continued

VII-13

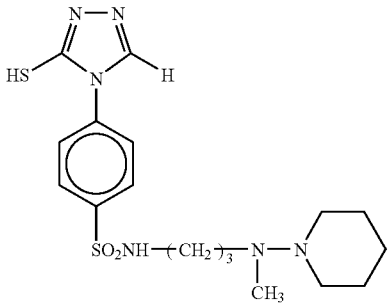

VII-14

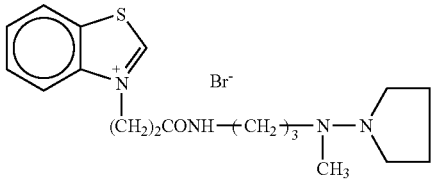

VII-15

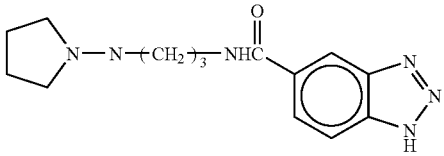

VII-16

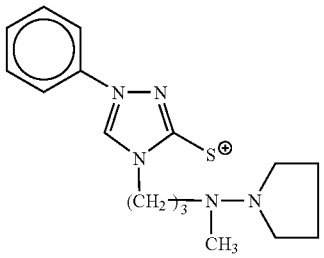

Het in general formula (VII) used in the present invention is disclosed in, for example, U.S. Pat. No. 3,266,897, Belgian Patent No. 671,402, JP-A-60-138548, JP-A-59-68732, JP-A-59-123838, JP-B-58-9939, JP-A-59-137951, JP-A-57-202531, JP-A-57-164734, JP-A-57-14836, JP-A-57-116340, U.S. Pat. No. 4,418,140, JP-A-58-95728, JP-A-55-79436, OLS No. 2,205,029, OLS No. 1,962,605, JP-A-55-59463, JP-B-48-18257, JP-B-53-28084, JP-A-53-48723, JP-B-59-52414, JP-A-58-217928, JP-B-49-8334, U.S. Pat. No. 3,598,602, U.S. Pat. No. 887,009, U.K.P. No. 965,047, Belgian Patent No. 737809, U.S. Pat. No. 3,622,340, JP-A-60-87322, JP-A-57-211142, JP-A-58-158631, JP-A-59-15240, U.S. Pat. No. 3,671,255, JP-B-48-34166, JP-B-48-322112, JP-A-58-221839, JP-B-48-32367, JP-A-60-130731, JP-A-60-122936, JP-A-60-117240, U.S. Pat. No. 3,228,770, JP-B-43-13496, JP-B-43-10256, JP-B-47-8725, JP-B-47-30206, JP-B-47-4417, JP-B-51-25340, U.K.P. No. 1,165,075, U.S. Pat. No. 3,512,982, U.S. Pat. No. 1,472,845, JP-B-39-22067, JP-B-39-22068, U.S. Pat. No. 3,148,067, U.S. Pat. No. 3,759,901, U.S. Pat. No. 3,909,268, JP-B-50-40665, JP-B-39-2829, U.S. Pat. No. 3,148,066, JP-B-45-22190, U.S. Pat. No. 1,399,449, U.K.P. No. 1,287,284, U.S. Pat. No. 3,900,321, U.S. Pat. No. 3,655,391, U.S. Pat. No. 3,910,792, U.K.P. No. 1,064,805, U.S. Pat. No. 3,544,336, U.S. Pat. No. 4,003,746, U.K.P. No. 1,344,525, U.K.P. No. 972,211, JP-B-43-4136, U.S. Pat. No. 3,140,178, French Patent No. 2,015,456, U.S. Pat. No. 3,114,637, Belgian Patent No. 681,359, U.S. Pat. No. 3,220,839, U.K.P. No. 1,290,868, U.S. Pat. No. 3,137,578, U.S. Pat. No. 3,420,670, U.S. Pat. No. 2,759,908, U.S. Pat. No. 3,622,340, OLS No. 2,501,261, DAS No. 1,772,424, U.S. Pat. No. 3,157,509, French Patent No. 1,351,234, U.S. Pat. No. 3,630,745, French Patent No. 2,005,204, German Patent No. 1,447,796, U.S. Pat. No. 3,915,710, JP-B-49-8334, U.K.P. No. 1,021,199, U.K.P. No. 919,061, JP-B-46-17513, U.S. Pat. No. 3,202,512, OLS No. 2,553,127, JP-A-50-104927, French Patent No. 1,467,510, U.S. Pat. No. 3,449,126, U.S. Pat. No. 3,503,936, U.S. Pat. No. 3,576,638, French Patent No. 2,093,209, U.K.P. No. 1,246,311, U.S. Pat. No. 3,844,788, U.S. Pat. No. 3,535,115, U.K.P. No. 1,161,264, U.S. Pat. No. 3,841,878, U.S. Pat. No. 3,615,616, JP-A-48-39039, U.K.P. No. 1,249,077, JP-B-48-34166, U.S. Pat. No. 3,671,255, U.K.P. No. 1459160, JP-A-50-6323, U.K.P. No. 1,402,819, OLS No. 2,031,314, Research Disclosure No. 13651, U.S. Pat. No. 3,910,791, U.S. Pat. No. 3,954,478, U.S. Pat. No. 3,813,249, U.K.P. No. 1,387,654, JP-A-57-135945, JP-A-57-96331, JP-A-57-22234, JP-A-59-26731, OLS No. 2,217,153, U.K.P. No. 1,394,371, U.K.P. No. 1,308,777, U.K.P. No. 1,389,089, U.K.P. No. 1,347,544, German Patent No. 1,107,508, U.S. Pat. No. 3,386,831, U.K.P. No. 1,129,623, JP-A-49-14120, JP-B-46-34675, JP-A-50-43923, U.S. Pat. No. 3,642,481, U.K.P. No. 1,269,268, U.S. Pat. No. 3,128,185, U.S. Pat. No. 3,295,981, U.S. Pat. No. 3,396,023, U.S. Pat. No. 2,895,827, JP-B-48-38418, JP-A-48-47335, JP-A-50-87028, U.S. Pat. No. 3,236,652, U.S. Pat. No. 3,443,951, U.K.P. No. 1,065,669, U.S. Pat. No. 3,312,552, U.S. Pat. No. 3,310,405, U.S. Pat. No. 3,300,312, U.K.P. No. 952,162, U.K.P. No. 952,162, U.K.P. No. 948,442, JP-A-49-120628, JP-B-48-35372, JP-B-47-5315, JP-B-39-18706, JP-B-43-4941, and JP-A-59-34530. That compound can be synthesized by referring to them.

Hy in general formula (VII) of the present invention can be prepared by various methods. For example, it can be prepared by a method in which a hydrazine is alkylated. The known methods for the alkylation include a method in which hydrazine is substitution alkylated using alkyl halide and alkyl sulfonate, a method in which hydrazine is reductively alkylated using a carbonyl compound and sodium cyanoborohydride, and a method in which hydrazine is acylated and thereafter reduced with lithium aluminum hydride. For example, these methods are disclosed in S. R. Sandler, W. Karo, "Organic Functional Group Preparation" Volume 1, Chapter 14, pp. 434–465, Academic Press (1968); E. L. Clennan et al, Journal of The American Chemical Society, Vol. 112, No. 13, 5080 (1990), and so on. That compound can be prepared by referring to them.

For bond formation reactions such as an amide bond formation reaction and an ester bond formation reaction of the —(M)k2-(Hy) moiety, methods known in organic chemistry can be utilized. Specifically, any method can be applied such as a method in which Het and Hy are connected, a method in which Hy is connected to a synthesis raw material and an intermediate of Het and thereafter Het is synthesized and a method in which a synthesis raw material and an intermediate of Hy are connected to an Het moiety and thereafter Hy is synthesized. The synthesis can be performed through a suitable selection. With respect to these synthesis reactions for connection, reference should be made to the literature regarding organic synthetic reaction, for example, Japanese Chemical Society Ed., New Experimental Chemistry Series No. 14, Synthesis and Reaction of Organic Compounds, Vols. I to V, Maruzene, Tokyo, 1977; Yoshiro Ogata, "The Theory of Organic Reaction," Maruzene, Tokyo, 1962; and L. F. Fieser and M. Fieser, "Advanced Organic Chemistry," Maruzene, Tokyo, 1962. More specifically, the synthesis can be performed according to the methods described in Examples 1 and 2 in JP-A-7-135341.

When a compound is added in the preparation of an emulsion, this compound can be added at any point during the preparation. For example, the compound can be added during silver halide grain formation, before or during desalting, before or during chemical ripening, or before the preparation of a complete emulsion. The compound can also be added separately a plurality of times during these steps. The compound represented by general formula (VII) of the present invention is preferably added after being dissolved in any of water, a water-soluble solvent such as methanol and ethanol, and a solvent mixture of these. When a compound is dissolved in water, if the compound becomes to exhibit an increased solubility when the pH is raised or lowered, it can be added after being dissolved through the raising or lowering of the pH.

The compounds represented by general formula (VII) are preferably used for an emulsion layer, but they may be added to a protective layer and an intermediate layer as well as an emulsion layer previously and then be caused to diffuse during application. The timing of their addition of the compound represented by general formula (VII) of the present invention may be either before or after the addition of a sensitizing dye. Those compounds are caused to be contained in a silver halide emulsion in a ratio of $1\times10^{-9}$ to $5\times10^{-2}$ mol, preferably $1\times10^{-8}$ to $2\times10^{-3}$ mol, per mol of the silver halide.

The compounds represented by general formulas (VIII-1) and (VIII-2) will be described in detail below. In general formula (VII-1), examples of the substituents represented by Rb10, Rb11, Rb12 and Rb13 include an alkyl group (preferably having 1–30 carbon atoms, more preferably 1–20 carbon atoms, e.g., methyl, ethyl and iso-propyl), an aralkyl group (preferably having 7–30 carbon atoms, more preferably 7–20 carbon atoms, e.g., phenylmethyl), an alkenyl group (preferably having 2–20 carbon atoms, more preferably 2–10 carbon atoms, e.g., allyl), an alkoxy group (preferably having 1–20 carbon atoms, more preferably 1–10 carbon atoms, e.g., methoxy and ethoxy), an aryl group (preferably having 6–30 carbon atoms, more preferably 6–20 carbon atoms), an acylamino group (preferably having 2–30 carbon atoms, more preferably 2–20 carbon atoms, e.g., acetylamino), a sulfonylamino group (preferably having 1–30 carbon atoms, more preferably 1–20 carbon atoms, e.g., methanesulfonylamino), an ureido group (preferably having 1–30 carbon atoms, more preferably 1–20 carbon atoms, e.g., methylureido), an alkoxycarbonylamino group (preferably having 2–30 carbon atoms, more preferably 2–20 carbon atoms, e.g., methoxycarbonylamino), an aryloxycarbonylamino group (preferably having 7–30 carbon atoms, more preferably 7–20 carbon atoms, e.g., a phenyloxycarbonylamino group), an aryloxy group (preferably having 6–30 carbon atoms, more preferably 6–20 carbon atoms, e.g., phenyloxy), a sulfamoyl group (preferably having 0–30 carbon atoms, more preferably 0–20 carbon atoms, e.g., methylsulfamoyl), a carbamoyl group (preferably having 1–30 carbon atoms, more preferably 1–20 carbon atoms, e.g., carbamoyl and methylcarbamoyl), a mercapto group, an alkylthio group (preferably having 1–30 carbon atoms, more preferably 1–20 carbon atoms, e.g., methylthio and carboxymethylthio), an arylthio group (preferably having 6–30 carbon atoms, more preferably 6–20 carbon atoms, e.g., phenylthio), a sulfonyl group (preferably having 1–30 carbon atoms, more preferably 1–20 carbon atoms, e.g., methanesulfonyl), a sulfinyl group (preferably having 1–30 carbon atoms, more preferably 1–20 carbon atoms, e.g., methanesulfinyl), a hydroxyl group, a halogen atom (e.g., a chlorine atom, a bromine atom and a fluorine atom), a cyano group, a sulfo group, a carboxyl group, a phosphono group, an amino group (preferably having 0–30 carbon atoms, more preferably 1–20 carbon atoms, e.g., methylamino), an aryloxycarbonyl group (preferably having 7–30 carbon atoms, more preferably 7–20 carbon atoms), an acyl group (preferably having 2–30 carbon atoms, more preferably 2–20 carbon atoms, e.g., acetyl and benzoyl), an alkoxycarbonyl group (preferably having 2–30 carbon atoms, more preferably 2–20 carbon atoms, e.g., methoxycarbonyl), an acyloxy group (preferably having 2–30 carbon atoms, more preferably 2–20 carbon atoms, e.g., acetoxy), a nitro group, a hydroxamic acid group, and a heterocyclic group (e.g., pyridyl, furyl and thienyl). These substituents may further be substituted.

Preferable examples of the substituents represented by Rb10, Rb11, Rb12 and Rb13 include an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group, more preferably an alkyl group, an alkoxy group, a halogen atom, a sulfo group, a carboxyl group, an acylamino group, a sulfonylamino group, an ureido group, an alkoxycarbonylamino group and an aryloxycarbonylamino group, and particularly preferably an alkyl group, a halogen atom, an acylamino group, a sulfonylamino group, an ureido group, an alkoxycarbonylamino group and an aryloxycarbonylamino group.

Preferably, from one to three of Rb10, Rb11, Rb12 and Rb13 are each a hydrogen atom, and more preferably, from two to three of Rb10, Rb11, Rb12 and Rb13 are each a hydrogen atom. The most preferable is the case where three of them are each a hydrogen atom. When Rb10 and R13 are each an alkyl group, they are not substituents having the same numbers of carbon atoms. For example, it is possible that Rb10=t-$C_8H_{17}$ and Rb13=n-$C_{15}H_{31}$, but it is impossible that both Rb10 and Rb13 are t-$C_8H_{17}$. When Rb10 and Rb13 are substituents of the same type, the difference in the number of carbon atoms between Rb10 and Rb13 is preferably 5 or more, and more preferably 10 or more. What described above for Rb10 and Rb13 is applied equally to Rb11 and R12.

Among the compounds represented by general formula (VIII-b), those represented by general formula (VIII-1-a) are preferable, and those represented by general formula (VIII-1-b) are more preferable. The compounds represented by general formula (VIII-1-c) are particularly preferable.

(VIII-1-a)

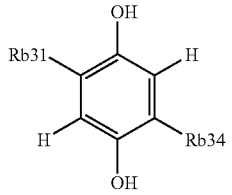

In the above formula, Rb31 and Rb34 have the same meanings as Rb10 and Rb13 of general formula (VIII-1) and their preferable ranges are also the same as those of Rb10 and Rb13.

(VIII-1-b)

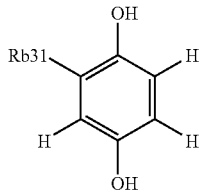

In the above formula, Rb31 has the same meaning as Rb10 of general formula (VIII-1) and its preferable range is also the same as that of Rb10.

(VIII-1-c)

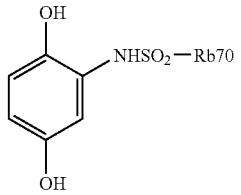

In the above formula, Rb70 is an alkyl group that may have a substituent. As the substituent the alkyl group may have, those presented as substituents represented by Rb31 can be applied.

In general formula (VIII-2), examples of substituents represented by Rb14, Rb15 and Rb16 include the substituents that the substituents represented by Rb10, Rb11, Rb12 and Rb13 may have. Preferable examples of the substituent represented by Rb14 include an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group, more preferably include an alkyl group, an alkoxy group, a halogen atom, a sulfo group, a carboxyl group, an acylamino group, a sulfonylamino group, an ureido group, an alkoxycarbonylamino group and an aryloxycarbonylamino group, and particularly preferably include an alkyl group, a halogen atom, an acylamino group, a sulfonylamino group, an ureido group, an alkoxycarbonylamino group and an aryloxycarbonylamino group.

Preferable examples of the substituent represented by Rb15 include an alkyl group, an alkoxy group, a hydroxyl group, a halogen atom, an acylamino group, a sulfonylamino group, an ureido group, an alkoxycarbonylamino group, an aryloxycarbonylamino group, an alkylthio group, an arylthio group, an amino group and an acyloxy group, more preferably include an alkyl group, an alkoxy group, a hydroxyl group, an acylamino group, a sulfonylamino group, an ureido group, an alkoxycarbonylamino group and an aryloxycarbonylamino group, and particularly preferably include an alkyl group, an acylamino group, a sulfonylamino group, an ureido group, an alkoxycarbonylamino group and an aryloxycarbonylamino group.

Preferable examples of the substituent represented by Rb16 include an alkyl group, an alkoxy group, a hydroxyl group, a halogen atom, a sulfo group, a carboxyl group, an acylamino group, a sulfonylamino group, an ureido group, an alkoxycarbonylamino group, an aryloxycarbonylamino group, an alkylthio group, an arylthio group, an amino group and an acyloxy group, more preferably include an alkyl group, an alkoxy group, a halogen atom, a sulfo group, a carboxyl group, an acylamino group, a sulfonylamino group, an ureido group, an alkoxycarbonylamino group and an aryloxycarbonylamino group, and particularly preferably include an alkyl group.

Z represents a group of non-metallic atoms required to form a 4- to 6-membered ring. Preferable examples of such a non-metallic atom include a carbon atom, an oxygen atom, a nitrogen atom and a sulfur atom, more preferably a carbon atom and an oxygen atom, and particularly preferably a carbon atom. The preferable number of ring members is 5 or 6, and more preferably 6. The ring may have a substituent thereon and, for example, those presented as the substituent represented by Rb14 can be applied as such a substituent. Preferable examples of such a substituent include an alkyl group, an alkenyl group and an alkoxy group, more preferably an alkyl group and an alkenyl group. These substituents may further have a substituent.

Among the compounds represented by general formula (VIII-2), preferred are the compounds represented by general formula (VIII-2-a), and more preferred are the compounds represented by general formula (VIII-2-b).

(VIII-2-a)

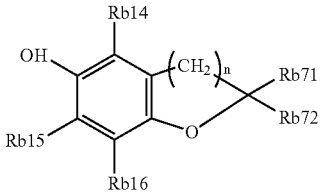

In the formula, Rb14, Rb15 and Rb16 have the same meanings as those in general formula (VIII-2), and their preferable ranges are also the same as those of Rb14, Rb15 and Rb16 in general formula (VIII-2). n represents 1 or 2. Rb71 and Rb72 each represent an alkyl group, an alkenyl group or an alkoxy group.

(VIII-2-b)

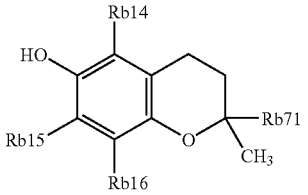

In the formula, Rb14, Rb15 and Rb16 have the same meanings as those in general formula (VIII-2), and their preferable ranges are also the same as those of Rb14, Rb15 and Rb16 in general formula (VIII-2). Rb71 represents an alkyl group, an alkenyl group or an alkoxy group. n is preferably 2. The alkyl group and the alkenyl group represented by Rb71 and Rb72 may be straight chain, branched or cyclic, and preferably is straight chain or branched. The preferable number of carbon atoms is from 1 to 30, and more preferably from 1 to 20. Examples of the alkyl group include methyl, ethyl and iso-propyl. As the alkenyl group, allyl is presented. With respect to the alkoxy groups represented by Rb71 and Rb72, their alkyl moieties may be straight chain, branched or cyclic. Further, Rb71 and Rb72 may form a ring like a spirochroman. The alkoxy group preferably has 1–20 carbon atoms and more preferably has 1–10 carbon atoms. Examples thereof include methoxy and ethoxy.

The compounds represented by general formulas (VIII-1) and (VIII-2) are specifically exemplified by, but are not restricted to, the following:

VIII-1-1

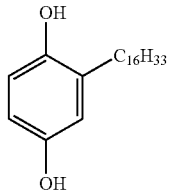

VIII-1-2

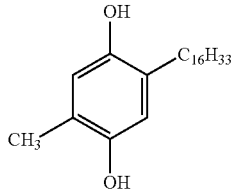

VIII-1-3

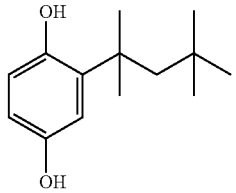

VIII-1-4

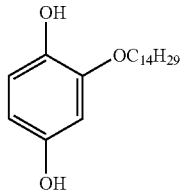

VIII-1-5

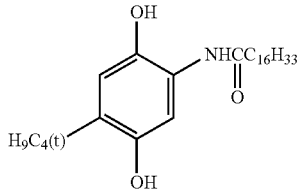

VIII-1-6

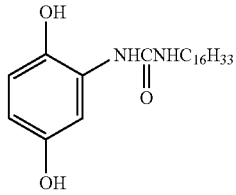

-continued
VIII-1-7
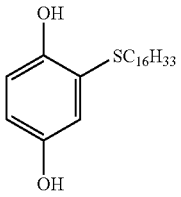
VIII-1-8
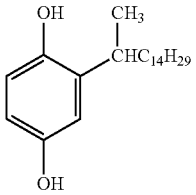
VIII-1-9
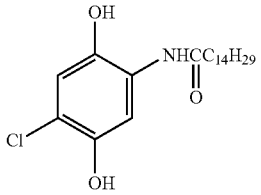
VIII-1-10
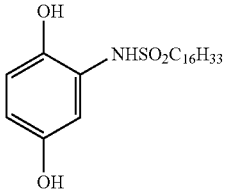
VIII-1-11
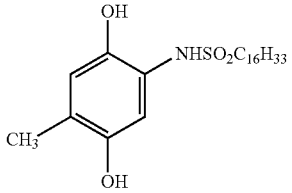
VIII-1-12
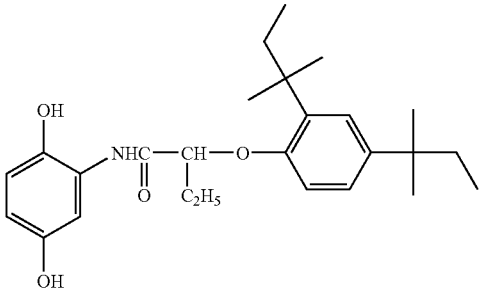
VIII-1-13
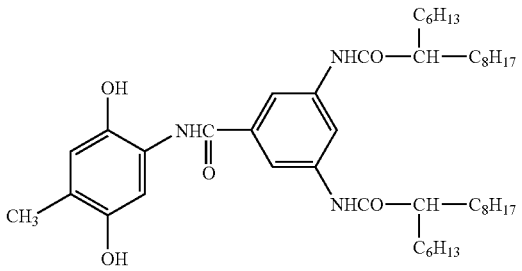
-continued
VIII-1-14
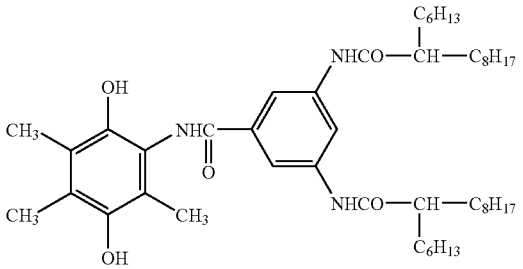
VIII-1-15
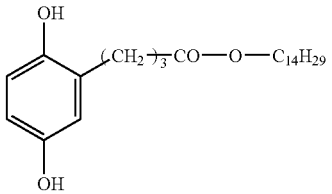
VIII-1-16
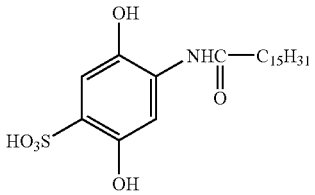
VIII-1-17
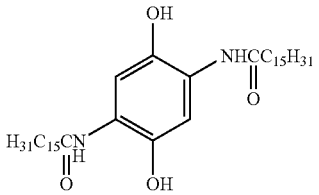
VIII-1-18
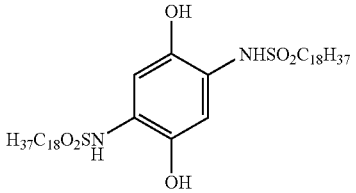
VIII-1-19
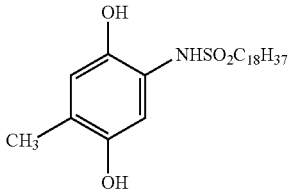
VIII-1-20
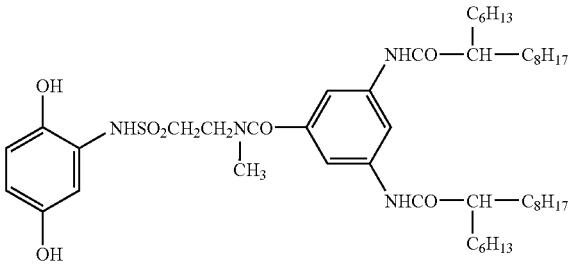

-continued

VIII-1-21

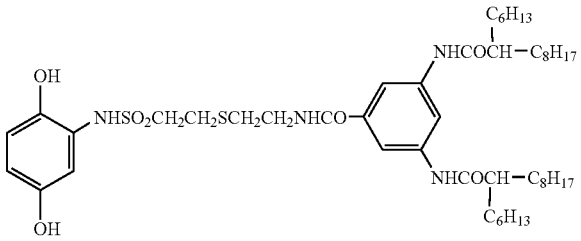

VIII-1-22

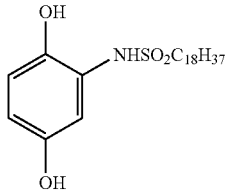

VIII-2-1

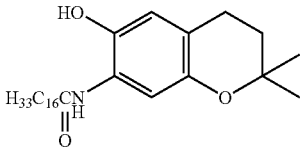

VIII-2-2

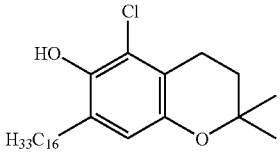

VIII-2-3

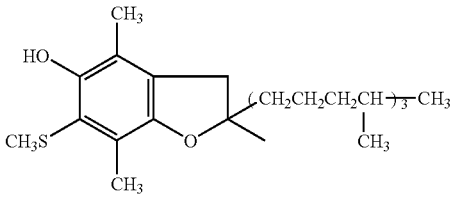

VIII-2-4

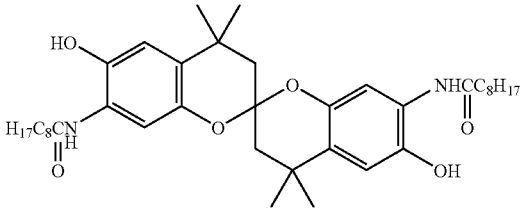

The compounds represented by general formulas (VIII-1) and (VIII-2) can be prepared according to the methods described in, for example, U.S. Pat. Nos. 2,728,659, 2,549,118 and 2,732,300, Journal of American Chemical Society, 111, 20, 1989, 7932, Synthesis, 12, 1995, 1549, Q. J. Pharm, Pharmacol., 17, 1944, 325, Chem. Pharm, Bull., 14, 1966, 1052, and Chem. Pharm, Bull., 16, 1968, 853.

The compounds represented by general formulas (VIII-1) and (VIII-2) can be prepared according to the methods described in, for example, U.S. Pat. Nos. 2,421,811, 2,421,812, 2,411,967 and 2,681,371, J. Amer. Chem. Soc., 65, 1943, 1276, J. Amer. Chem. Soc., 65, 1943, 1281, J. Amer. Chem. Soc., 63, 1941, 1887, J. Amer. Chem. Soc., 107, 24, 1985, 7053, Helv. Chim. Acta., 21, 1938, 939, Helv. Chim. Acta., 28, 1945, 438, Chem. Ber., 71, 1938, 2637, J. Org. Chem., 4, 1939, 311, J. Org. Chem., 6, 1941, 229, J. Chem. Soc., 1938, 1382, Helv. Chim. Acta., 21, 1931, 1234, Tetrahedron Lett., 33, 26, 1992, 3795, J. Chem. Soc. Perkin. Trans. 1, 1981, 1437, and Synthesis, 6, 1995, 693.

The compounds represented by formulas (VIII-1) and (VIII-2) are preferably added after being formed into an emulsified dispersion by a known dispersing method. When emulsifying and dispersing those compounds, it is possible to cause them to coexist with additives generally used in the photograph industry such as dye-forming couplers and high-boiling organic solvents. The compounds may be added as a fine crystal dispersion.

The addition amounts of the compounds represented by general formulas (VIII-1) and (VIII-2) are each $5\times10^{-4}$ to 1 mol, and preferably $1\times10^{-3}$ to $5\times10^{-1}$ mol, per mol of silver halide in the emulsion layers to which they are added.

With respect to the combination of the compound of general formula (VII) and the compound of (VIII-1) or (VIII-2), preferred is the combination of the compound represented by general formula (VII-F) and the compound represented by general formula (VIII-1-b) or (VIII-2).

In the present invention, the compound represented by general formula (VII), a compound selected from the group consisting of the compounds represented by general formulas (VIII-1) and (VIII-2), and a compound selected from the group consisting of the compounds represented by general formulas (IX-1), (IX-2) and (X) may be added to the same layer or to separate layers.

The compound represented by general formula (IX-1) will be described in more detail. In the formula, the alkyl group is a straight chain, branched or cyclic alkyl group that may have a substituent. In general formula (IX-1), Rc1 represents a substituted or unsubstituted alkyl group (preferably, an alkyl group having 1–13 carbon atoms, e.g., methyl, ethyl, i-propyl, cyclopropyl, butyl, isobutyl, cyclohexyl, t-octyl, decyl, dodecyl, hexadecyl and benzyl), a substituted or unsubstituted alkenyl group (preferably, an alkenyl group having 2–14 carbon atoms, e.g., allyl, 2-butenyl, isopropenyl, oleyl and vinyl), and a substituted or unsubstituted aryl group (preferably, an aryl group having 6–14 carbon atoms, e.g., phenyl and naphthyl). Rc2 represents a hydrogen atom or the groups presented for Rc1. Rc3 is a hydrogen atom or a substituted or unsubstituted alkyl group having 1–10 carbon atoms (e.g., methyl, i-butyl and cyclohexyl) or a substituted or unsubstituted an alkenyl group (e.g., vinyl and i-propenyl). The total of the numbers of the carbon atoms contained in Rc1, Rc2 and Rc3 is 20 or less, and preferably 12 or less. Examples of substituents when Rc1 to Rc3 are substituted groups include a hydroxyl group, an alkoxy group, an aryloxy group, a silyl group, a silyloxy group, an alkylthio group, an arylthio group, an amino group, an acylamino group, a sulfonamide group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, a hydroxyamino group and a heterocyclic group. Rc1 and Rc3, or Rc2 and Rc3 may be bonded together to form a 5- to 7-membered ring.

Among the compounds represented by general formula (IX-1), preferred are compounds having the total number of carbon atoms is 20 or less, more preferably 12 or less.

The following are specific examples of the compound represented by general formula (IX-1), but the present invention is not restricted to them.

(IX-1-1)
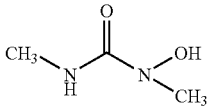
(IX-1-2)
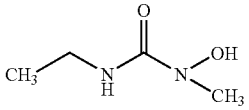
(IX-1-3)
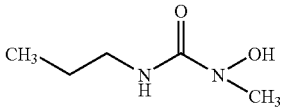
(IX-1-4)
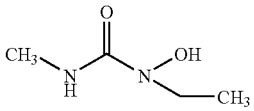
(IX-1-5)
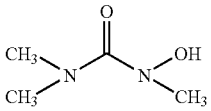
(IX-1-6)
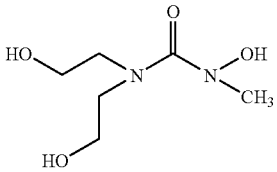
(IX-1-7)
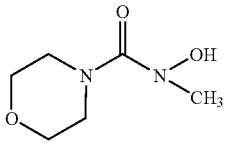
(IX-1-8)
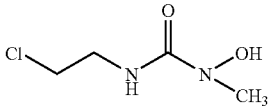
(IX-1-9)
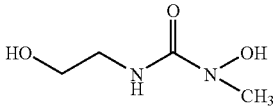
(IX-1-10)
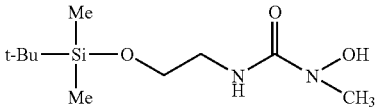
(IX-1-11)
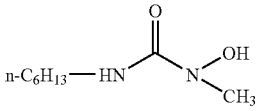
(IX-1-12)
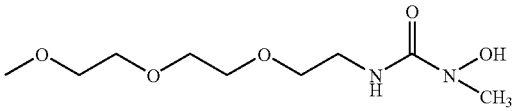
-continued
(IX-1-13)
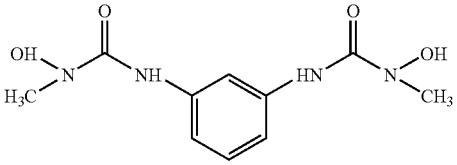
(IX-1-14)
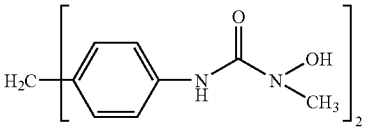
(IX-1-15)
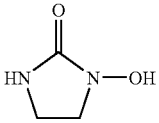
(IX-1-16)
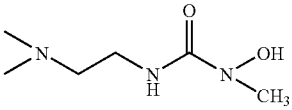
(IX-1-17)
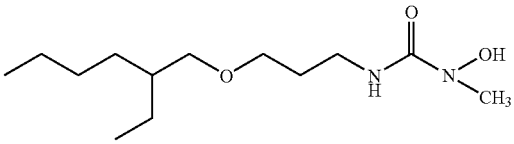
(IX-1-18)
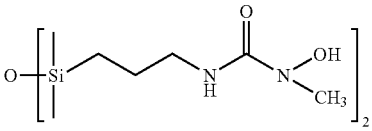
(IX-1-19)
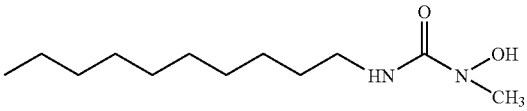
(IX-1-20)
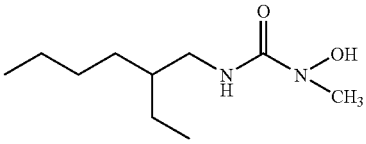
(IX-1-21)
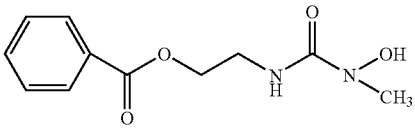
(IX-1-22)
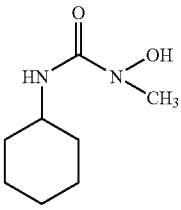

-continued (IX-1-23)

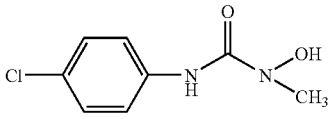

(IX-1-24)

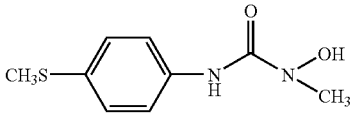

(IX-1-25)

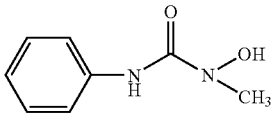

(IX-1-26)

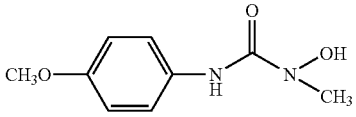

(IX-1-27)

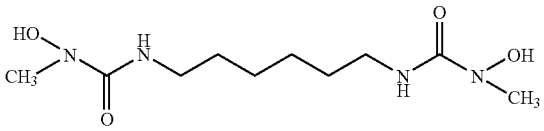

(IX-1-28)

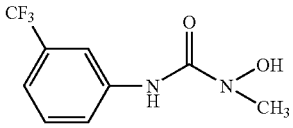

(IX-1-29)

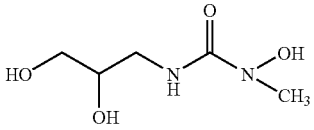

(IX-1-30)

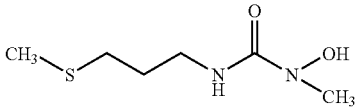

(IX-1-31)

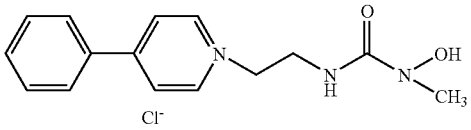

(IX-1-32)

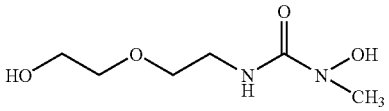

(IX-1-33)

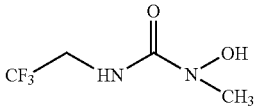

(IX-1-34)

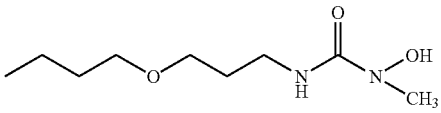

-continued (IX-1-35)

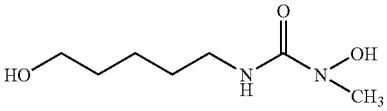

(IX-1-36)

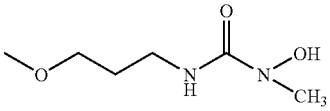

(IX-1-37)

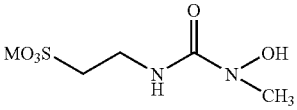

(IX-1-38)

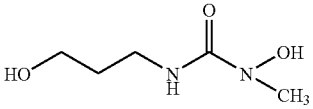

(IX-1-39)

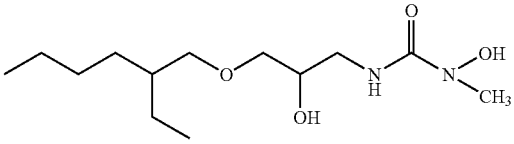

(IX-1-40)

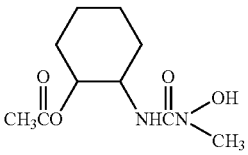

(IX-1-41)

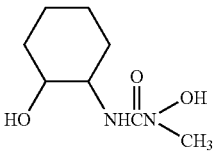

These compounds used in the present invention can be easily prepared by the methods described in J. Org. Chem., 27, 4054 ('62), J. Amer. Chem. Soc., 73, 2981 ('51) and JP-B-49-10692 and methods according to them.

In the present invention, the compound represented by general formula (IX) may be added after being dissolved in any of water, a water-soluble solvent such as methanol and ethanol, and a solvent mixture of these, or by emulsion dispersion. When a compound is dissolved in water, if the compound becomes to exhibit an increased solubility when the pH is raised or lowered, it can be added after being dissolved through the raising or lowering of the pH. It is also possible to cause a surfactant to coexist.

In the present invention, the compound represented by general formula (IX-1) is preferably added when an emulsion is prepared. When a compound is added in the preparation of an emulsion, this compound can be added at any point during the preparation. For example, the compound can be added during silver halide grain formation, before or during desalting, before or during chemical ripening, or before the preparation of a complete emulsion. The compound can also be added separately a plurality of times during these steps. Preferably, it is added before, during or after chemical sensitization. Further, it may be added before application of a coating solution. It may be added to a layer adjacent to an emulsion layer or another layer, resulting in its addition to the emulsion layer through its diffusion in the layer. Further, it is also possible use a mixture obtained by dispersing and dissolving the compound in an emulsified material after mixing the mixture with the above-mentioned emulsion.

The preferable addition amount of the compound represented by general formula (IX-1) depends greatly on the manner of its addition as described above and the kind of the compound to be added, but the compound is used preferably in an amount of from $1\times10^{-6}$ mol to $5\times10^{-2}$ mol, more preferably from $1\times10^{-5}$ mol to $5\times10^{-3}$ mol, per mol of an lightsensitive silver halide.

Next, the compound represented by general formula (IX-2) of the present invention will be described in detail.

G1 and G2 each represent a hydrogen atom or a monovalent substituent. They may be bonded together to form a ring. As the monovalent substituent, any one can be applied, but preferred is the aforementioned Yy. Preferred is a compound selected from the following general formulas (A-I), (A-II), (A-III), (A-IV) and (A-V):

(A-I)

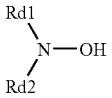

(A-II)

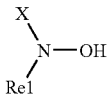

(A-III)

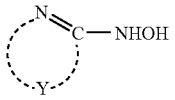

(A-IV)

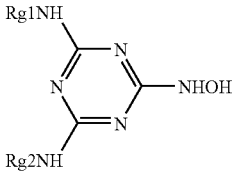

(A-V)

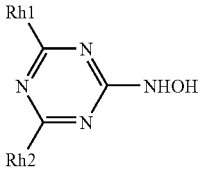

In general formula (A-I), Rd1 represents an alkyl group, an alkenyl group, an aryl group, an acyl group, an alkyl- or arylsulfonyl group, an alkyl- or arylsulfinyl group, a carbamoyl group, a sulfamoyl group, an alkoxycarbonyl group or an aryloxycarbonyl group. Rd2 represents a hydrogen atom or a group presented for Rd1. It is to be noted that when Rd1 is an alkyl group, an alkenyl group or an aryl group, Rd2 is an acyl group, an alkyl- or arylsulfonyl group, an alkyl- or arylsulfinyl group, a carbamoyl group, a sulfamoyl group, an alkoxycarbonyl group or an aryloxycarbonyl group. Rd1 and Rd2 may be combined to form a 5- to 7-membered ring. Iv general formula (A-II), X represents a heterocyclic group, and Re1 represents an alkyl group, an alkenyl group or an aryl group. X and Re1 may be combined to form a 5- to 7-membered ring. In general formula (A-III), Y represents a group of non-metallic atoms required to form a 5-membered ring together with the —N═C— group. Y further represents a group of nonmetallic atoms required to form a 6-membered ring together with the —N═C— group, and the end of Y at which Y bonds with the carbon atom of the —N═C— group is a group selected from the group consisting of —N(Rf1)-, —C(Rf2)(Rf3)-, —C(Rf4)=, —O— and —S—, each of which bonds with the carbon atom of the —N═C— group via the left side bond thereof, and the above Rf1 to Rf4 each represent a hydrogen atom or a substituent. In general formula (A-IV), Rg1 and Rg2 may be the same or different from each other and each represent an alkyl group or an aryl group, provided that, when both Rg1 and Rg2 are the same substituted alkyl groups, each of Rg1 and Rg2 represents an alkyl group having 8 or more carbon atoms. In general formula (A-V), Rh1 and Rh2 may be the same or different from each other and each represent a hydroxylamino group, a hydroxyl group, an amino group, an alkylamino group, an arylamino group, an alkoxy group, an aryloxy group, an alkylthio group, an arylthio group, an alkyl group or an aryl group, provided that Rh1 and Rh2 do not simultaneously represent —NHRh3, wherein Rh3 represents an alkyl group or an aryl group. Rd1 and Rd2, and X and Re1 may be bonded together to form a 5- to 7-membered ring.

The inventors of the present invention have found that oxygen is one of the causes of variations in the photographic properties occurring while a lightsensitive material is stored or after photographing and before development. They estimate that a certain compound in a lightsensitive material reacts with oxygen to have an influence on the photographic properties and compounds represented by formulas (A-I) to (A-V) above capture this compound. Variations of the photographic properties are sometimes increased when a gelatin coating amount is increased. They estimate that this is so because a slight amount of an impurity in gelatin reacts with oxygen to have an influence on the photographic properties. It is also found that the resistance to pressure can be improved by the compounds represented by formulas (A-I) to (A-V). The present invention will be described in more detail below.

The compounds represented by general formulas (A-I) to (A-V) will be described in more detail.

In these formulas, the alkyl group is a straight chain, branched or cyclic alkyl group, which may have a substituent. In general formula (A-I), Rd1 represents an alkyl group (preferably, an alkyl group having 1–36 carbon atoms, e.g., methyl, ethyl, i-propyl, cyclopropyl, butyl, isobutyl, cyclohexyl, t-octyl, decyl, dodecyl, hexadecyl and benzyl), an alkenyl group (preferably, an alkenyl group having 2–36 carbon atoms, e.g., allyl, 2-butenyl, isopropenyl, oleyl and vinyl), an aryl group (preferably, an aryl group having 6–40 carbon atoms, e.g., phenyl and naphthyl), an acyl group (preferably, an acyl group having 2–36 carbon atoms, e.g., acetyl, benzoyl, pivaloyl, α-(2,4-di-tert-amylphenoxy)butyryl, myristoyl, stearoyl, naphthoyl, m-pentadecylbenzoyl, and isonicotinoyl), an alkyl- or arylsulfonyl group (preferably, an alkylsulfonyl group having 1–36 carbon atoms or an arylsulfonyl group having 6–36 carbon atoms, e.g., methanesulfonyl, octanesulfonyl, benzenesulfonyl and toluenesulfonyl), an alkyl- or arylsulfinyl group (preferably an alkylsulfinyl group having 1–40 carbon atoms or an arylsulfinyl group having 6–40 carbon atoms, e.g., methanesulfinyl and benzenesulfinyl), a carbamoyl group (also including an N-substituted carbamoyl group and preferably a carbamoyl group having 0–40 carbon atoms, e.g., N-ethylcarbamoyl, N-phenylcarbamoyl, N,N-dimethylcarbamoyl and N-butyl-N-phenylcarbamoyl), a sulfamoyl group (also including an N-substituted sulfamoyl group and preferably a sulfamoyl group having 1–40 carbon atoms, e.g., N-methylsulfamoyl, N,N-diethylsulfamoyl, N-phenylsulfamoyl, N-cyclohexyl-N-phenylsulfamoyl and N-ethyl-N-dodecylsulfamoyl), an alkoxycarbonyl group (preferably an alkoxycarbonyl group having 2–36 carbon atoms, e.g., methoxycarbonyl, cyclohexyloxycarbonyl, benzyloxycarbonyl, isoamyloxycarbonyl and hexadecyloxycarbonyl), or an aryloxycarbonyl group (preferably an aryloxycarbonyl group having 7 to 40 carbon atoms, e.g., phenoxycarbonyl and naphthoxycarbonyl). Rd2 represents a hydrogen atom or a group presented for Rd1.

In general formula (A-II), X represents a heterocyclic group (a group which forms a 5- to 7-membered heterocyclic ring having at least one of a nitrogen atom, a sulfur atom, an oxygen atom and a phosphor atom as a ring constituent atom and in which the bonding position (the position of a monovalent group) of the heterocyclic ring is preferably a carbon atom, e.g., 1,3,5-triazin-2-yl, 1,2,4-triazin-3-yl, pyridin-2-yl, pyradinyl, pyrimidinyl, purinyl, quinolyl, imidazolyl, 1,2,4-triazol-3-yl, benzimidazol-2-yl, thienyl, furyl, imidazolydinyl, pyrrolinyl, tetrahydrofuryl, morpholinyl and phosphinolin-2-yl). Re1 represents an alkyl group, an alkenyl group or an aryl group in the same meaning as Rd1 in general formula (A-I).

In formula (A-III), Y represents a group of non-metallic atoms (e.g., the cyclic group formed is imidazolyl, benzimidazolyl, 1,3-thiazol-2-yl, 2-imidazolin-2-yl, purinyl or 3H-indol-2-yl) required to form a 5-membered ring together with —N═C—. Y further represents a group of non-metallic atoms required to form a 6-membered ring together with the —N═C— group, and the end of Y which bonds to a carbon atom in the —N═C— group represents a group (which bonds to a carbon atom in —N═C— on the left side of the group) selected from —N(Rf1)-, —C(Rf2) (Rf3)-, —C(Rf4)=, —O—, and —S—. Rf1 to Rf4 may be the same or different and each represents a hydrogen atom or a substituent (e.g., an alkyl group, an alkenyl group, an aryl group, an alkoxy group, an aryloxy group, an alkylthio group, an arylthio group, an alkylamino group, an arylamino group and a halogen atom). Examples of the 6-membered cyclic group formed by Y are quinolyl, isoquinolyl, phthaladinyl, quinoxalinyl, 1,3,5-triazin-5-yl and 6H-1,2,5-thiadiazin-6-yl.

In general formula (A-IV), each of Rg1 and Rg2 represents an alkyl group (preferably an alkyl group having 1–36 carbon atoms, e.g., methyl, ethyl, i-propyl, cyclopropyl, n-butyl, isobutyl, hexyl, cyclohexyl, t-octyl, decyl, dodecyl, hexadecyl and benzyl) or an aryl group (preferably an aryl group having 6–40 carbon atoms, e.g., phenyl and naphthyl). When Rg1 and Rg2 are simultaneously unsubstituted alkyl groups and Rg1 and Rg2 are identical groups, Rg1 and Rg2 are alkyl groups having 8 or more carbon atoms.

In general formula (A-V), each of Rh1 and Rh2 represents a hydroxylamino group, a hydroxyl group, an amino group, an alkylamino group (preferably an alkylamino group having 1–50 carbon atoms, e.g., methylamino, ethylamino, diethylamino, methylethylamino, propylamino, dibutylamino, cyclohexylamino, t-octylamino, dodecylamino, hexadecylamino, benzylamino and benzylbutylamino), an arylamino group (preferably an arylamino group having 6–50 carbon atoms, e.g., phenylamino, phenylmethylamino, diphenylamino and naphthylamino), an alkoxy group (preferably an alkoxy group having 1–36 carbon atoms, e.g., methoxy, ethoxy, butoxy, t-butoxy, cyclohexyloxy, benzyloxy, octyloxy, tridecyloxy and hexadecyloxy), an aryloxy group (preferably an aryloxy group having 6–40 carbon atoms, e.g., phenoxy and naphthoxy), an alkylthio group (preferably an alkylthio group having 1–36 carbon atoms, e.g., methylthio, ethylthio, i-propylthio, butylthio, cyclohexylthio, benzylthio, t-octylthio and dodecylthio), an arylthio group (preferably an arylthio group having 6–40 carbon atoms, e.g., phenylthio and naphthylthio), an alkyl group (preferably an alkyl group having 1–36 carbon atoms, e.g., methyl, ethyl, propyl, butyl, cyclohexyl, i-amyl, sec-hexyl, t-octyl, dodecyl and hexadecyl), or an aryl group (preferably an aryl group having 6–40 carbon atoms, e.g., phenyl and naphthyl). It is to be noted that Rh1 and Rh2 cannot be —NHR (R is an alkyl group or an aryl group) at the same time.

Rd1 and Rd2 or X and Re1 may be bonded together to form a 5- to 7-membered ring. Examples of such a ring include a succinimide ring, a phthalimide ring, a triazole ring, a urazol ring, a hydantoin ring and a 2-oxo-4-oxazolidinone ring. Each group in the compounds represented by general formulas (A-I) to (A-V) may be further substituted with a substituent. Examples of such a substituent include an alkyl group, an alkenyl group, an aryl group, a heterocyclic group, a hydroxyl group, an alkoxy group, an aryloxy group, an alkylthio group, an arylthio group, an amino group, an acylamino group, a sulfonamide group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group and a hydroxyamino group.

In general formula (A-I), preferred is a compound in which Rd2 is a hydrogen atom, an alkyl group, an alkenyl group or an aryl group and Rd1 is an acyl group, a sulfonyl group, a sulfinyl group, a carbamoyl group, a sulfamoyl group, an alkoxycarbonyl group or an aryloxycarbonyl group. More preferred is a compound in which Rd2 is an alkyl group or an alkenyl group and Rd1 is an acyl group, a sulfonyl group, a carbamoyl group, a sulfamoyl group, an alkoxycarbonyl group or an aryloxycarbonyl group. The most preferred is a compound in which Rd2 is an alkyl group and Rd1 is an acyl group.

In general formula (A-II), Re1 is an alkyl group or an alkenyl group is preferable. A compound in which Re1 is an alkyl group is more preferable. On the other hand, as general formula (A-II), a compound represented by the following general formula (A-II-1) is preferable, and it is more preferable that X is 1,3,5-triazin-2-yl. A compound represented by the following general formula (A-II-2) is most preferable.

(A-II-1)

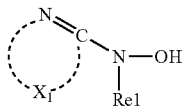

In general formula (A-II-1), Re1 represents Re1 in general formula (A-II), and $X_1$ represents a group of non-metallic atoms required to form a 5- or 6-membered ring. Of the compounds represented by general formula (A-II-1), a compound in which $X_1$ forms a 5- or 6-membered heterocyclic aromatic ring is more preferable.

(A-II-2)

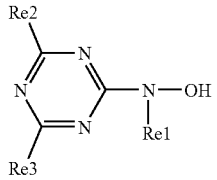

In general formula (A-II-2), Re1 has the same meaning as Re1 in general formula (A-II). Re2 and Re3 may be the same or different and each represent a hydrogen atom or a substituent. Of the compounds represented by general formula (A-II-2), a compound in which each of Re2 and Re3 is a hydroxyamino group, a hydroxyl group, an amino group, an alkylamino group, an arylamino group, an alkoxy group, an aryloxy group, an alkylthio group, an arylthio group, an alkyl group or an aryl group is particularly preferable.

Of the compounds represented by general formula (A-III), a compound in which Y is a group of non-metal atoms required to form a 5-membered ring is preferable, and a compound in which the end atom of Y which bonds to a carbon atom of the —N═C— group is a nitrogen atom is more preferable. A compound in which Y forms an imidazoline ring is most preferable. This imidazoline ring may also be condensed with a benzene ring.

Of the compounds represented by general formula (A-IV), a compound in which each of Rg1 and Rg2 is an alkyl group is preferable. In general formula (A-V), each of Rh1 and Rh2 is preferably a group selected from a hydroxyamino group, an alkylamino group and an alkoxy group. It is particularly preferable that Rh1 is a hydroxylamino group and Rh2 is an alkylamino group.

Of the compounds represented by general formulas (A-I) to (A-V), a compound having 15 or less carbon atoms in total is preferable to be made act also on layers other than the layer to which it is added, and a compound having 16 or more carbon atoms in total is preferable to be made act only on the layer to which it is added. Of the compounds represented by general formulas (A-I) to (A-V), the compounds represented by general formulas (A-I), (A-II), (A-IV) and (A-V) are preferable, the compounds represented by general formulas (A-I), (A-IV) and (A-V) are more preferable, and the compounds represented by general formulas (A-I) and (A-V) are most preferable. Specific examples of the compounds represented by general formulas (A-I) to (A-V) are presented below, but the present invention is not restricted to them.

IX-2-1

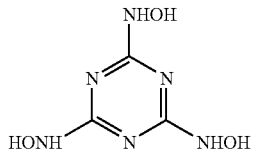

IX-2-2

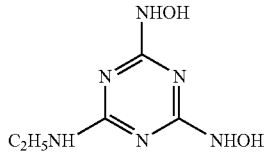

-continued

IX-2-3

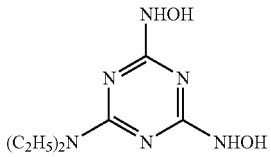

IX-2-4

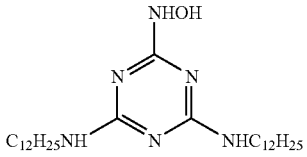

IX-2-5

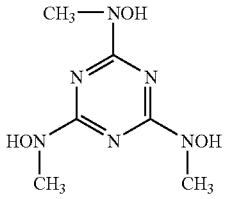

IX-2-6

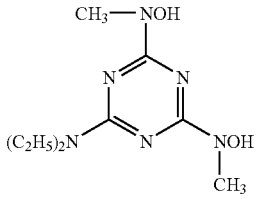

IX-2-7

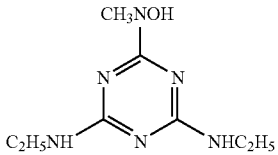

IX-2-8

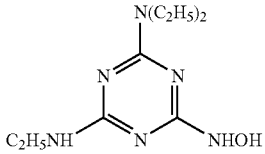

IX-2-9

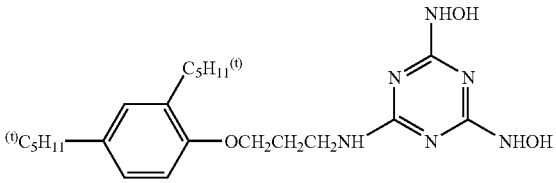

IX-2-10

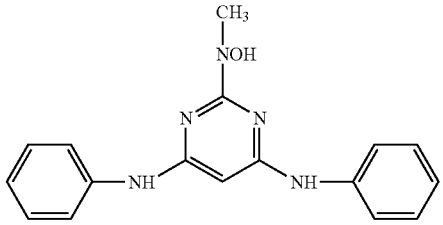

-continued
IX-2-11
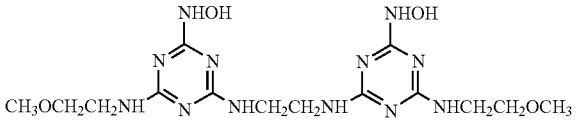
IX-2-12
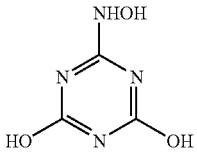
IX-2-13
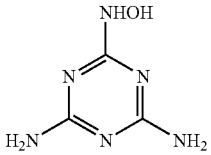
IX-2-14
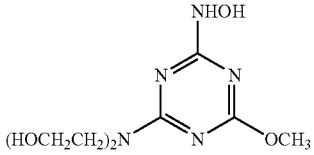
IX-2-15
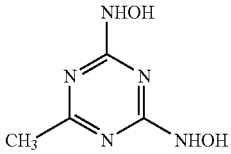
IX-2-16
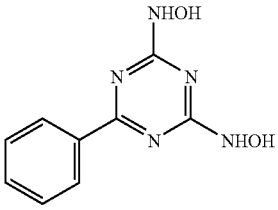
IX-2-17
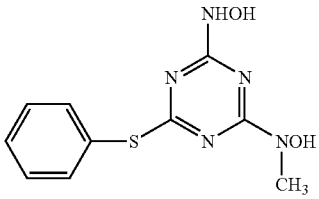
IX-2-18
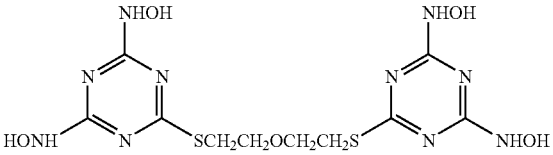
-continued
IX-2-19
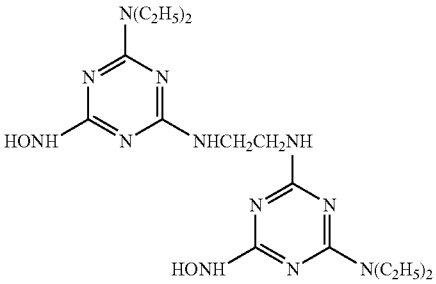
IX-2-20
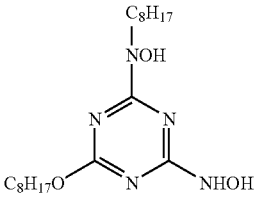
IX-2-21
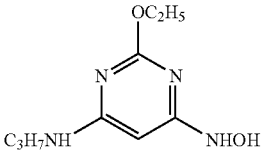
IX-2-22
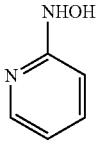
IX-2-23
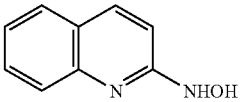
IX-2-24
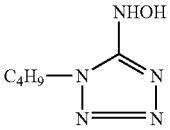
IX-2-25
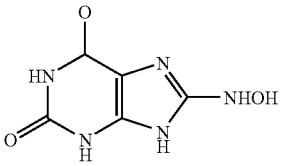
IX-2-26
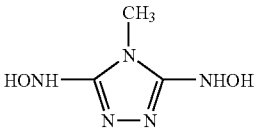
IX-2-27
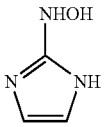

-continued
IX-2-28
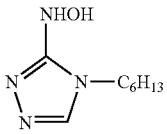
IX-2-29
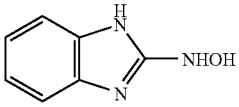
IX-2-30
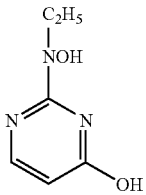
IX-2-31
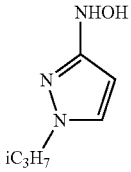
IX-2-32
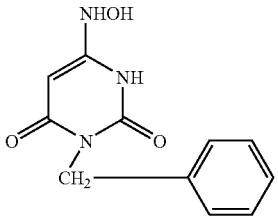
IX-2-33
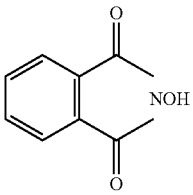
IX-2-34
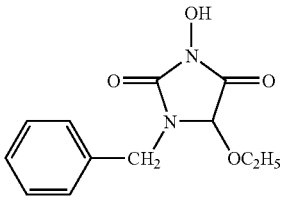
IX-2-35
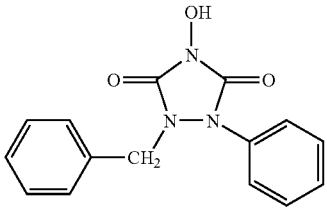
-continued
IX-2-36
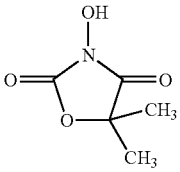
IX-2-37
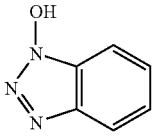
IX-2-38
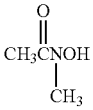
IX-2-39
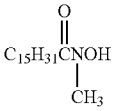
IX-2-40
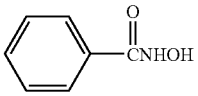
IX-2-41
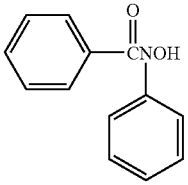
IX-2-42
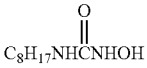
IX-2-43
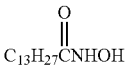
IX-2-44
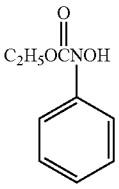
IX-2-45
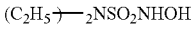
IX-2-46
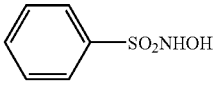
IX-2-47
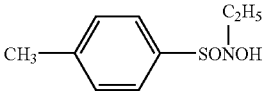
IX-2-48
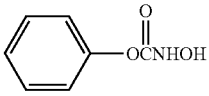

-continued

IX-2-49

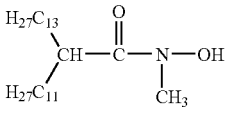

IX-2-50

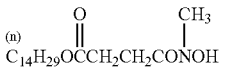

IX-2-51

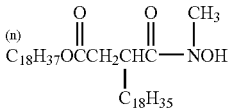

IX-2-52

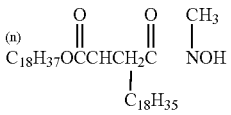

IX-2-53

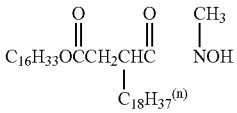

IX-2-54

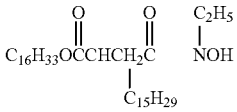

IX-2-55

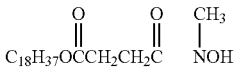

The correspondence between these compounds and general formulas (A-I) to (A-V) is as follows:

General formula (A-I) A-33 to A-55.

General formula (A-II) A-5 to A-7, A-10, A-20, A-30.

General formula (A-III) A-21 to A-29, A-31, A-32.

General formula (A-IV) A-8, A-11, A-19.

General formula (A-V) A-1 to A-4, A-9, A-12 to A-18

These compounds of the present invention can be easily synthesized by methods described in, for example, J. Org. Chem., 27, 4054 ('62), J. Amer. Chem. Soc., 73, 2981 ('51), and JP-B-49-10692, or by methods based on these methods. In the present invention, the compounds represented by general formulas (A-I) to (A-V) may be added after being dissolved in any of water, a water-soluble solvent such as methanol or ethanol, and a solvent mixture of these solvents, or may be added by emulsion dispersion. Further, they may also be added prior to the preparation of an emulsion. When a compound is dissolved in water, if the compound becomes to exhibit an increased solubility when the pH is raised or lowered, it may be added after being dissolved through the raising or lowering of the pH. In the present invention, two or more different types of the compounds represented by general formulas (A-I) to (A-V) may be used together. For example, using a water soluble compound and an oil soluble compound in combination is advantageous from the viewpoint of photographic performance. The application amounts of the compounds (A-I) to (A-V) are preferably $10^{-4}$ mmol/m$^2$ to 10 mmol/m$^2$, and more preferably $10^{-3}$ mmol/m$^2$ to 1 mmol/m$^2$.

Next, the compound represented by general formula (X) will be described. In general formula (X), Rb17, Rb18 and Rb19 each independently represent a hydrogen atom, an alkyl group, an alkenyl group, an alkynyl group, an aryl group or a heterocyclic group. Rb20 represents a hydrogen atom, an alkyl group, an alkenyl group, an alkynyl group, an aryl group, a heterocyclic group or NRb21Rb22. J represents —CO— or —$SO_2$—, and n represents 0 or 1. Rb21 represents a hydrogen atom, a hydroxyl group, an amino group, an alkyl group, an alkenyl group, an alkynyl group, an aryl group or a heterocyclic group. Rb22 represents a hydrogen atom, an alkyl group, an alkenyl group, an alkynyl group, an aryl group or a heterocyclic group.

In Rb17, Rb18 and Rb19, the alkyl group, the alkenyl group and the alkynyl group are those having 1–30 carbon atoms, and particularly a straight chain, branched or cyclic alkyl having 1–10 carbon atoms, an alkenyl group having 2–10 carbon atoms and an alkynyl group having 2–10 carbon atoms. Examples of the alkyl group, the alkenyl group, the alkynyl group and the aralkyl group include methyl, ethyl, propyl, cyclopropyl, allyl, propargyl and benzyl. In Rb17, Rb18 and Rb19, the aryl group is preferably an aryl group having 6–30 carbon atoms, and particularly preferably, a monocyclic or condensed aryl group having 6–12 carbon atoms. Examples thereof are phenyl and naphthyl. In Rb17, Rb18 and Rb19, the heterocyclic group represented is a 3- to 10-membered, saturated or unsaturated, heterocyclic group containing at least one of a nitrogen atom, oxygen atom and sulfur atom. This group may be a monocyclic ring or may form a condensed ring with another aromatic ring. The heterocycle is preferably a 5- or 6-membered, aromatic, heterocyclic ring. Examples thereof include pyridyl, imidazolyl, quinolyl, benzimidazolyl, pyrimidyl, pyrazolyl, isoquinolyl, thiazolyl, thienyl, furyl and benzothioazolyl.

In Rb20, the alkyl group, the alkenyl group, the alkynyl group, the aryl group and the heterocyclic group have the same meanings as Rb17, Rb18 and Rb19. In NRb21Rb22 of Rb20, the alkyl group, the alkenyl group, the alkynyl group, the aryl group and the heterocyclic group have the same meanings as Rb17, Rb18 and Rb19. Each of the substituents represented by Rb17, Rb18, Rb19, Rb20, Rb21 and Rb22 may be substituted with the aforementioned substituent Yy.

In general formula (X), Rb17 and Rb18, Rb17 and Rb19, Rb19 and Rb20, or Rb20 and Rb18 may be bonded together to form a ring.

In general formula (X), when n is 0, it is preferable that Rb17, Rb18 and Rb19 are each an alkyl group having 1–10 carbon atoms, an alkenyl group having 2–10 carbon atoms, an alkynyl group having 2–10 carbon atoms, an aryl group having 6–10 carbon atoms or a nitrogen-containing heterocyclic group, Rb20 is a hydrogen atom, an alkyl group having 1–10 carbon atoms, an alkenyl group having 2–10 carbon atoms, an alkynyl group having 2–10 carbon atoms, an aryl group having 6–10 carbon atoms, or a nitrogen-containing heterocyclic group. It is more preferable that Rb17, Rb18 and Rb19 are each an alkyl group having 1–10 carbon atoms, an alkenyl group having 2–10 carbon atoms, an alkynyl group having 2–10 carbon atoms, an aryl group having 6–10 carbon atoms or a nitrogen-containing heterocyclic group, Rb20 is a hydrogen atom. When n is 1, it is preferable that Rb17, Rb18 and Rb19 are each a hydrogen atom, an alkyl group having 1–10 carbon atoms, an alkenyl group having 2–10 carbon atoms, an alkynyl group having 2–10 carbon atoms, an aryl group having 6–10 carbon atoms or a nitrogen-containing heterocyclic group, J is —CO—, Rb20 is a hydrogen atom, an alkyl group having 1–10 carbon atoms, an alkenyl group having 2–10 carbon atoms, an alkynyl group having 2–10 carbon atoms, an aryl group having 6–10 carbon atoms, a nitrogen-containing heterocyclic group or NRb21Rb22, Rb21 is a hydrogen atom, a hydroxyl group, an amino group, an alkyl group having 1–10 carbon atoms, an alkenyl group having 2–10 carbon atoms, an alkynyl group having 2–10 carbon atoms, an aryl group having 6–10 carbon atoms or a nitrogen-containing heterocyclic group, and Rb22 is a hydrogen atom, an alkyl group having 1–10 carbon atoms, an alkenyl group having 2–10 carbon atoms, an alkynyl group, an aryl group having 6–10 carbon atoms or a nitrogen-containing heterocyclic group. It is more preferable that Rb17 is an aryl group having 6–10 carbon atoms, Rb18 and Rb19 are each a hydrogen atom, J is —CO—, Rb20 is NRb21Rb22, and Rb59 is a hydrogen atom, a hydroxyl group, an alkyl group having 1–10 carbon atoms, an alkenyl group or an alkynyl group.

Specific examples of the compound represented by general formula (X) are presented below, but the present invention is not restricted to them.

X-1

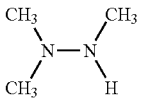

X-2

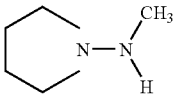

X-3

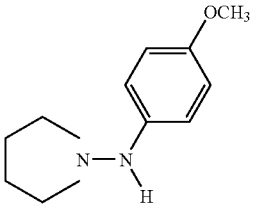

X-4

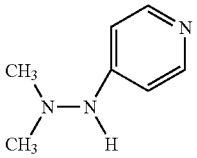

X-5

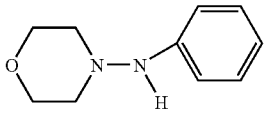

X-6

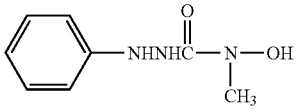

X-7

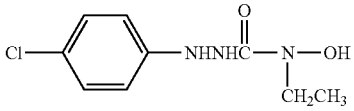

X-8

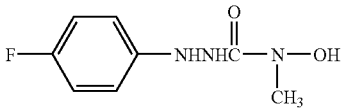

-continued

X-9

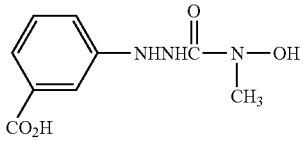

X-10

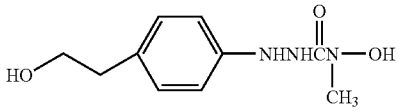

X-11

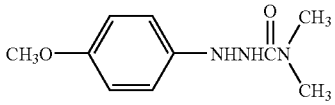

X-12

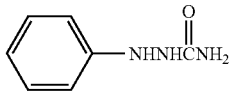

X-13

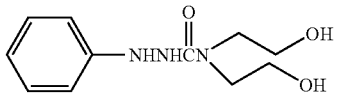

X-14

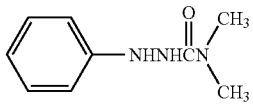

The compound represented by general formula (X) is readily available as chemicals on the market or as a compound synthesized from these chemicals on the market by known methods.

The compound represented by general formula (X) is preferably added to a layer adjacent to an emulsion layer or another layer before or during application of a coating solution, thereby being added to the emulsion layer through its dispersion therein. It is also possible to add that compound before, during or after the chemical sensitization in preparation of an emulsion. The preferable addition amount of that compound depends greatly on the manner of its addition as described above and the kind of the compound to be added, but in general, the compound is used in an amount of from $5\times10^{-6}$ mol to 0.05 mol, preferably from $1\times10^{-5}$ mol to 0.005 mol, per mol of an lightsensitive silver halide. The addition of the compound in an amount more than the amount mentioned above is not preferable because it will result in some adverse effect such as increase of fogging. It is preferable that the compound represented by general formula (X) is added after being dissolved in a water-soluble solvent. The pH of the solution may be decreased or increased with an acid or a base, and a surfactant may exist together with that compound. Further, that compound may be added after being formed into an emulsified dispersion and then being dissolved in a high boiling organic solvent. Alternatively, it may be added after being formed into a fine crystal dispersion by a known dispersing process. Two or more compounds represented by general formula (X) may be used together. When two or more compounds are used together, they may be added to either the same layer or separate layers.

Here, the above general formula (XI) will be described in more detail.

In the general formula (XI), $X^2$ and $Y^2$ each independently represent a hydroxyl group, —$NR^{i23}R^{i24}$ or —$NHSO_2R^{i25}$. $R^{i21}$ and $R^{i22}$ each independently represent a hydrogen atom or an optional substituent. Examples of such an optional substituent include an alkyl group (preferably that having 1–20 carbon atoms, e.g., methyl, ethyl, octyl, hexadecyl and t-butyl), an aryl group (preferably that having 6–20 carbon atoms, e.g., phenyl and p-tolyl), an amino group (preferably that having 0–20 carbon atoms, e.g., unsubstituted amino, diethylamino, diphenylamino and hexadecylamino), an amide group (preferably that having 1–20 carbon atoms, e.g., acetylamino, benzoylamino, octadecanoylamino and benzenesulfonamind), an alkoxy group (preferably that having 1–20 carbon atoms, e.g., methoxy, ethoxy and hexadecyloxy), an alkylthio group (preferably that 1–20 carbon atoms, e.g., methylthio, butylthio and octadecylthio), an acyl group (preferably that having 1–20 carbon atoms, e.g., acetyl, hexadecanoyl, benzoyl and benzenesulfonyl), a carbamoyl group (preferably that having 1–20 carbon atoms, e.g., unsubstituted carbamoyl, N-hexylcarbamoyl and N,N-diphenylcarbamoyl), an alkoxycarbonyl group (preferably that having 2–20 carbon atoms, e.g., methoxycarbonyl and octyloxycarbonyl), a hydroxyl group, a halogen atom (e.g., F, Cl and Br), a cyano group, a nitro group, a sulfo group and a carboxyl group.

These substituents may further be substituted with another substituent (e.g., those presented for Yy).

$R^{i21}$ and $R^{i22}$ may be bonded together to form a carbon ring or a heterocycle (both preferably being a 5- to 7-membered ring). $R^{i23}$ and $R^{i24}$ each independently represent a hydrogen atom, an alkyl group (preferably that having 1–10 carbon atoms, e.g., ethyl, hydroxyethyl and octyl), an aryl group (preferably that having 6–10 carbon atoms, e.g., phenyl and naphthyl), or a heterocyclic group (preferably that having 2–10 carbon atoms, e.g., 2-furanyl and 4-pyridyl), and these may further be substituted with a substituent.

$R^{i23}$ and $R^{i24}$ may be bonded together to form a nitrogen-containing heterocycle (preferably a 5- to 7-membered ring). $R^{i25}$ represents an alkyl group (preferably that having 1–20 carbon atoms, e.g., ethyl, octyl and hexadecyl), an aryl group (preferably that having 6–20 carbon atoms, e.g., phenyl, p-tolyl and 4-dodecyloxyphenyl), an amino group (preferably that having 0–20 carbon atoms, e.g., N,N-diethylamino, N,N-diphenylamino and morpholino), or a heterocyclic group (preferably that having 2–20 carbon atoms, e.g., 3-pyridyl), and these may further be substituted.

In general formula (XI), $X^2$ is preferably —$NR^{i23}R^{i24}$ or —$NHSO_2R^{i25}$. $R^{i21}$ and $R^{i22}$ are each preferably a hydrogen atom, an alkyl group or an aryl group. They may be bonded together to form a carbon ring or a heterocycle. Details of these groups are the same as $R^{i23}$ and $R^{i24}$.

Specific examples of the compound represented by general formula (XI) are presented below, but the present invention is not restricted to them.

XI-1

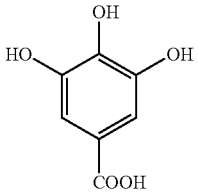

-continued

XI-2

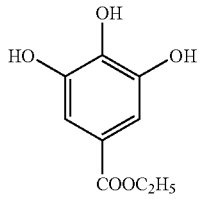

XI-3

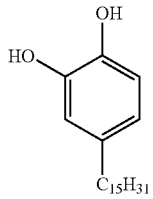

XI-4

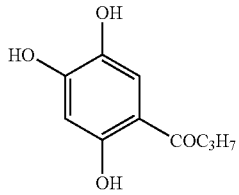

XI-5

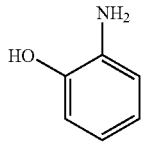

XI-6

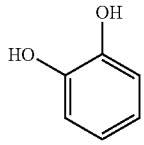

XI-7

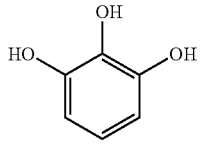

XI-8

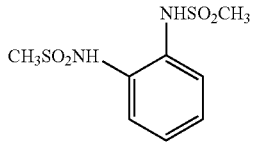

XI-9

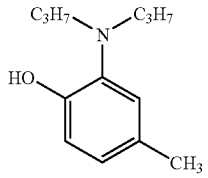

XI-10

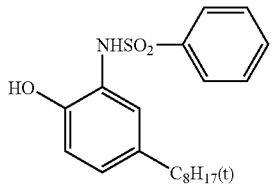

-continued (XI)-11

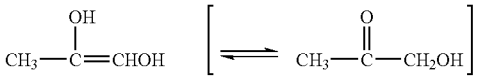

(XI)-12

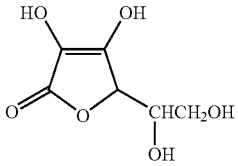

(XI)-13

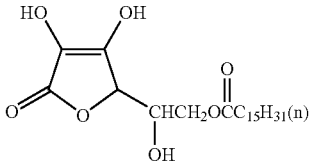

(XI)-14

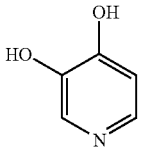

(XI)-15

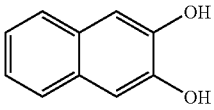

(XI)-16

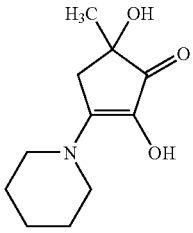

(XI)-17

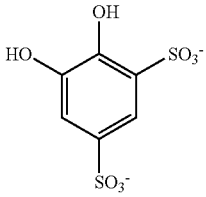

Among the compounds represented by formulas (VI) to (XI), those represented by formulas (IX-1), (IX-2), (VIII-1), (VII-2), (VII), (VI), and (X) are preferable, those represented by (IX-1), (IX-2), (VIII-1), (VII-2), and (VII) are more preferable, and those represented by formulas (IX-1), (IX-2), (VIII-1), and (VIII-2) are much more preferable. Especially preferable compounds are those represented by formulas (IX-1) and (IX-2).

With respect to the lightsensitive layer of the present invention, one or more layers may be provided on a support. The layers may be provided not only on one side of the support but also on both sides thereof. The lightsensitive layer of the present invention may be used for black-and-white silver halide photographic lightsensitive materials (e.g., X-ray lightsensitive materials, lithographic lightsensitive materials and negative films for black-and-white photographing) and color photographic lightsensitive materials (e.g., color negative films, color reversal films and color papers). In addition, the lightsensitive layer of the present invention may also be used for diffusion transfer lightsensitive materials (e.g., color diffusion transfer elements and silver salt diffusion transfer elements), and heat-developable lightsensitive materials (both black-and-white and color).

The color photographic lightsensitive material will be described in detail below, but it is not limited to this description.

The silver halide photographic material is only required to be provided with at least one of a blue-sensitive layer, a green-sensitive layer and a red-sensitive layer, on a support. The number of layers and order thereof of the material is not particularly limited. As an typical example, a silver halide photographic lightsensitive material provided with at least one unit of silver halide emulsion layers each having the same color-sensitivity but different in light-sensitivity, on a support, can be mentioned. The silver halide emulsion layers are a unit lightsensitive layer sensitive to one of blue light, green light and red light. In a multi-layered silver halide color photographic material, the unit lightsensitive layers are usually arranged in an order of a red-sensitive layer, a green-sensitive-layer, and a blue-sensitive layer on a support in this order from the one closest to the support. However, the arrangement order may be reversed depending on the purpose of the photographic material. Further, the arrangement order in which a different lightsensitive layer is sandwiched between the same color sensitive layers may be acceptable.

A non lightsensitive layer, such as a inter layer for each layer, can be formed between the silver halide lightsensitive layers and as the uppermost layer and the lowermost layer.

These intermediate layers may contain couplers and DIR compounds described in JP-A's-61-43748, 59-113438, 59-113440, 61-20037 and 61-20038, and may contain color-mixing inhibitor as usually may be.

As for a plurality of silver halide emulsion layers constituting respective unit lightsensitive layer, a two-layered structure of high- and low-speed emulsion layers can be preferably used as described in DE (German Patent) 1,121,470 or GB 923,045, the disclosures of which are incorporated herein by reference. Usually, preferable arrangement of high- and low-speed emulsion layers is in this order so as to the speed becomes lower toward the support, and a non lightsensitive layer may be arranged between each silver halide emulsion layers. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

Various layer configurations and arrangements can be selected depending on the purpose of each lightsensitive material, as mentioned above.

The above various additives can be used in the lightsensitive material according to the present technology, to which other various additives can also be added in conformity with the object.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical-sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |

-continued

| | Types of additives | RD17643 | RD18716 | RD308119 |
|---|---|---|---|---|
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couples may be used in the present invention, and the specific examples thereof are described in the patents described in the patents described in the aforementioned Research Disclosure No. 17643, VII-C to G and No. 307105, VII-C to G.

Preferred yellow couplers are those described in, for example, U.S. Pat. Nos. 3,933,051, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and European Patent No. 249,473A.

Particularly preferred magenta couplers are 5-pyrazolone and pyrazoloazole compounds. Particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, European Patent Nos. 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451,820, 4,080,211, 4,367,282, 4,409,320 and 4,576,910, British Patent No. 2,102,137 and European Patent No. 341,188A.

The couplers capable of forming a colored dye having a suitable diffusibility are preferably those described in U.S. Pat. No. 4,366,237, British Patent No. 2,125,570, European Patent No. 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. 4,163,670, JP-B-57-39413, U.S. Pat. Nos. 4,004,929 and 4,138,258 and British Patent No. 1,146,368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds that release a photographically useful residue during a coupling reaction are also preferably usable in the present invention. DIR couplers which release a development inhibitor are preferably those described in the patents shown in the above described RD 17643, VII-F and No. 307105, VII-F as well as those described in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in British Patent Nos. 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidate of a developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in European Patent Nos. 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322,027. The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2,4-di-t-amylphenyl)phthalate, bis(2,4-di-t-amylphenyl) isophthalate and bis(1,1-diethylpropyl)phthalate), phosphates and phosphonates (such as triphenyl phosphate, tricresyl phosphate, 2-ethylhexyldihenyl phosphate, tricyclohexyl phosphate, tri-2-ethylhexyl phosphate, tridodecyl phoshate, tributoxyethyl phosphate, trichloropropyl phosphate and di-2-ethylhexylphenyl phosphate), benzoates (such as 2-ethylhexyl benzoate, dodecyl benzoate and 2-ethylhexyl-p-hydroxybenzoate), amides (such as N,N-di ethyldodecaneamide, N,N-diethyllaurylamide and N-tetradecylpyrrolidone), alcohols and phenols (such as isostearyl alcohol and 2,4-di-tert-amylphenol), aliphatic carboxylates (such as bis(2-ethylhexyl) sebacate, dioctyl azelate, glycerol tributyrate, isostearyl lactate and trioctyl citrate), aniline derivatives [such as N,N-dibutyl-2-butoxy-5-tert-octylaniline] and hydrocarbons (such as paraffin, dodecylbenzene and diisopropylnaphthalene). Co-solvents usable in the present invention include, for example, organic solvents having a boiling point of at least about 30° C., preferably 50 to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. No. 4,199,363 and West German Patent Application (OLS) Nos. 2,541,274 and 2,541,230.

The color photosensitive material used in the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, positive color films and reversal color papers. The present invention may be particularly preferably used as color dupe films.

Suitable supports usable in the present invention are described, for example, on page 28 of the above-described RD. No. 17643, from right column, page 647 to left column, page 648 of RD. No. 18716 and on page 879 of RD. No. 307105.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. The thickness is determined at 25° C. and at a relative humidity of 55% (2 days). The film-swelling rate $T_{1/2}$ can be determined by a method known in this technical field. For example, it can be determined with a swellometer described on pages 124 to 129 of A. Green et al., "Photogr. Sci. Eng.", Vol. 19, No. 2. $T_{1/2}$ is defined to be the time required for attaining the thickness of a half (½) of the saturated film thickness (the saturated film thickness being 90% of the maximum thickness of the film swollen with the color developer at 30° C. for 3 minute 15 seconds)

The film-swelling rate $T_{1/2}$ can be controlled by adding a hardener to gelatin used as the binder or by varying the time conditions after the coating.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

The color photographic lightsensitive material according to the present invention may be developed by a conventional method described in aforementioned RD. No. 17643, pages 28 to 29, ditto No. 18716, page 651, left to right columns, and ditto No. 30705, pages 880 to 881.

The color developer to be used in the development of the light-sensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-bis-carboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

Further, when reversal processing is to be performed on the photographic material, color development is usually performed after black-and-white development. As the black-and-white developer, known black-and-white developers can be used singly or in combination, which include dihydroxybenzenes, such as hydroquinone, 3-pyrazolidones, such as 1-phenyl-3-pyrazolidone, or aminophenols, such as N-methyl-p-aminophenol. Theses black-and-white developers usually have a pH of from 9 to 12. The replenishment rate of the developer is usually 3 liter (hereinafter liter is also referred to as "L") or less per $m^2$ of the lightsensitive material, though depending on the type of the color photographic material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate}=[\text{area of processing solution in contact with air } (cm^2)]/[\text{volume of processing solution } (cm^3)]$$

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The period for the color development processing usually sets between 2 to 5 min, the processing time can be shortened further by setting high pH and temperature, and using high concentration color developer.

The photographic emulsion layer that has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-28426 and Research Disclosure No. 17129 (July 1978), thiazolidine derivatives as described in JP-A-51-140129, thiourea derivatives as described in JP-B-45-8506, JP-A's-52-20832, and 53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A's-49-40943, 49-59644, 53-94927, 54-35727, 55-26506 and 58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferably, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the light-sensitive material (for example, the kind of materials such as couplers, etc.), the end use of the light-sensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248–253 (May 1955).

According to the multi-stage counter-current system described in the above reference, although the requisite amount of water can be greatly reduced, bacteria would grow due to an increase of the retention time of water in the tank, and floating masses of bacteria stick to the light-sensitive material. In the processing for the color light-sensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyo-gijutsukai, (1982), and Nippon Bokin Bobi Gakkai (ed.), "Bokin bobizai jiten" (1986).

The washing water has a pH value of from 4 to 9, preferably from 5 to 8 in the processing for the light-sensitive material of the present invention. The temperature of the water and the washing time can be selected from broad ranges depending on the characteristics and end use of the light-sensitive material, but usually ranges from 15° C. to 45° C. in temperature and from 20 seconds to 10 minutes in time, preferably from 25° C. to 45° C. in temperature and from 30 seconds to 5 minutes in time. The light-sensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color light-sensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors, when it is contained in the light-sensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide lightsensitive material of the invention may be applied to heat-development lightsensitive material as described, for example, in U.S. Pat. No. 4,500,626, and JP-A's-60-133449, 59-218443 and 61-238056, and European Patent 210 660A2.

Further, the silver halide color photographic lightsensitive material of the invention can exhibit advantages easily when it is applied to lens-fitted film unit described, for example, in Jap. Utility Model KOKOKU Publication Nos. 2-32615 and 3-39784, which is effective.

EXAMPLE

The present invention will be specifically described by examples below. However, the present invention is not limited to there examples.

Example 1

Silver halide emulsions Em-A1 to -A11 were prepared by the following preparation methods.

(Em-A1)

42.2 L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of low-molecular weight gelatin having a molecular weight of 15,000 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 47.8 g of KBr were added. After that, the temperature was raised to 40° C. to ripen the material. After the ripening, 923 g of phthalated gelatin whose phthalation ratio is 97% and molecular weight is 100,000 and 79.2 g of KBr were added, and 15,947 mL of an aqueous solution containing 5,103 g of $AgNO_3$ and an aqueous KBr solution were added over 12 min by the double jet method while the flow rate was accelerated such that the final flow rate was 1.4 times the initial flow rate. During the addition, silver potential was maintained at −60 mV against a saturated calomel electrode. After washing with water, gelatin was added, the pH and the pAg were adjusted to 5.7 and 8.8, respectively, and the weight in terms of silver of the emulsion and the gelatin amount were adjusted to 131.8 g and 64.1 g, respectively, per kg of the emulsion, thereby preparing a seed emulsion. 1,211 mL of an aqueous solution containing 46 g of phthalated gelatin whose phthalation ratio is 97% and 1.7 g of KBr was vigorously stirred at 75° C. After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, 410 mL of an aqueous solution containing 144.5 g of $AgNO_3$ and a mixed aqueous KBr and KI solution containing 7 mol % of KI were added over 56 min by the double jet method while the flow rate was accelerated such that the final flow rate was 3.7 times the initial flow rate. During the addition, the silver potential was maintained at −30 mV against a calomel electrode. 121.3 mL of an aqueous solution containing 45.6 g of $AgNO_3$ and a KBr solution were added by the double jet method over 22 min. During the addition, the silver potential was maintained at +20 mV against a saturated calomel electrode. The temperature was raised to 82° C., followed by adjustment of the silver potential at −80 mV by an addition of KBr, an AgI fine grain emulsion having a grain size of 0.037 μm was added in an amount of 6.33 g in terms of silver. Immediately after the addition, 206.2 mL of an aqueous solution containing 66.4 g of $AgNO_3$ was added over 16 min. The silver potential was maintained at −80 mV with a KBr solution for the initial period of the addition of 5 min. After washing with water, gelatin comprising, in an amount of 30%, components each having a molecular weight measured according to the PAGI method of 280,000 or more was added, and the pH and the pAg were adjusted to 5.8 and 8.7, respectively, at 40° C. After compounds 11 and 12 were added, temperature was raised to 60° C. After sensitizing dyes 11 and 12 were added, potassium thiocyanate, chloroauric acid, sodium thiosulfate, and N,N-dimethylselenourea were added to optimally perform chemical sensitization. At the end of this chemical sensitization, compounds 13 and 14 were added. "Optimal chemical sensitization" herein means that the addition amount of each of the sensitizing dyes and the compounds was $10^{-1}$ to $10^{-8}$ mol per mol of a silver halide.

Compound 11

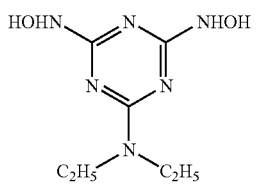

-continued

Compound 12

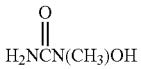

Sensitizing dye 11

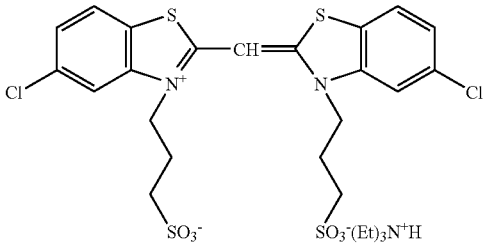

Sensitizing dye 12

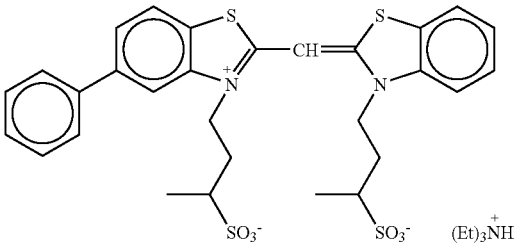

Compound 13

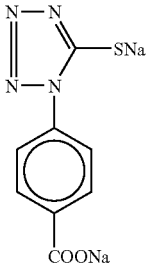

Compound 14

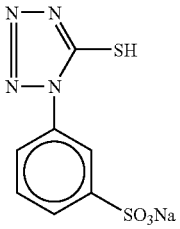

The thus obtained grains were observed with a transmission electron microscope while cooling them with liquid nitrogen to find that 10 or more dislocation lines per grain were observed near side faces thereof.

(Em-A2)

Emulsion Em-A2 was prepared in the same manner as (Em-A1), except that compound (I-13) of the invention was added in an amount of $1\times10^{-4}$ mol/mol Ag at the time of chemical sensitization.

(Em-A3)

Emulsion Em-A3 was prepared in the same manner as (Em-A2), except that compound (IX-2–3) of the invention was added in an amount of $1\times10^{-4}$ mol/mol Ag at the time of chemical sensitization.

(Em-A4)

After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, 381 mL of an aqueous solution containing 134.4 g of $AgNO_3$ and an aqueous KBr solution were added over 56 min by the double jet method while the flow rate was accelerated such that the final flow rate was 3.7 times the initial flow rate. At this time, an AgI fine grain emulsion having a grain size of 0.037 μm was simultaneously added so that the silver iodide content became 7 mol % while accelerating the flow rate, and the silver potential was maintained at −30 mV against a saturated calomel electrode. 121.3 mL of an aqueous solution containing 45.6 g of $AgNO_3$ and a KBr solution were added by the double jet method over 22 min. During the addition, the silver potential was maintained at +20 mV against a saturated calomel electrode. The temperature was raised to 82° C., followed by adjustment of the silver potential at −80 mV by an addition of KBr, an AgI fine grain emulsion having a grain size of 0.037 μm was added in an amount of 6.33 g in terms of silver. Immediately after the addition, 206.2 mL of an aqueous solution containing 66.4 g of $AgNO_3$ was added over 16 min. The silver potential was maintained at −80 mV with a KBr solution for the initial period of the addition of 5 min. After washing with water, gelatin comprising, in an amount of 30%, components each having a molecular weight measured according to the PAGI method of 280,000 or more was added, and the pH and the pAg were adjusted to 5.8 and 8.7, respectively, at 40° C. The same procedure as in Em-A1 was conducted after this.

The thus obtained grains were observed with a transmission electron microscope while cooling them with liquid nitrogen to find that 10 or more dislocation lines per grain were observed near side faces thereof.

(Em-5)

Emulsion Em-A5 was prepared in the same manner as (Em-A4), except that compound (I-13) of the invention was added in an amount of $1\times10^{-4}$ mol/mol Ag at the time of chemical sensitization.

(Em-6)

Emulsion Em-A6 was prepared in the same manner as (Em-A5Y except that compound (IX-2-3) of the invention was added in an amount of $1\times10^{-4}$ mol/mol Ag at the time of chemical sensitization.

(Em-7)

After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, 381 mL of an aqueous solution containing 134.4 g of $AgNO_3$ and an aqueous KBr solution were added over 56 min by the double jet method while the flow rate was accelerated such that the final flow rate was 3.7 times the initial flow rate. At this time, an AgI fine grain emulsion having a grain size of 0.037 μm was simultaneously added so that the silver iodide content became 7 mol % while accelerating the flow rate, and the silver potential was maintained at −30 mV against a saturated calomel electrode. 121.3 mL of an aqueous solution containing 45.6 g of $AgNO_3$ and a KBr solution were added by the double jet method over 22 min. During the addition, the silver potential was maintained at +20 mV against a saturated calomel electrode. The temperature was decreased to 40° C., followed by adjustment of the silver potential at −40 mV by an addition of KBr, then, an aqueous solution containing 14.5 g of sodium p-iodoacetamidebenzenesulfonate mono-hydrate was added, followed by adding 57 mL of 0.8M aqueous sodium sulfite solution with a constant flow rate for 1 min, while maintaining the pH at 9.0, thereby iodide ions were made to generate. After 2 min, the temperature was raised to 55° C. over 15 min and the pH was returned to 5.5. After that, 206.2 mL of an aqueous solution containing 66.4 g of $AgNO_3$ was added over 16 min. During the addition, the silver potential was maintained at −50 mV with a KBr solution. After washing with water, gelatin comprising, in an amount of 30%, components each having a molecular weight measured according to the PAGI method of 280,000 or more was added, and the pH and the pAg were adjusted to 5.8 and 8.7, respectively, at 40° C. The same procedure as in Em-A1 was conducted after this.

The thus obtained grains were observed with a transmission electron microscope while cooling them with liquid nitrogen to find that 10 or more dislocation lines per grain were observed near side faces thereof. The dislocation lines positioned at the periphery portion were localized near corner portions of the tabular grains.

(Em-A8)

Emulsion Em-A8 was prepared in the same manner as (Em-A7), except that each of compounds (I-13) and (IX-2-3) of the invention were added in an amount of $1\times10^{-4}$ mol/mol Ag at the time of chemical sensitization.

(Em-A9)

Emulsion Em-A9 was prepared in the same manner as (EM-A8). except that compound (IX-2-3) of the invention was added in an amount of $1\times10^{-4}$ mol/mol Ag at the time of chemical sensitization.

(Em-A10)

After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, 381 mL of an aqueous solution containing 134.4 g of $AgNO_3$ and an aqueous KBr solution were added over 56 min by the double jet method while the flow rate was accelerated such that the final flow rate was 3.7 times the initial flow rate. At this time, an AgI fine grain emulsion having a grain size of 0.037 μm was simultaneously added so that the silver iodide content became 7 mol % while accelerating the flow rate, and the silver potential was maintained at −30 mV against a saturated calomel electrode. 330.8 mL of an aqueous solution containing 102.4 g of $AgNO_3$ and a KBr solution were added by the double jet method over 60 min. During the addition, the silver potential for the initial 50 min was maintained at +20 mV, and the remaining 10 min was maintained at 120 mV against a saturated calomel electrode. The temperature was raised to 50° C., 55 mL of 0.3% aqueous KI solution was added over 10 min. Immediately after this, 100 mL of an aqueous solution containing 14.2 g of $AgNO_3$, 120 mL of an aqueous solution containing 2.1 g of NaCl and 4.17 g of KBr, and a solution containing 0.0133 mol of AgI fine grains were added simultaneously. At this time, $9.4\times10^{-4}$ mol of $K_4[RuCN]_6$ per mol of $AgNO_3$ being added were made to present. After that, a sensitizing dye was added, in order to stabilization of epitaxial. After washing with water, gelatin comprising, in an amount of 30%, components each having a molecular weight measured according to the PAGI method of 280,000 or more was added, and the pH and the pAg were adjusted to 5.8 and 8.7, respectively, at 40° C. The same procedure as in Em-A1 was conducted after this.

The thus obtained grains were observed with a transmission electron microscope while cooling them with liquid nitrogen to find that epitaxial phase was joined at corner portion of the tabular grains.

(Em-A11)

Emulsion Em-A11 was prepared in the same manner as (Em-A10), except that each of compounds (I-13) and (IX-2-3) of the invention was added in an amount of $1\times10^{-4}$ mol/mol Ag at the time of chemical sensitization.

(Em-A12)

Emulsion Em-A12 was prepared in the same manner as (Em-A11). except that compound (IX-2-3) of the invention was added in an amount of $1\times10^{-4}$ mol/mol Ag at the time of chemical sensitization.

(Em-A13)

After 9.9 g of the above-mentioned seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the silver potential was maintained at −20 mV against a saturated calomel electrode. After 2 mg of sodium benzenethiosulfonate and 2 mg of thiourea dioxide were added, an AgBrI fine grain emulsion (average grain size: 0.015 μm) having a silver iodide content of 7 mol % was added over 90 min to the reaction vessel while preparing the fine grain emulsion in a mixing apparatus provide outside the reaction vessel. In the mixing apparatus, 762 mL of an aqueous solution containing 134.4 g of $AgNO_3$ and 762 mL of aqueous solution containing 90.1 g of KBr, 9.46 g of KI and 38.1 g of gelatin having a molecular weight of 20,000 were added simultaneously to prepare the emulsion. During the addition, the silver potential was maintained at −30 mV against a saturated calomel electrode. 121.3 mL of an aqueous solution containing 45.6 g of $AgNO_3$ and a KBr aqueous solution were added by the double jet method over 22 min. During the addition, the silver potential was maintained at +20 mV against a saturated calomel electrode. The temperature was raised to 82° C., and the silver potential was adjusted to −80 mV by the addition of KBr, then an AgI fine grain emulsion having a grain size of 0.037 μm was added in an amount of 6.33 g in terms of KI weight. Immediately after the addition, 206.2 mL of an aqueous solution containing 66.4 g of $AgNO_3$ was added over 16 min. The silver potential was maintained at −80 mV with a KBr solution for the initial period of the addition of 5 min. After washing with water, gelatin comprising, in an amount of 30%, components each having a molecular weight measured according to the PAGI method of 280,000 or more was added, and the pH and the pAg were adjusted to 5.8 and 8.7, respectively, at 40° C. The same procedure as in Em-A1 was conducted after this.

The thus obtained grains were observed with a transmission electron microscope while cooling them with liquid nitrogen to find that 10 or more dislocation lines were observed near side faces thereof.

(Em-A14)

Emulsion Em-A14 was prepared in the same manner as (Em-A13), except that each of compounds (I-13) and (IX-2-3) of the invention was added in an amount of $1\times10^{-4}$ mol/mol Ag at the time of chemical sensitization.

(Em-A15)

Emulsion Em-A15 was prepared in the same manner as (Em-A14). except that compound (IX-2-3) of the invention was added in an amount of $1\times10^{-4}$ mol/mol Ag at the time of chemical sensitization.

(Em-B: Emulsion for a Low-Speed Blue Sensitive Layer)

1192 mL of an aqueous solution containing 0.96 g of a low-molecular-weight gelatin and 0.9 g of KBr was vigorously agitated while maintaining the temperature at 40° C. 37.5 mL of an aqueous solution containing 1.49 g of $AgNO_3$ and 37.5 mL of an aqueous solution containing 1.5 g of KBr were added by the double jet method over a period of 30 sec. After 1.2 g of KBr was added, the temperature was raised to 75° C., and the mixture was ripened. After full ripening, 30 g of trimellitated gelatin whose amino groups are chemically modified with trimellitic acid and having a molecular weight of 100,000 was added, and the pH was adjusted to 7. 6 mg of thiourea dioxide was added. An aqueous solution of KBr and 116 mL of an aqueous solution containing 29 g of $AgNO_3$ were added by the double jet method while increasing the flow rate so that the final flow rate became 3 times the initial flow rate. During this period, the silver potential was maintained at −20 mV against saturated calomel electrode. Further, 440.6 mL of an aqueous solution containing 110.2 g of $AgNO_3$ and an aqueous solution of KBr were added by the double jet method over a period of 30 min while increasing the flow rate so that the final flow rate was 5.1 times the initial flow rate. During this period, the AgI fine grain emulsion used in the preparation of Em-A1 was simultaneously added while conducting a flow rate increase so that the silver iodide content was 15.8 mol %, and the silver potential was maintained at 0 mV against saturated calomel electrode. An aqueous solution of KBr and 96.5 mL of an aqueous solution containing 24.1 g of $AgNO_3$ were added by the double jet method over a period of 3 min. During the addition the silver potential was maintained at 0 mV. After 26 mg of sodium ethythiosulfonate was added, the temperature was raised to 55° C., and the silver potential was adjusted to −90 mV by adding a KBr solution. 8.5 g in terms of KI weight of the aforementioned AgI fine grain emulsion was added. Immediately after the addition, 228 mL of an aqueous solution containing 57 g of $AgNO_3$ was added over 5 min. At this time the silver potential at the completion of the addition was adjusted to +20 mV by a KBr aqueous solution. The emulsion was washed with water and chemically sensitized in almost the same manner as in Em-A1.

(Em-C: Emulsion for a Low-Speed Blue Sensitive Layer)

1192 mL of an aqueous solution containing 1.02 g of phthalated gelatin whose phthalation ratio is 97%, molecular weight is 100,000 and containing 35 μmol of methionine per g and 0.97 g of KBr, was vigorously agitated while maintaining the temperature at 35° C. 42 mL of an aqueous solution containing 4.47 g of $AgNO_3$ and 42 mL of an aqueous solution containing 3.16 g of KBr were added by the double jet method over a period of 9 sec. After 2.6 g of KBr was added, the temperature was raised to 66° C., and the mixture was thoroughly ripened. After full ripening, 41.2 g of trimellitated gelatin used in the preparation of Em-B and having a molecular weight of 100,000, and 18.5 g of NaCl were added. After the pH was adjusted to 7.2, 8 mg of dimethylaminborane was added. An aqueous solution of KBr and 203 mL of an aqueous solution containing 26 g of $AgNO_3$ were added by the double jet method while increasing the flow rate so that the final flow rate became 3.8 times the initial flow rate. During this period, the silver potential was maintained at −30 mV against saturated calomel electrode. Further, 440.6 mL of an aqueous solution containing 110.2 g of $AgNO_3$ and an aqueous solution of KBr were added by the double jet method over a period of 24 min while increasing the flow rate so that the final flow rate was 5.1 times the initial flow rate. During this period, the AgI fine grain emulsion used in the preparation of Em-A1 was simultaneously added while conducting a flow rate increase so that the silver iodide content was 2.3 mol %, and the silver potential was maintained at −20 mV against saturated calomel electrode. After 10.7 mL of 1N aqueous solution of potassium thiocyanate was added, an aqueous solution of KBr and 153.5 mL of an aqueous solution containing 24.1 g of $AgNO_3$ were added by the double jet method over a period of 2 min 30 sec. During the addition the silver potential was maintained at 10 mV. The silver potential was maintained at 10 mV. The silver potential was adjusted to −70 mV by adding a KBr solution. 6.4 g in terms of KI weight of the aforementioned AgI fine grain emulsion was added. Immediately after the addition, 404 mL of an aqueous solution containing 57 g of $AgNO_3$ was added over 45 min. At this time the silver potential at the completion of the addition was adjusted to −20 mV by a KBr aqueous solution. The emulsion was washed with water and chemically sensitized in almost the same manner as in Em-A1.

(Em-D: Emulsion for a Low-Speed Blue Sensitive Layer)

Em-D was prepared by changing the addition amount of $AgNO_3$ at nucleation to twice. Further, the potential at the completion of the addition of the 404 mL final solution containing 57 g of $AgNO_3$, was changed to +90 mV, by adjusting the KBr solution. Other conditions were almost the same as for Em-C. (Em-E: Magenta Color Layer Having a Spectral Sensitivity Peak in a Region of 480 to 550 nm. A Layer Imparting Inter-Layer Effect on Red-Sensitive Layer)

1,200 mL of an aqueous solution containing 0.71 g of low molecular weight gelatin having molecular weight of 15,000, 0.92 g of KBr and 0.2 g of the modified silicone oil used in the preparation of the Em-A1 were held at 39° C. and stirred with violence at pH 1.8. An aqueous solution containing 0.45 g of $AgNO_3$ and an aqueous KBr solution containing 1.5 mol % of KI were added over 17 sec by the double jet method. During the addition, the excess KBr concentration was held constant. The temperature was raised to 56° C. to ripen the material. After through ripening, 20 g of phthalated gelatin having a phthalation ratio of 97%, molecular weight of 100,000, and containing 35 μm of methionine per gram, was added. After the pH was adjusted to 5.9, 2.9 g of KBr were added. 288 mL of an aqueous solution containing 28.8 g of $AgNO_3$ and an aqueous KBr solution were added over 53 min by the double jet method. During the addition, the AgI fine grain emulsion used in the preparation of Em-A1 was simultaneously added such that the silver iodide content was 4.1 mol % and the silver potential was maintained at −60 mV against calomel electrode. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, the aforementioned AgI fine grain emulsion was simultaneously added at an accelerated flow rate such that the silver iodide content was 10.5 mol %, and the silver potential was maintained at −70 mV. After 1 mg of thiourea dioxide was added, 132 mL of an aqueous solution containing 41.8 g of $AgNO_3$ and an aqueous KBr solution were added over 25 min by the double jet method. The addition of the aqueous KBr solution was so adjusted that the silver potential at the completion of the addition was +20 mV. After 2 mg of sodium benzenethiosulfonate was added, pH was adjusted to 7.3. After KBr was added to adjust the silver potential at 70 mV, the above-mentioned AgI fine grain emulsion was added in an amount of 5.73 g in terms of a KI weight. Immediately after the addition, 609 mL of an aqueous solution containing 66.4 g of $AgNO_3$ were added over 10 min. For the first 6 min of the addition, the silver potential was held at −70 mV by a KBr solution. The resultant emulsion was washed with water, then gelatin was added. The pH and pAg of the mixture was adjusted to 6.5 and 8.2, respectively, at 40° C. After compounds 11 and 12 were added, the temperature was raised to 56° C. After 0.0004 mol of the above-mentioned AgI fine grains, per mol of silver, were added sensitizing dyes 13 and 14 were added. Chemical sensitization was optimally performed by addition of potassium thiocyanate, chloroauric acid, sodium thiosulfonate and N,N-dimethylselenourea. At the completion of the chemical sensitization, compounds 13 and 14 were added.

Sensitizing dye 13

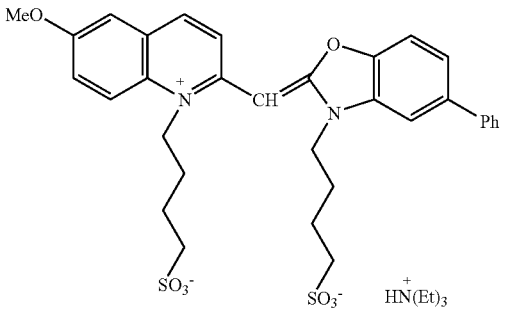

Sensitizing dye 14

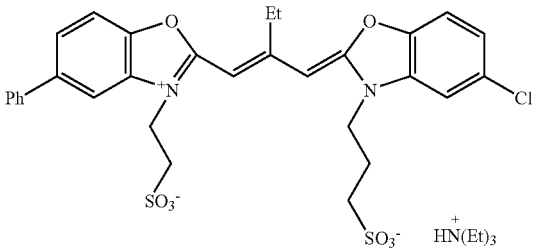

(Em-F: Emulsion for a Medium-Speed Green Sensitive Layer)

Em-F was prepared in almost the same manner as Em-E, except that the addition amount of $AgNO_3$ during nucleation was changed to 3.1 times. Also, the sensitizing dyes used for Em-E were changed to sensitizing dyes 15, 16 and 17.

Sensitizingy dye 15

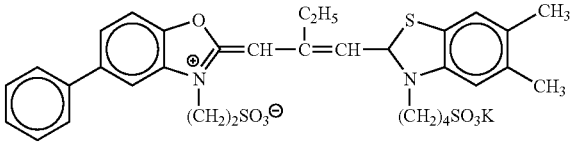

Sensitizing dye 16

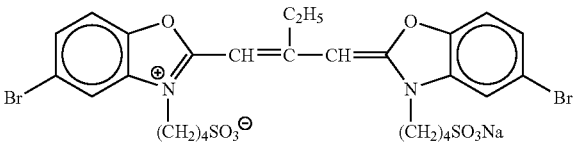

Sensitizing dye 17

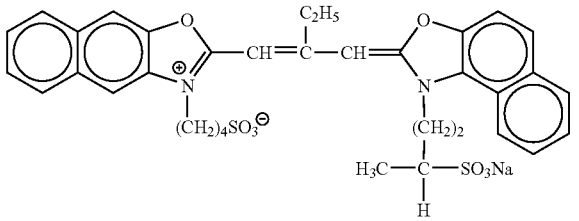

(Em-G: Emulsion for a Low-Speed Green Sensitive Layer)

1,200 mL of an aqueous solution containing 0.70 g of low molecular weight gelatin having molecular weight of 15,000, 0.9 g of KBr, 0.175 g of KI and 0.2 g of the modified silicone oil used in the preparation of the Em-A1 were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 69° C. to ripen the material. After completion of ripening, 27.8 g of trimellitated gelatin whose amino groups were modified with trimellitic acid, having molecular weight of 100,000 and containing 35 μm, per gram, of methionine was added. After the pH was adjusted to 6.3, 2.9 g of KBr were added. 270 mL of an aqueous solution containing 27.58 g of $AgNO_3$ and an aqueous KBr solution were added over 37 min by the double jet method. At this time, an AgI fine grain emulsion having a grains size of 0.008 μm, which was prepared immediately before the addition thereof in a separate chamber furnished with a magnetic coupling induction type agitator as described in JP-A-10-43570, by mixing a low-molecular-weight gelatin whose molecular weight was 15,000, an aqueous solution of $AgNO_3$ and an aqueous solution of KI, was simultaneously added, so that the silver iodide content was 4.1 mol %. Further, the silver potential was maintained at −60 mV against calomel electrode. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion was simultaneously added at an accelerated flow rate such that the silver iodide content was 7.9 mol %, and the silver potential was maintained at −70 mV. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the silver potential at the completion of the addition was +20 mV. The temperature was raised to 78° C., and the pH was adjusted to 9.1, then, the potential was set to −60 mV by the addition of KBr. The AgI fine grain emulsion used in the preparation of Em-A1 was added in an amount of 5.73 g in terms of a KI weight. Immediately after the addition, 321 mL of an aqueous solution containing 66.4 g of $AgNO_3$ were added over 4 min. For the first 2 min of the addition, the silver potential was held at −60 mV by a KBr solution. The resultant emulsion was washed with water and chemically sensitized almost the same manner as in Em-F.

(Em-H: Emulsion for a Low-Speed Green Sensitive Layer)

An aqueous solution containing 17.8 g of ion-exchanged gelatin having a molecular weight of 100,000, 6.2 g of KBr, and 0.46 g of KI was vigorously agitated while maintaining the temperature at 45° C. An aqueous solution containing 1.85 g of $AgNO_3$ and an aqueous solution containing 3.8 g of KBr were added by the double jet method over a period of 47 sec. After the temperature was raised to 63° C., 24.1 g of ion-exchanged gelatin having a molecular weight of 100,000 was added to ripen. After through ripening, an aqueous solution of KBr and an aqueous solution containing 133.4 g of $AgNO_3$ were added by the double jet method over a period of 20 min while increasing the flow rate so that the final flow rate was 2.6 times the initial flow rate. During this period, the silver potential was maintained at +40 mV against calomel electrode. Further, 0.1 mg of $K_2IrCl_6$ was added 10 min after the initiation of the addition. After 7 g of NaCl was added, an aqueous solution containing 45.6 g of $AgNO_3$ and a KBr solution were added by the double jet method over 12 min. During this period, the silver potential was maintained at +90 mV. Further, 100 mL of an aqueous solution containing 29 mg of yellow prussiate of potash was added over 6 min from the initiation of the addition. After 14.4 g of KBr was added, the AgI fine grain emulsion used for the preparation of Em-A1 was added in an amount of 6.3 g in terms of KI amount. Immediately after the addition, an aqueous solution containing 42.7 g of $AgNO_3$ and a KBr solution were added by the double jet method over 11 min. During this period, the silver potential was held at +90 mV. The resultant emulsion was washed with water and chemically sensitized almost the same manner as in Em-F.

(Em-I: Emulsion for a High-Speed Red Sensitive Layer)

Em-I was prepared by almost the same manner as Em-H, except that the temperature at nucleation was changed to 38° C.

(Em-J1: Emulsion for a High-Speed Red Sensitive Layer)

1200 mL of an aqueous solution containing 0.38 g of phthalated gelatin having a molecular weight of 100,000 and a phthalation rate of 97%, and 0.99 g of KBr was vigorously agitated while maintaining the temperature at 60° C. and the pH at 2. An aqueous solution containing 1.96 g of $AgNO_3$ and an aqueous solution containing 1.97 g of KBr and 0.172 g of KI were added by the double jet method over a period of 30 sec. After the completion of ripening, 12.8 g of trimellitated gelatin whose amino groups were modified with trimellitic acid, having molecular weight of 100,000 and containing 35 μmol, per gram, of methionine was added. After the pH was adjusted to 5.9, 2.99 g of KBr and 6.2 g of NaCl were added. 60.7 mL of an aqueous solution containing 27.3 g of $AgNO_3$ and a KBr solution were added by the double jet method over 35 min. During this period, the silver potential was maintained at −50 mV against saturated calomel electrode. An aqueous solution of KBr and an aqueous solution containing 65.6 g of $AgNO_3$ were added by the double jet method over a period of 37 min while increasing the flow rate so that the final flow rate was 2.1 times the initial flow rate. During this period, the AgI fine grain emulsion used for the preparation of Em-A1 was simultaneously added with an accelerated flow rate so that the silver iodide content was 6.5 mol %, and the silver potential was maintained at −50 mV. After 1.5 g of thiourea dioxide was added, 132 mL of an aqueous solution containing 41.8 g of $AgNO_3$ and an KBr solution were added by the double jet method over 13 min. The addition of KBr solution was so adjusted that silver potential at the completion of the addition was +40 mV. After 2 mg of sodium benzenethiosulfonate was added, KBr was added to adjust the silver potential to −100 mV. The above-mentioned AgI fine grain emulsion was added in an amount of 6.2 g in terms of KI weight. Immediately after the addition, 300 mL of an aqueous solution containing 88.5 g of $AgNO_3$ was added over 8 min. The addition of a KBr solution was so adjusted that the potential at the completion of the addition was +60 mV. After washing the mixture with water, gelatin was added, and pH and pAg were adjusted to 6.5 and 8.2, respectively at 40° C. After addition of compounds 11 and 12, the temperature was raised to 61° C. After sensitizing dyes 18, 19, 20 and 21 were added, $K_2IrCl_6$, potassium thiocyanate, chlorauric acid, sodium thiosulfonate and N,N-dimethylselenourea were added to perform optimal chemical sensitization. At the completion of the chemical sensitization, compounds 13 and 14 were added.

Sensitizing dye 18

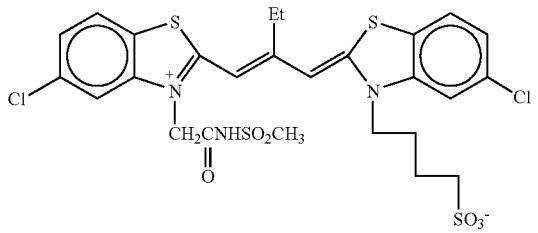

Sensitizing dye 19

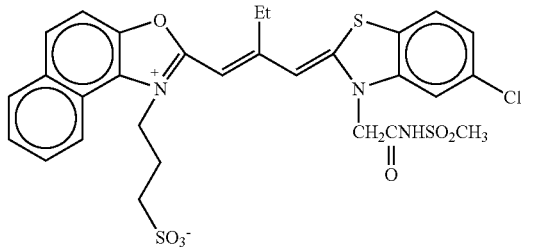

Sensitizing dye 20

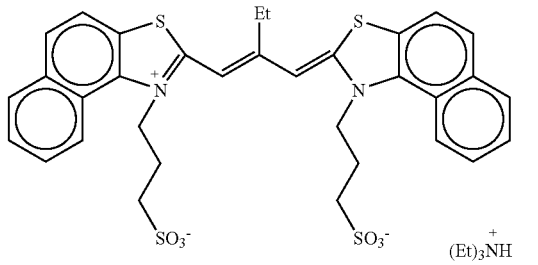

-continued

Sensitizing dye 21

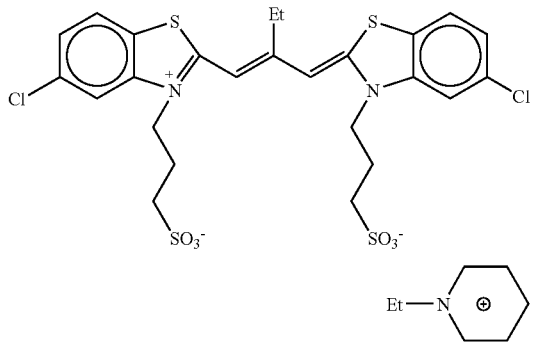

Em-J2 was prepared in the same manner as Em-J1, except that compound (I-13) of the invention was added in an amount of $1\times10^{-4}$ mol/mol Ag at the time of chemical sensitization.

(Em-J3)

Em-J3 was prepared in the same manner as (Em-J2) except that compound (IX-2-50) of the invention was added in an amount of $1\times10^{-4}$ mol/mol Ag at the time of chemical sensitization.

(Em-J4 to Em-J8)

Em-J4 to Em-J8 were prepared in the same manner as Em-J1, except that compound (IV-2) of the invention was added at the time of chemical sensitization so that the contents thereof with respect to the sensitizing dyes were those as set forth in Table 1, respectively.

(Em-J9 to Em-J13)

Em-J9 to Em-J13 were prepared in the same manner as Em-J2, except that compound (IV-2) of the invention was added at the time of chemical sensitization so that the contents thereof with respect to the sensitizing dyes were those as set forth in Table 1, respectively.

(Em-J14)

1200 mL of an aqueous solution containing 0.38 g of phthalated gelatin having a molecular weight of 100,000 and a phthalation rate of 97%, and 0.99 g of KBr was vigorously agitated while maintaining the temperature at 60° C. and the pH at 2. An aqueous solution containing 1.96 g of $AgNO_3$ and an aqueous solution containing 1.97 g of KBr and 0.172 g of KI were added by the double jet method over a period of 30 sec. After the completion of ripening, 12.8 g of trimellitated gelatin whose amino groups were modified with trimellitic acid, having molecular weight of 100,000 and containing 35 μmol, per gram, of methionine was added. After the pH was adjusted to 5.9, 2.99 g of KBr and 6.2 g of NaCl were added. 60.7 mL of an aqueous solution containing 27.3 g of $AgNO_3$ and a KBr solution were added by the double jet method over 35 min. During this period, the silver potential was maintained at −50 mV against saturated calomel electrode. An aqueous solution of KBr and an aqueous solution containing 65.6 g of $AgNO_3$ were added by the double jet method over a period of 37 min while increasing the flow rate so that the final flow rate was 2.1 times the initial flow rate. During this period, the AgI fine grain emulsion used for the preparation of Em-A1 was simultaneously added with an accelerated flow rate so that the silver iodide content was 6.5 mol %, and the silver potential was maintained at −50 mV. After 1.5 g of thiourea dioxide was added, 132 mL of an aqueous solution containing 41.8 g of $AgNO_3$ and an KBr solution were added by the double jet method over 13 min. The addition of KBr solution was so adjusted that silver potential at the completion of the addition was +40 mV. After 2 mg of sodium benzenethiosulfonate was added, the temperature was lowered to 40° C., and KBr was added to adjust the silver potential to −40 mV. While keeping the temperature at 40° C., a solution containing 14.2 g of sodium p-iodoacetamidobenzenesulfonate monohydrate was added, then 57 mL of 0.8M aqueous sodium sulfite solution was added over 1 min at a constant rate, and the pH was controlled to 9.0, thereby iodide ions were made to generate. Two minutes after this, the temperature was raised to 55° C. over 15 min, then pH was lowered to 5.5. Immediately after that, 300 mL of an aqueous solution containing 88.5 g of $AgNO_3$ was added over 20 min. During the addition, the silver potential was maintained at −50 mV by adding a KBr solution. After washing the mixture with water, gelatin was added, and pH and pAg were adjusted to 6.5 and 8.2, respectively at 40° C. Then, the same processing as for Em-J1 was conducted.

(Em-J15)

Em-J15 was prepared in the same manner as Em-J14, except that compound (I-13) of the invention was added in an amount of $1\times10^{-4}$ mol/mol Ag at the time of chemical sensitization.

(Em-J16)

Em-J16 was prepared in the same manner as Em-J15, except that compound (IV-2) of the invention was added at the time of chemical sensitization so that the addition amount thereof was 25 mol % of the sensitizing dyes added.

(Em-J17)

Em-J17 was prepared in the same manner as Em-J16, except that compound (IX-2-50) of the invention was added in an amount of $1\times10^{-4}$ mol/mol Ag at the time of chemical sensitization.

(Em-J18)

1200 mL of an aqueous solution containing 0.38 g of phthalated gelatin having a molecular weight of 100,000 and a phthalation rate of 97%, and 0.99 g of KBr was vigorously agitated while maintaining the temperature at 60° C. and the pH at 2. An aqueous solution containing 1.96 g of $AgNO_3$ and an aqueous solution containing 1.97 g of KBr and 0.172 g of KI were added by the double jet method over a period of 30 sec. After the completion of ripening, 12.8 g of trimellitated gelatin whose amino groups were modified with trimellitic acid, having molecular weight of 100,000 and containing 35 μmol, per gram, of methionine was added. After the pH was adjusted to 5.9, 2.99 g of KBr and 6.2 g of NaCl were added. 60.7 mL of an aqueous solution containing 27.3 g of $AgNO_3$ and a KBr solution were added by the double jet method over 35 min. During this period, the silver potential was maintained at −50 mV against saturated calomel electrode. An aqueous solution of KBr and an aqueous solution containing 65.6 g of $AgNO_3$ were added by the double jet method over a period of 37 min while increasing the flow rate so that the final flow rate was 2.1 times the initial flow rate. During this period, the AgI fine grain emulsion used for the preparation of Em-A1 was simultaneously added with an accelerated flow rate so that the silver iodide content was 6.5 mol %, and the silver potential was maintained at −50 mV. After 1.5 g of thiourea dioxide was added, 132 mL of an aqueous solution containing 41.8 g of $AgNO_3$ and an KBr solution were added by the double jet method over 13 min. The addition of KBr solution was so adjusted that silver potential at the completion of the addition was +40 mV. After 2 mg of sodium benzenethiosulfonate was added, the temperature was lowered to 5° C. While maintaining the temperature at 50° C., 55 mL of 0.3% aqueous solution of KI was added over 10 min. Immediately after that, 100 mL of an aqueous solution containing 14.2 g of $AgNO_3$, 120 mL of an aqueous solution containing 2.1 g of NaCl and 4.17 g of KBr, and a solution containing 0.0133 mole of AgI fine grains were simultaneously added. During this, $9.4\times10^{-4}$ mole of $K_4[RuCN]_6$ per mol of $AgNO_3$ to be added was made present in the reaction mixture. After that, sensitizing dyes were added in order to stabilize the epitaxial. After washing the mixture with water, gelatin was added, and pH and pAg were adjusted to 6.5 and 8.2, respectively at 40° C. Then, the same processing as for Em-J1 was conducted.

(Em-J19)

Em-J19 was prepared in the same manner as Em-J18, except that compound (I-13) of the invention was added in an amount of $1\times10^{-4}$ mol/mol Ag at the time of chemical sensitization.

(Em-J20)

Em-J20 was prepared in the same manner as Em-J19, except that compound (IV-2) of the invention was added at the time of chemical sensitization so that the addition amount thereof was 25 mol % of the sensitizing dyes added.

(Em-J21)

Em-J21 was prepared in the same manner as Em-J20, except that compound (IX-2-50) of the invention was added in an amount of $1\times10^{-4}$ mol/mol Ag at the time of chemical sensitization.

(Em-J22)

1200 mL of an aqueous solution containing 0.38 g of phthalated gelatin having a molecular weight of 100,000 and a phthalation rate of 97%, and 0.99 g of KBr was vigorously agitated while maintaining the temperature at 60° C. and the pH at 2. An aqueous solution containing 1.96 g of $AgNO_3$ and an aqueous solution containing 1.97 g of KBr and 0.172 g of KI were added by the double jet method over a period of 30 sec. After the completion of ripening, 12.8 g of trimellitated gelatin whose amino groups were modified with trimellitic acid, having molecular weight of 100,000 and containing 35 μmol, per gram, of methionine was added. After the pH was adjusted to 5.9, 2.99 g of KBr and 6.2 g of NaCl were added. Into a mixing apparatus situated outside the reaction vessel, 762 mL of an aqueous solution containing 92.9 g of $AgNO_3$ and 762 mL of an aqueous solution containing 60.8 g of KBr, 5.9 g of KI, and 38.1 g of gelatin having a molecular weight of 20,000 were simultaneously added thereby preparing a AgBrI fine grain emulsion (average grain size: 0.015 μm). While preparing the fine grain emulsion, the fine emulsion was added to the reaction vessel over 90 min. At this time, silver potential was maintained at −30 mV against saturated calomel electrode. After 1.5 g of thiourea dioxide was added, 132 mL of an aqueous solution containing 41.8 g of $AgNO_3$ and an KBr solution were added by the double jet method over 13 min. The addition of KBr solution was so adjusted that silver potential at the completion of the addition was +40 mV. After 2 mg of sodium benzenethiosulfonate was added, the temperature was lowered to 50° C. Then the temperature was lowered to 40° C., KBr was added to adjust the silver potential to −40 mV. While keeping the temperature at 40° C., a solution containing 14.2 g of sodium p-iodoacetamidobenzenesulfonate monohydrate was added, then 57 mL of 0.8M aqueous sodium sulfite solution was added over 1 min at a constant rate, and the pH was controlled to 9.0, thereby iodide ions were made to generate. Two minutes after this, the temperature was raised to 55° C. over 15 min, then pH was lowered to 5.5. Immediately after that, 300 mL of an aqueous solution containing 88.5 g of $AgNO_3$ was added over 20 min. During the addition, the silver potential was maintained at −50 mV by adding a KBr solution. After washing the mixture with water, gelatin comprising, in an amount of 30%, components each having a molecular weight measured according to the PAGI method of 280,000 or more was added, and pH and pAg were adjusted to 6.5 and 8.2, respectively at 40° C. Then, the same processing as for Em-J1 was conducted.

(Em-J23)

Em-J23 was prepared in the same manner as Em-J22, except that compound (I-13) of the invention was added in an amount of $1\times10^{-4}$ mol/mol Ag at the time of chemical sensitization.

(Em-J24)

Em-J24 was prepared in the same manner as Em-J23, except that compound (IV-2) of the invention was added at the time of chemical sensitization so that the addition amount thereof was 25 mol % of the sensitizing dyes added.

(Em-J25)

Em-J25 was prepared in the same manner as Em-J24, except that each of compounds (I-13) and (IX-2-50) of the invention was added in an amount of $1\times10^{-4}$ mol/mol Ag at the time of chemical sensitization.

TABLE 1

| Emulsion No. | Compound No. added to emulsion | Content with respect to sensitizing dye (mol %) |
|---|---|---|
| Em-J1 | none | — |
| Em-J4 | IV-2 | 2 |
| Em-J5 | IV-2 | 5 |
| Em-J6 | IV-2 | 10 |
| Em-J7 | IV-2 | 25 |
| Em-J8 | IV-2 | 50 |
| Em-J9 | IV-2 | 2 |
| Em-J10 | IV-2 | 5 |
| Em-J11 | IV-2 | 10 |
| Em-J12 | IV-2 | 25 |
| Em-J13 | IV-2 | 50 |

(Em-K: Emulsion for a Medium-Speed Red Sensitive Layer)

1200 mL of an aqueous solution containing 4.9 g of low molecular weight gelatin having a molecular weight of 15,000 and 5.3 g of KBr was vigorously agitated while maintaining the temperature at 60° C. 27 mL of an aqueous solution containing 8.75 g of $AgNO_3$ and 36 mL of an aqueous solution containing 6.45 g of KBr were added by the double jet method over 1 min. After the temperature was raised to 77° C., 21 mL of an aqueous solution containing 6.9 g of $AgNO_3$ was added over 2.5 min. 26 g of $NH_4NO_3$, 56 mL of 1N NaOH solution were sequentially added, then, ripened the mixture. After completion of ripening, pH was adjusted to 4.8. 438 mL of an aqueous solution containing 141 g of $AgNO_3$ and 458 mL of an aqueous solution containing 102.6 g of KBr were added by the double jet method while the flow rate was accelerated so that the final flow rate was 4 times the initial flow rate. After the temperature was raised to 55° C., 240 mL of an aqueous solution containing 7.1 g of $AgNO_3$ and an aqueous solution containing 6.46 g of KI were added by the double jet method over 5 min. After 7.1 g of KBr was added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added by the double jet method over 8 min. The thus obtained mixture was washed with water and chemically sensitized by almost the same manner as for Em-J1.

(Em-L: Emulsion for a Medium-Speed Red Sensitive Layer)

Em-L was prepared by almost the same manner as Em-K, except that the temperature during nucleation was changed to 42° C.

(Em-M, -N, and -O)

Em-M, -N, and -O were prepared by almost the same manner as Em-H or Em-I, but the chemical sensitization was performed by almost the same manner as in Em-J.

(Em-P1)

Em-P1 was prepared in the same manner as Em-J1, except that the sensitizing dyes were changed to sensitizing dyes 15, 16 and 17 to perform optimal chemical sensitization.

(Em-P2)

Em-P2 was prepared in the same manner as Em-P1, except that compound (I-13) of the invention was added in an amount of $1\times10^{-4}$ mol/mol Ag at the time of chemical sensitization.

(Em-P3)

Em-P3 was prepared in the same manner as Em-P2, except that compound (IX-2-50) of the invention was added in an amount of $1\times10^{-4}$ mol/mol Ag at the time of chemical sensitization.

(Em-P4)

Em-P4 was prepared in the same manner as Em-J14, except that the sensitizing dyes were changed to sensitizing dyes 15, 16 and 17, to perform optimal chemical sensitization.

(Em-P5)

Em-P5 was prepared in the same manner as Em-P4, except that compound (I-13) of the invention was added in an amount of $1\times10^{-4}$ mol/mol Ag at the time of chemical sensitization.

(Em-P6)

Em-P6 was prepared in the same manner as Em-P5, except that compound (IX-2-50) of the invention was added in an amount of $1\times10^{-4}$ mol/mol Ag at the time of chemical sensitization.

(Em-P7)

Em-P7 was prepared in the same manner as Em-J18, except that the sensitizing dyes were changed to sensitizing dyes 15, 16 and 17, to perform optimal chemical sensitization.

(Em-P8)

Em-P8 was prepared in the same manner as Em-P7, except that compound (I-13) of the invention was added in an amount of $1\times10^{-4}$ mol/mol Ag at the time of chemical sensitization.

(Em-P9)

Em-P9 was prepared in the same manner as Em-P8, except that compound (IX-2-50) of the invention was added in an amount of $1\times10^{-4}$ mol/mol Ag at the time of chemical sensitization.

(Em-P10)

Em-P10 was prepared in the same manner as Em-J22, except that the sensitizing dyes were changed to sensitizing dyes 15, 16 and 17, to perform optimal chemical sensitization.

(Em-P11)

Em-P11 was prepared in the same manner as Em-P10, except that compound (I-13) of the invention was added in an amount of $1\times10^{-4}$ mol/mol Ag at the time of chemical sensitization.

(Em-P12)

Em-P12 was prepared in the same manner as Em-P11, except that compound (IX-2-50) of the invention was added in an amount of $1\times10^{-4}$ mol/mol Ag at the time of chemical sensitization.

The characteristics of the thus obtained silver halide emulsions Em-A1 to Em-P12 are set forth in Table 2.

TABLE 2

Grain characteristics of silver halide emulsions Em-A1 to P12

| Emulsion No. | E.S.D. μm | P.A.D. μm | Aspect ratio | I content mol % | Surface index of main planes | Cl content mol % |
|---|---|---|---|---|---|---|
| Em-A1 to A3 | 1.7 | 3.15 | 9.5 | 6.1 | (111) | 0 |
| Em-A4 to A6 | 1.7 | 3.25 | 10.5 | 6.1 | (111) | 0 |
| Em-A7 to A9 | 1.7 | 3.2 | 10 | 6.1 | (111) | 0 |
| Em-A10 to A12 | 1.7 | 3.25 | 10.5 | 6.1 | (111) | 0 |
| Em-A13 to A15 | 1.7 | 3.4 | 12 | 6.1 | (111) | 0 |
| Em-B | 1.0 | 2.0 | 12.2 | 10.0 | (111) | 0 |
| Em-C | 0.7 | — | 1 | 4.0 | (111) | 1.0 |
| Em-D | 0.4 | 0.53 | 3.5 | 4.1 | (111) | 2.0 |
| Em-E | 1.1 | 2.63 | 20.6 | 6.7 | (111) | 0 |
| Em-F | 1.2 | 2.74 | 18 | 6.9 | (111) | 0 |
| Em-G | 0.9 | 1.98 | 15.9 | 6.1 | (111) | 0 |
| Em-H | 0.7 | 1.22 | 8 | 6.0 | (111) | 2.0 |
| Em-I | 0.4 | 0.63 | 6 | 6.0 | (111) | 2.0 |
| Em-J1 to J13 | 1.3 | 3.18 | 22 | 3.5 | (111) | 0 |
| Em-J14 to J17 | 1.3 | 3.18 | 22 | 3.5 | (111) | 0 |
| Em-J18 to J21 | 1.3 | 3.22 | 23 | 3.5 | (111) | 0 |
| Em-J22 to J25 | 1.3 | 3.28 | 24 | 3.5 | (111) | 0 |
| Em-K | 1.0 | 2.37 | 20 | 4.0 | (111) | 0 |
| Em-L | 0.8 | 1.86 | 19 | 3.6 | (111) | 0 |
| Em-M | 0.6 | 1.09 | 8.9 | 2.9 | (111) | 2.0 |
| Em-N | 0.4 | 0.63 | 6 | 2.0 | (111) | 2.0 |
| Em-O | 0.3 | 0.38 | 3 | 1.0 | (111) | 2.0 |
| Em-P1 to P3 | 1.3 | 3.18 | 22 | 3.5 | (111) | 0 |
| Em-P4 to P6 | 1.3 | 3.18 | 22 | 3.5 | (111) | 0 |
| Em-P7 to P9 | 1.3 | 3.22 | 23 | 3.5 | (111) | 0 |
| Em-P10 to P12 | 1.3 | 3.28 | 24 | 3.5 | (111) | 0 |

E.S.D. = Equivalent sphere diameter

P.A.D. = Projected area diameter

The outline of the preparation formula of an emulsified dispersion is set forth below.

Into 10% gelatin solution, a solution of a coupler dissolved in ethyl acetate, a high boiling organic solvent, and a surfactant were added and mixed using a homogenizer (produced by NIHONSEIKI), thereby emulsify the mixture to obtain a emulsified dispersion.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 μm$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2 μm thick magnetic recording layer. 10 mg/m$^2$ of silica grains (0.3 μm) were added as a matting agent, and 10 mg/m$^2$ of aluminum oxide (0.15 μm) coated with 3-poly (polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material. For the preparation of the samples, emulsions, emulsified dispersions and couplers set forth in Tables 3, 4, and 5 were used. Regarding emulsions, couplers, high-boiling organic solvents, and surfactants, the substitution was conducted in the same amount. When the substitution was conducted using plural kinds of the emulsions, couplers, high-boiling organic solvents, or surfactants, the substitution was conducted so that the total amount of the plural kinds was the same amount. Specifically, when one coupler is substituted with two kinds of couplers, the amount of each one of the two coupler is ½ the one coupler to be substituted. Similarly, when one emulsion is replaced with three kinds of emulsions, the amount of each one of the three emulsions is ⅓ the one emulsion to be substituted.

(Compositions of Sensitive Layers)

The main ingredients used in the individual layers are classified as follows, however, the use thereof are not limited to those specified below.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| 1st layer (1st antihalation layer) | | |
|---|---|---|
| Black colloidal silver | silver | 0.155 |
| AgBrI (2) of surface fogged emulsion having 0.07 μm | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

-continued

| | | |
|---|---|---|
| 2nd layer (2nd antihalation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| AgBrI (2) emulsion having 0.07 μm | silver | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion M | silver | 0.065 |
| Silver iodobromide emulsion N | silver | 0.100 |
| Silver iodobromide emulsion O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion K | silver | 0.21 |
| Silver iodobromide emulsion L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion J | silver | 1.67 |
| ExC-1 | | 0.18 |
| ExC-3 | | 0.07 |
| ExC-6 | | 0.047 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (Interimage donating layer (layer for donating interimage effect to red-sensitive layer)) | | |
| Silver iodobromide emulsion E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion G | silver | 0.39 |
| Silver iodobromide emulsion H | silver | 0.28 |
| Silver iodobromide emulsion I | silver | 0.35 |

-continued

| | | |
|---|---|---|
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion F | silver | 0.20 |
| Silver iodobromide emulsion G | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Emulsion Em-P1 of Example 1 | silver | 1.200 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Silver iodobromide emulsion B | silver | 0.18 |
| Silver iodobromide emulsion C | silver | 0.20 |
| Silver iodobromide emulsion D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| AgBrI (2) emulsion having 0.07 μm | silver | 0.30 |
| UV-1 | | 0.21 |
| UV-2 | | 0.13 |
| UV-3 | | 0.20 |
| UV-4 | | 0.025 |
| F-11 | | 0.009 |
| F-18 | | 0.005 |

-continued

| | |
|---|---|
| F-19 | 0.005 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained B-4 to B-6, F-1 to F-17, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

The compounds used in the formation of each layer are as follows.

ExC-1

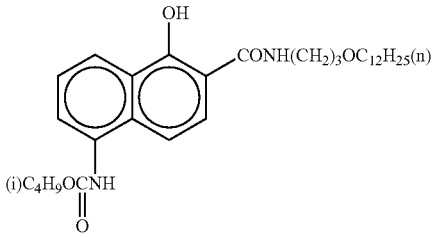

ExC-2

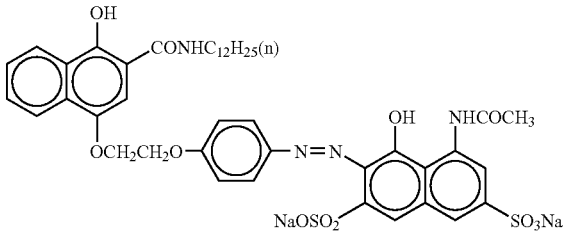

ExC-3

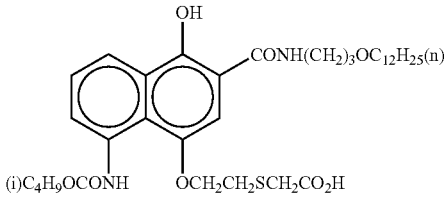

ExC-4

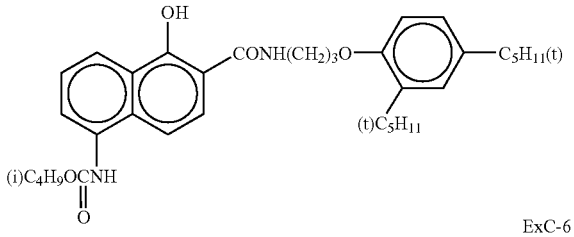

ExC-5

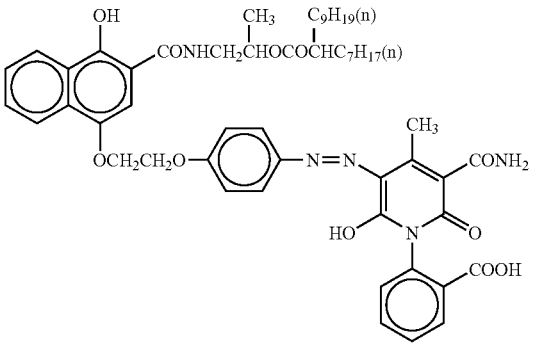

ExC-6

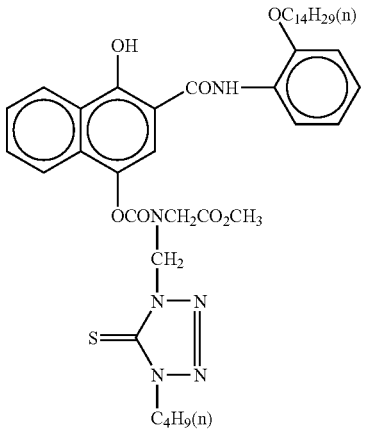

-continued
ExC-8
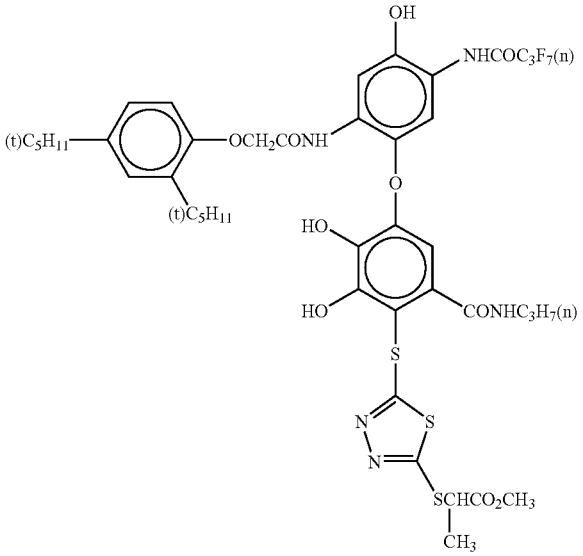
ExM-1
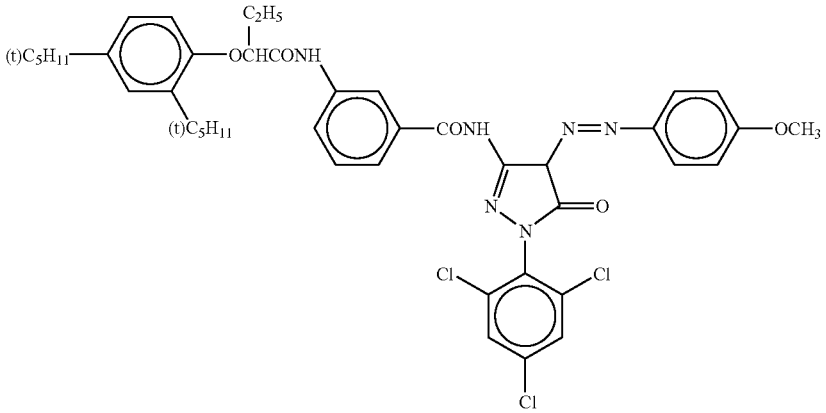
ExM-2
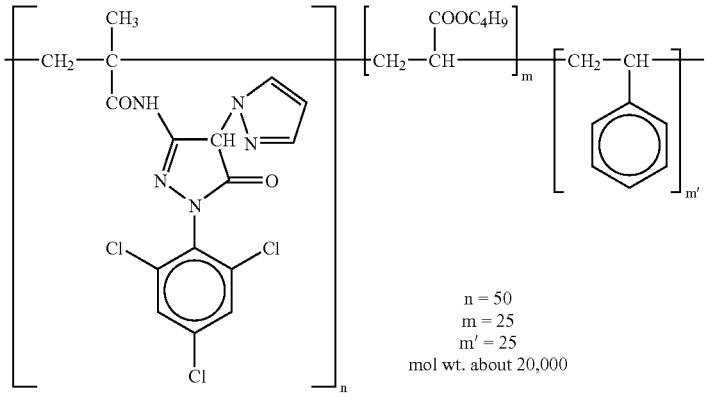

-continued
ExM-3
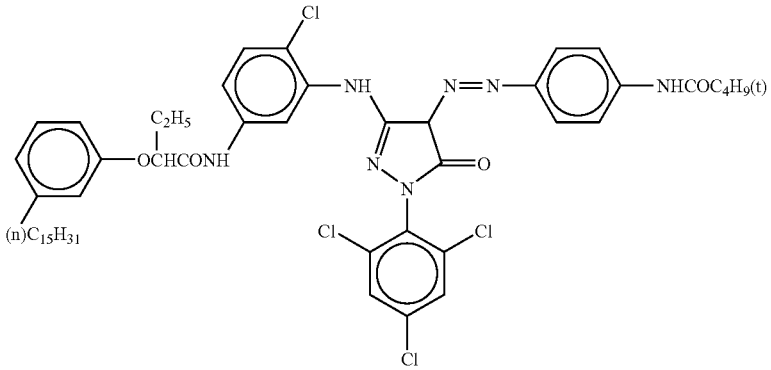
ExM-4
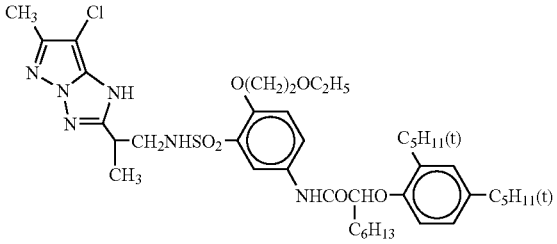
ExM-5
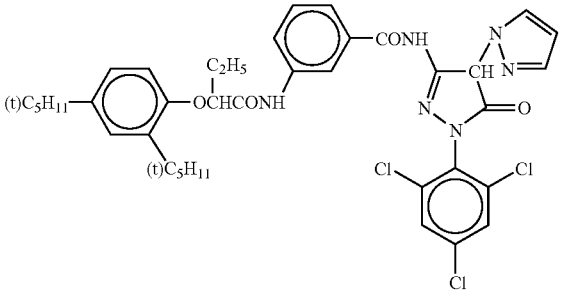
ExY-1
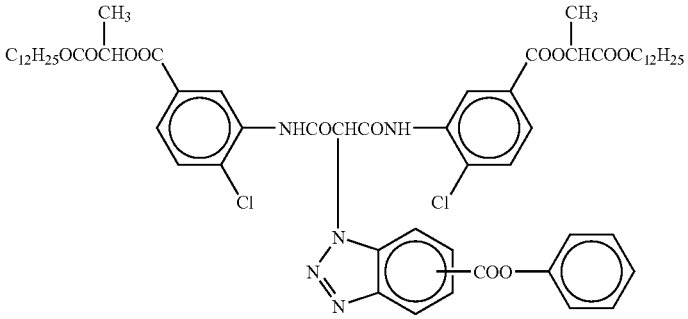
ExY-2
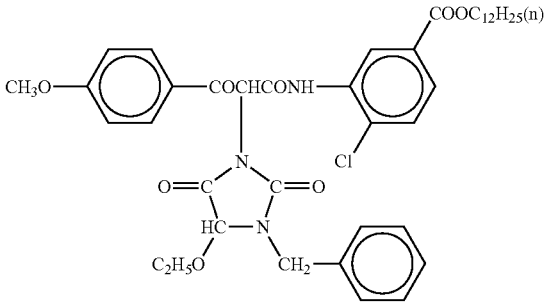
ExY-3
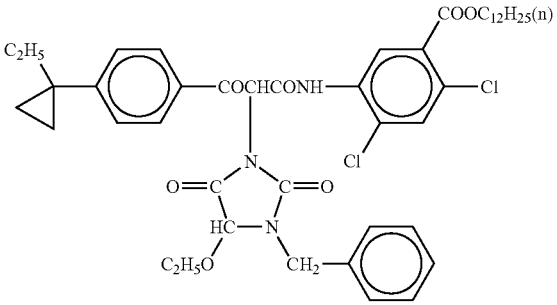

-continued
ExY-4
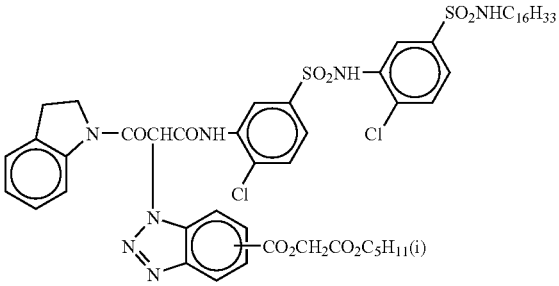
ExY-5
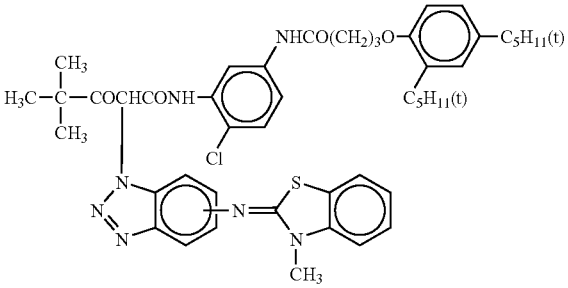
ExG-1
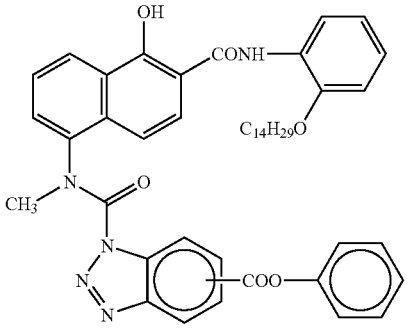
ExY-6
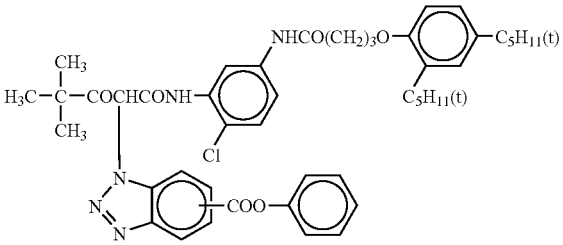
ExF-1
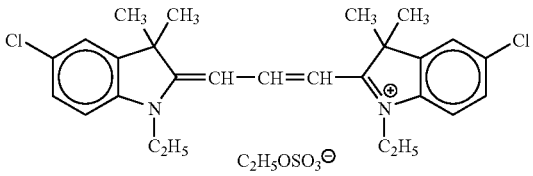
ExF-2
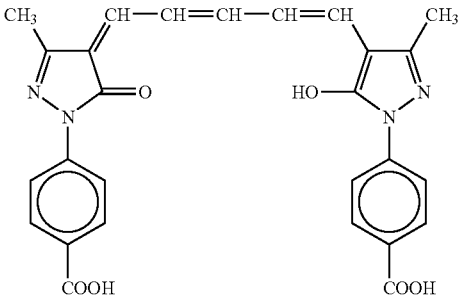
ExF-3
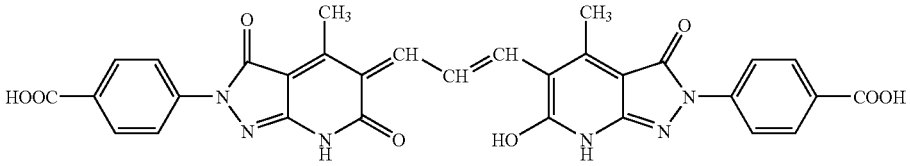
ExF-4
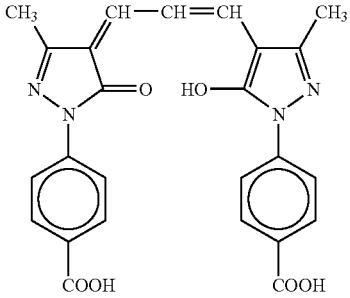
ExF-5
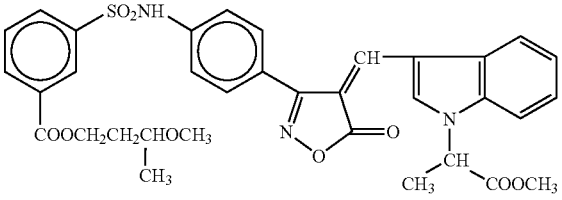

-continued
ExF-6
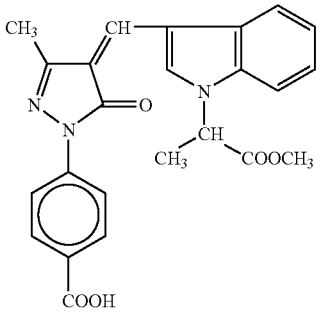
Cpd-1
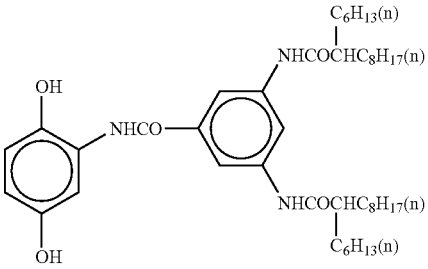
Cpd-2
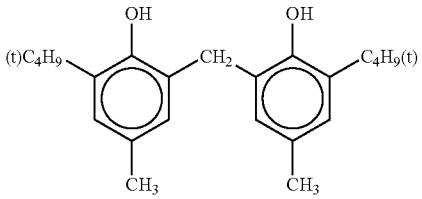
Cpd-3
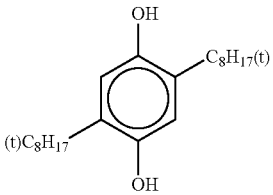
Cpd-4
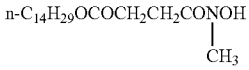
UV-1
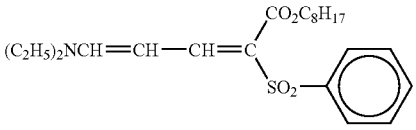
UV-2
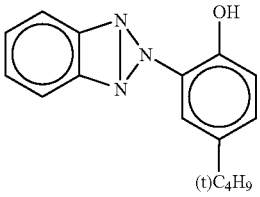
UV-3
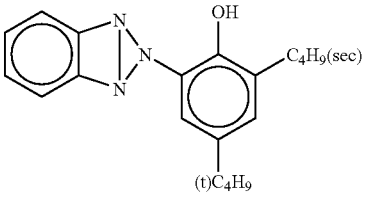
UV-4
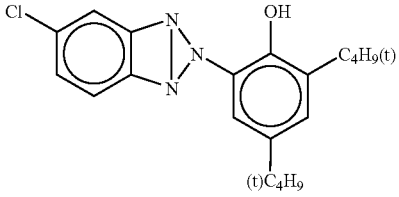
HBS-1
Tricresyl phostate
Di-n-butyl phthalate
HBS-2
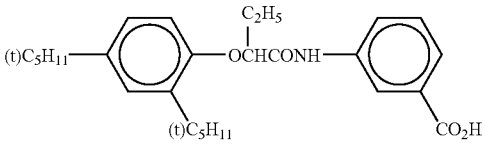
HBS-3
Tri (2-ethylhexyl) phosphate
HBS-4
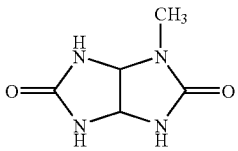
H-1
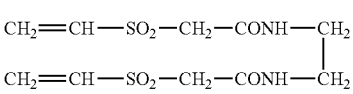
S-1
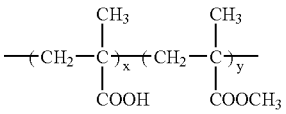
B-1
x/y = 10/90 (Weight ratio)
Average mol wt.: about 35,000

-continued
B-2
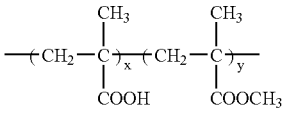
x/y = 40/60 (Weight ratio)
Average mol wt.: about 20,000
B-3
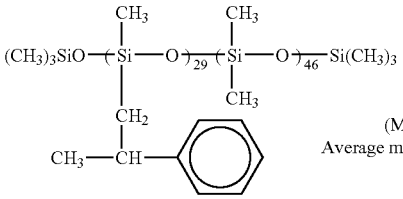
(Molar ratio)
Average mol wt.: about 8,000
B-4
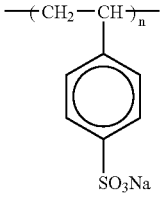
Average mol. wt.: about 750,000
B-5
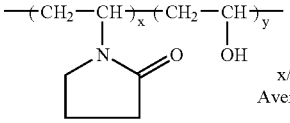
x/y = 70/30 (Weight ratio)
Average mol. wt.: about 17,000
B-6
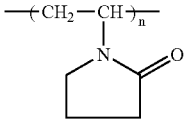
Average mol. wt.: about 10,000
W-1
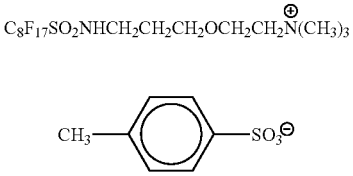
W-2
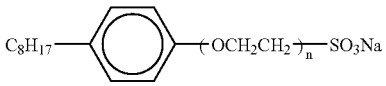
n = 2–4
W-4
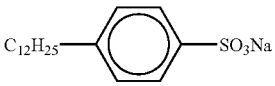
W-5
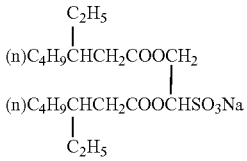
W-6
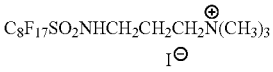
W-7
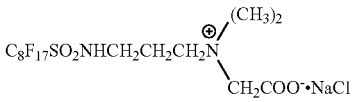
W-8
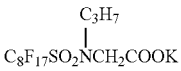
F-1
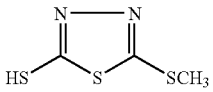
F-2
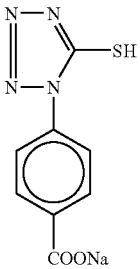
F-3
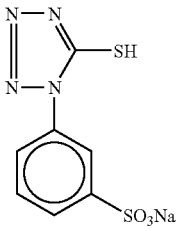
F-4
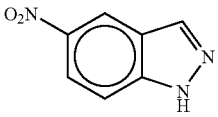

-continued
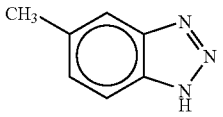
F-5
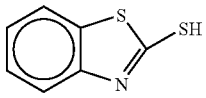
F-6
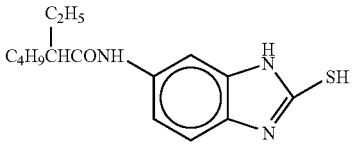
F-7
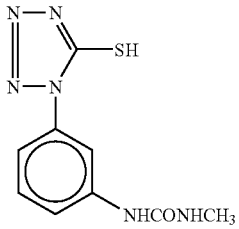
F-8
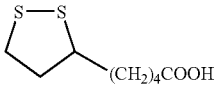
F-9
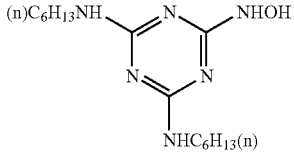
F-10
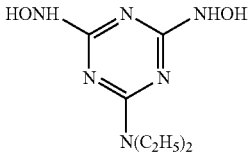
F-11
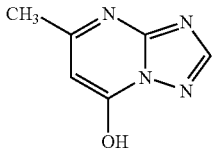
F-12
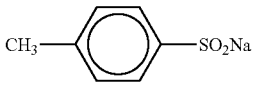
F-13
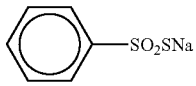
F-14
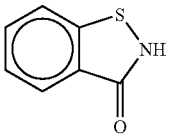
F-15
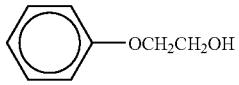
F-16
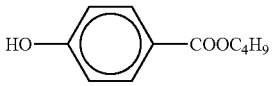
F-17
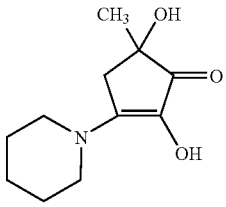
F-18
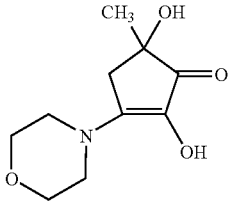
F-19

TABLE 3

Construction of 14th layer (High-speed blue sensitive layer)

| Sample | Emulsion | H.B.S. | Surfactant | Coupler | Remarks |
|---|---|---|---|---|---|
| 101 | Em-A1 | HBS-1 | W-4 | ExY-6 | Comp. |
| 102 | Em-A2 | HBS-1 | W-4 | ExY-6 | Comp. |
| 103 | Em-A2 | S-1 | A-1 | ExY-6 | Inv. |
| 104 | Em-A2 | S-37 | A-1 | ExY-6 | Inv. |
| 105 | Em-A2 | HBS-1 | W-4 | II-12 | Inv. |
| 106 | Em-A2 | HBS-1 | W-4 | II-106 | Inv. |
| 107 | Em-A2 | HBS-1 | W-4 | II-12, II-106 | Inv. |
| 108 | Em-A2 | S-1 | A-1 | II-12, II-106 | Inv. |
| 109 | Em-A3 | S-1 | A-1 | II-12, II-106 | Inv. |
| 110 | Em-A4 | HBS-1 | W-4 | ExY-6 | Comp. |
| 111 | Em-A5 | HBS-1 | W-4 | ExY-6 | Comp. |
| 112 | Em-A5 | S-1 | A-1 | II-12, II-106 | Inv. |
| 113 | Em-A6 | S-1 | A-1 | II-12, II-106 | Inv. |
| 114 | Em-A7 | HBS-1 | W-4 | ExY-6 | Comp. |
| 115 | Em-A8 | HBS-1 | W-4 | ExY-6 | Comp. |
| 116 | Em-A8 | S-1 | A-1 | II-12, II-106 | Inv. |
| 117 | Em-A9 | S-1 | A-1 | II-12, II-106 | Inv. |
| 118 | Em-A10 | HBS-1 | W-4 | ExY-6 | Comp. |
| 119 | Em-A11 | HBS-1 | W-4 | ExY-6 | Comp. |
| 120 | Em-A11 | S-1 | A-1 | II-12, II-106 | Inv. |
| 121 | Em-A12 | S-1 | A-1 | II-12, II-106 | Inv. |
| 122 | Em-A13 | HBS-1 | W-4 | ExY-6 | Comp. |
| 123 | Em-A14 | HBS-1 | W-4 | ExY-6 | Comp. |
| 124 | Em-A14 | S-1 | A-1 | II-12, II-106 | Inv. |
| 125 | Em-A15 | S-1 | A-1 | II-12, II-106 | Inv. |

H.B.S = High boiling organic solvent

TABLE 4

Construction of 11th layer (High-speed green sensitive layer)

| Sample | Emulsion | H.B.S. | Surfactant | Coupler | Remarks |
|---|---|---|---|---|---|
| 201 | Em-P1 | HBS-1 | W-4 | ExY-5 | Comp. |
| 202 | Em-P2 | HBS-1 | W-4 | ExY-5 | Comp. |
| 203 | Em-P2 | S-1 | A-1 | II-12, II-106 | Inv. |
| 204 | Em-P3 | S-1 | A-1 | II-12, II-106 | Inv. |
| 205 | Em-P4 | HBS-1 | W-4 | ExY-5 | Comp. |
| 206 | Em-P5 | HBS-1 | W-4 | ExY-5 | Comp. |
| 207 | Em-P5 | S-1 | A-1 | II-12, II-106 | Inv. |
| 208 | Em-P6 | S-1 | A-1 | II-12, II-106 | Inv. |
| 209 | Em-P7 | HBS-1 | W-4 | ExY-5 | Comp. |
| 210 | Em-P8 | HBS-1 | W-4 | ExY-5 | Comp. |
| 211 | Em-P8 | S-1 | A-1 | II-12, II-106 | Inv. |
| 212 | Em-P9 | S-1 | A-1 | II-12, II-106 | Inv. |
| 213 | Em-P10 | HBS-1 | W-4 | ExY-5 | Comp. |
| 214 | Em-P11 | HBS-1 | W-4 | ExY-5 | Comp. |
| 215 | Em-P11 | S-1 | A-1 | II-12, II-106 | Inv. |
| 216 | Em-P12 | S-1 | A-1 | II-12, II-106 | Inv. |

H.B.S = High boiling organic solvent

TABLE 5

Construction of 6th layer (High-speed red sensitive layer)

| Sample | Emulsion | H.B.S. | Surfactant | Coupler | Remarks |
|---|---|---|---|---|---|
| 301 | Em-J1 | HBS-1 | W-4 | ExC-6 | Comp. |
| 302 | Em-J2 | HBS-1 | W-4 | ExC-6 | Comp. |
| 303 | Em-J2 | S-1 | A-1 | II-12, II-106 | Inv. |
| 304 | Em-J3 | S-1 | A-1 | II-12, II-106 | Inv. |
| 305 | Em-J4 | HBS-1 | W-4 | ExC-6 | Comp. |
| 306 | Em-J5 | HBS-1 | W-4 | ExC-6 | Comp. |
| 307 | Em-J6 | HBS-1 | W-4 | ExC-6 | Comp. |
| 308 | Em-J7 | HBS-1 | W-4 | ExC-6 | Comp. |
| 309 | Em-J8 | HBS-1 | W-4 | ExC-6 | Comp. |
| 310 | Em-J9 | HBS-1 | W-4 | ExC-6 | Inv. |
| 311 | Em-J10 | HBS-1 | W-4 | ExC-6 | Inv. |
| 312 | Em-J11 | HBS-1 | W-4 | ExC-6 | Inv. |
| 313 | Em-J12 | HBS-1 | W-4 | ExC-6 | Inv. |

TABLE 5-continued

Construction of 6th layer (High-speed red sensitive layer)

| Sample | Emulsion | H.B.S. | Surfactant | Coupler | Remarks |
|---|---|---|---|---|---|
| 314 | Em-J13 | HBS-1 | W-4 | ExC-6 | Inv. |
| 315 | Em-J11 | S-1 | A-1 | II-12, II-106 | Inv. |
| 316 | Em-J14 | HBS-1 | W-4 | ExC-6 | Comp. |
| 317 | Em-J15 | HBS-1 | W-4 | ExC-6 | Comp. |
| 318 | Em-J16 | HBS-1 | W-4 | ExC-6 | Inv. |
| 319 | Em-J16 | S-1 | A-1 | II-12, II-106 | Inv. |
| 320 | Em-J17 | S-1 | A-1 | II-12, II-106 | Inv. |
| 321 | Em-J18 | HBS-1 | W-4 | ExC-6 | Comp. |
| 322 | Em-J19 | HBS-1 | W-4 | ExC-6 | Comp. |
| 323 | Em-J20 | HBS-1 | W-4 | ExC-6 | Inv. |
| 324 | Em-J20 | S-1 | A-1 | II-12, II-106 | Inv. |
| 325 | Em-J21 | S-1 | A-1 | II-12, II-106 | Inv. |
| 326 | Em-J22 | HBS-1 | W-4 | ExC-6 | Comp. |
| 327 | Em-J23 | HBS-1 | W-4 | ExC-6 | Comp. |
| 328 | Em-J24 | HBS-1 | W-4 | ExC-6 | Inv. |
| 329 | Em-J24 | S-1 | A-1 | II-12, II-106 | Inv. |
| 330 | Em-J25 | S-1 | A-1 | II-12, II-106 | Inv. |

H.B.S = High boiling organic solvent

Evaluations of the samples are as follows. The samples were subjected to light for 1/100 sec through continuous wedges and a gelatin filter SC-39, which is a long wavelength light transmitting filter having a cut-off wavelength of 390 nm, manufactured by Fuji Photo Film Co., Ltd. The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 issued by Japan Institute of Invention and Innovation.

The processing steps and compositions of processing solutions are as follows.

(Processing steps)

| Step | Time | Temp. | Qty. of replenisher* | Tank vol. |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide lightsensitive material (equivalent to one 24 Ex. film).

The stabilizer was fed from stabilization (2) to stabilization (1) by counter current, and the fixer was also fed from fixing (2) to fixing (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| | Tank soln. (g) | Replenisher (g) |
|---|---|---|
| (Color developer) | | |
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(□-hydroxyethyl)amino]-aniline sulfate | 4.5 | 6.5 |
| Water | q.s. ad 1.0 L | |
| pH | 10.05 | 10.18 |
| This pH was adjusted by the use of potassium hydroxide and sulfuric acid. | | |
| (Bleaching soln.) | | |
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad 1.0 L | |
| pH | 4.6 | 4.0 |
| This pH was adjusted by the use of aqueous ammonia. | | |
| (Fixing (1) tank soln.) | | |
| 5:95 (by volume) mixture of the above bleaching tank soln. and the following fixing tank soln, pH 6.8. | | |
| (Fixing (2)) | | |
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water | q.s. ad 1.0 L | |
| pH | 7.4 | 7.45 |
| This pH was adjusted by the use of aqueous ammonia and acetic acid. | | |

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

| (Stabilizer): common to tank solution and replenisher. | (g) |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water | q.s. ad 1.0 L |
| pH | 8.5 |

The above-mentioned processing was performed to samples 101 to 125. In addition, another set of samples 101 to 125 were left to stand for 3 days under the condition of 50° C. and 80% RH, and subjected to the same processing. Evaluations of photographic performances were conducted by measuring density of the processed samples through a blue filter. Results obtained are set forth in Table 6.

As set forth in Table 6, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound represented by general formula (IV) or (V) of the invention, attained low fogging and high-speed photographic materials. In addition, the combination of the compounds represented by formulas (VI) to (X) set forth above, attained photographic materials with strong resistance to fogging during storage.

TABLE 6

| | Photographic performance with blue filter | | Photographic performance after subjecting to thermal condition | | |
|---|---|---|---|---|---|
| Sample | Sensitivity | Fog | Sensitivity | Fog | Remarks |
| 101 | 100 | 0.25 | 90 | 0.40 | Comp. |
| 102 | 135 | 0.35 | 75 | 0.75 | Comp. |
| 103 | 135 | 0.27 | 120 | 0.55 | Inv. |
| 104 | 135 | 0.28 | 120 | 0.56 | Inv. |
| 105 | 135 | 0.28 | 120 | 0.56 | Inv. |
| 106 | 135 | 0.27 | 120 | 0.55 | Inv. |
| 107 | 135 | 0.27 | 120 | 0.55 | Inv. |
| 108 | 135 | 0.26 | 120 | 0.55 | Inv. |
| 109 | 137 | 0.25 | 128 | 0.35 | Inv. |
| 110 | 103 | 0.25 | 88 | 0.38 | Comp. |
| 111 | 137 | 0.36 | 77 | 0.78 | Comp. |
| 112 | 137 | 0.27 | 121 | 0.53 | Inv. |
| 113 | 138 | 0.26 | 127 | 0.34 | Inv. |
| 114 | 105 | 0.26 | 91 | 0.39 | Comp. |
| 115 | 139 | 0.37 | 83 | 0.80 | Comp. |
| 116 | 139 | 0.27 | 124 | 0.55 | Inv. |
| 117 | 139 | 0.26 | 130 | 0.33 | Inv. |
| 118 | 99 | 0.28 | 88 | 0.41 | Comp. |
| 119 | 134 | 0.40 | 80 | 0.88 | Comp. |
| 120 | 134 | 0.29 | 120 | 0.56 | Inv. |
| 121 | 135 | 0.28 | 128 | 0.36 | Inv. |
| 122 | 104 | 0.25 | 92 | 0.39 | Comp. |
| 123 | 138 | 0.36 | 81 | 0.79 | Comp. |
| 124 | 138 | 0.26 | 121 | 0.54 | Inv. |
| 125 | 139 | 0.26 | 129 | 0.32 | Inv. |

The above-mentioned processing was performed to samples 201 to 216. In addition, another set of samples 201 to 216 were left to stand for 3 days under the condition of 50° C. and 80% RH, and subjected to the same processing. Evaluations of photographic performances were conducted by measuring density of the processed samples through a green filter. Results obtained are set forth in Table 7.

As set forth in Table 7, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound represented by general formula (IV) or (V) of the invention, attained low fogging and high-speed photographic materials. In addition, the combination of the compounds represented by formulas (VI) to (X) set forth above, attained photographic materials with strong resistance to fogging during storage.

TABLE 7

| | Photographic performance with green filter | | Photographic performance after subjecting to thermal condition | | |
|---|---|---|---|---|---|
| Sample | Sensitivity | Fog | Sensitivity | Fog | Remarks |
| 201 | 100 | 0.27 | 85 | 0.40 | Comp. |
| 202 | 156 | 0.40 | 70 | 1.05 | Comp. |
| 203 | 155 | 0.29 | 125 | 0.65 | Inv. |
| 204 | 155 | 0.29 | 135 | 0.45 | Inv. |
| 205 | 103 | 0.26 | 86 | 0.40 | Comp. |
| 206 | 158 | 0.39 | 72 | 1.10 | Comp. |
| 207 | 158 | 0.29 | 125 | 0.63 | Inv. |
| 208 | 157 | 0.29 | 136 | 0.43 | Inv. |
| 209 | 99 | 0.29 | 83 | 0.46 | Comp. |
| 210 | 154 | 0.41 | 73 | 1.08 | Comp.. |
| 211 | 154 | 0.31 | 124 | 0.65 | Inv. |
| 212 | 155 | 0.30 | 133 | 0.44 | Inv. |
| 213 | 105 | 0.28 | 87 | 0.47 | Comp. |
| 214 | 160 | 0.40 | 79 | 1.11 | Comp. |
| 215 | 159 | 0.29 | 127 | 0.66 | Inv. |
| 216 | 159 | 0.28 | 139 | 0.46 | Inv. |

The above-mentioned processing was performed to samples 301 to 330. In addition, another set of sample 201 to 216 were left to stand for 3 days under the condition of 50° C. and 80% RH, and subjected to the same processing. Evaluations of photographic performances were conducted by measuring density of the processed samples through a red filter. Results obtained are set forth in Table 8.

As set forth in Table 8, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound" represented by general formula (IV) or (V) of the invention, attained low fogging and high-speed photographic materials. In addition, the combination of the compounds represented by formulas (VI) to (X) set forth above, attained photographic materials with strong resistance to fogging during storage.

TABLE 8

| | Photographic performance with red filter | | Photographic performance after subjecting to thermal condition | | |
|---|---|---|---|---|---|
| Sample | Sensitivity | Fog | Sensitivity | Fog | Remarks |
| 301 | 100 | 0.27 | 87 | 0.42 | Comp. |
| 302 | 158 | 0.41 | 76 | 1.20 | Comp. |
| 303 | 158 | 0.29 | 103 | 0.81 | Inv. |
| 304 | 159 | 0.29 | 125 | 0.50 | Inv. |
| 305 | 118 | 0.28 | 98 | 0.43 | Comp. |
| 306 | 125 | 0.27 | 105 | 0.41 | Comp. |
| 307 | 128 | 0.26 | 107 | 0.40 | Comp. |
| 308 | 124 | 0.25 | 103 | 0.40 | Comp. |
| 309 | 116 | 0.26 | 95 | 0.41 | Comp. |
| 310 | 172 | 0.41 | 92 | 1.18 | Inv. |
| 311 | 178 | 0.40 | 94 | 1.18 | Inv. |
| 312 | 180 | 0.42 | 96 | 1.20 | Inv. |
| 313 | 176 | 0.41 | 93 | 1.20 | Inv. |
| 314 | 169 | 0.40 | 85 | 1.19 | Inv. |
| 315 | 177 | 0.27 | 111 | 0.78 | Inv. |
| 316 | 103 | 0.28 | 88 | 0.43 | Comp. |
| 317 | 160 | 0.40 | 78 | 1.18 | Comp. |
| 318 | 178 | 0.40 | 83 | 1.19 | Inv. |
| 319 | 177 | 0.29 | 112 | 0.82 | Inv. |
| 320 | 177 | 0.28 | 141 | 0.48 | Inv. |
| 321 | 99 | 0.30 | 86 | 0.44 | Comp. |
| 322 | 158 | 0.42 | 74 | 1.25 | Comp. |
| 323 | 175 | 0.41 | 92 | 1.21 | Inv. |
| 324 | 176 | 0.31 | 111 | 0.84 | Inv. |
| 325 | 177 | 0.31 | 142 | 0.49 | Inv. |
| 326 | 105 | 0.28 | 88 | 0.42 | Comp. |
| 327 | 163 | 0.40 | 78 | 1.20 | Comp. |
| 328 | 181 | 0.40 | 93 | 1.20 | Inv. |
| 329 | 180 | 0.29 | 113 | 0.85 | Inv. |
| 330 | 181 | 0.28 | 144 | 0.45 | Inv. |

The results set forth above reveal that the combination of the compounds of the invention can attain silver halide photographic materials having high speed, and low fogging, and low sensitivity decrease and low fog increase due to storage under thermal conditions.

Example 2

Emulsion Em-X1: (100) Silver Iodobromide Tabular Emulsion

A polyvinyl alcohol (having vinyl acetate with polymerization degree of 1700, and average saponification rate of 98% in alcohol, hereinafter referred to as polymer (PV)) and an aqueous gelatin solution (1200 mL of water containing 5 g of a polymer (PV) and 8 g of a deionized alkali-processed gelatin) were prepared in a reaction vessel. The pH was adjusted to 11 and the temperature was held at 55° C. While the resultant solution was stirred, 200 mL of Ag-1 solution (containing 0.58 mol/L of $AgNO_3$) and 200 mL of X-1 solution (containing 0.58 mol/L of KBr) were added over 40 minutes. The addition was performed by the double-jet method using a precision liquid transmission pump.

After 5 minutes had passed, the pH was adjusted to 6. An Ag-2 solution (containing 1.177 mol/L of $AgNO_3$) and a X-2 solution (containing 1.177 mol/L of KBr) were used. While the pBr was maintained at 3.1, 600 mL of each solution was added at a flow rate of 12 mL/minute by the fixed quantity double-jet method. Then, an aqueous gelatin solution (200 mL of water containing 30 g of gelatin) and the spectral sensitizing dyes 22, 23 and 24 were added, 100 mL of each of the Ag-3 solution (2.94 mol/L of $AgNO_3$) and X-3 solution (2.7 mol/L of KBr, 0.24 mol/L of KI) were added at 5 mL/minute. The grain formation step was completed.

Thereafter, the temperature was raised to 35° C., and washed with water by a precipitation washing method. A gelatin solution was added to redisperse the emulsion, and the pH and the pAg were adjusted to 6 and 8.7, respectively.

Sensitizing dye 22

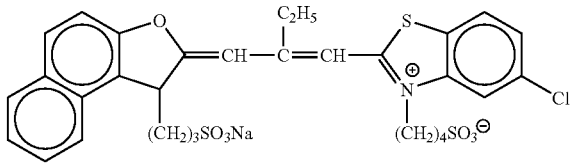

Sensitizing dye 23

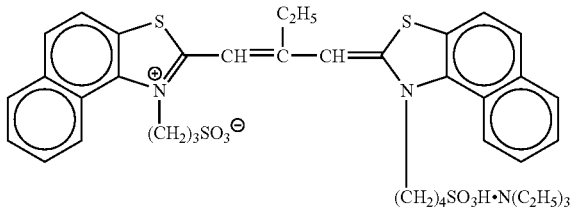

Sensitizing dye 24

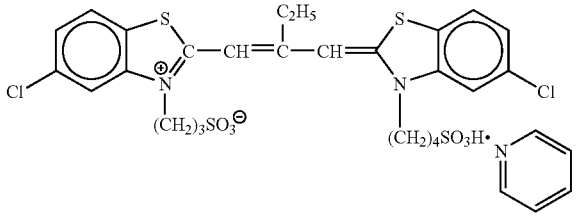

The grains thus prepared are occupied by the following grains in an amount of 93% or more of the total projected area, which was obtained from replica TEM images of emulsion grains: main planes are (100) planes, an equivalent-circle diameter is 0.4 μm or more, a thickness is 0.08 μm, and an aspect ratio is 9.5 or more.

The above emulsion was optimally chemically sensitized referring to Em-J1 of Example 1, except for the sensitizing dyes.

(Em-X2)

Em-X2 was obtained in the same manner as Em-X1, except that compound (I-13) of the invention was added in an amount of $1\times10^{-4}$ mol/mol Ag at the time of chemical sensitization.

(Em-X3)

Em-X3 was obtained in the same manner as EM-X2, except that compound (IV-2) of the invention was added at the time of chemical sensitization in an amount of 10 mol % of the sensitizing dyes added.

(Em-X4)

Em-X4 was obtained in the same manner as Em-X3, except that compound (IX-2-50) of the invention was added in an amount of $1\times10^{-4}$ mol/mol Ag at the time of chemical sensitization.

Each emulsion in a dissolved state was left to stand for 30 min at 40° C. On a cellulose triacetate film support provided with an under coat layer, each of the above emulsions Em-X1 to -X4 was coated with the coating conditions set forth in Table 9 below.

TABLE 9

| | |
|---|---|
| (1) Emulsion layer | |
| Emulsion: Each emulsion | (silver $1.63 \times 10^{-2}$ mol/m$^2$) |
| Coupler | |
| ExM-1 | ($2.26 \times 10^{-3}$ mol/m$^2$) |
| ExY-5 | ($8.0 \times 10^{-3}$ g/m$^2$) |
| High boiling organic solvent | ($1.8 \times 10^{-1}$ g/m$^2$) |
| Gelatin | (3.24 g/m$^2$) |
| Surfactant | |
| (2) Protective layer | |
| H-1 | (0.08 g/m$^2$) |
| Gelatin | (1.8 g/m$^2$) |

Samples 401 to 405 were prepared by replacing the emulsion to be coated, as set forth in Table 10.

TABLE 10

| Sample | Emulsion | H.B.S. | Surfactant | Coupler (with respect to ExY-5) | Remarks |
|---|---|---|---|---|---|
| 401 | Em-X1 | HBS-1 | W-4 | ExY-5 | Comp. |
| 402 | Em-X2 | HBS-1 | W-4 | ExY-5 | Comp. |
| 403 | Em-X2 | S-1 | A-1 | II-12, II-106 | Inv. |
| 404 | Em-X3 | S-1 | A-1 | II-12, II-106 | Inv. |
| 405 | Em-X4 | S-1 | A-1 | II-12, II-106 | Inv. |

H.B.S. = High oiling organic solvent

These samples were subjected to hardening processing at 40° C., relative humidity of 70% for 14 hr. Thereafter, the samples were exposed to light for 1/100 sec through continuous wedges, and subjected to the development processing below. Density of the processed samples was measured with a green filter to obtain photographic speed and fog density before the long-term storage. Sensitivity was indicated in a relative value of a reciprocal of an exposure amount required to reach the density of fog density plus 0.2. As an evaluation of storage fogging of the sensitive materials, the samples were stored for 14 days under the conditions of 40° C. and relative humidity of 60%. Then, the samples were exposed to light for 1/100 sec, and subjected to the development processing below. Density of the processed samples was measured with a green filter to obtain fogg density after the long-term storage. The density difference between before and after storage was calculated.

The processing was carried out by the use of automatic processor FP-362B manufactured by Fuji Photo Film Co., Ltd.

The processing steps and compositions of processing solutions are as follows.

(Processing steps)

| Step | Time | Temp. | Qty. of replenisher* | Tank vol. |
|---|---|---|---|---|
| Color development | 3 min 5 sec | 38.0° C. | 15 mL | 10.3 L |
| Bleaching | 50 sec | 38° C. | 5 mL | 3.6 L |
| Fixing (1) | 50 sec | 38° C. | — | 3.6 L |

-continued (Processing steps)

| Step | Time | Temp. | Qty. of replenisher* | Tank vol. |
|---|---|---|---|---|
| Fixing (2) | 50 sec | 38° C. | 7.5 mL | 3.6 L |
| Stabilization (1) | 20 sec | 38° C. | — | 1.9 L |
| Stabilization (2) | 20 sec | 38° C. | — | 1.9 L |
| Stabilization (3) | 20 sec | 38° C. | 30 mL | 1.9 L |
| Drying | 1 min 30 sec | 60° C. | | |

*The replenishment rate is a value per 1.1 m of a 35-mm wide lightsensitive material (equivalent to one 24 Ex. film).

The stabilizer was counterflowed in the order of (3)→(2)→(1), and the fixer was also connected from (2) to (1) by counterflow piping. Also, the tank solution of stabilizer (2) was supplied to fixer (2) in an amount of 15 mL as a replenishment rate. Additionally, as the developer a color developer (A) replenisher and a color developer (B) replenisher having the following compositions were replenished in amounts of 12 mL and 3 mL, respectively, i.e., a total of 15 mL, as a replenishment rate. Note that the amounts of the developer, bleaching solution, and fixer carried over to the bleaching step, fixing step, and washing step, respectively, were 2.0 mL per 1.1 m of a 35-mm wide sensitized material. Note also that each crossover time was 6 sec, and this time was included in the processing time of each preceding step.

The compositions of the processing solutions are presented below.

| (Color developer (A)) | [Tank solution] | [Replenisher] |
|---|---|---|
| Diethylenetriamine pentaacetic acid | 2.0 g | 4.0 g |
| Sodium 4,5-dihydroxy benzene-1,3-disulfonate | 0.4 g | 0.5 g |
| Disodium-N,N-bis(2-sulfonateethyl) hydroxylamine | 10.0 g | 15.0 g |
| Sodium sulfite | 4.0 g | 9.0 g |
| Hydroxylamine sulfate | 2.0 g | — |
| Potassium bromide | 1.4 g | — |
| Diethyleneglycol | 10.0 g | 17.0 g |
| Ethyleneurea | 3.0 g | 5.5 g |
| 2-methyl-4-[N-ethyl-N-(β-hydroxyethyl)amino] aniline sulfate | 4.7 g | 11.4 g |
| Potassium carbonate | 39 g | 59 g |
| Water to make | 1.0 L | 1.0 L |
| pH (controlled by sulfuric acid and KOH) | 10.05 | 10.50 |

The above tank solution indicates the composition after (color developer (B)) below was mixed.

| (Color developer (B)) | [Tank solution] | [Replenisher] |
|---|---|---|
| Hydroxylamine sulfate | 2.0 g | 4.0 g |
| Water to make | 1.0 L | 1.0 L |
| pH (controlled by sulfuric acid and KOH) | 10.05 | 4.0 |

The above tank solution indicates the composition after (color developer (A)) described above was mixed.

| | [Tank solution] | [Replenisher] |
|---|---|---|
| (Bleaching solution) | | |
| Ferric ammonium 1,3-diaminopropanetetra acetate monohydrate | 120 g | 180 g |
| Ammonium bromide | 50 g | 70 g |
| Succinic acid | 30 g | 50 g |
| Maleic acid | 40 g | 60 g |
| Imidazole | 20 g | 30 g |
| Water to make | 1.0 L | 1.0 L |
| pH (controlled by ammonia water and nitric acid) | 4.6 | 4.0 |
| (Fixer) | | |
| Ammonium thiosulfate (750 g/L) | 280 mL | 1,000 mL |
| Aqueous ammonium bisulfite solution (72%) | 20 g | 80 g |
| Imidazole | 5 g | 45 g |
| 1-mercapto-2-(N,N-dimethylaminoethyl)-tetrazole | 1 g | 3 g |
| Ethylenediamine tetraacetic acid | 8 g | 12 g |
| Water to make | 1 L | 1 L |
| pH (controlled by ammonia water and nitric acid) | 7.0 | 7.0 |

| (Stabilizer) | [Common to tank solution and replenisher] |
|---|---|
| Sodium p-toluenesulfinate | 0.03 g |
| p-Nonylphenoxypolyglycidol (glycidol average polymerization degree 10) | 0.4 g |
| Disodium ethylenediaminetetraacetate | 0.05 g |
| 1,2,4-triazole | 1.3 g |
| 1,4-bis(1,2,4-triazole-1-isomethyl) piperazine | 0.75 g |
| 1,2-benzoisothiazoline-3-one | 0.10 g |
| Water to make | 1.0 L |
| pH | 8.5 |

The results of the evaluations are set forth in Table 11. Sensitivity is indicated in a relative value of a reciprocal of an exposure amount required to reach a fog density plus 0.2. In the emulsion of the present invention, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound represented by general formula (IV) of the invention, attained low fogging and high-speed photographic materials. In addition, the combination of the compounds represented by formulas (VI) to (X) set forth above, attained photographic materials with strong resistance to fogging during storage.

TABLE 11

| Sample | Sensitivity | Fog | Sensitivity after subjecting to thermal condition | Fog after subjecting to thermal condition | Remarks |
|---|---|---|---|---|---|
| 401 | 100 | 0.25 | 84 | 0.42 | Comp. |
| 402 | 145 | 0.45 | 65 | 1.1 | Comp. |

TABLE 11-continued

| Sample | Sensitivity | Fog | Sensitivity after subjecting to thermal condition | Fog after subjecting to thermal condition | Remarks |
|---|---|---|---|---|---|
| 403 | 144 | 0.26 | 127 | 0.64 | Inv. |
| 404 | 145 | 0.24 | 133 | 0.43 | Inv. |
| 405 | 152 | 0.23 | 135 | 0.44 | Inv. |

Example 3

Emulsion Em-Y1: (111) Silver Chloride Tabular Emulsion

Into 1.2 L of water, 2.0 g of sodium chloride and 2.8 g of an inert gelatin were added, 60 mL of Ag-1 solution (containing 9 g of $AgNO_3$) and 60 mL of X-1 solution (containing 3.2 g of sodium chloride) were added by the double jet method over 1 minute while maintaining the temperature in the vessel at 35° C. One minute after the completion of the addition, 0.8 millimole of N-benzyl-4-phenylpyridinium chloride was added. Additional 1 min after that, 3.0 g of sodium chloride was added. The temperature in the reaction vessel was raised to 60° C. over the next 25 min. After ripening the mixture for 16 min at 60° C., 560 g of 10% phthalated gelatin aqueous solution and $1\times10^{-5}$ mole of sodium thiosulfonate were added. Thereafter, 317.5 mL of Ag-2 solution (containing 127 g of $AgNO_3$), X2 solution (containing 54.1 g of sodium chloride), and 160 mL of crystal habit-controlling agent 1 solution (M/50) were added over 20 min at accelerated flow rates. Additional 2 min after that, Ag-3 solution (containing 34 g of $AgNO_3$) and X-3 solution (containing 11.6 g of sodium chloride and 1.27 mg of yellow prussiate of potash) were added over 5 min. Then, 33.5 mL of 0.1N thiocyanic acid, and 0.32 millimole of sensitizing dye 25, 0.48 millimole of sensitizing dye 26, and 0.05 millimole of sensitizing dye 27 were added.

Sensitizing dye 25

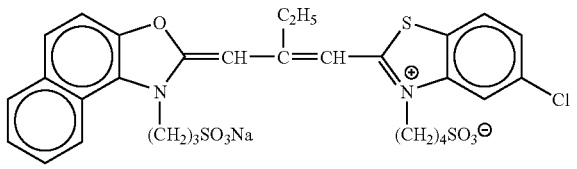

Sensitizing dye 26

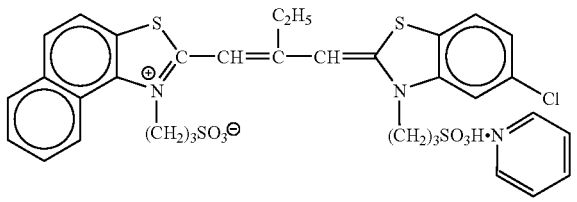

-continued

Sensitizing dye 27

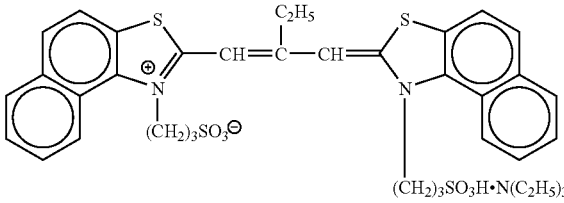

Crystal habit-controlling agent 1

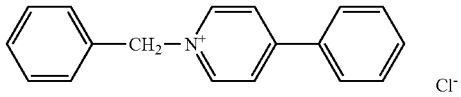

The temperature was decreased to 40° C., and washed with water by a precipitation washing method. An aqueous gelatin solution was added to redisperse the emulsion, and the pH and the pAg were adjusted to 6.2 and 7.5, respectively.

The grains thus prepared were occupied by the following grains in an amount of 50% or more of the total projected area, which was obtained from replica TEM images of emulsion grains: main planes are (111) planes, an equivalent-sphere diameter is 0.56–0.66 μm, a projected area diameter is 0.95–1.15 μm, and a grain thickness is 0.12–0.16 μm.

The above emulsion was optimally chemically sensitized referring to Em-J1 of Example 1, except for the sensitizing dyes to obtain Em-Y1.

(Em-Y2)

Em-Y2 was obtained in the same manner as Em-Y1, except that compound (I-13) of the invention was added in an amount of $1\times10^{-4}$ mol/mol Ag at the time of chemical sensitization.

(Em-Y3)

Em-Y3 was obtained in the same manner as Em-Y2, except that compound (IV-2) of the invention was added at the time of chemical sensitization in an amount of 10 mol % of the sensitizing dyes added.

(Em-Y4)

Em-Y4 was obtained in the same manner as Em-Y3, except that compound (IX-2-50) of the invention was added in an amount of $1\times10^{-4}$ mol/mol Ag at the time of chemical sensitization.

Each emulsion in a dissolved state was left to stand for 30 min at 40° C. On a cellulose triacetate film support provided with an under coat layer, each of the above emulsions Em-Y1 to —Y4 was coated with the coating conditions set forth in Table 9 above.

Samples 501 to 505 were prepared by replacing the emulsion to be coated as set forth in Table 12.

TABLE 12

| Sample | Emulsion | H.B.S. | Surfactant | Coupler (with respect to ExY-5) | Remarks |
|---|---|---|---|---|---|
| 501 | Em-Y1 | HBS-1 | W-4 | ExY-5 | Comp. |
| 502 | Em-Y2 | HBS-1 | W-4 | ExY-5 | Comp. |
| 503 | Em-Y2 | S-1 | A-1 | II-12, II-106 | Inv. |

TABLE 12-continued

| Sample | Emulsion | H.B.S. | Surfactant | Coupler (with respect to ExY-5) | Remarks |
|---|---|---|---|---|---|
| 504 | Em-Y3 | S-1 | A-1 | II-12, II-106 | Inv. |
| 505 | Em-Y4 | S-1 | A-1 | II-12, II-106 | Inv. |

H.B.S. = High oiling organic solvent

The results of the evaluations conducted in the same manner as in Example 3 are set forth in Table 13 below. Sensitivity is indicated in a relative value of a reciprocal of an exposure amount required to reach a fog density plus 0.2. In the emulsion of the present invention, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound represented by general formula (IV) of the invention, attained low fogging and high-speed photographic materials. In addition, the combination of the compounds represented by formulas (VI) to (X) set forth above, attained photographic materials with strong resistance to fogging during storage.

TABLE 13

| Sample | Sensitivity | Fog | Sensitivity after subjecting to thermal condition | Fog after subjecting to thermal condition | Remarks |
|---|---|---|---|---|---|
| 501 | 100 | 0.28 | 83 | 0.48 | Comp. |
| 502 | 143 | 0.48 | 62 | 1.2 | Comp. |
| 503 | 141 | 0.28 | 125 | 0.68 | Inv. |
| 504 | 143 | 0.26 | 132 | 0.48 | Inv. |
| 505 | 150 | 0.27 | 134 | 0.49 | Inv. |

Example 4

Emulsion Em-Z1: (100) silver chloride tabular emulsion containing, in a shell portion, 0.4 mol % of iodide with respect to the total silver amount 1200 mL of water, 25 g of gelatin, 0.4 g of sodium chloride, and 4.5 mL of 1N silver nitrate solution (pH=4.5) were added into a reaction vessel and maintained the temperature at 40° C. Next, Ag-1 solution (silver nitrate 0.2 g/mL) and X-1 solution (sodium chloride 0.069 g/mL) were added at a flow rate of 48 mL/min over 4 min while vigorously stirring the mixture. 15 sec after that, 150 mL of an aqueous polyvinyl alcohol solution (containing 6.7 g of poly vinylalcohol having vinyl acetate with polymerization degree of 1700, and average saponification rate of 98% or more in alcohol, hereinafter referred to as PVA-1 in 1 L of water) was added and pH was adjusted to 3.5. The temperature was raised to 75° C. over 15 min, 23 mL of 1N aqueous sodium hydroxide solution was added to adjust pH to 6.5. 4.0 mL of 1-(5-methylureidophenyl)-5-mercaptoteterzole (0.05%) and 4.0 mL of N,N'-dimethylimidazolidine-2-thion (1% aqueous solution) were added.

After adding 4 g of sodium chloride, followed by adjustment of the silver potential against a saturated calomel electrode at room temperature to 100 mV, the Ag-1 solution and X-1 solution were added over 15 min at a linearly increasing flow rate from 40 mL/min to 42 mL/min, while maintaining the silver potential at 100 mV. In addition, 12.5 mL of 1N silver nitrate aqueous solution was added to adjust the pH at 4.0. After 28.8 g of sodium chloride was added, followed by adjusting the silver potential at 60 mV, 0.38 millimole of sensitizing dye 25, 0.56 millimole of sensitizing dye 26, and 0.06 millimole of sensitizing dye 27, and Ag-2 solution (silver nitrate 0.1 g/mL) and X-2 solution (an aqueous solution containing 33.8 g of sodium chloride and 1.95 g of potassium iodide in 1 L, so that the total amount of iodide becomes 0.4 mol % of the total silver amount) was added at a flow rate of 40 mL/min. Thereafter, the mixture was left to stand for 10 min at 75° C.

The temperature was decreased to 40° C., and washed with water by a precipitation washing method. An aqueous gelatin solution was added to redisperse the emulsion, and the pH and the pAg were adjusted to 6.0 and 7.3, respectively.

The grains thus prepared were occupied by the following grains in an amount of 50% or more of the total projected area, which was obtained from replica TEM images of emulsion grains: main planes are (100) planes, an equivalent-sphere diameter is 0.4–0.5 μm, a grain thickness is 0.10–0.12 μm, an aspect ratio is 6.5 or more, and ratio of neighboring sides is 1.1–1.3.

The above emulsion was optimally chemically sensitized referring to Em-J1 of Example 1, except for the sensitizing dyes to obtain Em-Z1.

(Em-Z2)

Em-Z2 was obtained in the same manner as Em-Z1, except that compound (I-13) of the invention was added in an amount of $1\times10^{-4}$ mol/mol Ag at the time of chemical sensitization.

(Em-Z3)

Em-Z3 was obtained in the same manner as Em-Z2, except that compound (IV-2) of the invention was added at the time of chemical sensitization in an amount of 10 mol % of the sensitizing dyes added.

(Em-Z4)

Em-Z4 was obtained in the same manner as Em-Z3, except that compound (IX-2-50) of the invention was added in an amount of $1\times10^{-4}$ mol/mol Ag at the time of chemical sensitization.

Each emulsion in a dissolved state was left to stand for 30 min at 40° C. On a cellulose triacetate film support provided with an under coat layer, each of the above emulsions Em-Z1 to -Z4 was coated with the coating conditions set forth in Table 9 above.

Samples 601 to 605 were prepared by replacing the emulsion to be coated as set forth in Table 14.

TABLE 14

| Sample | Emulsion | H.B.S. | Surfactant | Coupler (with respect to ExY-5) | Remarks |
|---|---|---|---|---|---|
| 601 | Em-Z1 | HBS-1 | W-4 | ExY-5 | Comp. |
| 602 | Em-Z2 | HBS-1 | W-4 | ExY-5 | Comp. |
| 603 | Em-Z2 | S-1 | A-1 | II-12, II-106 | Inv. |
| 605 | Em-Z3 | S-1 | A-1 | II-12, II-106 | Inv. |

TABLE 14-continued

| Sample | Emulsion | H.B.S. | Surfactant | Coupler (with respect to ExY-5) | Remarks |
|---|---|---|---|---|---|
| 606 | Em-Z4 | S-1 | A-1 | II-12, II-106 | Inv. |

H.B.S. = High oiling organic solvent

Evaluation was conducted in the similar manner as in Example 3. The results obtained are set forth below.

TABLE 15

| Sample | Sensitivity | Fog | Sensitivity after subjecting to thermal condition | Fog after subjecting to thermal condition | Remarks |
|---|---|---|---|---|---|
| 601 | 100 | 0.30 | 80 | 0.47 | Comp. |
| 602 | 145 | 0.50 | 65 | 1.15 | Comp. |
| 603 | 144 | 0.31 | 123 | 0.67 | Inv. |
| 604 | 145 | 0.30 | 133 | 0.45 | Inv. |
| 605 | 152 | 0.31 | 135 | 0.46 | Inv. |

Sensitivity is indicated in a relative value of a reciprocal of an exposure amount required to reach a fog density plus 0.2. In the emulsion of the present invention, the combination of the compound represented by general formula (I) of the invention with the compound represented by general formula (II) or (III) of the invention; the combination of the compound represented by general formula (I) of the invention with the surfactant of the invention and the high-boiling point organic solvent of the invention; and the combination of the compound represented by general formula (I) with the compound represented by general formula (IV) of the invention, attained low fogging and high-speed photographic materials. In addition, the combination of the compounds represented by formulas (VI) to (X) set forth above, attained photographic materials with strong resistance to fogging during storage.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic lightsensitive material comprising a support having thereon at least one red-sensitive layer, at least one green-sensitive layer and at least one blue-sensitive layer wherein the at least one blue-sensitive layer contains at least one compound represented by formula (I), and an emulsified dispersion containing at least one surfactant having a critical micelle concentration of $4.0\times10^{-3}$ mol/L or less in an amount of 0.01% by weight or more based on all the ingredients contained in the blue-sensitive layer:

$$(X)k-(L)m-(A-B)n \quad (I)$$

wherein X represents an adsorbing group to silver halide or a light-absorbing group having at least one atom selected from the group consisting of N, S, P, Se and Te; L represents a bivalent linking group having at least one atom selected from the group consisting of C, N, S and O; A represents an electron-donating group; B represents a leaving group or a hydrogen atom, wherein after—(A-B)$_n$ portion is oxidized, B is eliminated or deprotonated thereby to form a radical A.; k and m independently represent an integer of 0 to 3; and n represents 1 or 2.

2. The silver halide photographic lightsensitive material according to claim 1, wherein 50% or more of the total projected area of all the silver halide grains contained in the blue lightsensitive layer is occupied by silver halide grains satisfying the following requirements (a) to (d):

(a) parallel main planes thereof are (111) faces, (b) an aspect ratio thereof is 2 or more, (c) ten or more dislocation lines per grain are present, and (d) tabular silver halide grains each formed of silver iodobromide or silver chloroiodobromide whose silver chloride content is less than 10 mol %.

3. The silver halide photographic lightsensitive material according to claim 1, wherein 50% or more of the total projected area of all the silver halide grains contained in the blue lightsensitive layer is occupied by silver halide grains satisfying the following requirements (a), (d) and (e):

(a) parallel main planes thereof are (111) faces, (d) tabular silver halide grains each formed of silver iodobromide or silver chloroiodobromide whose silver chloride content is less than 10 mol%, and (e) hexagonal tabular grains each having at least one epitaxial junction per grain at an apex portion and/or a side face portion and/or a main plane portion thereof.

4. The silver halide photographic lightsensitive material according to claim 1, wherein 50% or more of the total projected area of all the silver halide grains contained in the blue lightsensitive layer is occupied by silver halide grains satisfying the following requirements (d), (f) and (g):

(d) tabular silver halide grains each formed of silver iodobromide or silver chloroiodobromide whose silver chloride content is less than 10 mol %, (f) parallel main planes thereof are (100) faces, and (g) an aspect ratio thereof is 2 or more.

5. The silver halide photographic lightsensitive material according to claim 1, wherein 50% or more of the total projected area of all the silver halide grains contained in the blue lightsensitive layer is occupied by silver halide grains satisfying the following requirements (g), (h) and (i):

(g) an aspect ratio thereof is 2 or more, (h) parallel main planes thereof are (111) faces or (100) faces, and (i) tabular grains each having a silver chloride content of at least 80 mol %.

6. The silver halide lightsensitive material according to claim 1, wherein the emulsified dispersion further contains a high-boiling organic solvent having a dielectric constant of 7.0 or less.

7. The silver halide photographic lightsensitive material according to claim 6, wherein 50% or more of the total projected area of all the silver halide grains contained in the blue lightsensitive layer is occupied by silver halide grains satisfying the following requirements (a) to (d):

(a) parallel main planes thereof are (111) faces, (b) an aspect ratio thereof is 2 or more, (c) ten or more dislocation lines per grain are present, and (d) tabular silver halide grains each formed of silver iodobromide or silver chloroiodobromide whose silver chloride content is less than 10 mol %.

8. The silver halide photographic lightsensitive material according to claim 6, wherein 50% or more of the total projected area of all the silver halide grains contained in the blue lightsensitive layer is occupied by silver halide grains satisfying the following requirements (a), (d) and (e):

(a) parallel main planes thereof are (111) faces, (d) tabular silver halide grains each formed of silver iodobromide or silver chloroiodobromide whose silver chloride content is less than 10 mol %, and (e) hexagonal tabular grains each having at least one epitaxial junction per grain at an apex portion and/or a side face portion and/or a main plane portion thereof.

9. The silver halide photographic lightsensitive material according to claim 6, wherein 50% or more of the total projected area of all the silver halide grains contained in the blue lightsensitive layer is occupied by silver halide grains satisfying the following requirements (d), (f) and (g):

(d) tabular silver halide grains each formed of silver iodobromide or silver chloroiodobromide whose silver chloride content is less than 10 mol %, (f) parallel main planes thereof are (100) faces, and (g) an aspect ratio thereof is 2 or more.

10. The silver halide photographic lightsensitive material according to claim 6, wherein 50% or more of the total projected area of all the silver halide grains contained in the blue lightsensitive layer is occupied by silver halide grains satisfying the following requirements (g), (h) and (i):

(g) an aspect ratio thereof is 2 or more, (h) parallel main planes thereof are (111) faces or (100) faces, and (i) tabular grains each having a silver chloride content of at least 80 mol %.

11. The silver halide photographic lightsensitive material according to claim 1, where said blue-sensitive layer comprises a high-speed blue-sensitive layer and a low-speed blue-sensitive layer and said high-speed blue-sensitive layer contains said emulsified dispersion and said compound represented by formula (I).

* * * * *